US008262452B2

(12) United States Patent
Okuaki et al.

(10) Patent No.: US 8,262,452 B2
(45) Date of Patent: Sep. 11, 2012

(54) GAMING DEVICE AND ITS CONTROL METHOD

(75) Inventors: Masato Okuaki, Tokyo (JP); Hitoshi Arisawa, Tokyo (JP)

(73) Assignee: Konami Digital Entertainment Co. Ltd. (JP)

( * ) Notice: Subject to any disclaimer, the term of this patent is extended or adjusted under 35 U.S.C. 154(b) by 999 days.

(21) Appl. No.: 12/279,339

(22) PCT Filed: Feb. 9, 2007

(86) PCT No.: PCT/JP2007/052387

§ 371 (c)(1),
(2), (4) Date: Aug. 15, 2008

(87) PCT Pub. No.: WO2007/094261

PCT Pub. Date: Aug. 23, 2007

(65) Prior Publication Data

US 2009/0005147 A1 Jan. 1, 2009

(30) Foreign Application Priority Data

Feb. 13, 2006 (JP) ..... 2006-034934

(51) Int. Cl.
*G07C 13/00* (2006.01)
*G07C 15/00* (2006.01)
*A63F 9/24* (2006.01)

(52) U.S. Cl. ..... 463/16; 463/17; 463/18; 463/21; 463/25; 273/138.1; 273/139; 273/142 A; 273/269; 379/93.13

(58) Field of Classification Search ..... 463/10–13, 463/17–19, 21–22, 25–29; 273/138.1, 139, 273/142 B, 142 A, 142 J, 269, 304; 283/903; 379/93.13; 705/14.12, 14.38, 14.6, 14.65, 705/16–17, 39, 44; *G07C 13/00, 15/00; A63F 9/24*
See application file for complete search history.

(56) References Cited

U.S. PATENT DOCUMENTS 5,131,655 A * 7/1992 Ugawa ..... 273/121 B (Continued)

FOREIGN PATENT DOCUMENTS

JP 7-265491 A 10/1995

(Continued)

OTHER PUBLICATIONS

Supplementary European Search Report of Jan. 26, 2010 for European Patent Application No. EP 07708323, 7 pages.

(Continued)

*Primary Examiner* — Arthur O. Hall
(74) *Attorney, Agent, or Firm* — Fountainhead Law Group P.C.

(57) ABSTRACT

It is possible to select plural types of drawing games in accordance with a condition and to provide a game player with the selected drawing games. A game device (1) for performing a bingo game for drawing either a first prize or a second prize with a ball B includes two stages (1100 and 1200) for respectively performing a drawing with the ball B, drawing game performing means for performing a digital drawing game for drawing any of a plurality of prizes including a third prize to be rewarded for the ball B, a fourth prize for setting subsequent game conditions to be a normal mode, and a fifth prize for setting the subsequent game conditions to be a probability change mode, setting the subsequent games to be the normal mode when the fourth prize is rewarded, and setting the subsequent games to be the probability change mode when the fifth prize is rewarded, supply means for supplying the ball B to a predetermined transporting path, and first feeding means and second feeding means for feeding the ball B to the stage (1000) when the present game condition is in the normal mode and for feeding the ball B to the stage (1200) when the present game condition is in the probability change mode.

17 Claims, 63 Drawing Sheets

U.S. PATENT DOCUMENTS

| | | | | |
|---|---|---|---|---|
| 5,634,639 | A * | 6/1997 | Tokito et al. | 273/123 R |
| 5,857,910 | A * | 1/1999 | Watanabe et al. | 463/17 |
| 6,082,734 | A * | 7/2000 | Uehara et al. | 273/142 E |
| 7,168,702 | B1 * | 1/2007 | Shoemaker | 273/138.1 |
| 7,413,511 | B2 * | 8/2008 | Seelig et al. | 463/22 |
| 7,547,018 | B2 * | 6/2009 | Lin | 273/144 A |
| 7,699,316 | B2 * | 4/2010 | Seelig et al. | 273/144 B |
| 2006/0019735 | A1 * | 1/2006 | Toyoda | 463/17 |
| 2006/0055109 | A1 * | 3/2006 | Yokota et al. | 273/142 R |

FOREIGN PATENT DOCUMENTS

| | | |
|---|---|---|
| JP | 2002-210225 A | 7/2002 |

OTHER PUBLICATIONS

"Grand Cross," Konami Amusement Machine Catalogue 2006 AOU, Kokokuyo Bira, Konami Co., Ltd., National Center for Industrial Property Information Ukeire, Feb. 17, 2006.

International Search Report PCT/JP2007/052387.

* cited by examiner

Fig.7
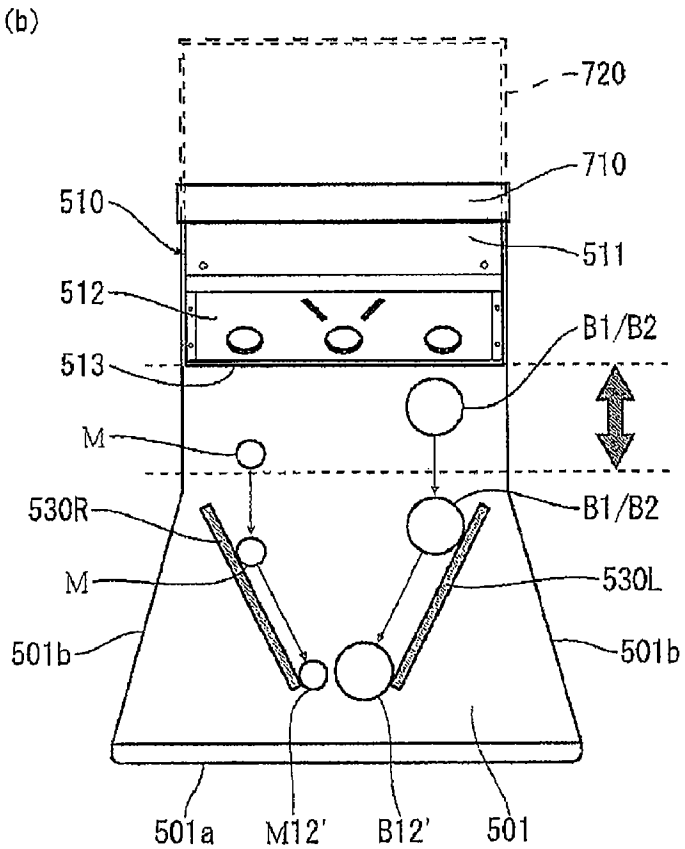
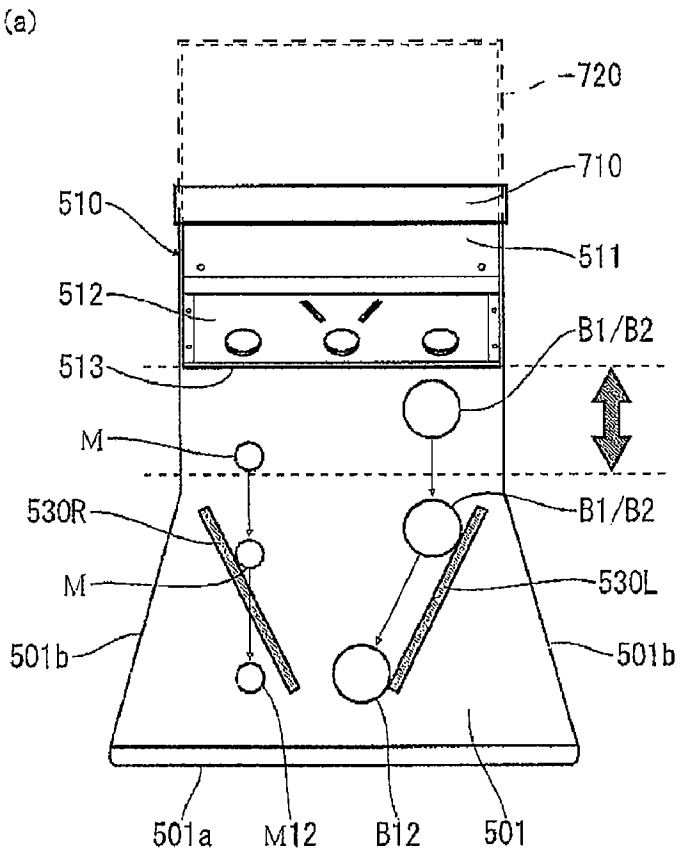

MODIFIED EXAMPLE 1

MODIFIED EXAMPLE 2

MODIFIED EXAMPLE 3

MODIFIED EXAMPLE 4

MODIFIED EXAMPLE 5

MODIFIED EXAMPLE 4

Fig.38
(a)
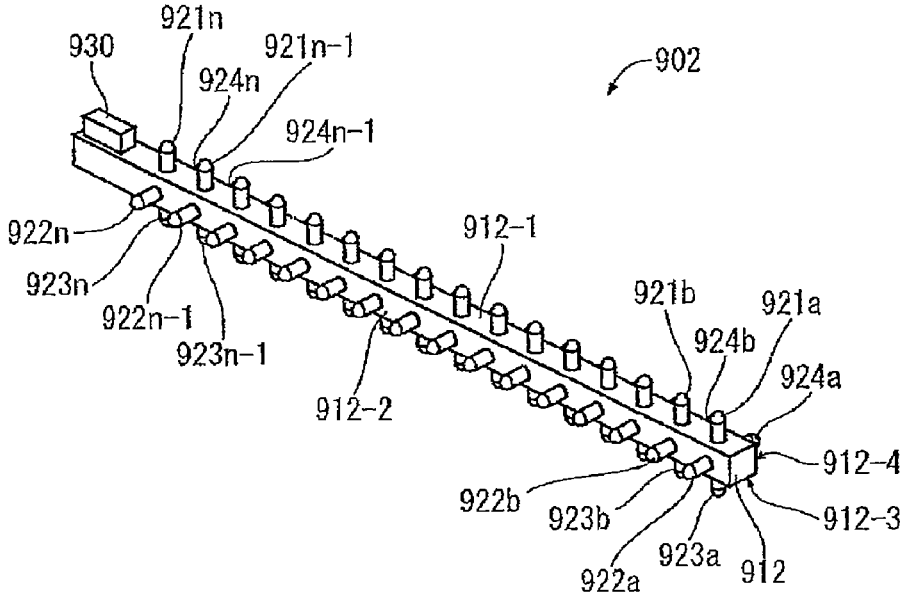
(b)
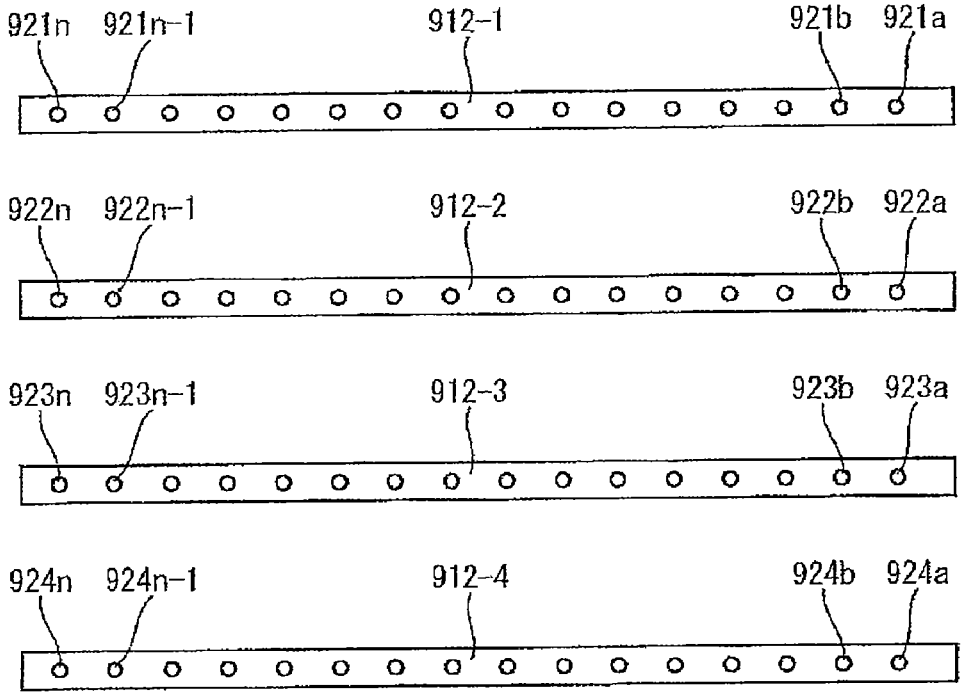

Fig. 47

(a)

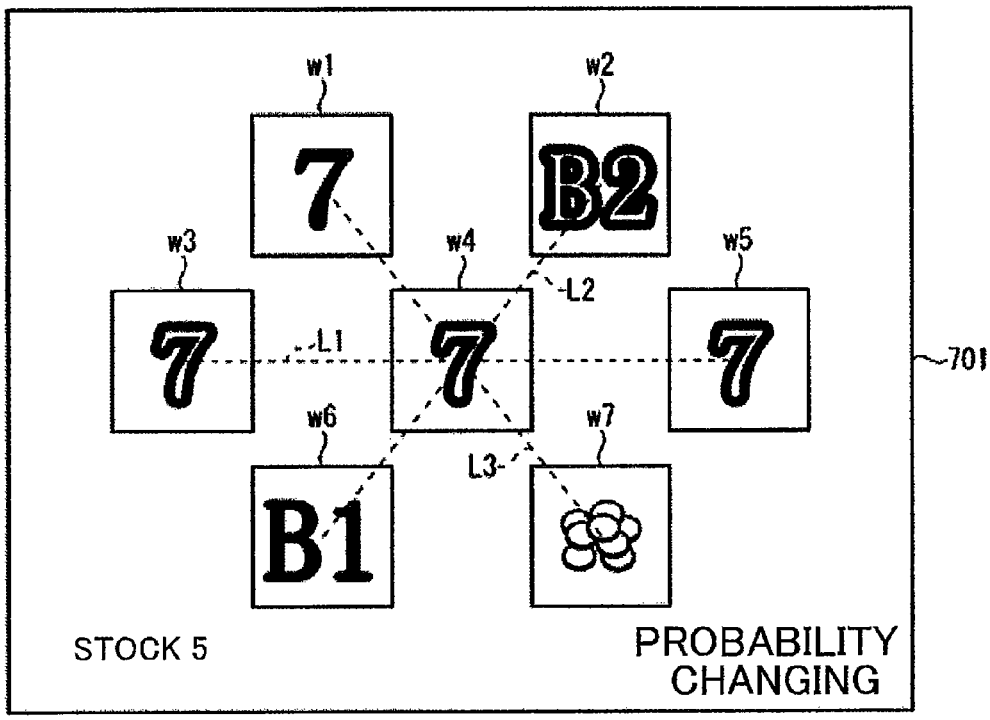

(b)

- 7 : BIG BONUS A IMAGE PATTERN
- 7 : BIG BONUS B IMAGE PATTERN
- B1 : BALL B1 PRIZE A IMAGE PATTERN
- B1 : BALL B1 PRIZE B IMAGE PATTERN
- B2 : BALL B2 PRIZE A IMAGE PATTERN
- B2 : BALL B2 PRIZE B IMAGE PATTERN
- : SMALL BONUS A IMAGE PATTERN
- : SMALL BONUS B IMAGE PATTERN
- + : NON-PRIZE-WINNING OPTION IMAGE PATTERN (c)

| PRIZE/ NON-PRIZE WINNING OPTION | PRIZE-WINNING RANGE | |
|---|---|---|
| | NORMAL MODE | PROBABILITY CHANGE MODE |
| BIG BONUS A | 0 ~ 31(32) | 0 ~ 63(64) |
| BIG BONUS B | 32 ~ 63(32) | 64 ~ 127(64) |
| BALL B1 PRIZE A | 64 ~ 191(128) | 128 ~ 383(256) |
| BALL B1 PRIZE B | 192 ~ 319(128) | 384 ~ 639(256) |
| BALL B2 PRIZE A | 320 ~ 383(64) | 640 ~ 767(128) |
| BALL B2 PRIZE B | 384 ~ 447(64) | 768 ~ 895(128) |
| SMALL BONUS A | 448 ~ 959(512) | 896 ~ 1919(1024) |
| SMALL BONUS B | 960 ~ 1983(1024) | 1920 ~ 3967(2048) |
| NON-PRIZE-WINNING OPTION | 1984 ~ 4095(2112) | 3968 ~ 4095(128) |

Fig. 61

(a)

7 : BIG BONUS A IMAGE PATTERN

7 : BIG BONUS B IMAGE PATTERN

B : BALL PRIZE A IMAGE PATTERN

B : BALL PRIZE B IMAGE PATTERN

: SMALL BONUS A IMAGE PATTERN

: SMALL BONUS B IMAGE PATTERN

: NON-PRIZE-WINNING OPTION IMAGE PATTERN (b)

| PRIZE/NON-PRIZE-WINNING OPTION | PRIZE-WINNING RANGE | |
|---|---|---|
| | NORMAL MODE | PROBABILITY CHANGE MODE |
| BIG BONUS A | 0 ~ 31(32) | 0 ~ 63(64) |
| BIG BONUS B | 32 ~ 63(32) | 64 ~ 127(64) |
| BALL PRIZE A | 64 ~ 319(256) | 128 ~ 639(512) |
| BALL PRIZE B | 320 ~ 447(128) | 640 ~ 895(256) |
| SMALL BONUS A PRIZE | 448 ~ 959(512) | 896 ~ 1919(1024) |
| SMALL BONUS B PRIZE | 960 ~ 1983(1024) | 1920 ~ 3967(2048) |
| NON-PRIZE-WINNING OPTION | 1984 ~ 4095(2112) | 3968 ~ 4095(128) |

GAMING DEVICE AND ITS CONTROL METHOD

FIELD OF THE INVENTION

The present invention relates to a game device, and especially to a game device that is capable of providing a game player with a pusher game for pushing an approximately disk shaped game medium such as a medal and an approximately spherical shaped game medium, a digital drawing game, and a table game using the approximately spherical shaped game medium.

BACKGROUND ART

A game device using an approximately spherical shaped game medium (e.g., a ball) and an approximately disk shaped game medium (e.g., a medal) has been generally known. In the present explanation, a game device using these types of game media is referred to as a medal game device. Note that the term "game medium" in the present application means a tangible entity to be used when a game is performed.

A pusher game device has been widely known as a typical example of the medal game device. In general, the pusher game is configured to include a slot into which a game player inserts a game medium, a playing field on which the game medium inserted into the slot is temporarily accumulated, an outlet for discharging the game medium inserted into the slot to the playing field, and a pusher part for pushing the game medium on the playing field at a predetermined cycle. Note that a single or plurality of game medium/media of the game media pushed by the pusher part fall(s) from the playing field, and then paid out to a game player or is/are stored in the interior of the game device.

The medal game device as typified by the above pusher game device is configured that a game player plays a game by shooting a game medium. Result of the game is influenced by the timing when the game medium is shot, the direction in which the game medium is shot, or the amount of game media to be shot.

DISCLOSURE OF THE INVENTION

Problems the Invention is to Solve

Meanwhile, a more complicated game property has been recently demanded. For example, the inventors of the present invention found that it is possible to realize the complicated game property by selecting a drawing game(s) from plural types of drawing games (e.g., bingo game) in accordance with a condition and providing a game player with the selected drawing game(s).

In response to this, it is an object of the present invention to provide a game device, which is capable of selecting plural types of drawing games in accordance with a condition and providing a game player with the selected drawing games, and a method of controlling the same.

Means to Solve the Problem

For the purpose of achieving the object, a first invention is a game device that is configured to perform a first drawing game for drawing either a first prize or a second prize with a drawing medium, and the game device includes a first drawing field for drawing either the first prize or the second prize with the drawing medium, a second drawing field for drawing either the first prize or the second prize with the drawing medium, drawing game performing means for performing a second drawing game for electrically drawing any of a plurality of prizes including a third prize for providing a game player with the drawing medium, a fourth prize for setting subsequent game conditions to a first game condition in which winning probability of winning the third prize is first winning probability, and a fifth prize for setting the subsequent game conditions to a second game condition in which winning probability of winning the third prize is second winning probability that is higher than the first winning probability, controlling either the first game condition or the second game condition as a present game condition, performing subsequent second drawing games under the first game condition when the fourth prize is rewarded, and performing the subsequent second drawing games under the second game condition when the fifth prize is rewarded, supply means for supplying the drawing medium to a predetermined transporting path, game condition specifying means for specifying the present game condition that is controlled by the drawing game performing means, first feeding means for feeding the drawing medium to the first drawing field when the present game condition is in the first game condition, and second feeding means for feeding the drawing medium to the second drawing field when the present game condition is in the second game condition.

With two fields in which a drawing is performed (i.e., the first drawing field and the second field), it will be possible to provide a game player with two types of first drawing games whose degrees of expectation of winning a prize are different from each other, for example, when winning probabilities of winning a prize in the drawing fields are set to be different from each other. Also, it will be possible to provide a game player with a game that is the combination of the first drawing game and the electric second drawing game with a configuration that the drawing medium to be used in the first drawing game is paid out to a game player when the third prize is rewarded as the result of the electric second drawing game. Furthermore, it will be possible to realize game conditions whose degrees of expectation are different from each other with a configuration that the drawing game performing means controls two game conditions (the first game condition and the second game condition) whose winning probabilities of winning the third prize are different from each other, and thus it will be possible to provide a game player with a more complex game. Moreover, it will be possible to determine which of the drawing fields should be selectively used, that is, which of the first drawing games whose degrees of expectation are different from each other should be selectively provided to a game player, based on the present game condition, by using different drawing field depending on the present game condition of the second drawing game. Thus, according to the present invention, it is possible to realize a game device that is capable of selecting plural types of drawing games in accordance with a condition and providing the selected drawing games to a game player.

Also, a second invention is the game device according to the first invention, and in the game device, winning probability of winning the second prize in the second drawing field is higher than winning probability of winning the second prize in the first drawing field.

As described above, it is possible to provide a game player with two types of first drawing games whose degrees of expectation for winning a prize are different from each other by setting winning probabilities of winning a prize in the drawing fields to be different from each other.

Also, a third invention is the game device according to the first invention or the second invention, and in the game device, the first drawing field includes a first disk on which the drawing medium is allowed to go round while the drawing medium rotationally moves, and a plurality of first prize-winning spots which are provided in the first disk and into which the drawing medium is allowed to rotationally enter. In the game device, the second drawing field is disposed to surround the first disk, and includes a ring shaped second disk on which the drawing medium is allowed to go round while the drawing medium rotationally moves and a plurality of second prize-winning spots which are provided in the second disk and into which the drawing medium is allowed to rotationally enter. The game device further includes prize correspondingly allocating means for correspondingly allocating either the first prize or the second prize to each of the plurality of first prize-winning spots and the plurality of second prize-winning spots, first reward means for rewarding either the first prize or the second prize when the drawing medium enters any of the plurality of first prize-winning spots, the first prize or the second prize being correspondingly allocated to the first prize-winning spot into which the drawing medium enters, and second reward means for rewarding either the first prize or the second prize when the drawing medium enters any of the plurality of second prize-winning spots, the first prize or the second prize being correspondingly allocated to the second prize-winning spot into which the drawing medium enters.

It will be possible to mechanically draw a prize with the drawing medium (e.g., ball) by providing a plurality of prize-winning spots in the first and second drawing fields, respectively, and at the same time as this, by correspondingly allocating a prize to each of the prize-winning spots. Also, with a configuration that a space between adjacent first prize-winning spots in the first disk and a space between adjacent second prize-winning spots in the ring shaped second disk disposed to surround the first disk to be the same, for instance, the number of the second prize-winning spots arranged outside will be accordingly greater than that of the first prize-winning spots arranged inside. Because of this, when the number of the prize-winning spots to which a prize with relatively big benefit (e.g., paying-out to a game player) is correspondingly allocated is identically set with respect to both of the first prize-winning spots and the second prize-winning spots, it is possible to set degree of expectation for a drawing in the second drawing field that is disposed inside to be higher than that in the first drawing field. Furthermore, it will be possible to set behavior of the drawing medium to be concentric movement both when a drawing is performed in the first drawing field and when a drawing is performed in the second drawing field with a configuration that the second disk is disposed to surround the first disk. As a result, it will be possible for a game player to see a drawing in the first drawing field and a drawing in the second drawing field in approximately the same line of sight.

Also, a fourth invention is the game device according to the third invention. In game device, the first disk rotates around a predetermined rotational axis, and the second disk rotates around the predetermined rotational axis.

It will be difficult for a game player to predict into which prize-winning spot the drawing medium enters by making the first disk and the second disk, on both of which the game medium goes round while rotationally moving, rotate on their axes. As a result, it is possible to make a game player to have more interest in a drawing with the drawing medium.

Also, a fifth invention is the game device according to the third invention or the fourth invention. In the game device, the prize correspondingly allocating means correspondingly allocates the second prize to the greater number of the first prize-winning spot(s) and/or the second prize-winning spot (s) when the present game condition is in the second game condition than the number of the first prize-winning spot(s) and/or the second prize-winning spot(s) when the present game condition is in the first game condition.

It will be possible to change not only degree of expectation in the second drawing game but also degree of expectation in the first drawing game depending on a game condition by setting the number of the first prize-winning spot(s) and/or the second prize-winning spot(s) that are correspondingly allocated to the second prize in the second game condition to be greater than that in the first game condition, and thus it will be possible to provide a game player with a more complex game.

Also, a sixth invention is the game device according to one of the first to fifth inventions, and the game device further includes an accumulating part for temporarily accumulating the drawing medium provided to a game player. In the game device, the supply means supplies the drawing medium to the predetermined transporting path by directly or indirectly pushing the drawing medium from the accumulating part to the predetermined transporting path.

For example, it will be possible to provide a game player with a game that is the combination of a pusher game and the first drawing game with a configuration that the drawing medium accumulated in the accumulating part is pushed by the supply means and is fed to the transporting path.

Also, a seventh invention is the game device according to the sixth invention, and the game device further includes paying-out means for paying out the drawing medium to the accumulating part based on the drawing result in the second drawing game.

It will be possible to provide a game player with a game in which a pusher game is further added to the combination of the first drawing game and the second drawing game, for instance, by paying out the drawing medium obtained in the second drawing game to the accumulating part.

Also, an eighth invention is the game device according to one of the first to seventh inventions. In the game device, the supply means supplies the drawing medium to the predetermined transporting path based on the drawing result in the second drawing game.

It will be possible to provide a game player with a game that is the combination of the first drawing game and the electric second drawing game with a configuration that the drawing medium to be used in the first drawing game is directly supplied to the predetermined transporting path when the third prize is rewarded as the result of the electric second drawing game.

Also, a ninth invention is the game device according to one of the first to eighth inventions, the game device further includes bingo game performing means for performing a bingo game using a bingo table on which plural types of characters are arranged. In the game device, the first prize is configured to be rewarded to any of the plural types of characters to be used in the bingo game.

It is possible to provide a game player with plural types of bingo games by setting the first drawing game to be a drawing game in a bingo game.

Also, a tenth invention is the game device according to one of the first to ninth inventions, the drawing medium is a ball.

It is possible to apply a ball to the drawing medium, for instance.

Also, an eleventh invention is a method of controlling a game device that is configured to perform a first drawing game for drawing either a first prize or a second prize by shooting a drawing medium into a first drawing field having a plurality of prize-winning spots to each of which the first prize or the second prize is correspondingly allocated, and for drawing either the first prize or the second prize by shooting the drawing medium into a second drawing field having a plurality of second prize-winning spots to each of which the first prize or the second prize is correspondingly allocated. The method of controlling a game device includes a first step for performing a second drawing game for electrically drawing any of a plurality of prizes including a third prize for providing a game player with the drawing medium, a fourth prize for setting subsequent game conditions to a first game condition in which winning probability of winning the third prize is first winning probability, and a fifth prize for setting the subsequent game conditions to be a second game condition in which winning probability of winning the third prize is second winning probability that is higher than the first winning probability, controlling either the first game condition or the second game condition as a present game condition, performing subsequent second drawing games under the first game condition when the fourth prize is rewarded, and performing the subsequent second drawing games under the second game condition when the fifth prize is rewarded, a second step for supplying the drawing medium to a predetermined transporting path, a third step for specifying the present game condition that is controlled in the first step when the drawing medium is supplied to the predetermined transporting path, a fourth step for feeding the drawing medium to the first drawing field when the present game condition specified in the third step is in the first game condition, a fifth step for detecting into which of the plurality of first prize-winning spots the drawing medium enters, a sixth step for specifying a prize correspondingly allocated to the first prize-winning spot for which entrance of the drawing medium is detected in the fifth step, a seventh step for feeding the drawing medium to the second drawing field when the present game condition specified in the third step is in the second game condition, an eighth step for detecting into which of the plurality of second prize-winning spots in the second drawing field the drawing medium enters, and a ninth step for specifying the prize correspondingly allocated to the second spot for which entrance of the second drawing medium is detected in the eighth step.

It will be possible to provide a game player with two types of first drawing games whose degrees of expectation for winning a prize are different from each other, when two drawing fields (i.e., the first drawing field and the second drawing field) are used and winning probabilities of winning a prize in the drawing fields are set to be different from each other, for instance. In this type of game device, it will be possible to provide a game player with a game that is the combination of the first drawing game and the electric second drawing game with a configuration that the drawing medium to be used in the first drawing game is paid out to a game player when the third prize is rewarded as the result of the electric second drawing game. Furthermore, it will be possible to realize game conditions whose degrees of expectation are different from each other with a configuration that two game conditions (the first game condition and the second game condition) whose winning probabilities of winning the third prize are different from each other are controlled, and thus it will be possible to provide a game player with a more complex game. Moreover, it will be possible to determine which of the drawing fields should be selectively used, that is, which of the first drawing games whose degrees of expectation are different from each other should be selectively provided to a game player, based on the present game condition, by using a different drawing field depending on the present game condition of the second drawing game. Thus, according to the present invention, it is possible to realize a method of controlling a game device that is capable of selecting plural types of drawing games in accordance with a condition and providing the selected drawing games to a game player.

Also, a twelfth invention is the method of controlling a game device according to the eleventh invention. In the method, ratio of the number of the second prize-winning spots to which the second prize is correspondingly allocated to the number of the second prize-winning spots to which the first prize is correspondingly allocated is greater than ratio of the number of the first prize-winning spots to which the second prize is correspondingly allocated to the number of the first prize-winning spots to which the first prize is correspondingly allocated.

As described above, it is possible to provide a game player with two types of first drawing games whose winning probabilities of winning a prize are different from each other by setting winning probabilities of winning a prize in the drawing fields to be different from each other.

Also, a thirteenth invention is the method of controlling a game device according to the eleventh invention or the twelfth invention. In the method, the game device further includes an accumulating part for temporarily accumulating the drawing medium provided to a game player, and a pushing part for feeding the drawing medium to the predetermined transporting path by directly or indirectly pushing the drawing medium accumulated in the accumulating part to the predetermined transporting path. In the method, the second step is configured to supply the drawing medium to the predetermined transporting path by driving the pushing part. The method further includes a tenth step for paying out the drawing medium to the accumulating part based on the drawing result in the second drawing game in the first step.

It will be possible to provide a game player with a game that is the combination of the first drawing game and the electric second drawing game with a configuration that the drawing medium to be used in the first drawing game is paid out to a game player when the third prize is rewarded as the result of the electric second drawing game. Also, it will be possible to provide a game player with a game in which a pusher game is further added to the combination of the first drawing game and the second drawing game, for instance, by paying out the drawing medium obtained in the second drawing game to the accumulating part.

Also, a fourteenth invention is the method of controlling a game device according to the eleventh invention or the twelfth invention. In the method, the second step is configured to supply the drawing medium to the predetermined transporting path based on the drawing result in the second drawing game in the first step.

It will be possible to provide a game player with a game that is the combination of the first drawing game and the electric second drawing game with a configuration that the drawing medium to be used in the first drawing game is directly supplied to the predetermined transporting path when the third prize is rewarded as the result of the electric second drawing game.

Also, a fifteenth invention is the method of controlling a game device according to one of the eleventh to fourteenth inventions, and the method further includes an eleventh step for correspondingly allocating the second prize to the greater number of the first prize-winning spot(s) and/or the second prize-winning spot(s) when the present game condition is in the second game condition than the number of the first prize-winning spot(s) and/or the second prize-winning spot(s) when the present game condition is in the first game condition.

It will be possible to change not only degree of expectation in the second drawing game but also degree of expectation in the first drawing game depending on a game condition by setting the number of the first prize-winning spot(s) and/or the second prize-winning spot(s) that are correspondingly allocated to the second prize in the second game condition to be greater than that in the first game condition, and thus it will be possible to provide a game player with a more complex game.

Also, a sixteenth invention is the method of controlling a game device of one of the eleventh to fifteenth inventions, and the method further includes a twelfth step for performing a bingo game using a bingo table on which plural types of characters are arranged. In the step, the first prize is configured to be rewarded to any of the plural types of characters to be used in the bingo game.

It will be possible to provide a game player with plural types of bingo games by setting the first drawing game to be a drawing game in a bingo game.

Also, a seventeenth invention is the method of controlling a game device of one of the eleventh to sixteenth inventions, and in the method, the drawing medium is a ball.

It will be possible to apply a ball to the drawing medium, for instance.

Effects of the Invention

According to the present invention, it is possible to realize a game device that is capable of selecting plural types of drawing games in accordance with a condition and providing a game player with the selected drawing games and a method of controlling the same.

BRIEF DESCRIPTION OF THE DRAWINGS

FIG. 7 is a diagram illustrating flow of a medal M and a ball B1/B2 on a main table 501 of an embodiment of the present invention.

FIG. 38(*a*) is a perspective view illustrating a modified example 2 of a configuration of the medal movement simulation rendering unit of an embodiment of the present invention, and FIG. 38(*b*) is a diagram illustrating arrangement of LEDs disposed on each of the lateral surfaces in FIG. 38(*a*).

FIG. 47(*a*) is a diagram illustrating an example of a screen shot to be displayed for a game player while a digital drawing game in accordance with an embodiment of the present invention is performed. FIG. 47(*b*) is a diagram illustrating an example of image patterns to be used in the digital drawing game in accordance with an embodiment of the present invention. FIG. 47(*c*) is a table illustrating notification range allocated to each of prizes in the digital drawing game in accordance with an embodiment of the present invention.

FIG. 61(*a*) is a diagram illustrating an example of image patterns to be used in a digital drawing game in accordance with a modified example 1 of an embodiment of the present invention. FIG. 61(*b*) is a table illustrating notification range allocated to each of prizes in the digital drawing game in accordance with the modified example 1 of an embodiment of the present invention.

BEST MODE FOR CARRYING OUT THE INVENTION

The best mode for carrying out the present invention will be hereinafter explained in detail with reference to the figures.

(1) Embodiment

First, an embodiment of the present invention will be explained in detail with reference to figures. Note that respective figures only roughly illustrate shape, dimension, and positional relationship to the extent that the content of the present invention is understandable. Therefore, the present invention is not limited to the shape, the dimension, and the positional relationship, which are exemplified in the respective figures. Also, a part of hatching to be illustrated in cross-sections is omitted in the respective figures for clear illustration of the configuration. Furthermore, numeric values to be exemplified in the following paragraphs are only preferred examples of the present invention. Therefore, the present invention is not limited to the exemplified numeric values. This is also true for the respective embodiments to be described.

(1-1) Entire Configuration

In the present embodiment, a medal is exemplified as the above described approximately disk shaped game medium, and a game device is exemplified as a game device using the medal.

Figure 1:
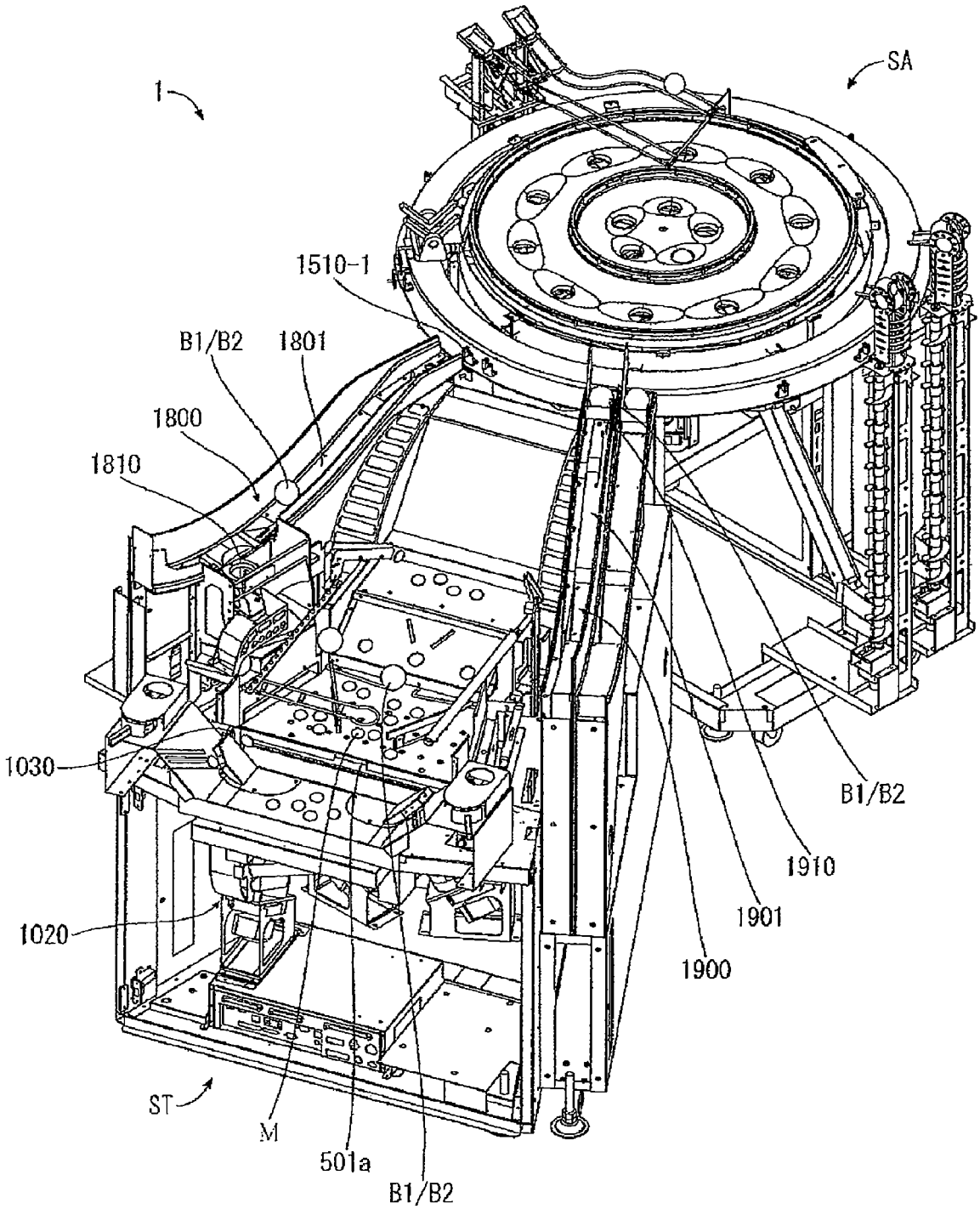
FIG. 1 is a perspective view illustrating a part of the entire configuration of a game device of an embodiment of the present invention.

FIG. 1 is a partial perspective view for illustrating a configuration of a game device 1 of an embodiment of the present invention. Note that FIG. 1 selectively illustrates a basic configuration of the pusher game device 1 for the purpose of giving a simple explanation.

As illustrated in FIG. 1, the game device 1 is made up of a satellite SA and a station ST. Note that the figure illustrates an example that a single station ST is provided with a single satellite SA, but it is actually possible to combine a single satellite SA with a plurality of stations ST. In this case, a plurality of stations ST are disposed to surround the satellite SA.

(1-1-1) Configuration of Station

Also, FIG. 2 selectively illustrates a configuration of the station ST illustrated in FIG. 1, and its overall configuration will be explained with reference to FIGS. 1 and 2. The station ST is an element for providing a game player with a variety of games such as a pusher game, a bingo game, and a digital drawing game.

Figure 2:
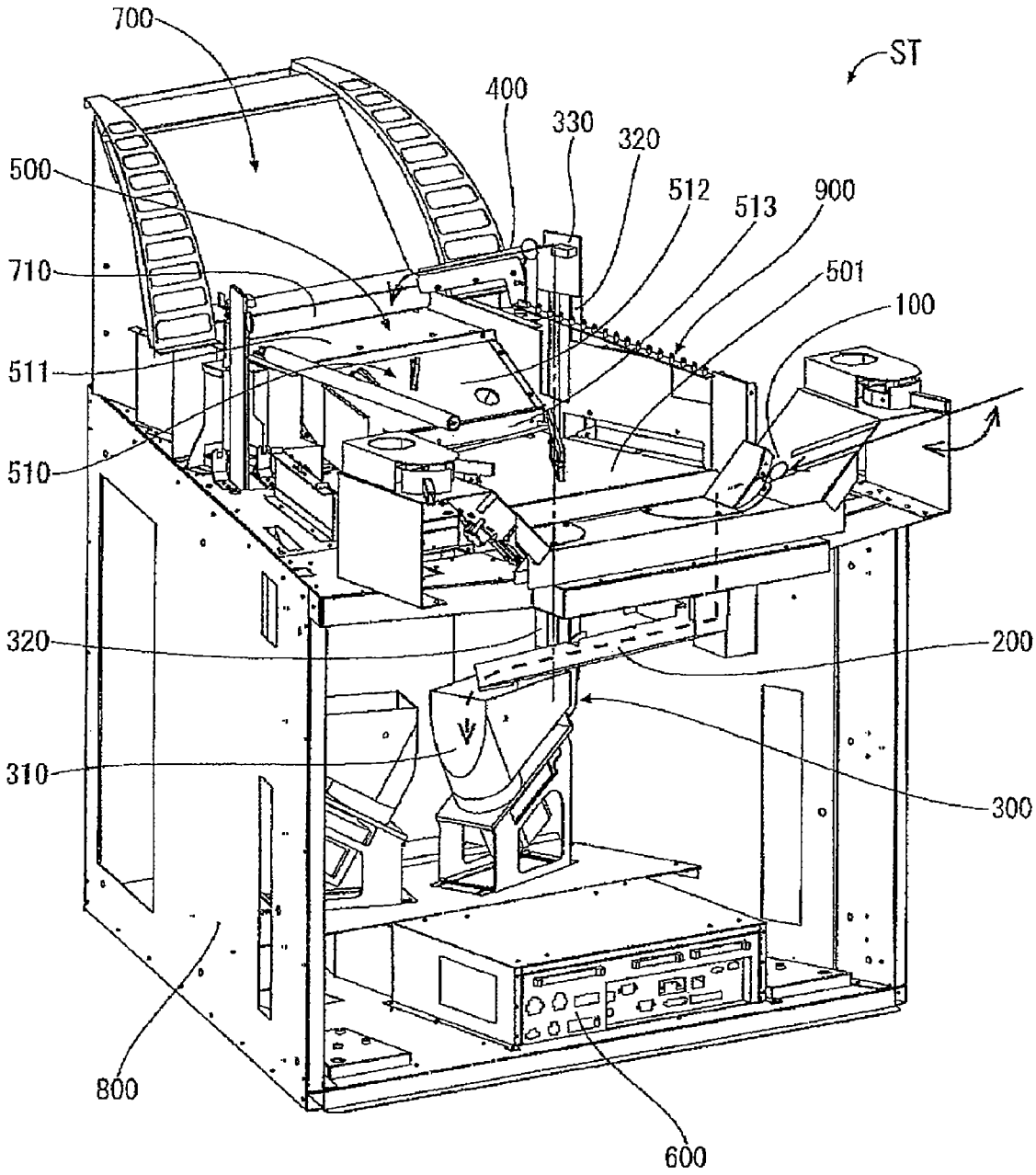
FIG. 2 is a perspective view illustrating a schematic configuration of a station ST illustrated in FIG. 1.

As illustrated in FIG. 2, the station ST includes a medal shooting mechanism (shooting unit) 100, a medal transporting path 200, a lifting-up hopper 300, a medal discharging path 400, a playing field 500, a control unit 600 (this is referred to as a first control unit), a display unit 700, and a chassis 800.

The chassis 800 is configured to be a framework of the station ST. The medal shooting mechanism 100 is disposed on the upper front side of the chassis 800. The display unit 700 is disposed on the upper rear side of the chassis 800. The playing field 500 is disposed on the upper center of the chassis 800. In addition, the medal transporting path 200, the lifting-up hopper 300, the first control unit 600, and the like are accommodated in the interior of chassis 800. Here, the term "front side" means the side on which a game player is positioned when he/she plays a game. The term "rear side" means the opposite side from the side on which a game player is positioned when he/she plays a game. The term "center" means an area disposed between the above described "front side" and "rear side."

The medal shooting mechanism 100 is a mechanism for shooting a medal M (i.e., game medium) into the game device 1 when a game player plays a game. The medal M shot from the medal shooting mechanism 100 is transported to the lifting-up hopper 300 via the medal transporting path 200, and is temporarily stored in the lifting-up hopper 300. As described above, the medal transporting path 200 and the lifting-up hopper 300 are disposed in the interior of the chassis 800. Note that the medal transporting path 200 mechanically and physically connects the medal shooting mechanism 100 and the lifting-up hopper 300, and has a function of transporting the medal M shot from the medal shooting mechanism 100 to the lifting-up hopper 300.

The lifting-up hopper 300 includes a medal accumulating part 310 for accumulating the medal M, a lifting-up part 320 for lifting up the medal M to a predetermined height, and a medal discharging part (discharging part) 330 for discharging the lifted-up medal M at a predetermined timing. In addition, a medal discharging path 400 for guiding the discharged medal M to the playing field 500 is disposed at an outlet of medal discharging part 330 so as to be capable of swinging from side to side.

The upper end of the lifting-up part 320 is disposed above the playing field 500. Accordingly, the medal discharging part 330, which is disposed at the upper end of the lifting-up part 320, is also disposed above the playing field 500. Therefore, the medal M temporarily accumulated in the medal accumulating part 310 provided below the playing field 500 is lifted up to a position higher than the playing field 500 by the lifting-up part 320, and then it is shot from the medal discharging part 330 to the playing field 500 via the medal discharging path 400.

The playing field 500 is mainly made up of a main table 501 for accumulating a medal that is in an effective condition, and a pusher part 510 that is disposed on the main table 501. Note that the effective condition means a condition that a medal is currently involved in a game. Also, the playing field 500 will be explained in detail in the following paragraphs.

The pusher part 510 includes an upper surface (hereinafter referred to as a sub-table 511) for accumulating the medal M that is in the effective condition, a sloped table 512 on which the medal M falling from the sub-table 511 slides, and a pushing wall 513 for pushing the medal M accumulated on the main table 501.

In addition, the pusher part 510 is slidably provided on the main table 501 of the playing field 500, and slides back and forth at a constant cycle or at an arbitrary cycle. A part (rear side) of the pusher part 510 is accommodated in a housing part 720 to be described, which is provided below the display unit 700. The pusher part 510 slides in/out the housing part 720 and thus reciprocates back and forth.

Note that a framework member 710 of a display 701 in the display unit 700 is slidably made contact with the sub-table 511. Therefore, when the pusher part 510 is moved in a direction that it is accommodated in the housing part 720, the medal M on the sub-table 511 is pushed by the framework member 710. A part of medals M on the sub-table 511 falls on the sloped table 512 by the pushing movement.

A part of the medals M falling from the sub-table 511 enters apertures (these are referred to as award-winning apertures 515-1, 515-2, 515-3) provided in the sloped table 512. On the other hand, the rest of the medals M directly falls to the main table 501 and is accumulated on the main table 501.

In a similar way to the medal M on the sub-table 511, the medal M on the main table 501 is pushed by the sliding movement of the pusher part 510. In other words, the pusher part 510 is disposed on the main table 501 without any gap, and accordingly, the medal M on the main table 501 is pushed by the pushing wall 513 that forms the front surface of the pusher part 510 when the pusher part 510 is moved in a direction that it is carried out of the housing part 720. A part of the medals M on the main table 501 falls down by the pushing movement. The medal M falling from a game player's side (referred to as "front end 501*a*" (see FIG. 1)) is paid out to a game player, and the other medal M, for example, the medal M falling from the sides (referred to as "side ends 501*b*") of the main table 501 is stored in a predetermined accumulating part in the interior of the station ST.

Also, as illustrated in FIG. 2, the station ST of the present embodiment includes a medal movement simulation rendering unit 900 in addition to the above described elements. As described in the following paragraphs, the medal movement simulation rendering unit 900 includes a plurality of light-emitting parts (i.e., LEDs 920 to be described) that are arranged from the vicinity of the medal shooting mechanism 100 to the vicinity of the medal discharging part 330. A scene that the medal M inserted into the medal shooting mechanism 100 moves is rendered in a simulated way by causing the light-emitting parts to light up sequentially from the medal shooting mechanism 100 side to the medal discharging part 330 side. In this case, a path in which the medal M actually moves and a simulated path by rendering are not necessarily the same, and are not necessarily adjacent to each other.

Also, the medal M inserted in the medal shooting mechanism 100 is temporarily stored in the medal accumulating part 310 of the lifting-up hopper 300. The medal M stored in the medal accumulating part 310 is lifted up by the lifting-up part 320, and is thus preliminarily set in the medal discharging part 330 of the lifting-up hopper 300. When the medal M is inserted into the medal shooting mechanism 100, the lifting-up hopper 300 discharges the medal M preliminarily set in the medal discharging part 330 to the playing field 500 based on the control by the first control unit 600. As described above, in the present embodiment, the medal M inserted by a game player and the medal M to be actually shot to the playing field 500 are different from each other.

Also, when the medal M is inserted into the medal shooting mechanism 100, the medal movement simulation rendering unit 900 causes the arranged LEDs 920 to sequentially light up from the medal shooting mechanism 100 side to the medal discharging part 330 side based on the control by the first control unit 600. Here, it is possible to render a scene that the medal M inserted into the medal shooting mechanism 100 moves in a simulated way by the medal movement simulation rendering unit 900 by controlling the timing of causing the LED 920 disposed in the vicinity of the medal discharging part 330 to light up and the timing of discharging the medal M from the medal discharging part 330.

As illustrated in FIG. 1, in addition to the above elements, the station ST includes a ball shooting mechanism 1800 at least on its one side.

The ball shooting mechanism 1800 is a mechanism for shooting a ball B1 or B2 (to be described) to the playing field 500, and includes a sloped rail part 1801 and a ball shooting position drawing mechanism 1810. Note that the ball B1 and the ball B2 are game media to be used in a bingo game to be described.

The sloped rail part 1801 is an element for guiding the ball B1 or the ball B2 shot from a ball carrier 1520 (to be described) to the ball shooting position drawing mechanism 1810 under the gravity. Therefore, the ball shooting slope 1801 is a down slope. Also, the ball shooting position drawing mechanism 1810 is an element for selecting a position on the playing field 500 to which the ball B1 or the ball B2 is shot by a drawing. Thus, the ball B1 or the ball B2 shot to the station ST from the ball carrier 1520 (to be described) is shot to the playing ground 500 via the sloped rail part 1801 and the ball shooting position drawing mechanism 1810.

Also, as illustrated in FIG. 1, the station ST includes a ball transporting mechanism 1900 at least on its one side. The ball transporting mechanism 1900 is an element for transporting the ball B1 or the ball B2 fallen from the main table 501 of the playing field 500 to the satellite SA side, and includes a ball transporting path 1040, a ball transporting part 1910, and a ball transporting part traveling slope 1901, which are to be described. As illustrated in FIG. 4, the ball transporting path 1040 is provided below a front end 501*a*, and guides the ball B1 or the ball B2 fallen from the front end 501*a* to the ball transporting part 1910. The ball transporting part 1910 is an element for transporting the ball B1 or the ball B2 received through the ball transporting path 1040 to the satellite SA, and travels the ball transporting part traveling slope 1901 based on the control by the first control unit 600. Note that the ball B1 or the ball B2 transported to the satellite SA side is transferred to the ball carrier 1520 to be described (see FIG. 3).

Furthermore, another game (e.g., bingo game and digital drawing game), which is displayed in the display unit 700 of the station ST, is provided for a game player.

For example, the bingo game is a drawing game progressed with a drawing using a plurality of kinds (two kinds in the present embodiment) of balls B1 and B2 (to be described) and the satellite SA, and is progressed by a control unit to be described (this is referred to as a second control unit, and is not illustrated in the figure) in the satellite SA and the first control unit 600 in the station ST. Note that the second control unit to be described (not illustrated in the figure) in the satellite SA mainly controls the progression of the entire bingo game, and the first control unit 600 in the station ST mainly takes charge of the control of each game player's side in the bingo game. In addition, a matrix type bingo table to be used in the bingo game is generated by the first control unit 600 in the station ST, for instance, and is displayed in the display unit 700. Note that in the bongo game, depending on the status of winning, the ball B1 and/or the ball B2, the medal M, and the like are shot to the playing field 500 of the corresponding station ST, and the right to join in another game in addition to the bingo game is obtained. Also, in addition to this, a variety of benefits (e.g., directly paying-out the medal M to a game player) may be configured to be given to a game player.

Also, the digital drawing game is a drawing game in which the first control unit 600 of the station ST mainly digitally performs a drawing. The digital drawing game is displayed in the display unit 700 and is performed while the bingo game is not progressed, for instance. For example, the digital drawing game is started when the medal M enters any of the award-winning apertures 515-1, 515-2, and 515-3, which are provided in the slope table 512 of the pusher part 510. Note that in the digital drawing game, depending on the status of winning, the ball B1 and/or the ball B2, the medal M, and the like are shot to the playing field 500 of the corresponding station ST and probability of the drawing becomes advantageous for a game player. Also, in addition to this, a variety of benefits (e.g., directly paying-out the medal M and the like to a game player) may be configured to be given to a game player. Thus, a game condition that is advantageous for a game player is referred to as a provability change mode or a game condition while probability changes. Note game conditions excluding this condition are referred to as a normal mode.

Also, as illustrated in FIG. 1, the station ST includes a medal paying-out mechanism that has a lifting-up hopper 1020 and a medal paying-out part 1030. When the medal paying-out mechanism is driven, the medal(s) M, the number of which is the same as that of the medal(s) M fallen from the front end 501*a*, and the medal(s) M directly paid put to a game player, are paid out to an accumulating part 101 of the medal shooting mechanism 100.

(1-1-2) Configuration of Satellite

Next, FIG. 3 selectively illustrates a configuration of the satellite SA illustrated in FIG. 1, and its overall configuration will be explained with reference to FIGS. 1 and 3. The satellite SA of the present embodiment is an element for performing a drawing in a bingo game.

Figure 3:
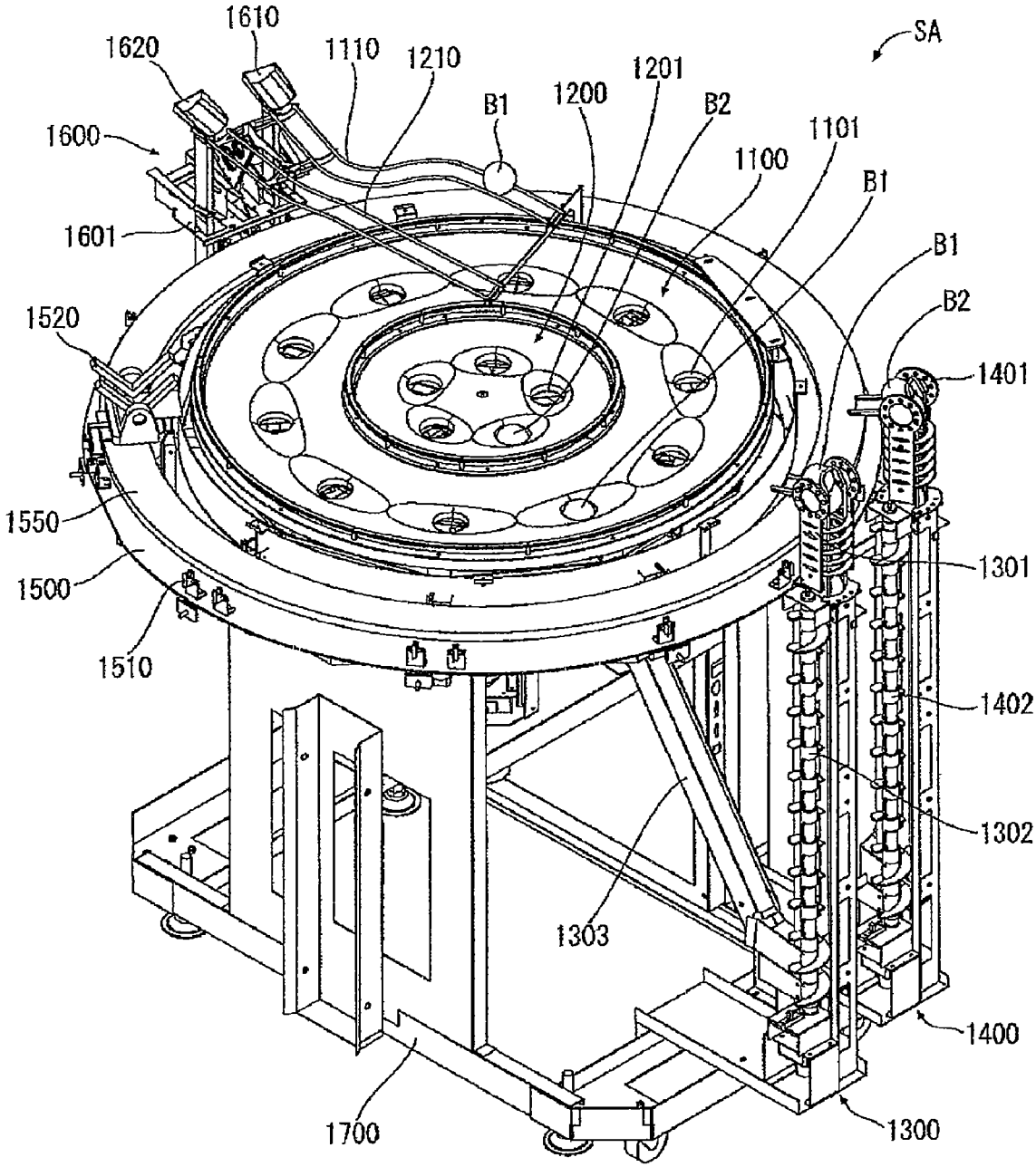
FIG. 3 is a perspective view illustrating a schematic configuration of a satellite SA illustrated in FIG. 1.
Figure 4:
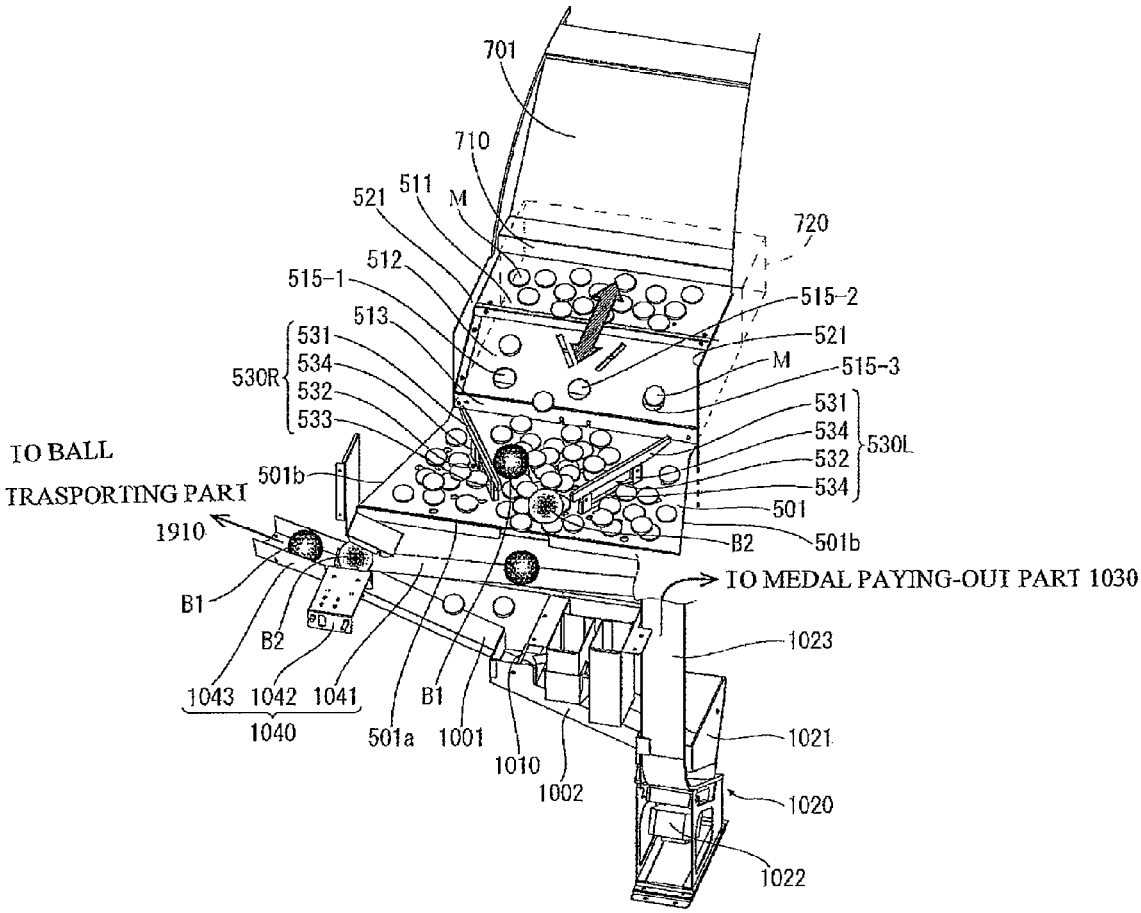
FIG. 4 is a partial perspective view selectively illustrating a playing field 500 and its peripheral part of an embodiment of the present invention.

As illustrated in FIG. 3, the satellite SA includes an outer bingo stage 1100, an inner bingo stage 1200, a ball supply mechanisms 1300 and 1400, a ball transporting path 1500, a ball shooting mechanism 1600, and a support base 1700.

The support base 1700 is an element functioning as a framework of the satellite SA, and supports other elements. The inner bingo stage 1200 is disposed on the upper center of the support base 1700, and the outer bingo stage 1100 is disposed to circularly surround the inner bingo stage 1200. Furthermore, the ball transporting path 1500 is disposed to circularly surround the outer bingo stage 1100. The ball supply mechanisms 1300 and 1400 are provided on the side of the ball transporting path 1500.

The ball supply mechanisms 1300 is an element for supplying a kind of ball, for example, the ball B1 that is made of non-metal. On the other hand, the ball supply mechanisms 1400 is an element for supplying a ball, the kind of which is different from that of the ball B1, for instance, the ball B2 that is made of metal. Note that the difference between the ball B1 and the ball B2 may be defined based on other factors (e.g., ball color) regardless of whether the balls are made of metal or non-metal.

The ball supply mechanisms 1300 includes a ball supply part 1301, a lifting-up part 1302, and a ball returning path 1303. The ball supply part 1301 is an element for supplying the ball B1 to a ball carrier 1520 to be described. The lifting-up part 1302 is an element for lifting up the ball B1 to the ball supply part 1301. The ball returning path 1303 is an element functioning as a path for returning the ball B1 supplied to the outer bingo stage 1100 (to be described) to the lifting-up part 1302 of the ball supply mechanisms 1300.

In the similar way to the above, the ball supply mechanism 1400 includes a ball supply part 1401, a lifting-up part 1402, and a ball returning path (not illustrated in the figure). The ball supply part 1401 is an element for supplying the ball B2 to the ball carrier 1520 to be described. The lifting-up part 1402 is an element for lifting up the ball B2 to the ball supply part 140*f*. The ball returning path (not illustrated in the figure) is an element functioning as a path for returning the ball B2 supplied to the inner bingo stage 1200 (to be described) to the lifting-up part 1402 of the ball of the ball supply mechanisms 1400.

The ball carrier 1520 is an element for transporting the ball B1 or the ball B2 along the outer periphery of the annular ball transporting path 1500. The ball carrier 1520 includes a receiving part that is made of two stick-shaped members that are bent in a V shape, and hold the ball B1 or the ball B2 by the receiving part. In addition, the ball carrier 1520 is fixed to a ring shaped member 1550 provided along the ball transporting path 1500. Therefore, when the ring shaped member rotates along the ball transporting path 1500, the ball carrier 1520 moves along the ball transporting path 1500.

The ball transporting path 1500 includes a plurality of sensor units 1510 on its outer peripheral surface. The sensor unit 1510 is an element for detecting whether or not the ball carrier 1520 exists in a position adjacent to this. Information detected by the sensor unit 1510 is inputted into the second control unit (not illustrated in the figure), for instance, arbitrarily or in a real time. The second control unit specifies a position of the ball carrier 1520 based on the information transmitted from the sensor unit 1510, and controls movement and stoppage of the ball carrier 1520 based on this. For example, when the ball B1 is supplied to the station ST illustrated in FIG. 1, the second control unit causes the ball carrier 1520 to stop in a position of a sensor unit 1510-1 based on the information transmitted from the sensor units 1510. Accordingly, the ball carrier 1520 is located in a position extended from the sloped rail part 1801. When the V-shaped receiving part of the ball carrier 1520 is tilted downward to the sloped rail part 1801 by the second control unit (not illustrated in the figure) under the condition, the ball B1 or the ball B2 held by the ball carrier 1520 is releases into the sloped rail part 1801 (see FIG. 1). Note that the sensor units 1510 are provided, for example, on the outer peripheral surface of the ball transporting path 1500, specifically, in a position in which the sloped rail part 1801 of each of the stations ST is disposed and a position in which the ball transporting part traveling slope 1901 is disposed, respectively.

The ball B1 or the ball B2 released into the slope rail part 1801 is shot to the playing field 500 via the ball shooting position drawing mechanism 1810. In a similar way to the medal M, the ball B1 or the ball B2 shot to the playing field 500 drops from the front end 501*a* of the main table 501 in the progression of a game. As described above, the dropped ball B1 or the ball B2 is set in the ball transporting part 1910 via the ball transporting path 1040 illustrated in FIG. 4. Note that the ball transporting path 1040 includes a ball receiving part 1041 for receiving only the ball B1 or the ball B2 and for passing the medal M to the downward. Also, the ball transporting part 1910 stands by at a ball outlet 1043 of the ball transporting path 1040 in a normal condition.

As described above, the ball transporting part 1910 is an element for transporting the ball B1 or the ball B2 to the satellite SA. When the ball B1 or the ball B2 is set, the ball transporting part 1910 moves up the ball transporting part traveling slope 1901 based on the control by the second control unit (not illustrated in the figure), and moves to the upper end of the ball transporting part traveling slope 1901. The ball carrier 1520 stands by in the vicinity of the upper end of the ball transporting part traveling slope 1901. The ball transporting part 1910 moves to the upper end of the ball transporting part traveling slope 1901, and then transfers the ball B1 or the ball B2 carried thereby to the ball carrier 1520. Note that the ball carrier 1520 takes a posture of holding the ball B1 or the ball B2 when the ball B1 or the ball B2 is transferred to the ball carrier 1520.

In addition, the ball carrier 1520 moves to a position opposed to the ball shooting mechanism 1600 based on the control by the second control unit (not illustrated in the figure) when the ball carrier 1520 receives the ball B1 or the ball B2. The ball shooting mechanism 1600 includes a saucer 1610 for shooting the ball B1 to the outer bingo stage 1100 and a saucer 1620 for shooting the ball B2 to the inner bingo stage 1200. The ball carrier 1520 moves to a position opposed to the saucer 1610 or the saucer 1620 based on the control by the above described second control unit (not illustrated in the figure) depending on a kind of ball (B1 or B2) held by the ball carrier 1520. The saucers 1610 and 1620 move down to a position opposed to the ball carrier 1520 when they receive the ball from the ball carrier 1520, and move up to a position opposed to ball shooting paths 1110 and 1210 when they receive the ball from the ball carrier 1520. Then, they hold the ball until a ball release timing to be instructed by a game player comes, for instance.

For example, when the ball carrier 1520 receives the ball B1 from the ball transporting part 1910, the ball carrier 1520 travels along the ball transporting path 1500, and then transfers the ball B1 to the saucer 1610 of the ball shooting mechanism 1600. After the saucer 1610 receives the ball B1, the saucer 1610 releases the ball B1 that it holds into the ball shooting path 1110, for example, at the timing of following a game player's instruction. The released ball B1 is shot to the outer bingo stage 1100 after acceleration is obtained depending on the slope and the length of the ball shooting path 1110. Also, when the ball carrier 1520 receives the ball B2 from the ball transporting part 1910, for instance, the ball carrier 1520 travels along the ball transporting path 1500, and transfers the ball B2 to the saucer 1620 of the ball shooting mechanism 1600. After the saucer 1620 receives the ball B2, the saucer 1620 releases the ball B2 that it holds to the ball shooting path 1210, for instance, at the timing of following a game player's instruction. The released ball B2 is shot to the inner bingo stage 1200 after acceleration is obtained depending on the slope and the length of the ball shooting path 1210. Note that it is possible to detect whether a kind of the ball transferred to the ball carrier 1520 is B1 or B2 by providing a metal sensor to the ball carrier 1520 when the ball B1 is made of non-metal and the ball B2 is made of metal. In addition, when color of the ball B1 is set to be different from that of the ball B2, it is possible to detect a kind of the transferred ball by providing a color sensor to the ball carrier 1520. Also, a detected kind of the ball is transmitted to the second control unit (not illustrated in the figure). Therefore, the ball carrier 1520 is controlled based on a kind of the ball informed to the second control unit.

The outer bingo stage 1100 includes a single or plurality of prize-winning spot(s) 1101 (which is/are also referred to as a first prize-winning spot(s)) with a certain degree of diameter through which the ball B1 is capable of passing, and rotates at a predetermined cycle. The prize-winning spot 1101 may be a hole, for example. However, the prize-winning spot 1101 is not limited to this, and any changes may be made for the prize-winning spot 1101 as long as the ball B1, which is the drawing medium, rotationally moves on the outer bingo stage 1100, which is the first drawing field, and is then capable of entering the prize-winning spot 1101. A number or a drawing pattern, which is used in the bingo game, is allocated to each of the prize-winning spots 1101. The ball B1 shot to the outer bingo stage 1100 goes around the outer bingo stage 1100 by acceleration obtained in the ball shooting path 1110 and rotation of the outer bingo stage 1100 itself, and then enters any of the prize-winning spot 1101. The information of the prize-winning spot 1101 that the ball B1 enters is arbitrarily transmitted to the second control unit (not illustrated in the figure). Note that the second control unit sets the number or the drawing pattern, which is allocated to the prize-winning spot 1101 that the ball B1 enters, to be prize-winning, and progresses the bingo game.

In a similar way to the above, the inner bingo stage 1200 includes a single or plurality of prize-winning spots 1201 (which is/are also referred to as a second prize-winning spot (s)) with a certain degree of diameter through which the ball B2 is capable of passing, and rotates at a predetermined cycle. The prize-winning spot 1201 may be a hole, for example. However, the prize-winning spot 1201 is not limited to this, and any changes may be made for the prize-winning spot 1201 as long as the ball B2, which is the drawing medium, rotationally moves on the inner bingo stage 1200, which is the second drawing field, and is then capable of entering the prize-winning spot 1201. A number or a drawing pattern in the bingo game is allocated to each of the prize-winning spots 1201. The ball B2 shot to the inner bingo stage 1200 goes around the inner bingo stage 1200 by acceleration obtained in the ball shooting path 1210 and rotation of the inner bingo stage 1200 itself, and enters any of the prize-winning spots 1201. The information of the prize-winning spot 1201 that the ball B2 enters is arbitrarily transmitted to the second control unit (not illustrated in the figure). Note that the second control unit sets the number or the drawing pattern, which is allocated to the prize-winning spot 1201 that the ball B2 enters, to be the prize-winning, and progresses the bingo game.

The ball B1 that entered the prize-winning spot 1101 is temporarily held at the entrance of the prize-winning spot 1101 so that a game player is capable of viewing it, and is then released to the ball returning path 1303 that is provided below the outer bingo stage 1100. In a similar way to the above, the ball B2 that entered the prize-winning spot 1201 is temporarily held at the entrance of the prize-winning spot 1201 so that the game player is capable of viewing it, and is then released to a ball returning path (not illustrated in the figure) that is provided below the inner bingo stage 1200.

Note that a bingo game using a ball in the present invention will be hereinafter explained in detail.

(1-2) Medal Shooting Mechanism

Also, a configuration of a medal shooting mechanism 100 of the present embodiment will be hereinafter explained in detail with reference to the figures.

(1-2-1) Medal Shooting Mechanism 100

Figure 10:
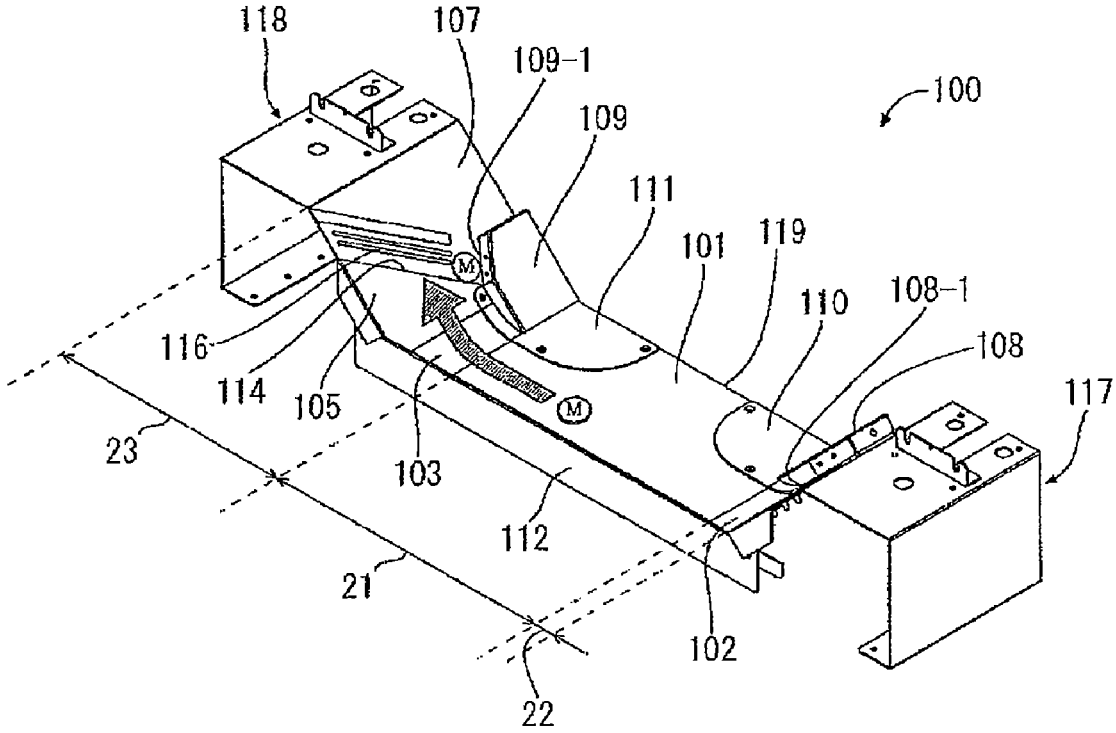
FIG. 10 is a perspective view illustrating a medal shooting mechanism in accordance with an embodiment of the present invention.
Figure 11:
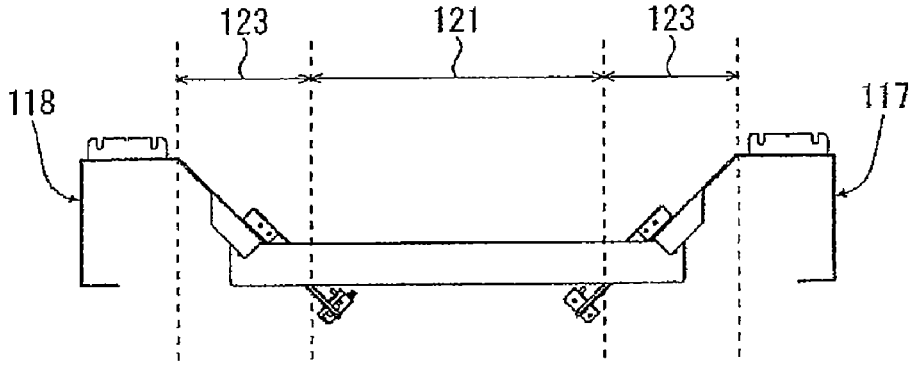
FIG. 11 is a front view of the medal shooting mechanism illustrated in FIG. 10.
Figure 12:
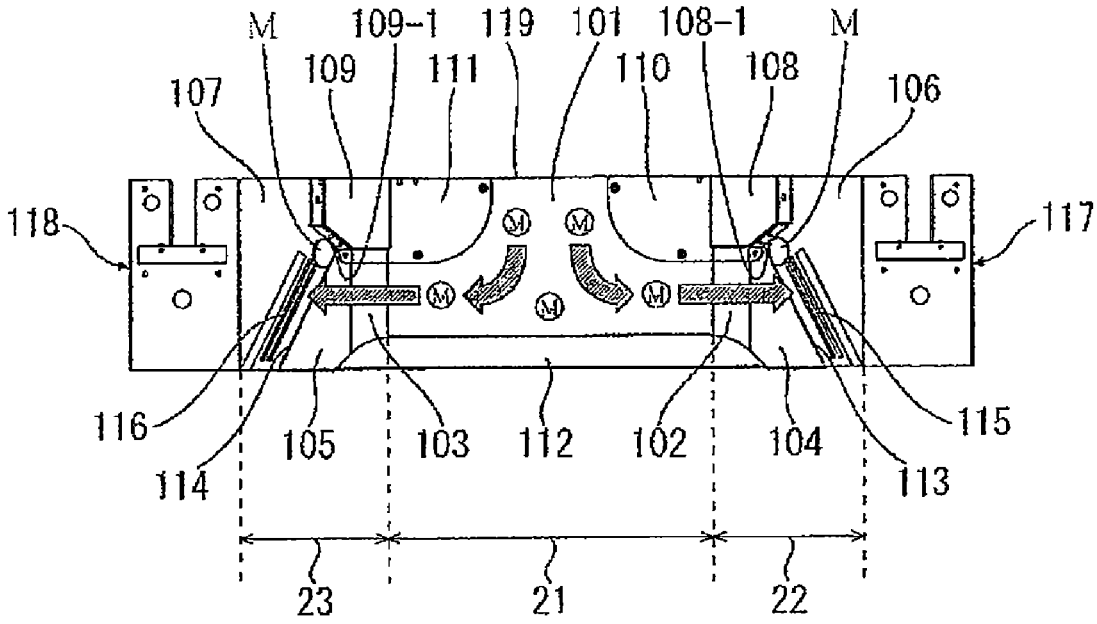
FIG. 12 is a top view of the medal shooting mechanism illustrated in FIG. 10.
Figure 13:
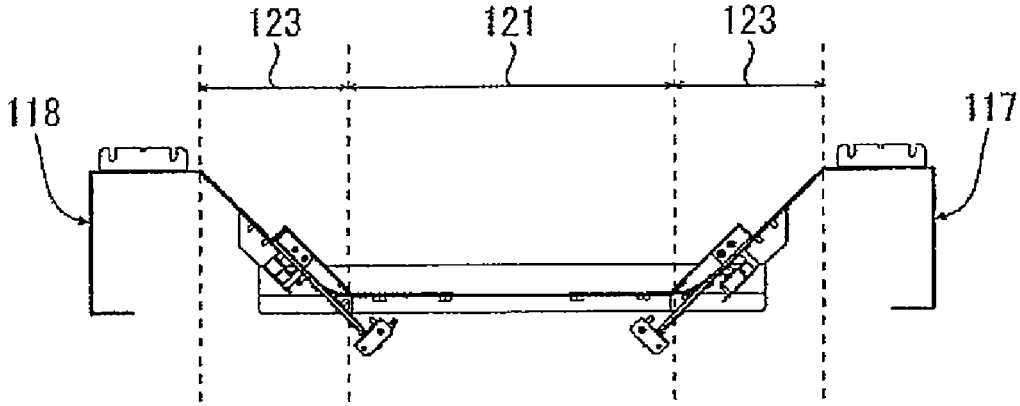
FIG. 13 is a back view of the medal shooting mechanism illustrated in FIG. 10.

FIG. 10 is a perspective view illustrating a medal shooting mechanism of an embodiment of the present invention. FIG. 11 is a front view of the medal shooting mechanism illustrated in FIG. 10. FIG. 12 is a top view of the medal shooting mechanism illustrated in FIG. 10. FIG. 13 is a back view of the medal shooting mechanism illustrated in FIG. 10.

The medal shooting mechanism 100 includes a flat area 21, a first sloped area 22 and a second sloped area 23 that are located on the both sides of the flat area 21, a first lateral structure 117 that is located external to the first sloped area 22, and a second lateral structure 118 that is located external to the second sloped area 23. The medal shooting mechanism 100 includes an accumulating part 101 on which a plurality of medals are accumulated. The accumulating part 101 makes up the flat area 21 of the medal shooting mechanism 100.

The medal shooting mechanism 100 further includes a first sloped wall that is continuously sloped up and extended from a first boundary area 102 adjacent to a first lateral portion of the accumulating part 101. The first sloped wall makes up the first sloped area 22. The first sloped wall is formed by the first sloped wall lower area 104 and the first sloped wall upper area 106. The first boundary area 102 is formed by a curved surface.

The medal shooting mechanism 100 further includes a second sloped wall that is continuously sloped up and extended from a second boundary area 103 adjacent to a second lateral portion of the accumulating part 101, which is located on the opposite side from the above described first lateral portion. The second sloped wall makes up the second sloped area 23. The second sloped wall is formed by the second sloped wall lower area 105 and the second sloped wall upper area 107. The second boundary area 103 is formed by a curved surface.

The medal shooting mechanism 100 further includes a first medal shooter 108 that includes a first medal slot 108-1 on a position adjacent to the first sloped wall, and a second medal shooter 109 that includes a second medal slot 109-1 on a position adjacent to the second sloped wall. The first boundary area 102, the first sloped wall lower area 104, the first sloped wall upper area 106, and the first medal shooter 108 make up the first sloped area 22 of the medal shooting mechanism 100. The second boundary area 103, the second sloped wall lower area 105, the second sloped wall upper area 107, and the second medal shooter 109 make up the second sloped area 23 of the medal shooting mechanism 100.

The first medal shooter 108 further includes a first attached flange 110. The first attached flange 10 is extended from a part of the first boundary area 102 to a part of the accumulating part 101. The second medal shooter 109 further includes a second attached flange 111. The second attached flange 111 is extended from a part of the second boundary area 103 to a part of the accumulating part 101. As illustrated in FIG. 12, the first attached flange 110 and the second attached flange 111 that are extended on the accumulating part 101 respectively have a largely-rounded corner. The first attached flange 110 and the second attached flange 111 delimit a medal accumulating area on which a medal M is accumulated on the accumulating part 101. The first attached flange 110 and the second attached flange 111 are separately disposed from each other, and the medal M is supplied from a medal supplying side 119 between the two flanges 110 and 111. Movement of the supplied medal M is restricted by the largely-rounded corners of the first attached flange 110 and the second attached flange 111. A first medal constraining plate 112 prevents the medal M from falling that is supplied from the accumulating part 101 to the front side on which a player stands, and is disposed on an opposite lateral side from the medal supplying side 119 of the accumulating part 101.

A first guide 113 is formed on the boundary between the first sloped wall lower area 104 and the first sloped wall upper area 106. The first guide 113 is configured to catch the medal slidingly falling along the first sloped wall upper area 106 and is also configured to make the medal slidingly roll into the first medal slot 108-1 along the first guide. The first guide 113 is formed by a first step 113 formed on the boundary between the first sloped wall lower area 104 and the first sloped wall upper area 106. The first step 113 is linearly sloped down and extended to the first medal slot 108-1. The first sloped wall upper area 106 includes at least one protrusion that is formed to reduce friction to be generated between the first sloped wall upper area 134 and the medal M slidingly rolling along the first guide 113. In other words, the first sloped wall upper area 106 includes at least one ridge-shaped protrusion 115 that is separated upward from the first guide 113 at distance less than diameter of the medal M and is extended approximately in parallel with a direction in which the first guide 113 is extended. Specifically, a plurality of ridge-shaped protrusions 115 are formed as illustrated in the figure.

A second guide 114 is formed on the boundary between the second sloped wall lower area 105 and the second sloped wall upper area 107. The second guide 114 is configured to catch the medal slidingly falling along the second sloped wall upper area 107 and is also configured to make the medal slidingly roll into the second medal slot 109-1 along the second guide. The second guide 114 is formed by a second step 114 formed on the boundary between the second sloped wall lower area 105 and the second sloped wall upper area 107. The second step 114 is linearly sloped down and extended to the second medal slot 109-1. The second sloped wall upper area 107 includes at least one protrusion that is formed to reduce friction to be generated between the second sloped wall upper are 135 and the medal M slidingly rolling along the second guide 114. In other words, the second sloped wall upper area 107 includes at least one ridge-shaped protrusion 116 that is separated upward from the second guide 114 at distance less than diameter of the medal M and is extended approximately in parallel with a direction in which the second guide 114 is extended. Specifically, a plurality of ridge-shaped protrusions 116 are formed as illustrated in the figure.

The external upper end of the first sloped wall upper area 106 is combined with the first lateral structure 117. The first lateral structure 117 is formed to have a deformed L-shaped cross section, and includes a flat top, a perpendicular wall, and a flat bottom. The flat top is continuously extended outward from the external upper end of the first sloped wall upper area 106. The perpendicular wall is perpendicularly extended downward from the external end of the flat top. The flat bottom is inwardly extended from the bottom end of the perpendicular wall. An operating handle of a control system for controlling a position and a direction of a discharging end of the medal discharging path 400 is attached to the flat top. A player controls the position and the direction of the discharging end of the medal discharging path 400 by manipulating the operating handle. The flat bottom serves as an attached flange for attaching the medal shooting mechanism 100 to the chassis 800 of the station ST.

The external upper end of the second sloped wall upper area 107 is combined with the second lateral structure 118. The second lateral structure 118 is formed to have a deformed L-shaped cross section, and includes a flat top, a perpendicular wall, and a flat bottom. The flat top is continuously extended outward from the external upper end of the second sloped wall upper area 107. The perpendicular wall is perpendicularly extended downward from the external end of the flat top. The flat bottom is inwardly extended from the bottom end of the perpendicular wall. An operating handle of a control system for controlling a position and a direction of a discharging end of the medal discharging path 400 is attached to the flat top. A player controls the position and the direction of the discharging end of the medal discharging path 400 by manipulating the operating handle. The flat bottom serves as an attached flange for attaching the medal shooting mechanism 100 to the chassis 800 of the station ST.

When the accumulating part 101, the first boundary area 102, the second boundary area 103, the first sloped wall lower area 104, the second sloped wall lower area 105, the first sloped wall upper area 106, and the second sloped wall upper area 107 are formed in one member, seams are not formed in the area on which the medal M is movable. Accordingly, it becomes possible to reduce the resistance.

Also, the first medal slot 108-1 of the first medal shooter 108 and the second medal slot 109-1 of the second medal shooter 109 have dimensions that only one medal M is allowed to be inserted thereinto at a time. The configuration serves to reliably prevent a situation that a plurality of medals M are stucked in the first medal shooter 108 or the second medal shooter 109 when the medals M are simultaneously inserted into the first medal slot 108-1 or the second medal slot 109-1.

The above described medal shooting mechanism 100 has an approximately symmetrical shape and structure with reference to the middle position between the first and second lateral portions.

Figure 14:
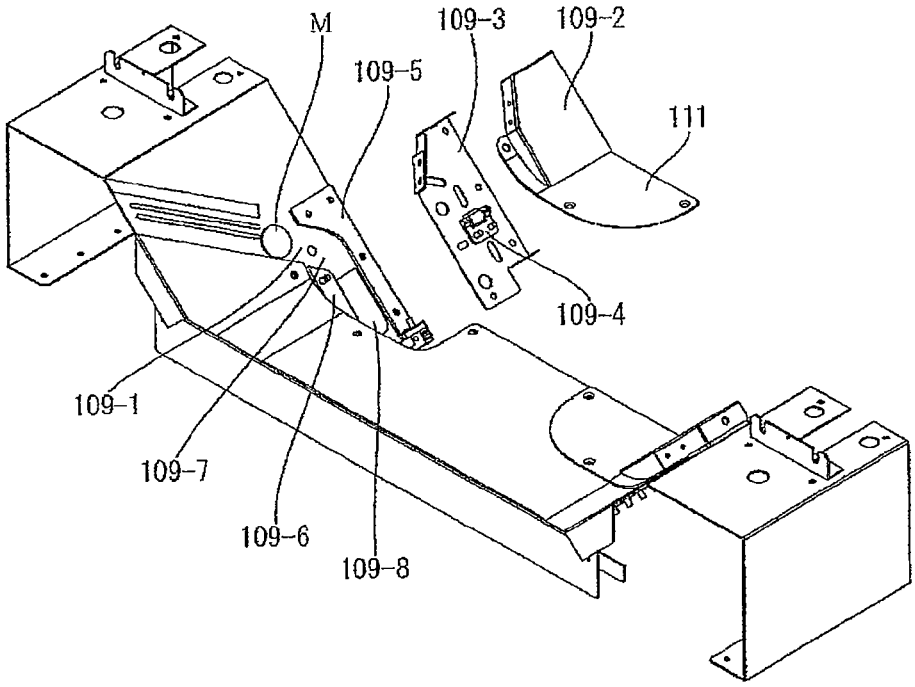
FIG. 14 is a partial exploded view of the medal shooting mechanism illustrated in FIG. 10.

FIG. 14 is a partial exploded view of the medal shooting mechanism illustrated in FIG. 10. The first medal shooter 108 and the second medal shooter 109 are formed in the same structure. Therefore, the internal structure of the second medal shooter 109 will be hereinafter explained with reference to FIG. 14.

The second medal shooter 109 includes a second medal slot 109-1 adjacent to the second guide 114, that is, an abutment portion of the second step 114, a medal shooting path 109-7 in communication with the abutment portion of the second step 114, a medal falling hole 109-8 in communication with the medal shooting path 109-7, and a first medal guide plate 109-5 and a second medal guide plate 109-6, both of which delimit the medal shooting path 109-7 and the both lateral portions of the falling hole 109-8. The medal shooting path 109-7 is formed to guide the medal M that is shot through the second medal slot 109-1 to the medal falling hole 109-8.

Furthermore, the second medal slot 109 includes a second intermediate plate 109-3 having a second roller 109-4. The second intermediate plate 109-3 is attached to the first medal guide plate 109-5 and the second medal guide plate 109-6. The second roller 109 is positioned on the medal falling hole 109-8. Therefore, when the medal M passing through the medal shooting path 109-7 heads to a position on the medal falling hole 109-8, the medal M comes into contact with the second roller 109 and is slightly pressed down, and thus it falls through the medal falling hole 109-8. The fallen medal M is transported to the lifting-up hopper 300 through the medal transporting path 200 illustrated in FIG. 1. Then, the medal M is lifted up to the supplying end of the medal discharging path 400 by the lifting-up hopper 300, and is supplied on the playing field 500 from the discharging end through the medal discharging path 400. Furthermore, the second medal slot 109 further includes a second medal shooter cover 109-2. The second medal shooter cover 109-2 covers the second intermediate plate 109-3. In addition, the second medal shooter cover 109-2 is integrally formed with the second attached flange 111. When the second attached flange 111 is fixed to the accumulating part 101, the second medal shooter cover 109-2 is indirectly fixed to a position on the second intermediate plate 109-3 is indirectly fixed.

When a game player slides the medal M accumulated on the accumulating part 101 upward along the first sloped wall lower area 104 and the first sloped wall upper area 106, and the second sloped wall lower area 105 and the second sloped wall upper area 107, all of which are continuously sloped up and extended from the accumulating part 101, and then releases the medal M, the medal M slidingly falls along the first sloped wall upper area 106 and the second sloped wall upper area 107 under the gravity and is caught by the first step 113 forming the first guide 113 and the second step 114 forming the second guide 114. Also, the first step 113 and the second step 114 are configured to make the medal M slidingly roll into the first medal slot 108-1 and the second medal slot 109-1 under the gravity.

In other words, if a game player slides the medal M upward along the first sloped wall lower area 104 and the first sloped wall upper area 106, and the second sloped wall lower area 105 and the second sloped wall upper area 107, all of which are continuously sloped up and extended from the accumulating part 101, and then releases the medal M, the medal M slidingly falls along the first sloped wall upper area 106 and the second sloped wall upper area 107 under the gravity and is caught by the first step 113 and the second step 114. Then, the medal M slidingly rolls into the first medal slot 108-1 of the first shooter and the second medal slot 109-1 along the first step 113 and the second step 114 under the gravity. When the medal M rolls along the first step 113 and the second step 114, the medal M is going to slide with respect to the first sloped wall upper area 106 and the second sloped wall upper area 107. In other words, it is only necessary for a game player to slide the medal M upward from the accumulating part 101 to the upper areas of the first sloped wall lower area 104 and the first sloped wall upper area 106, and the second sloped wall lower area 105 and the second sloped wall upper area 107, and then release the medal M. Therefore, it is not required for a game player to manually carry the medal M from the accumulating part 101 to the first medal slot 108-1 and the second medal slot 109-1 as is conventionally performed. In other words, this makes a game player comfortably move one's hand by making use of the gravity.

Accordingly, even when a game player continuously shoots medals M for a long time, it is possible to largely reduce game player's tiredness. In addition, a game player does not wear out ones nerves too much for shooting the medal M, and thus the game player is capable of concentrating on the game itself and really enjoying the game.

Also, if a game player slides the medal M upward along the first sloped wall lower area 104 and the first sloped wall upper area 106, and the second sloped wall lower area 105 and the second sloped wall upper area 107 and then releases the medal M, the medal M slidingly falls along the first sloped wall upper area 106 and the second sloped wall upper area 107 under the gravity and is caught by the first step 113 and the second step 114. Then, the medal M slidingly rolls into the first medal slot 108-1 of the first shooter and the second medal slot 109-1 along the first step 113 and the second step 114 under the gravity. In other words, it becomes possible to largely reduce game player's tiredness even when the game player continuously shoots the medal M for a long time without automating shooting of the medal M. Accordingly, it becomes possible to really fascinate a game player for a long time while the game player feels that the game player oneself actively plays the game.

It is only necessary for the first step 113 and the second step 114 to have a function of catching the medal M that slidingly falls along the first sloped wall upper area 106 and the second sloped wall upper area 107 under the gravity, and a function of making the medal M slidingly roll into the first medal slot 108-1 and the second medal slot 109-1 along the first step 113 and the second step 114 under the gravity. However, it is required to slidingly move the medal M to a position higher than the first guide 113 (i.e., the first step 113) and the second guide 114 (i.e., the second step 114). Therefore, when the medal M is slidingly moved upward, it is preferable that the first guide 113 (i.e., the first step 113) and the second guide 114 (i.e., the second step 114) does not block movement of the medal M. In consideration of this, it is meaningful that the first guide 113 is formed by the first step 113 and the second guide 114 is formed by the second step 114. Note that an important point is that the step surfaces of the first and second steps 113 and 114 face upward. With the configuration, it becomes easy to slidingly move the medal M upward across the first step 113 and the second step 114. In addition, it becomes possible to catch the medal M on the step surfaces of the first step 113 and the second step 114, when the medal M once slidingly moved upward is released from a hand of a game player and slidingly falls along the first sloped wall upper area 106 and the second sloped wall upper area 107. When the step surfaces of the first step 113 and the second step 114 face downward, it is impossible to block the medal M that slidingly moves upward along the first sloped wall lower area 104 and the first sloped wall upper areas 106, and the second sloped wall lower area 105 and the second sloped wall upper area 107, and it is also impossible to make the medal M slidingly roll into the first medal slot 108-1 and the second medal slot 109-1 under the gravity while the medal M is caught.

It is possible to achieve the first step 113 by configuring the first sloped wall lower area 104 to have thickness greater than that of the first sloped wall upper area 106. In addition, it is possible to achieve the second step 114 by forming the second sloped wall lower area 105 to have thickness greater than the second sloped wall upper area 107. For example, the first sloped wall and the second sloped wall may be formed by combining a first flat plate that is extended in both of the upper and lower areas and a second flat plate that is extended only in the lower area. In addition, the first sloped wall and the second sloped wall may be formed such that only the lower area of the first flat plate that is extended in both of the upper and lower areas is thinly processed. In both cases, it is possible to achieve the first step 113 and the second step 114 with an existing technique.

Also, it is possible to configure the first step 113 and the second step 114 to be extended to the first medal slot 108-1 and the second medal slot 109-1. In this case, it is required to make the medal M caught by the first step 113 and the second step 114 roll toward the first medal slot 108-1 and the second medal slot 109-1 under the gravity. Accordingly, the first step 113 and the second step 114 are sloped down and extended to the first medal slot 108-1 and the second medal slot 109-1. Specifically, the first step 113 and the second step 114 are formed to be linearly sloped down to the first medal slot 108-1 and the second medal slot 109-1. However, as a modified example, it is possible to form the first step 113 and the second step 114 to be curvilinearly sloped down to the first medal slot 108-1 and the second medal slot 109-1. Furthermore, it is also possible to form the first step 113 and the second step 114 by the combination of linear and curvilinear shapes. However, regardless of a position in the first step 113 and the second step 114 where the medal M is caught, the first step 113 and the second step 114, respectively, have the minimum-required slope angle for making the medal M roll toward the first medal slot 108-1 and the second medal slot 109-1 under the gravity.

Furthermore, it is required to form the abutment portions of the first step 113 and the second step 114 for making the medal M slidingly roll into the first medal slot 108-1 and the second medal slot 109-1 under the gravity. The abutment portions of the first step 113 and the second step 114 are disposed adjacent to the first medal slot 108-1 and the second medal slot 109-1. It is possible to provide a modified example that the abutment portions of the first step 113 and the second step 114 are not disposed to be adjacent to the first medal slot 108-1 and the second medal slot 109-1, that is, gaps are generated between the first step 113 and the first medal slot 108-1, and between the second step 114 and the second medal slot 109-1. However, this is not a matter as long as the medal M rolling the first step 113 and the second step 114 finally rolls into the first medal slot 108-1 and the second medal slot 109-1. For this purpose, the first medal slot 108-1 of the first medal shooter 108 and the second medal slot 109-1 of the second shooter 109 are disposed adjacent to the first sloped wall and the second sloped wall.

In addition, width of the step surfaces of the first step 113 and the second step 114, in other words, dimensions of the first step 113 and the second step 114 are determined such that the step surfaces of the first step 113 and the second step 114 are capable of catch the medal M that slidingly falls along the first sloped wall upper area 106 and the second sloped wall upper area 107. The minimum-required dimension of the first step 113 and the second step 114 depend on slope angles of the first sloped wall and the second sloped wall and the thickness of the medal M. For example, when the first sloped wall and the second sloped wall are formed to have large slope angles, the step surfaces of the first step 113 and the second step 114 are supposed to be formed to have widths greater than those of a case that the first sloped wall and the second sloped wall are formed to have small slope angles.

Furthermore, when widths of the step surfaces of the first step 113 and the second step 114 are formed to be much less than thickness of the medal M, it is impossible to catch the medal M that slidingly falls along the first sloped wall upper area 106 and the second sloped wall upper area 107, and thus the medal M sligingly falls to the accumulating part 101 across the first step 113 and the second step 114. As a result, it is impossible to insert the medal M into the first medal slot 108-1 and the second medal slot 109-1. Therefore, in consideration of thickness of the medal M and the slope angles of the first sloped wall and the second sloped wall, it is required for the step surfaces of the first step 113 and the second step 114 to have the minimum-required widths for catching the medal M that slidingly falls along the first sloped wall upper area 106 and the second sloped wall upper area 107. When the step surfaces of the first step 113 and the second step 114 are formed to have widths greater than thickness of the medal M, it is possible to increase the likelihood of catching the medal M that slidingly falls along the first sloped wall upper area 106 and the second sloped wall upper area 107. In addition, when the step surfaces of the first step 113 and the second step 114 are formed to have greater than twice the thickness of the medal M, it becomes possible to simultaneously catch two overlapping medals M that slidingly fall along the first sloped wall upper area 106 and the second sloped wall upper area 107. It should be note that when widths of the step surfaces of the first step 113 and the second step 114 are formed to be too large, the medal M may flop on the first step 113 and the second step 114 while the medal M is slidingly moved upward across the first step 113 and the second step 114, and thus there is a possibility that the medal M does not smoothly roll across the first step 113 and the second step 114.

Figure 29:
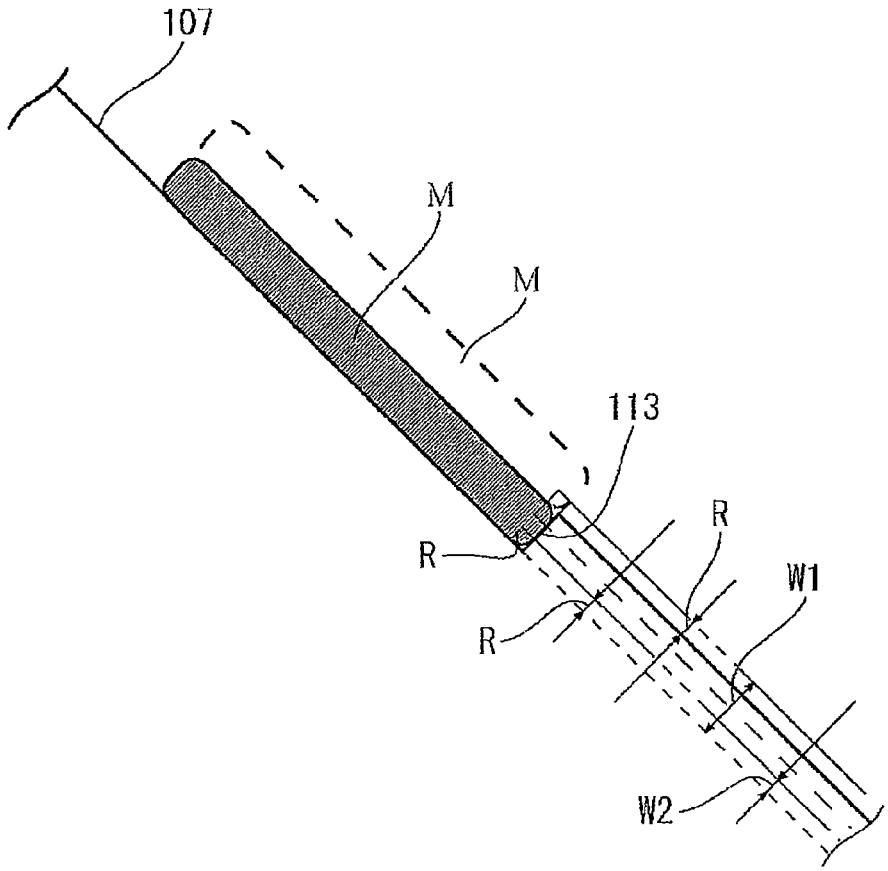
FIG. 29 is a diagram illustrating relation between thickness of a medal and width of step surfaces of the first and second steps.

FIG. 29 is a diagram for illustrating a relation between thickness of the medal M and widths of the step surfaces of the first step 113 and the second step 114. In a case that the peripheral portion of the medal M is formed to have a non-rectangular cross-section so that the corners of the cross-section are formed to have rounds R, the medal M may be caught by the first step 113 and the second step 114 when the step surfaces of the first step 113 and the second step 114 are formed to have widths W2 greater than or equal to thickness R of the round shaped portions. However, in a practical situation, the medal M that slidingly falls along the first sloped wall upper area 106 and the second sloped wall upper area 107 may not be caught by the first step 113 and the second step 114 as a result of impact and/or vibration to be generated when the medal M makes contact with the first step 113 and the second step 114. Therefore, the step surfaces of the first step 113 and the second step 114 are designed to have widths greater than the theoretically minimum-required width W2. Furthermore, as illustrated in FIG. 29, for the purpose of simultaneously catching the two overlapping medals M that slidingly fall along the first sloped wall upper area 106 and the second sloped wall upper area 107, the two overlapping medals M may be theoretically caught when the step surfaces of the first step 113 and the second step 114 are formed to have widths W I greater than or equal to the sum of thickness of the single medal M and thickness R of the round shaped portion. However, in a practical situation, impact and/or vibration are/is generated when two overlapping medals M slidingly fall along the first sloped wall upper area 106 and the second sloped wall upper area 107 and make contact with the first step 113 and the second step 114. Accordingly, one of the two medals M, which is overlapped on the other, may not be caught by the first step 113 and the second step 114. Therefore, for the purpose of catching both of the two overlapping medals M, the step surfaces of the first step 113 and the second step 114 are designed to have widths greater than the theoretically minimum-required width W1.

From the perspective, in order to catch the single medal M, it is preferable to design the step surface of the first step to have width approximately corresponding to thickness of the single game medium. Here, "approximately" corresponding to thickness of the single game medium means that the width includes error corresponding to the thickness R of the round shaped portion.

Furthermore, angle of the step surface of the first step is preferably right angle or acute angle with respect to the first sloped wall. When the angle of the step surface of the first step is set to be obtuse angle with respect to the first sloped wall, there is a high possibility that the game medium that slidingly falls along the first sloped wall slidingly falls without being caught by the first step.

When the first sloped wall and the second sloped wall are formed to have large slope angles, in other words, when the first sloped wall lower area 104 and the first sloped wall upper area 106, and the second sloped wall lower area 105 and the second sloped wall upper areas 107, are formed to be nearly perpendicular, it becomes difficult to slidingly move the medal M upward from the accumulating part 101 to the sloped wall lower area 104 and the first sloped wall upper area 106, and the second sloped wall lower area 105 and the second sloped wall upper area 107. On the other hand, when the first sloped wall and the second sloped wall are formed to have small slope angles, in other words, when the first sloped wall lower area 104 and the first sloped wall upper area 106, and the second sloped wall lower area 105 and the second sloped wall upper area 105 are set to be nearly flat, it becomes easy to slidingly move the medal M upward from the accumulating part 101 to the first sloped wall lower area 104 and the first sloped wall upper area 106, and the second sloped wall lower area 105 and the second sloped wall upper area 107. However, after a game player releases the medal M, the frictional force to be generated between the medal M and the first and second sloped walls will be increased. Therefore, the medal M becomes less easily slidingly falls along the first sloped wall upper area 106 and the second sloped wall upper area 107. In addition, the frictional force will be large, which is generated when the medal M slidingly moves on the first sloped wall upper area 106 and the second sloped wall upper area 107 while rolling along the first step 113 and the second step 114. Accordingly, there is a possibility that the medal M stops moving on the way to the first medal slot 108-1 and the second medal slot 109-1 and thus cannot reach the first medal slot 108-1 and the second medal slot 109-1. Therefore, in consideration of the above, it is required for the first sloped wall lower area 104 and the first sloped wall upper area 106, and the second sloped wall lower area 105 and the second sloped wall upper area 107 to have slope angle that is neither nearly perpendicular nor nearly flat. For example, it is preferable to set the first sloped wall lower area 104 and the first sloped wall upper area 106, and the second sloped wall lower area 105 and the second sloped wall upper area 107 to have the slope angle of 20-70 degrees. Furthermore, it is more preferable to set them to have the slope angle of 30-60 degrees. The first sloped wall lower area 104 and the first sloped wall upper area 106, and the second sloped wall lower area 105 and the second sloped wall upper area 107 may be typically set to have the slope angles of approximately 45 degrees.

Furthermore, for the purpose of slidingly moving the medal M upward from the accumulating part 101 to the first sloped wall lower area 104 and the second sloped wall lower area 105 with the minimum resistance, it is preferable to form the first boundary area 102 and the second boundary area 103 to be curved surfaces. The preferable curvature of the curved surfaces depends on diameter dimension of the medal M, but it is only necessary for the curved surfaces to have curvature radius sufficiently greater than diameter dimension of the medal M. It is possible to easily empirically decide the preferable curvature.

Furthermore, as described above, it is preferable to reduce the frictional resistance to be generated between the first and second sloped walls and the medal M as much as possible. A plurality of first ridge-shaped protrusions 115 and a plurality of second ridge-shaped protrusions 116 effectively work for reducing the frictional force. The medal M is formed in an approximately disk shape. Furthermore, when the first sloped wall upper area 106 and the second sloped wall upper area 107 are formed to have flat surfaces, the entire area of the lateral surface of the medal M makes contact with the flat surfaces of the first sloped wall upper area 106 and the second sloped wall upper area 107. Reducing the contact area between the medal M and the first sloped wall upper area 106 and the second sloped wall upper area 107 effectively works for reducing the frictional force to be generated between the medal M and the first sloped wall upper area 106 and the second sloped wall upper area 107. In order to reduce the contact area, the plurality of first ridge-shaped protrusions 115 and the plurality of second ridge-shaped protrusions 116 are formed in the first sloped wall upper area 106 and the second sloped wall upper area 107. With the configuration, the medal M that rolls on the first guide 113 (i.e., the first step 113) and the second guide 114 (i.e., the second step 114) slidingly makes contact with the plurality of first ridge-shaped protrusions 115 and the plurality of second ridge-shaped protrusions 116. Accordingly, the contact area between the medal M and the first sloped wall upper area 106 and the second sloped wall upper area 107 is reduced, and thus it is possible to effectively reduce the frictional force.

In order to reduce the frictional force, it is preferable to form at least the surfaces of the first sloped wall upper area 106 and the second sloped wall upper area 107 with material having self-lubricating property. Only the surfaces may be formed with the material having the self-lubricating property, or the entirety of the first sloped wall upper area 106 and the second sloped wall upper area 107 may be formed with the material having the self-lubricating property. Furthermore, in addition to the first sloped wall upper area 106 and the second sloped wall upper area 107, the surfaces of or the entirety of the first sloped wall lower area 104, the second sloped wall lower area 105, the first boundary area 102, the second boundary area 103, and the accumulating part 101 may be formed with the material having the self-lubricating property. It is possible to take engineering plastic such as Teflon (registered trademark) and oil-impregnated sintered metal (example of commercial product: oilless metal plate) as a typical example of the material having the self-lubricating property. However, the material is not necessarily limited to this. At least the surfaces of the first sloped wall upper area 106 and the second sloped wall upper area 107 are made of the material having the self-lubricating property, and instead of this, it is possible to remove the plurality of first ridge-shaped protrusions 115 and the plurality of second ridge-shaped protrusions 116, both of which are provided for reducing the frictional resistance.

As described above, the medal shooting mechanism 100 of the present embodiment includes the first sloped wall that is continuously sloped up and extended from the first boundary area 102 adjacent to the first lateral portion of the accumulating part 101. The first sloped wall makes up the first sloped area 22. The first sloped wall is formed by the first sloped wall lower area 104 and the first sloped wall upper area 106. The medal shooting mechanism 100 further includes the second sloped wall that is continuously sloped up and extended from the second boundary area 103 adjacent to the second lateral portion of the accumulating part 101, which is located on the opposite side from the above described first lateral portion. The second sloped wall makes up the second sloped area 23. The second sloped wall is formed by the second sloped wall lower area 105 and the second sloped wall upper area 107. It is only necessary for the first sloped wall and the second sloped wall to be formed for allowing the game medium to slidingly move upward and slidingly fall along the first sloped wall and the second sloped wall. Therefore, it is not necessarily required for the first sloped wall and the second sloped wall, respectively, to be formed by a sloped plane with predetermined slope angle. For example, the first sloped wall and the second sloped wall may be formed by a sloped-curved surface with non-uniform slope angle, respectively.

As described above, the guides for making the medal functioning as the game medium slidingly roll into the first medal slot 108-1 and the second medal slot 109-1 are formed by the first step 113 and the second step 114 that are respectively sloped down and extended to the first medal slot 108-1 and the second medal slot 109-1. However, it is not necessarily required for the first step 113 and the second step 114 to be formed linearly sloped down and extended for the purpose of allowing the medal caught by the first step 113 and the second step 114 to slidingly roll into the first medal slot 108-1 and the second medal slot 109-1 under the gravity. In other words, for the purpose of allowing the medal caught by the first step 113 and the second step 114 to slidingly roll into the first medal slot 108-1 and the second medal slot 109-1 under the gravity, it is only necessary for the first step 113 and the second step 114 to be entirely sloped down to the first medal slot 108-1 and the second medal slot 109-1. In short, it is only necessary for the potential energy of the medal M caught by the first step 113 and the second step 114 to be entirely greater than the potential energy of the medal M located in positions of the first medal slot 108-1 and of the second medal slot 109-1. For example, even if a rising portion is formed in the intermediate portion of the first step 113 and the second step 114, when the kinetic energy of the medal M is greater than the sum of the potential energy and the frictional energy of the rising portion, the medal M climbs the rising portion with the momentum of the rotational movement performed so far and then rolls into the first slot. In addition, when a rising portion is formed in the intermediate portion of the first step 113 and the second step 114 and the kinetic energy of the medal M is less than the sum of the potential energy and the frictional energy of the rising portion, this is not a matter as long as the medal M is capable of climbing the rising portion and then rolling into the first slot by being pushed by another medal M rotationally moving from behind. Also, the first step 113 and the second step 114 may be sloped down and extended in a stepped pattern toward the first medal slot 108-1 and the second medal slot 109-1.

According to the medal shooting mechanism 100 of the above described first embodiment of the present invention, even when a game player continuously shoots the game medium for a long time, it becomes possible to largely reduce game player's tiredness. In addition, a game player does not wear out ones nerves for shooting the game medium, and thus the game player is capable of concentrating on the game itself and really enjoying the game.

(A) Modified Example 1 of Medal Shooting Mechanism 100

Figure 15:
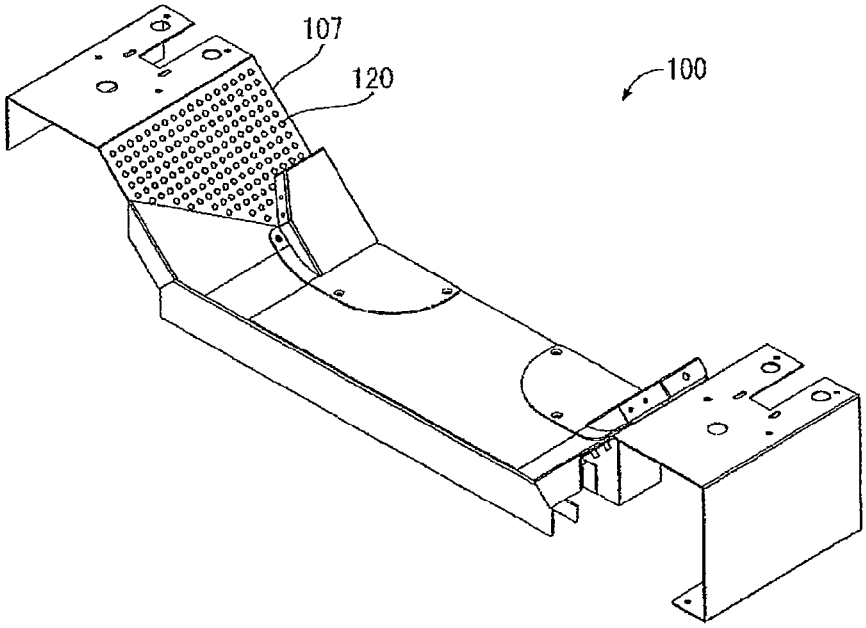
FIG. 15 is a perspective view illustrating a medal shooting mechanism of a modified example 1 of an embodiment of the present invention.

A modified example 1 of the above described embodiment will be hereinafter explained with reference to a figure. FIG. 15 is a perspective view illustrating a medal shooting mechanism of the present modified example. Only differences between the medal shooting mechanism of the present example and the above described medal shooting mechanism 100 are hereinafter explained, and the overlapping explanation will be hereinafter omitted.

A configuration that a plurality of scattered protrusions 120 are formed in the first sloped wall upper area 106 and the second sloped wall upper area 107 instead of forming the plurality of first ridge-shaped protrusions 115 and the plurality of second ridge-shaped protrusions 116 effectively works for reducing the contact area between the medal M and the first sloped wall upper area 106 and the second sloped wall upper area 107, and furthermore works for reducing the frictional resistance to be generated between the medal M and the first sloped wall upper area 106 and the second sloped wall upper area 107. Here, it is preferable to set intervals between adjacent protrusions 120 to be sufficiently less than diameter dimension of the medal M. Furthermore, it is preferable to form the plurality of protrusions 120 to be regularly scattered at predetermined intervals. With the configuration, the medal M that rolls on the first step 113 and the second step 114 slidingly makes contact with the plurality of scattered protrusions 120. Accordingly, the contact area between the medal M and the first sloped wall upper area 106 and the second sloped wall upper area 107 is reduced, and thus it is possible to effectively reduce the frictional force. From the perspective of reduction of the frictional force, it is preferable to form the plurality of protrusions 120 such that the top thereof is processed to be in a round shape.

(B) Modified Example 2 of Medal Shooting Mechanism 100

Figure 16:
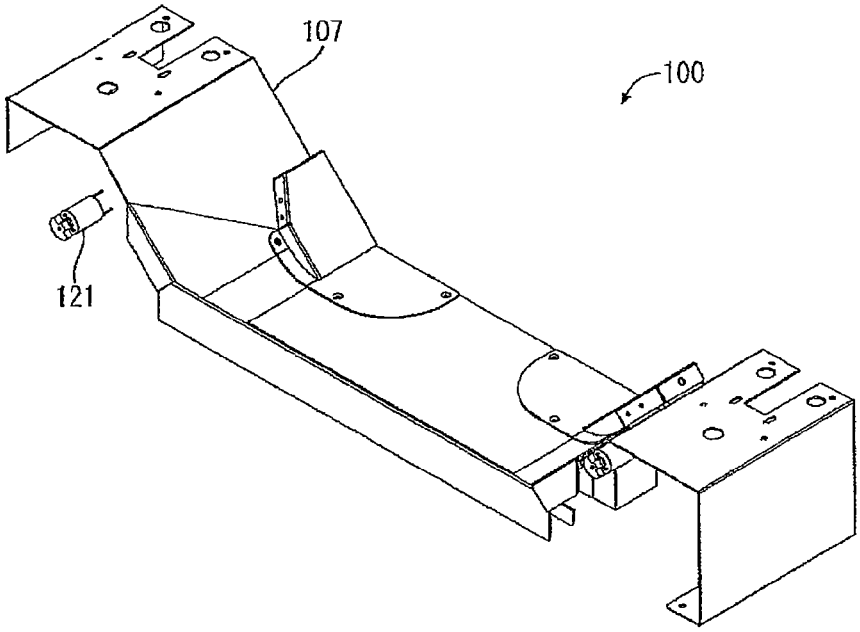
FIG. 16 is a perspective view illustrating a medal shooting mechanism of a modified example 2 of an embodiment of the present invention.

A modified example 2 of the above described embodiment will be hereinafter explained with reference to a figure. FIG. 16 is a perspective view illustrating a medal shooting mechanism of the present modified example. Only differences between the medal shooting mechanism of the present example and the above described medal shooting mechanism 100 are hereinafter explained, and the overlapping explanation will be hereinafter omitted.

The medal M and the first sloped wall and the second sloped wall are prevented from closely making contact with each other by applying minute vibration to the first sloped wall and the second sloped wall. As a result, it becomes possible to reduce the effective contact area between the medal M and the first sloped wall and the second sloped wall, and thus it becomes possible to effectively reduce the frictional force. It should be paid attention for avoiding a situation that the medal M instably rolls along the first step 113 and the second step 114 when too much vibration is applied to the first sloped wall and the second sloped wall. In addition, too much vibration is not preferable because it may make a game player discomfort.

(C) Modified Example 3 of Medal Shooting Mechanism 100

Figure 17:
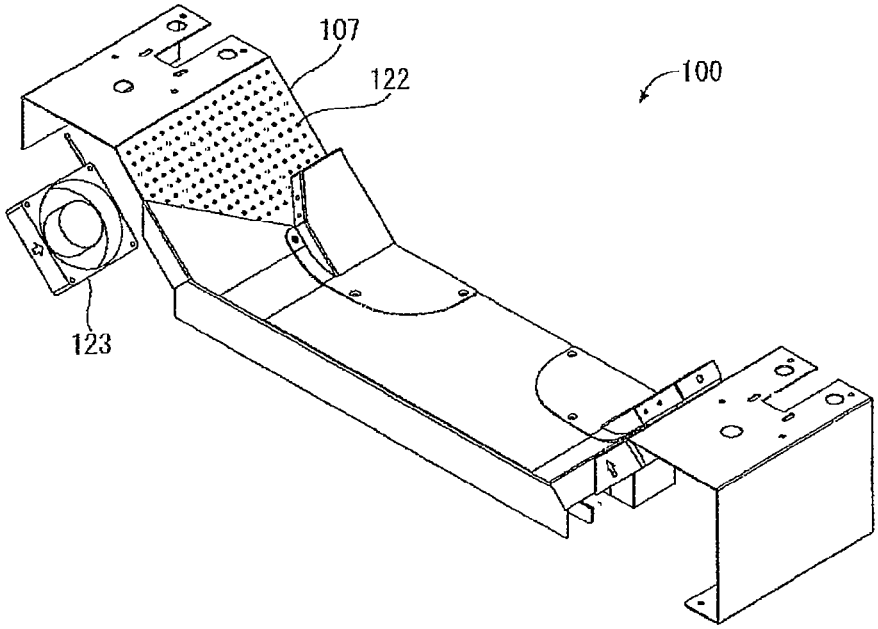
FIG. 17 is a perspective view illustrating a medal shooting mechanism of a modified example 3 of an embodiment of the present invention.

A modified example 3 of the above described embodiment will be hereinafter explained with reference to a figure. FIG. 17 is a perspective view illustrating a medal shooting mechanism of the present modified example. Only differences between the medal shooting mechanism of the present example and the above described medal shooting mechanism 100 are hereinafter explained, and the overlapping explanation will be hereinafter omitted.

In order to reduce the frictional force to be generated between the medal M and the first sloped wall and the second sloped wall, the first sloped wall upper area 106 and the second sloped wall upper area 107 have a plurality of scattered vent holes 122, respectively, and a ventilation fan 123 is provided on the back sides of the first sloped wall upper area 106 and the second sloped wall upper area 107, respectively.

Buoyancy for floating the medal M from the first sloped wall upper area 106 and the second sloped wall upper area 107 is applied to the medal M by ventilation through the plurality of vent holes 122. Accordingly, the contact force to be generated between the medal M and the first sloped wall upper area 106 and the second sloped wall upper area 107 is reduced. As a result, the frictional force to be generated between the medal and the first sloped wall upper area 106 and the second sloped wall upper area 107 is reduced. Here, it is preferable to set intervals between adjacent vent holes 122 to be sufficiently less than diameter dimension of the medal M. Furthermore, it is preferable to form the plurality of vent holes 122 to be regularly scattered at predetermined intervals. In addition, it is possible to achieve the ventilation fan 123 by disposing it on the back sides of the first sloped wall upper area 106 and the second sloped wall upper area 107, respectively. With the configuration, it becomes possible to efficiently reduce the frictional resistance because the medal M rolls along the first step 113 and the second step 114 in a state that the contact force to be generated between the medal M and the first sloped wall upper area 106 and the second sloped wall upper area 107 is reduced by buoyancy applied by the ventilation through the plurality of scattered vent holes 122.

(D) Modified Example 4 of Medal Shooting Mechanism 100

Figure 18:
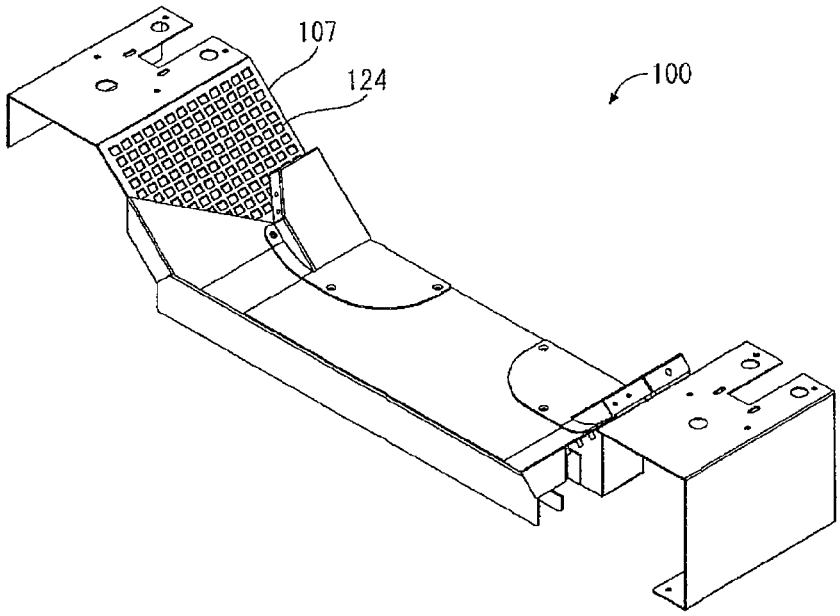
FIG. 18 is a perspective view illustrating a medal shooting mechanism of a modified example 4 of an embodiment of the present invention.

A modified example 4 of the above described embodiment will be hereinafter explained with reference to a figure. FIG. 18 is a perspective view illustrating a medal shooting mechanism of the present modified example. Only differences between the medal shooting mechanism of the present example and the above described the medal shooting mechanism 100 are hereinafter explained, and the overlapping explanation will be hereinafter omitted.

It is possible to provide a configuration that the first sloped wall upper area 106 and the second sloped wall upper area 107 are made up of a reticulate sloped wall 124, respectively, as another effective method for reducing the frictional force to be generated between the medal M and the first sloped wall and the second sloped wall. Here, reticulated grid intervals are set to be sufficiently less than diameter dimension of the medal M. When the first sloped wall upper area 106 and the second sloped wall upper area 107 are made up of the reticulate sloped wall 124, respectively, the contact area between the medal M and the first sloped wall upper area 106 and the second sloped wall upper area 107 is reduced. Thus it becomes possible to effectively reduce the frictional resistance.

(E) Modified Example 5 of Medal Shooting Mechanism 100

Figure 19:
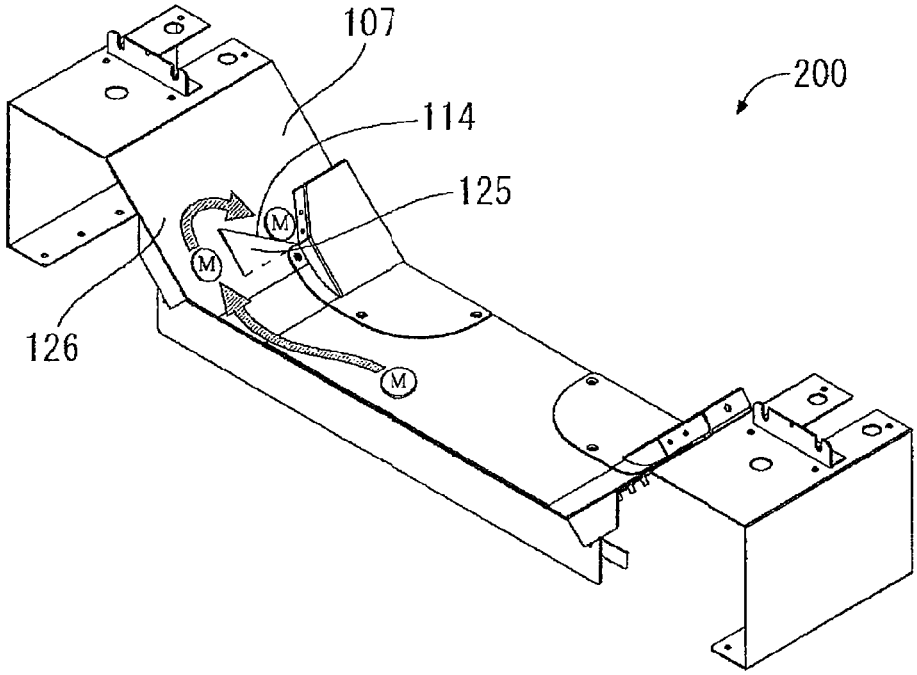
FIG. 19 is a perspective view illustrating a medal shooting mechanism of a modified example 5 of an embodiment of the present invention.

A modified example 5 of the above described embodiment will be hereinafter explained with reference to a figure. FIG. 19 is a perspective view illustrating a medal shooting mechanism of the present modified example. Only differences between the medal shooting mechanism of the present example and the above described the medal shooting mechanism 100 are hereinafter explained, and the overlapping explanation will be hereinafter omitted.

In the above described embodiment, each sloped wall is made up of a sloped wall upper area and a sloped wall lower area, and a step making up a guide is formed along a boundary between the sloped wall upper area and the sloped wall lower area. The step is configured to be extended to a medal slot from a lateral portion of the sloped wall upper area that is located on the opposite side from the medal slot. In other words, the step is configured to be extended on the entire area of the sloped wall. On the other hand, according to the modified example 5, it is possible to configure the step to be extended to the medal slot from an inner position that is separated from the lateral portion of the sloped wall upper area located on the opposite side from the medal slot at distance greater than or equal to diameter dimension of the single medal. When the step is extended from the inner position that is separated from the lateral portion of the sloped wall upper area at distance of the diameter dimension of the single medal, it becomes possible to move the medal to the sloped wall upper area through a sloped plane on which a step is not formed.

The above configuration will be hereinafter explained in detail with reference to FIG. 19. The second sloped wall is formed by a second sloped wall upper area 107, a third sloped wall lower area 125, and a fourth sloped wall lower area 126. The second step 114 that makes up the second guide is formed along the boundary between the third sloped wall lower area 125 and the second sloped wall upper area 107. The fourth sloped wall lower area 126 and the second sloped wall upper area 107 form a plain, and no step is formed on the boundary between the fourth sloped wall lower area 126 and the second sloped wall upper area 107. It is possible to form the third sloped wall lower area 125 by an approximately wedge-shaped flat plate that is provided on the single plane formed by the fourth sloped wall lower. area 126 and the second sloped wall upper area 107. In this case, thickness of the approximately wedge-shaped flat plate corresponds to width of the step of the above described step 114. Therefore, the thickness is determined based on the step width of the above described second step 114. Furthermore, it is required for the fourth sloped wall lower area 126 to have horizontal dimension greater than diameter dimension of the medal M in order to make the medal M move to the second sloped wall upper area 107 through the fourth sloped wall lower area 126.

With the configuration, a game player moves the medal M from the accumulating part 101 to the second sloped wall upper area 107 through the fourth sloped wall lower area 126, and further moves it to an upper position of the third sloped wall lower area 125, while the game player presses the medal M with ones finger. When the game player releases the medal M on the position, the medal M slidingly falls along the second sloped wall upper area 107, and is then caught by the second step 114 that is made up of the upper side of the approximately wedge-shaped flat plate. Then, as described above, the medal M slidingly rolls into the second medal slot 109-1 along the second step 114. According to the configuration, no step is formed on the boundary between the fourth sloped wall lower area 126 and the second sloped wall upper area 107. Therefore, it becomes possible to move the medal M to the second sloped wall upper area 107 without crossing over the second step 114.

It is possible to form the third sloped wall lower area 125 by an approximately wedge-shaped plate with non-uniform thickness, instead of the approximately wedge-shaped flat plate. Specifically, it is possible to form the upper side of the approximately wedge-shaped plate to have thickness corresponding to the step width of the second step 114. On the other hand, it is possible to form the lower side of the approximately wedge-shaped plate to have thickness of substantially zero by forming the approximately wedge-shaped plate to have thickness gradually reducing from the upper side to the lower side. With the configuration, it is not required to form a step on the lower side of the third sloped wall lower area 125.

With the configuration, a game player may move the medal M from the accumulating part 101 to the second sloped wall upper area 107 through the fourth sloped wall lower area 126 while the game player presses the medal M with one's finger. Also, the game player may move the medal M to the second sloped wall upper area 107 through the third sloped wall lower area 125 while the game player presses the medal M with one's finger, because no step is formed on the lower side of the third sloped wall lower area 125. When the game player moves the medal M to an upper position of the third sloped wall lower area 125 and then releases the medal M on the position, the medal M slidingly falls along the second sloped wall upper area 107, and is caught by the second step 114 that is made up of the upper side of the approximately wedge-shaped flat plate. Then, as described above, the medal M slidingly rolls into the second medal slot 109-1 along the second step 114.

(1-2-2) Medal Shooting Mechanism 100A

Figure 20:
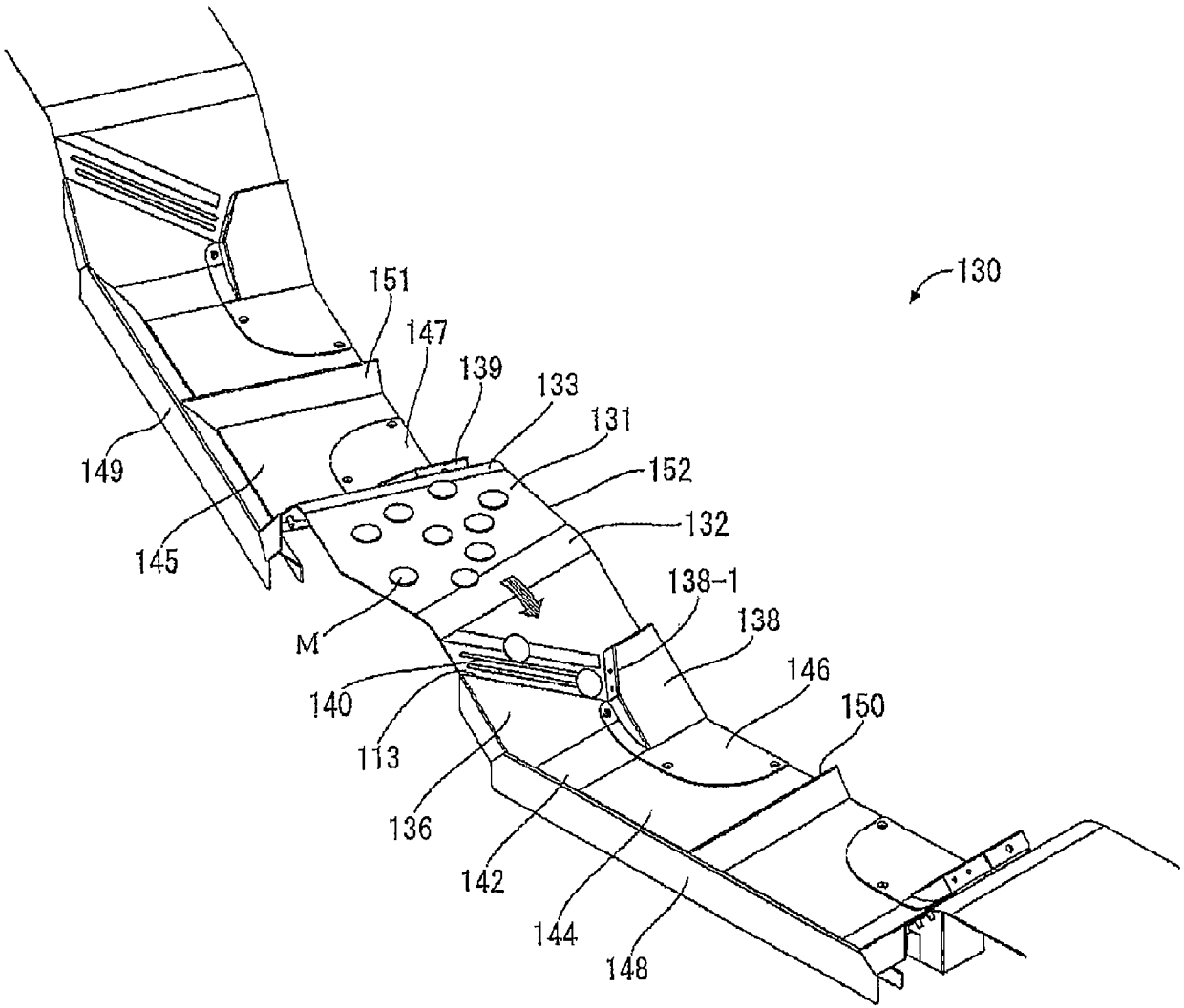
FIG. 20 is a perspective view illustrating another medal shooting mechanism of an embodiment of the present invention.
Figure 21:
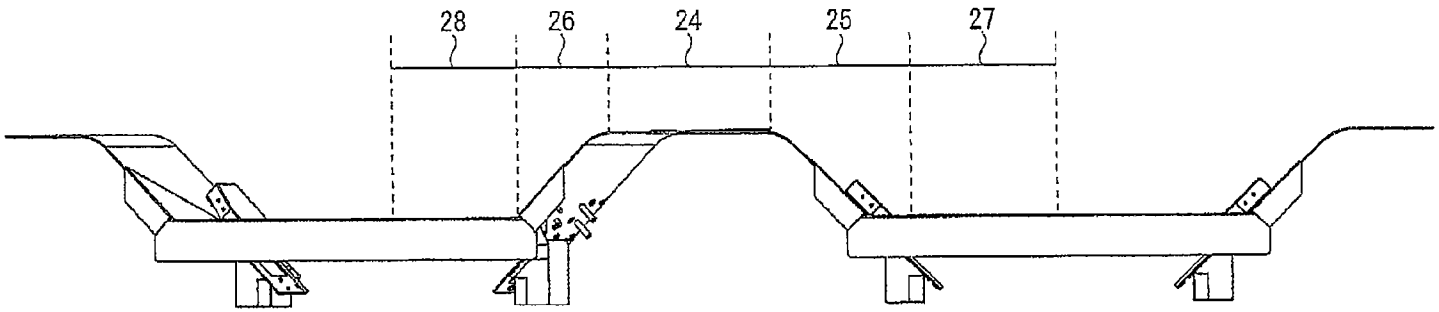
FIG. 21 is a front view of the medal shooting mechanism illustrated in FIG. 20.
Figure 22:
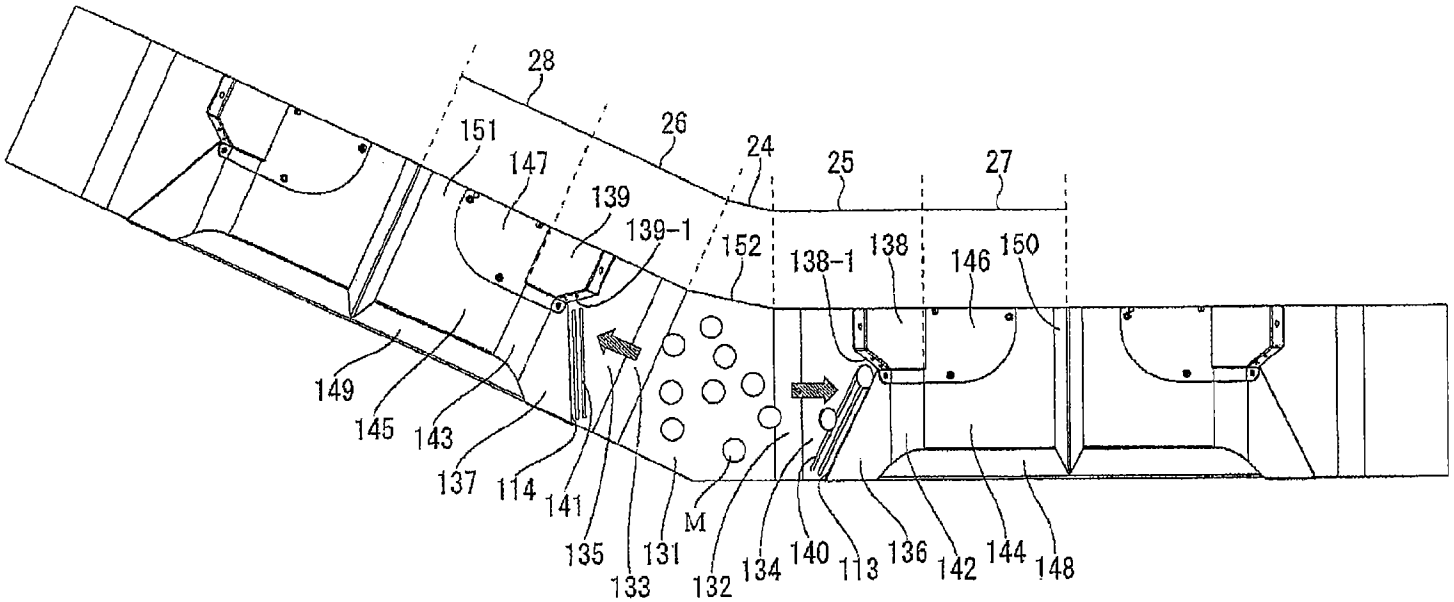
FIG. 22 is a top view of the medal shooting mechanism illustrated in FIG. 20.
Figure 23:
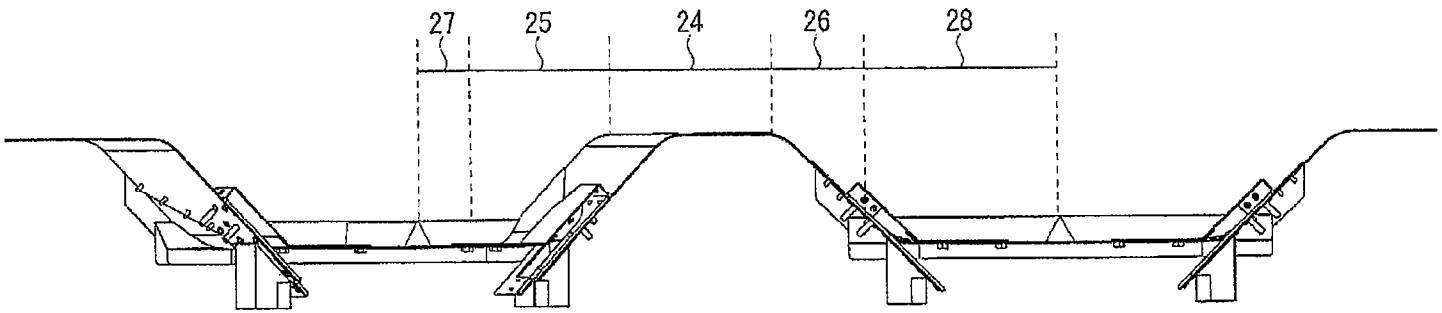
FIG. 23 is a back view of the medal shooting mechanism illustrated in FIG. 20.

Next, another medal shooting mechanism of the present embodiment will be explained in detail with reference to figures. FIG. 21 is a front view of a medal shooting mechanism illustrated in FIG. 20. FIG. 22 is a top view of the medal shooting mechanism illustrated in FIG. 20. FIG. 23 is a back view of the medal shooting mechanism illustrated in FIG. 20.

A medal shooting mechanism 130 includes a flat area 24, a first sloped area 25 and a second sloped area 26 that are located on the both sides of the flat area 24, a first lower flat area 27 that is located external to the first sloped area 25, and a second lower flat area 28 that is located external to the second sloped area 26. The medal shooting mechanism 130 includes an upper accumulating part 131 on which a plurality of medals are accumulated. The upper accumulating part 131 makes up the upper flat area 24 of the medal shooting mechanism 130. The medal shooting mechanism 130 includes the lower accumulating part 144 on which a plurality of medals are accumulated. The first lower accumulating part 144 makes up the first lower flat area 27 of the medal shooting mechanism 130. The medal shooting mechanism 130 includes the second lower accumulating part 145 on which a plurality of medals are accumulated. The second lower accumulating part 145 makes up the second lower flat area 28 of the medal shooting mechanism 130.

The medal shooting mechanism 130 further includes a first sloped wall that is continuously sloped down and extended from a first boundary area 132 adjacent to a first lateral portion of the upper accumulating part 131. The first sloped wall makes up the first sloped area 25. The first sloped wall is formed by the first sloped wall lower area 136 and the first sloped wall upper area 134. The first boundary area 132 is formed by a curved surface.

The medal shooting mechanism 130 further includes a second sloped wall that is continuously sloped down and extended from a second boundary area 133 adjacent to a second lateral portion of the upper accumulating part 131, which is located on the opposite side from the above described first lateral portion. The second sloped wall makes up the second sloped area 26. The second sloped wall is formed by the second sloped wall lower area 137 and the second sloped wall upper area 135. The second boundary area 133 is formed by a curved surface.

The medal shooting mechanism 130 further includes a first lower accumulating part 144 that is continuously and horizontally extended through the third boundary area 142 adjacent to the outer portion of the first sloped wall lower area 136. The first lower accumulating part 144 makes up the first lower flat area 27.

The medal shooting mechanism 130 further includes a second lower accumulating part 145 that is continuously and horizontally extended through the fourth boundary area 143 adjacent to the outer portion of the second sloped wall lower area 137. The second lower accumulating part 145 makes up the second lower flat area 28.

The medal shooting mechanism 130 further includes a first medal shooter 138 that includes a first medal slot 138-1 on a position adjacent to the first sloped wall, and a second medal shooter 139 that includes a second medal slot 139-1 on a position adjacent to the second sloped wall. The first boundary area 132, the first sloped wall lower area 136, the first sloped wall upper area 134, the first medal shooter 138, and the third boundary area 142 from the first sloped area 25 of the medal shooting mechanism 130. The second boundary area 133, the second sloped wall lower area 137, the second sloped wall upper area 135, the second medal shooter 139, and the fourth boundary area 143 form the second sloped area 26 of the medal shooting mechanism 130.

The first medal shooter 138 further includes a first attached flange 146. The first attached flange 146 is extended from a part of the third boundary area 142 to a part of the first lower accumulating part 144. The second medal shooter 139 further includes a second attached flange 147. The second attached flange 147 is extended from a part of the fourth boundary area 143 to a part of the second lower accumulating part 145. As illustrated in FIG. 22, the first attached flange 146 extended on the first lower accumulating part 144, and the second attached flange 147 extended on the second lower accumulating part 145 respectively have a largely-rounded corner. The first attached flange 146 and the second attached flange 147 delimit a medal accumulating area on which a medal M is accumulated on the first lower accumulating part 144 and the second lower accumulating part 145. The medal is supplied from a medal supplying side 152 of the upper accumulating part 131. A first medal constraining plate 148 for preventing the medal M from falling from the first lower accumulating part 144, and a first lower accumulating part partition 150 for separating the medal M to be accumulated on the first lower accumulating part 144 from the medal M to be accumulated in an adjacent medal shooting mechanism, are provided for the first lower accumulating part 144. A second medal constraining plate 149 for preventing the medal M from falling from the second lower accumulating part 145, and a second lower accumulating part partition 151 for separating the medal M to be accumulated on the second lower accumulating part 145 from the other medal M to be accumulated in an adjacent medal shooting mechanism, are provided for the second lower accumulating part 145. Furthermore, a medal constraining plate for preventing the medal M from falling from the front side of the upper accumulating part 131 may be provided, although not illustrated in the figure.

A first guide 113 is formed on the boundary between the first sloped wall lower area 136 and the first sloped wall upper area 134. The first guide 113 is configured to catch the medal slidingly falling along the first sloped wall upper area 134 and is also configured to make the medal slidingly roll into the first medal slot 138-1 along the first guide. The first guide 113 is formed by a first step 113 formed on the boundary between the first sloped wall lower area 136 and the first sloped wall upper area 134. The first step 113 is linearly sloped down and extended to the first medal slot 138-1. The first sloped wall upper area 134 includes at least one protrusion that is formed to reduce friction to be generated between the first sloped wall upper area 134 and the medal M slidingly rolling along the first guide 113. In other words, the first sloped wall upper area 134 includes at least one ridge-shaped protrusion 140 that is separated upward from the first guide 113 at distance less than diameter of the medal M and is extended approximately in parallel with a direction in which the first guide 113 is extended. Specifically, a plurality of ridge-shaped protrusions 140 are formed as illustrated in the figure.

A second guide 114 is formed on the boundary between the second sloped wall lower area 137 and the second sloped wall upper area 135. The second guide 114 is configured to catch the medal slidingly falling along the second sloped wall upper area 135 and is also configured to make the medal slidingly roll into the second medal slot 139-1 along the second guide. The second guide 114 is formed by a second step 114 formed on the boundary between the second sloped wall lower area 137 and the second sloped wall upper area 135. The second step 114 is linearly sloped down and extended to the second medal slot 139-1. The second sloped wall upper area 135 includes at least one protrusion that is formed to reduce friction to be generated between the second sloped wall upper are 135 and the medal M slidingly rolling along the second guide 114. In other words, the second sloped wall upper area 135 includes at least one ridge-shaped protrusion 141 that is separated upward from the second guide 114 at distance less than diameter of the medal M and is extended approximately in parallel with a direction in which the second guide 114 is extended. Specifically, a plurality of ridge-shaped protrusions 141 are formed as illustrated in the figure.

When the upper accumulating part 131, the first boundary area 132, the second boundary area 133, the first sloped wall lower area 136, the second sloped wall lower area 137, the first sloped wall upper area 134, the second sloped wall upper area 135, the third boundary area 142, the fourth boundary area 143, the first lower accumulating part 144, and the second lower accumulating part 145 are formed in one member, no seam is formed in the area on which the medal M is movable. Accordingly, it becomes possible to reduce the resistance.

Also, the first medal slot 138-1 of the first medal shooter 138 and the second medal slot 139-1 of the second medal shooter 139 have dimensions that only one medal M is allowed to be inserted thereinto at a time. The configuration serves to reliably prevent a situation that a plurality of medals M are stuck in the first medal shooter 138 or the second medal shooter 139 when the medals M are simultaneously inserted into the first medal slot 138-1 or the second medal slot 139-1.

The above described medal shooting mechanism 130 has an approximately symmetrical shape and structure with reference to the middle position between the first and second lateral portions.

The first medal shooter 138 and the second medal shooter 139 are formed in the same structure as the above described first medal shooter 108 and second medal shooter 109, which are explained with reference to FIG. 14. Therefore, the internal structure thereof will be hereinafter omitted.

When a game player slides the medal M accumulated on the upper accumulating part 131 to the upper area of the first sloped wall upper area 134 and the upper area of the second sloped wall upper area 135, which are continuously sloped down extended from the upper accumulating part 131, and then releases the medal M, the medal M slidingly falls along the first sloped wall upper area 134 and the second sloped wall upper area 135 under the gravity and is caught by the first step 113 making up the first guide 113 and by the second step 114 making up the second guide 114. Also, the first step 113 and the second step 114 are configured to make the medal M slidingly roll into the first medal slot 138-1 and the second medal slot 139-1 under the gravity.

In other words, if a game player moves the medal M to the upper area of the first sloped wall upper area 134 and the upper area of the second sloped wall upper area 135, which are continuously sloped down and extended from the upper accumulating part 131 and then releases the medal M, the medal M slidingly falls along the first sloped wall upper area 134 and the second sloped wall upper area 135 under the gravity and is caught by the first step 113 and the second step 114. Then, the medal M slidingly rolls into the first medal slot 138-1 of the first shooter and the second medal slot 139-1 along the first step 113 and the second step 114 under the gravity. When the medal M rolls along the first step 113 and the second step 114, the medal M is going to slide with respect to the first sloped wall lower area 136 and the first sloped wall upper area 134. In other words, it is only necessary for a game player to move the medal M to the upper area of the first sloped wall upper area 134 and the upper area of the second sloped wall upper area 135 and then release the medal M. Therefore, it is not required for a game player to manually carry the medal M from the upper accumulating part 131 to the first medal slot 138-1 and the second medal slot 139-1 as is conventionally performed. In other words, this makes a game player comfortably move one's hand by making use of the gravity.

Furthermore, there is a possibility that the medal M is not caught by the first step 113 and the second step 114. In this case, the medal M slidingly falls along the first and second sloped walls across the first step 113 and the second step 114, and reaches the first and second lower accumulating parts 144 and 145. Thus the medal M is accumulated thereon. It is possible to directly use the game medium accumulated on the first and second lower accumulating parts 144 and 145. If a game player slides the medal M that are accumulated on the first and second lower accumulating parts 144 and 145 upward along the first and second sloped walls and then releases the medal M, the medal M slidingly falls along the first sloped wall upper area 134 and the second sloped wall upper area 135 under the gravity and is caught by the first step 113 and the second step 114. Then, the medal M slidingly rolls into the first medal slot 138-1 and the second medal slot 139-1 along the first step 113 and the second step 114 under the gravity. The mechanism is the same as that explained in the above described first embodiment.

Accordingly, even when a game player continuously shoots the medal M for a long time, it is possible to largely reduce game player's tiredness. In addition, a game player does not wear out ones nerves too much for shooting the medal M, and thus the game player is capable of concentrating on the game itself and really enjoying the game.

Also, if a game player moves the medal M to the upper area of the first sloped wall upper area 134 and the upper area of the second sloped wall upper area 135, which are continuously sloped down and extended from the upper accumulating part 131 and then releases the medal M, the medal M slidingly falls along the first sloped wall upper area 134 and the second sloped wall upper area 135 under the gravity and is caught by the first step 113 and the second step 114. Then, the medal M slidingly rolls into the first medal slot 138-1 and the second medal slot 139-1 along the first step 113 and the second step 114 under the gravity. Furthermore, If a game player slides the medal M, which falls along the first sloped wall lower area 136 and the second sloped wall lower area 137 without being caught by the first step 113 and the second step 114 and is then accumulated on the first lower accumulating part 144 and the second lower accumulating part 145, upward along the first and second sloped walls and then releases the medal, the medal falls along the first sloped wall upper area 134 and the second sloped wall upper area 135 under the gravity, and is caught by the first step 113 and the second step 114. Then, the medal M slidingly rolls into the first medal slot 138-1 and the second medal slot 139-1 along the first step 113 and the second step 114 under the gravity. In other words, it becomes possible to largely reduce game player's tiredness even when the game player continuously shoots the medal M for a long time without automating shooting of the medal M. Accordingly, it becomes possible to really fascinate a game player for a long time while the game player feels that the game player oneself actively plays the game.

It is only necessary for the first step 113 and the second step 114 to have a function of catching the medal M that slidingly falls along the first sloped wall upper area 134 and the second sloped wall upper area 135 under the gravity, and a function of making the medal M slidingly roll into the first medal slot 138-1 and the second medal slot 139-1 along the first step 113 and the second step 114 under the gravity. However, it is required to slidingly move the medal M accumulated on the first and second lower accumulating parts 144 and 145 to a position higher than the first guide 113 (i.e., the first step) and the second guide 114 (i.e., the second step 114). Therefore, it is preferable that the first guide 113 (i.e., the first step 113) and the second guide 114 (i.e., the second step 114) do not block movement of the medal M, when the medal M is slidingly moved upward. In consideration of this, it is meaningful that the first guide 113 is formed by the first step 113 and the second guide 114 is formed by the second step 114. Note that an important point is that the step surfaces of the first and second steps 113 and 114 face upward. With the configuration, it becomes easy to slidingly move the medal M upward across the first step 113 and the second step 114. In addition, it becomes possible to catch the medal M on the step surfaces of the first step 113 and the second step 114, when the medal M once slidingly moved upward is released from a hand of a game player and slidingly falls along the first sloped wall upper area 134 and the second sloped wall upper area 135. When the step surfaces of the first step 113 and the second step 114 face downward, it is impossible to block the medal M that slidingly moves upward along the first sloped wall lower area 136 and the first sloped wall upper areas 134, and the second sloped wall lower area 137 and the second sloped wall upper area 135, and it is also impossible to make the medal M slidingly roll into the first medal slot 138-1 and the second medal slot 139-1 under the gravity while the medal M is caught.

It is possible to achieve the first step 113 by forming the first sloped wall lower area 136 to have thickness greater than the first sloped wall upper area 134. In addition, it is possible to achieve the second step 114 by forming the second sloped wall lower area 137 to have thickness greater than the second sloped wall upper area 135. For example, the first sloped wall and the second sloped wall may be formed by combining a first flat plate that is extended in both of the upper and lower areas and a second flat plate that is extended only in the lower area. In addition, the first sloped wall and the second sloped wall may be formed such that only the lower area of the first flat plate that is extended in both of the upper and lower areas is thinly processed. In both cases, it is possible to achieve the first step 113 and the second step 114 with an existing technique.

Also, it is possible to form the first step 113 and the second step 114 to be extended to the first medal slot 138-1 and the second medal slot 139-1. In this case, it is required to make the medal M caught by the first step 113 and the second step 114 roll toward the first medal slot 138-1 and the second medal slot 139-1 under the gravity. Accordingly, the first step 113 and the second step 114 are sloped down and extended to the first medal slot 138-1 and the second medal slot 139-1. Specifically, the first step 113 and the second step 114 are formed to be linearly sloped down to the first medal slot 138-1 and the second medal slot 139-1. However, as a modified example, it is possible to form the first step 113 and the second step 114 to be curvilinearly sloped down to the first medal slot 138-1 and the second medal slot 139-1. Furthermore, it is also possible to form the first step 113 and the second step 114 by the combination of linear and curvilinear shapes. However, regardless of a position in the first step 113 and the second step 114 where the medal M is caught, the first step 113 and the second step 114, respectively, have the minimum-required slope angle for making the medal M roll toward the first medal slot 138-1 and the second medal slot 139-1 under the gravity.

Furthermore, it is required to form the abutment portions of the first step 113 and the second step 114 for making the medal M slidingly roll into the first medal slot 138-1 and the second medal slot 139-1 under the gravity. The abutment portions of the first step 113 and the second step 114 are disposed adjacent to the first medal slot 138-1 and the second medal slot 139-1. It is possible to provide a modified example that the abutment portions of the first step 113 and the second step 114 are not adjacently disposed to the first medal slot 138-1 and the second medal slot 139-1 and thus gaps are generated between the first step 113 and the first medal slot 138-1, and between the second step 114 and the second medal slot 139-1. This is not a matter as long as the medal M rolling along the first step 113 and the second step 114 finally rolls into the first medal slot 138-1 and the second medal slot 139-1. For this purpose, the first medal slot 138-1 of the first medal shooter 108 and the second medal slot 139-1 of the second shooter 109 are disposed adjacent to the first sloped wall and the second sloped wall.

In addition, widths of the step surfaces of the first step 113 and the second step 114, in other words, dimensions of the first step 113 and the second step 114, are determined such that the step surfaces of the first step 113 and the second step 114 are capable of catching the medal M that slidingly falls along the first sloped wall upper area 134 and the second sloped wall upper area 135. The minimum-required dimension of the first step 113 and the second step 114 depend on slope angles of the first sloped wall and the second sloped wall and the thickness of the medal M. For example, when the first sloped wall and the second sloped wall are formed to have large slope angles, the step surfaces of the first step 113 and the second step 114 are supposed to be formed to have widths greater than those of a case that the first sloped wall and the second sloped wall are formed to have small slope angles.

Furthermore, when the step surfaces of the first step 113 and the second step 114 are formed to have widths much less than thickness of the medal M, it is impossible to catch the medal M that slidingly falls along the first sloped wall upper area 134 and the second sloped wall upper area 135, and then the medal M sligingly falls to the first lower accumulating part 144 and the second lower accumulating part 145 across the first step 113 and the second step 114. As a result, it is impossible to insert the medal M into the first medal slot 138-1 and the second medal slot 139-1. Therefore, in consideration of thickness of the medal M and the slope angles of the first sloped wall and the second sloped wall, it is required for the step surfaces of the first step 113 and the second step 114 to have the minimum-required widths for catching the medal M that slidingly falls along the first sloped wall upper area 134 and the second sloped wall upper area 135. When the step surfaces of the first step 113 and the second step 114 are formed to have widths greater than thickness of the medal M, it is possible to increase the likelihood of catching the medal M that slidingly falls along the first sloped wall upper area 134 and the second sloped wall upper area 135. In addition, when the step surfaces of the first step 113 and the second step 114 are formed to have greater than twice the thickness of the medal M, it becomes possible to simultaneously catch two overlapping medals M that slidingly fall along the first sloped wall upper area 134 and the second sloped wall upper area 135. It should be note that when widths of the step surfaces of the first step 113 and the second step 114 are formed to be too large, the medal M may flop on the first step 113 and the second step 114 while the medal M is slidingly moved upward across the first step 113 and the second step 114, and thus there is a possibility that the medal M does not smoothly roll across the first step 113 and the second step 114.

As illustrated in FIG. 29, in a case that the peripheral portion of the medal M is formed to have a non-rectangular cross-section so that the corners of the cross-section are formed to have rounds R, the medal M may be caught by the first step 113 and the second step 114 when the step surfaces of the first step 113 and the second step 114 are formed to have widths W2 greater than or equal to thickness R of the round shaped portions. However, in a practical situation, the medal M that slidingly falls along the first sloped wall upper area 134 and the second sloped wall upper area 135 may not be caught by the first step 113 and the second step 114 as a result of impact and/or vibration to be generated when the medal M makes contact with the first step 113 and the second step 114. Therefore, the step surfaces of the first step 113 and the second step 114 are designed to have widths greater than the theoretically minimum-required width W2. Furthermore, as illustrated in FIG. 29, for the purpose of simultaneously catching the two overlapping medals M that slidingly fall along the first sloped wall upper area 134 and the second sloped wall upper area 135, the two overlapping medals M may be theoretically caught when the step surfaces of the first step 113 and the second step 114 are formed to have widths W1 greater than or equal to the sum of thickness of the single medal M and thickness R of the round shaped portion. However, in a practical situation, impact and/or vibration are/is generated when two overlapping medals M slidingly fall along the first sloped wall upper area 134 and the second sloped wall upper area 135 and make contact with the first step 113 and the second step 114. Accordingly, one of the two medals M, which is overlapped on the other, may not be caught by the first step 113 and the second step 114. Therefore, for the purpose of catching both of the two overlapping medals M, the step surfaces of the first step 113 and the second step 114 are designed to have widths greater than the theoretically minimum-required width W1.

From the perspective, in order to catch the single medal M, it is preferable to design the step surface of the first step to have width approximately corresponding to thickness of the single game medium. Here, "approximately" corresponding to thickness of the single game medium means that the width includes error corresponding to the thickness R of the round shaped portion.

Furthermore, angle of the step surface of the first step is preferably right angle or acute angle with respect to the first sloped wall. When the angle of the step surface of the first step is set to be obtuse angle with respect to the first sloped wall, there is a high possibility that the game medium that slidingly falls along the first sloped wall slidingly falls without being caught by the first step.

When the first sloped wall and the second sloped wall are formed to have large slope angles, in other words, when the first sloped wall lower area 136 and the first sloped wall upper area 134, and the second sloped wall lower area 137 and the second sloped wall upper area 135 are formed to be nearly perpendicular, it becomes difficult to slidingly move the medal M upward from the lower accumulating part 144 to the first sloped wall lower area 136 and the first sloped wall upper area 134, and it is also becomes difficult to slidingly move the medal M upward from the second lower accumulating part 145 to the second sloped wall lower area 137 and the second sloped wall upper area 135. On the other hand, when the first sloped wall and the second sloped wall are formed to have small slope angles, in other words, when the first sloped wall lower area 136 and the first sloped wall upper area 134, and the second sloped wall lower area 137 and the second sloped wall upper area 135 are formed to be nearly flat, it is easy to slide the medal M upward from the first lower accumulating part 144 to the first sloped wall lower area 136 and the first sloped wall upper area 134, and it is also easy to slide the medal M upward from the second lower accumulating part 145 to the second sloped wall lower area 136 and the second sloped wall upper area 135. However, when a game player releases the medal, the frictional force to be generated between the medal M and the first sloped wall and the second sloped wall will be increased. Accordingly, it becomes difficult for the medal M to slidingly fall along the first sloped wall upper area 134 and the second sloped wall upper area 135. In addition, the large frictional force is generated when the medal M slides on the first sloped wall upper area 134 and the second sloped wall upper area 135 while it rolls along the first step 113 and the second step 114 under the gravity. Accordingly, there is a possibility that the medal M stops moving on the way to the first medal slot 138-1 and the second medal slot 138-2 and thus cannot reach the first medal slot 138-1 and the second medal slot 139-1. Therefore, in consideration of the above, it is required for the first sloped wall lower area 136 and the first sloped wall upper area 134, and the second sloped wall lower area 137 and the second sloped wall upper area 135 to have slope angle that is neither nearly perpendicular nor nearly flat. For example, it is preferable to set the first sloped wall lower area 136 and the first sloped wall upper area 134, and the second sloped wall lower area 137 and the second sloped wall upper area 135 to have the slope angle of 20-70 degrees. Furthermore, it is more preferable to set them to have the slope angle of 30-60 degrees. The first sloped wall lower area 136 and the first sloped wall upper area 134, and the second sloped wall lower area 137 and the second sloped wall upper area 135 may be typically set to have the slope angles of approximately 45 degrees.

Furthermore, for the purpose of slidingly moving the medal M to be accumulated on the first lower accumulating part 144 and the second lower accumulating part 145 upward to the first sloped wall lower area 136 and the second sloped wall lower area 137 with the minimum resistance, it is preferable to form the third boundary area 142 and the fourth boundary area 143 to be curved surfaces. The preferable curvature of the curved surfaces depends on diameter dimension of the medal M, but it is only necessary for the curved surfaces to have curvature radius sufficiently greater than diameter dimension of the medal M. It is possible to easily empirically decide the preferable curvature.

As described above, it is preferable to reduce the frictional resistance to be generated between the medal M and the first sloped wall and the second sloped wall as much as possible. A plurality of first ridge-shaped protrusions 140 and a plurality of second ridge-shaped protrusions 141 effectively work for reducing the frictional force. The medal M is formed in an approximately disk shape. Furthermore, when the first sloped wall upper area 134 and the second sloped wall upper area 135 are formed to have flat surfaces, the entire area of the lateral surface of the medal M makes contact with the flat surfaces of the first sloped wall upper area 134 and the second sloped wall upper area 135. Reducing the contact area between the medal M and the first sloped wall upper area 134 and the second sloped wall upper area 135 effectively works for reducing the frictional force to be generated between the medal M and the first sloped wall upper area 134 and the second sloped wall upper area 135. In order to reduce the contact area, the plurality of first ridge-shaped protrusions 140 and the plurality of second ridge-shaped protrusions 141 are formed in the first sloped wall upper area 134 and the second sloped wall upper area 135. With the configuration, the medal M that rolls on the first guide 113 (i.e., the first step 113) and the second guide 114 (i.e., the second step 114) slidingly makes contact with the plurality of first ridge-shaped protrusions 140 and the plurality of second ridge-shaped protrusions 141. Accordingly, the contact area between the medal M and the first sloped wall upper area 134 and the second sloped wall upper area 135 is reduced, and thus it is possible to effectively reduce the frictional force.

In order to reduce the frictional resistance, it is preferable to form at least surfaces of the first sloped wall upper area 134 and the second sloped wall upper area 135 with material having self-lubricating property. Only the surfaces may be formed with the material having the self-lubricating property, or the entirety of the first sloped wall upper area 134 and the second sloped wall upper area 135 may be formed with the material having the self-lubricating property. Furthermore, in addition to the first sloped wall upper area 134 and the second sloped wall upper area 135, the surfaces of or the entirety of the first sloped wall lower area 136, the second sloped wall lower area 137, the first boundary area 132, the second boundary area 133, the third boundary area 142, the fourth boundary area 143, the upper accumulating part 131, the first lower accumulating part 144, and the second lower accumulating part 145 may be formed with the material having the self-lubricating property. It is possible to take engineering plastic such as Teflon (registered trademark) and oil-impregnated sintered metal (example of commercial product: oilless metal plate) as a typical example of the material having the self-lubricating property. However, the material is not necessarily limited to this. Instead of forming at least the surfaces of the first sloped wall upper area 134 and the second sloped wall upper area 135 with the material having the self-lubricating property, it is possible to remove the plurality of first ridge-shaped protrusions 140 and the plurality of second ridge-shaped protrusions 141, both of which are provided for reducing the frictional resistance.

As described above, the medal shooting mechanism 130 of the present embodiment includes the upper accumulating part 131 on which a plurality of medals are accumulated. The upper accumulating part 131 makes up the upper flat area 24 of the medal shooting mechanism 130. The medal shooting mechanism 130 includes the lower accumulating part 144 on which a plurality of medals are accumulated. The first lower accumulating part 144 makes up the first lower flat area 27 of the medal shooting mechanism 130. The medal shooting mechanism 130 includes the second lower accumulating part 145 on which a plurality of medals are accumulated. The second lower accumulating part 145 makes up the second lower flat area 28 of the medal shooting mechanism 130.

The medal shooting mechanism 130 further includes the first sloped wall that is continuously sloped down and extended from the first boundary area 132 adjacent to the first lateral portion of the upper accumulating part 131. The first sloped wall makes up the first sloped area 25. The first sloped wall is formed by the first sloped wall lower area 136 and the first sloped wall upper area 134. It is only necessary for the first sloped wall and the second sloped wall to be formed for allowing the game medium to slidingly move upward and slidingly fall along the first sloped wall and the second sloped wall. Therefore, it is not necessarily required for the first sloped wall and the second sloped wall, respectively, to be formed by a sloped plane with predetermined slope angle. For example, the first sloped wall and the second sloped wall may be formed by a sloped-curved surface with non-uniform slope angle, respectively.

As described above, the guides for making the medal as the game medium slidingly roll into the first medal slot 138-1 and the second medal slot 139-1 are formed by the first step 113 and the second step 114 that are linearly sloped down and extended to the first medal slot 138-1 and the second medal slot 139-1, respectively. However, it is not necessarily required for the first step 113 and the second step 114 to be formed linearly sloped down and extended for the purpose of allowing the medal caught by the first step 113 and the second step 114 to slidingly roll into the first medal slot 108-1 and the second medal slot 109-1 under the gravity. In other words, for the purpose of allowing the medal caught by the first step 113 and the second step 114 to slidingly roll into the first medal slot 138-1 and the second medal slot 139-1 under the gravity, it is only necessary for the first step 113 and the second step 114 to be entirely sloped down to the first medal slot 138-1 and the second medal slot 139-1. In short, it is only necessary for the potential energy of the medal M caught by the first step 113 and the second step 114 to be entirely greater than the potential energy of the medal M located in positions of the first medal slot 138-1 and of the second medal slot 139-1. For example, even if a rising portion is formed in the intermediate portion of the first step 113 and the second step 114, when the kinetic energy of the medal M is greater than the sum of the potential energy and the frictional energy of the rising portion, the medal M climbs the rising portion with the momentum of the rotational movement performed so far and then rolls into the first slot. In addition, when a rising portion is formed in the intermediate portion of the first step 113 and the second step 114 and the kinetic energy of the medal M is less than the sum of the potential energy and the frictional energy of the rising portion, this is not a matter as long as the medal M is capable of climbing the rising portion and then rolling into the first slot by being pushed by another medal M rotationally moving from behind. Also, the first step 113 and the second step 114 may be sloped down and extended in a stepped pattern toward the first medal slot 138-1 and the second medal slot 139-1.

According to the medal shooting mechanism 130 of the above described first embodiment of the present invention, even when a game player continuously shoots the game medium for a long time, it becomes possible to largely reduce game player's tiredness. In addition, a game player does not wear out ones nerves for shooting the game medium, and thus the game player is capable of concentrating on the game itself and really enjoying the game.

(A) Modified Example 1 of Medal Shooting Mechanism 100A

Figure 24:
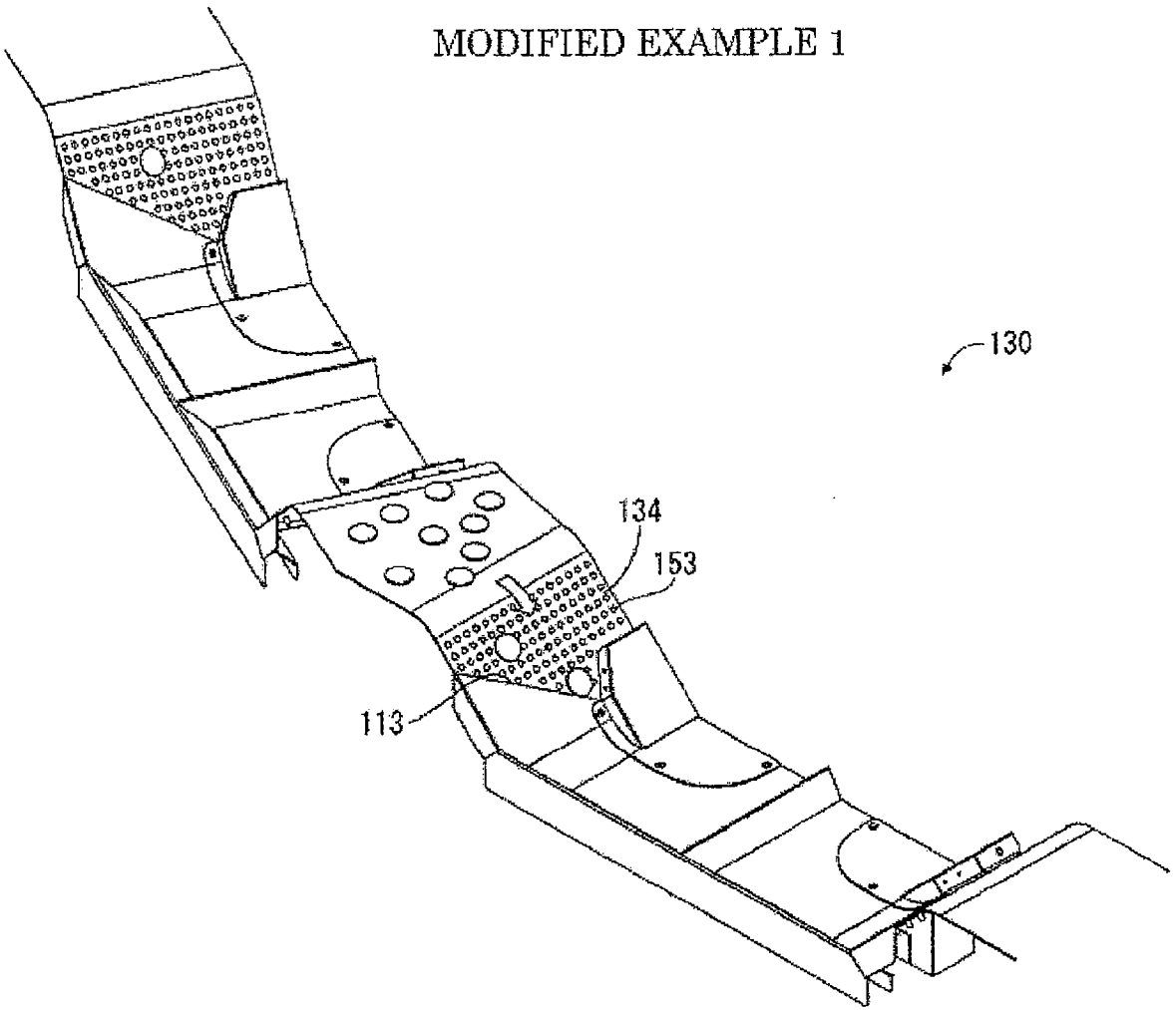
FIG. 24 is a perspective view illustrating a modified example 1 of another medal shooting mechanism of an embodiment of the present invention.

A modified example I of the above described medal shooting mechanism 100A will be hereinafter explained with reference to a figure. FIG. 24 is a perspective view illustrating a medal shooting mechanism of the present modified example. Only differences between the medal shooting mechanism of the present example and the above described medal shooting mechanism 100A are hereinafter explained, and the overlapping explanation will be hereinafter omitted.

A configuration that a plurality of scattered protrusions 153 are formed in the first sloped wall upper area 134 and the second sloped wall upper area 135 instead of forming the above described plurality of first ridge-shaped protrusions 115 and the above described plurality of second ridge-shaped protrusions 116 effectively works for reducing the contact area with the medal M and the first sloped wall upper area 134 and the second sloped wall upper area 135, and furthermore works for reducing the frictional resistance to be generated between the medal M and the first sloped wall upper area 134 and the second sloped wall upper area 135. Here, it is preferable to set intervals between adjacent protrusions 153 to be sufficiently less than diameter dimension of the medal M. Furthermore, it is preferable to form the plurality of protrusions 153 to be regularly scattered at predetermined intervals. With the configuration, the medal M that rolls on the first step 113 and the second step 114 slidingly makes contact with the plurality of scattered protrusions 153. Accordingly, the contact area between the medal M and the first sloped wall upper area 134 and the second sloped wall upper area 135 is reduced, and thus it is possible to effectively reduce the frictional force. From the perspective of reduction of the frictional force, it is preferable to form the plurality of protrusions 153 such that the top thereof is processed to be in a round shape.

(B) Modified Example 2 of Medal Shooting Mechanism 100A

Figure 25:
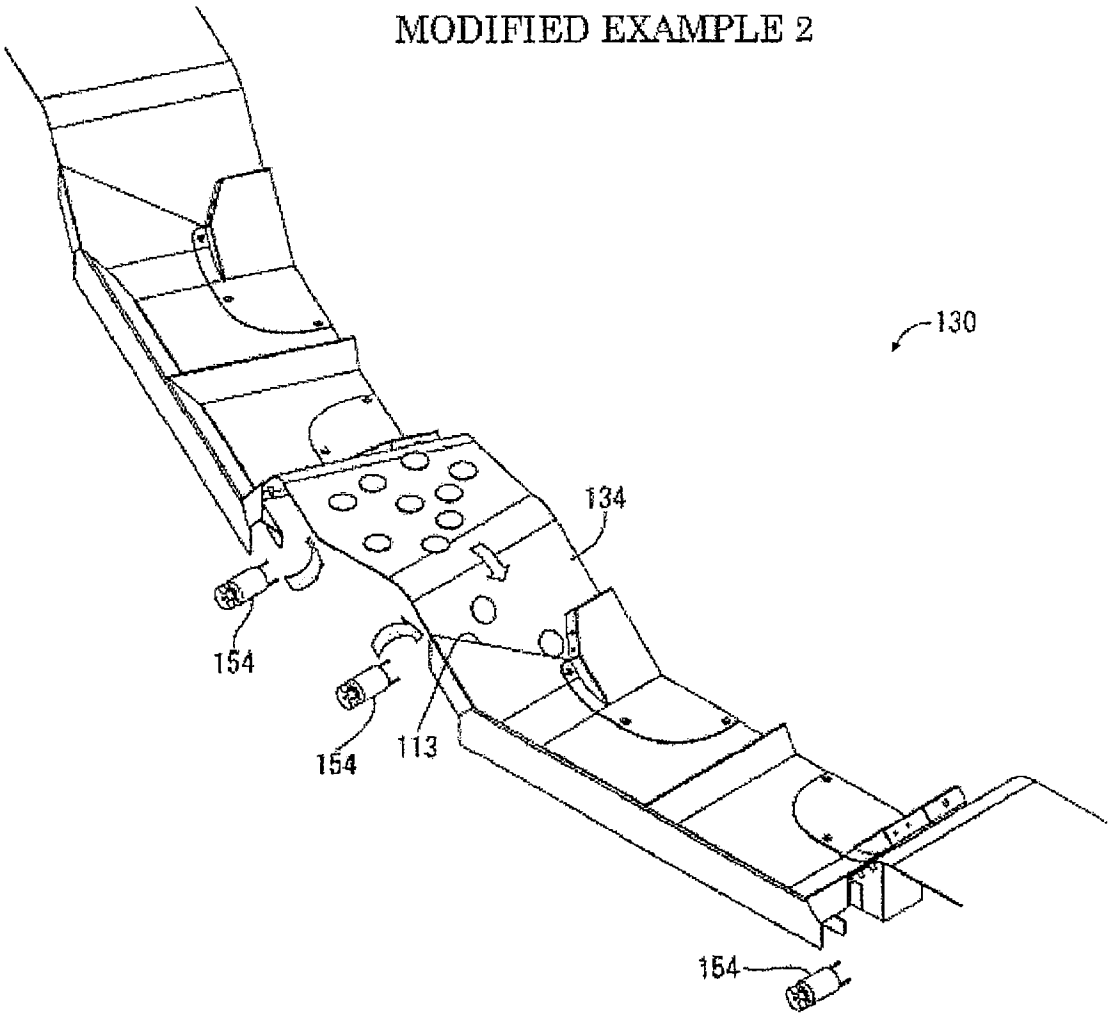
FIG. 25 is a perspective view illustrating a modified example 2 of another medal shooting mechanism of an embodiment of the present invention.

A modified example 2 of the above described medal shooting mechanism 100A will be hereinafter explained with reference to a figure. FIG. 25 is a perspective view illustrating a medal shooting mechanism of the present modified example. Only differences between the medal shooting mechanism of the present example and the above described medal shooting mechanism 100A are hereinafter explained, and the overlapping explanation will be hereinafter omitted.

A configuration for applying minute vibration to the first sloped wall and the second sloped wall by providing a vibration motor 154 on the back sides of the first sloped wall and the second sloped wall, respectively, effectively works for reducing the frictional force to be generated between the medal M and the first sloped wall and the second sloped wall. The medal M and the first sloped wall and the second sloped wall are prevented from closely making contact with each other by applying minute vibration to the first sloped wall and the second sloped wall. As a result, it becomes possible to reduce the effective contact area between the medal M and the first sloped wall and the second sloped wall, and thus it becomes possible to effectively reduce the frictional force. It should be paid attention for avoiding a situation that the medal M instably rolls along the first step 113 and the second step 114 when too much vibration is applied to the first sloped wall and the second sloped wall. In addition, too much vibration is not preferable because it may make a game player discomfort.

(C) Modified Example 3 of Medal Shooting Mechanism 100A

Figure 26:
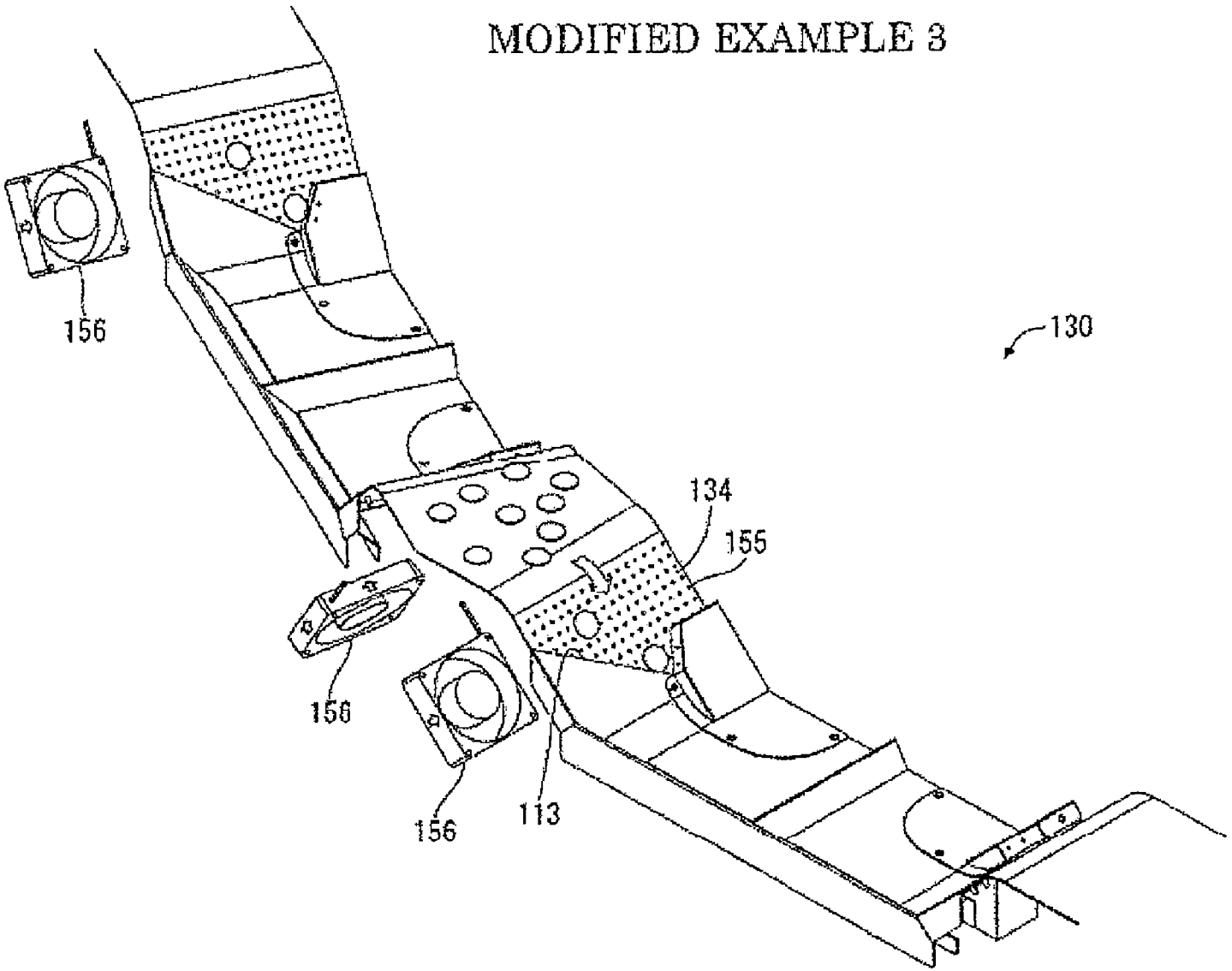
FIG. 26 is a perspective view illustrating a modified example 3 of another medal shooting mechanism of an embodiment of the present invention.

A modified example 3 of the above described medal shooting mechanism 100A will be hereinafter explained with reference to a figure. FIG. 26 is a perspective view illustrating a medal shooting mechanism of the present modified example. Only differences between the medal shooting mechanism of the present example and the above described medal shooting mechanism 100A are hereinafter explained, and the overlapping explanation will be hereinafter omitted.

In order to reduce the frictional force to be generated between the medal M and the first sloped wall and the second sloped wall, the first sloped wall upper area 134 and the second sloped wall upper area 135 have a plurality of scattered vent holes 155, respectively, and a ventilation fan 156 is provided on the back sides of the first sloped wall upper area 134 and the second sloped wall upper area 135, respectively.

Buoyancy for floating the medal M from the first sloped wall upper area 134 and the second sloped wall upper area 135 is applied to the medal M by ventilation through the plurality of vent holes 155. Accordingly, the contact force to be generated between the medal M and the first sloped wall upper area 134 and the second sloped wall upper area 135 is reduced. As a result, the frictional force to be generated between the medal M and the first sloped wall upper area 134 and the second sloped wall upper area 135 is reduced. Here, it is preferable to set intervals between adjacent vent holes 155 to be sufficiently less than diameter dimension of the medal M. Furthermore, it is preferable to form the plurality of vent holes 155 to be regularly scattered at predetermined intervals. In addition, it is possible to achieve the ventilation fan 156 by disposing it on the back sides of the first sloped wall upper area 134 and the second sloped wall upper area 135, respectively. With the configuration, it becomes possible to efficiently reduce the frictional resistance because the medal M rolls along the first step 113 and the second step 114 in a state that the contact force to be generated between the medal M and the first sloped wall upper area 134 and the second sloped wall upper area 135 is reduced by buoyancy applied by the ventilation through the plurality of scattered vent holes 155.

(D) Modified Example 4 of Medal Shooting Mechanism 100A

Figure 27:
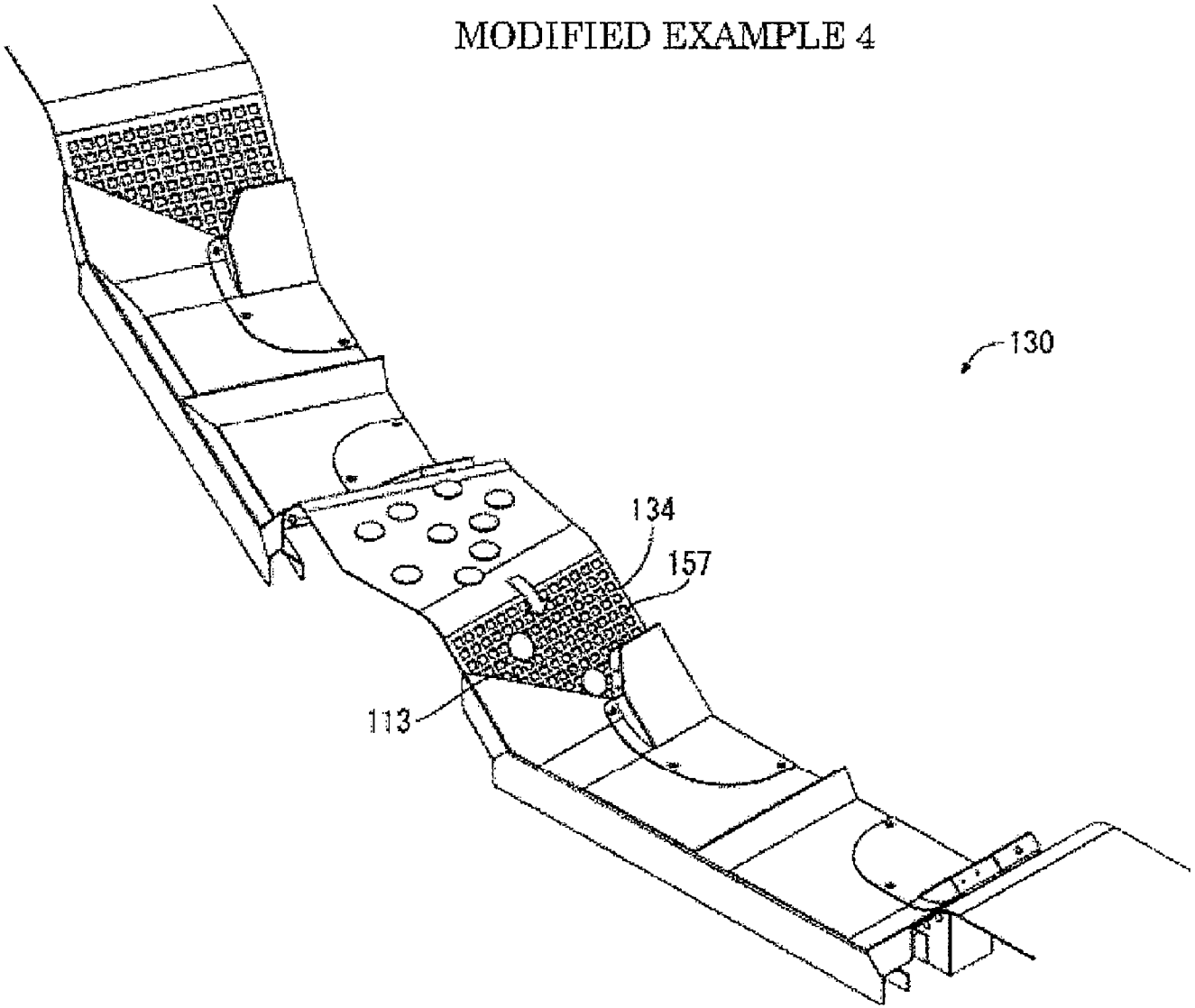
FIG. 27 is a perspective view illustrating a modified example 4 of another medal shooting mechanism of an embodiment of the present invention.

A modified example 4 of the above described medal shooting mechanism 100A will be hereinafter explained with reference to a figure. FIG. 27 is a perspective view illustrating a medal shooting mechanism of the present modified example. Only differences between the medal shooting mechanism of the present example and the above described medal shooting mechanism 100A are hereinafter explained, and the overlapping explanation will be hereinafter omitted.

It is possible to provide a configuration that the first sloped wall upper area 134 and the second sloped wall upper area 135 are made up of a reticulate sloped wall 157, respectively, as another effective method for reducing the frictional force to be generated between the medal M and the first sloped wall and the second sloped wall. Here, reticulated grid intervals are set to be sufficiently less than diameter dimension of the medal M. When the first sloped wall upper area 134 and the second sloped wall upper area 135 are made up of the reticulate sloped wall 157, respectively, the contact area between the medal M and the first sloped wall upper area 134 and the second sloped wall upper area 135 is reduced. Thus it becomes possible to effectively reduce the frictional resistance.

(E) Modified Example 5 of Medal Shooting Mechanism 100A

Figure 28:
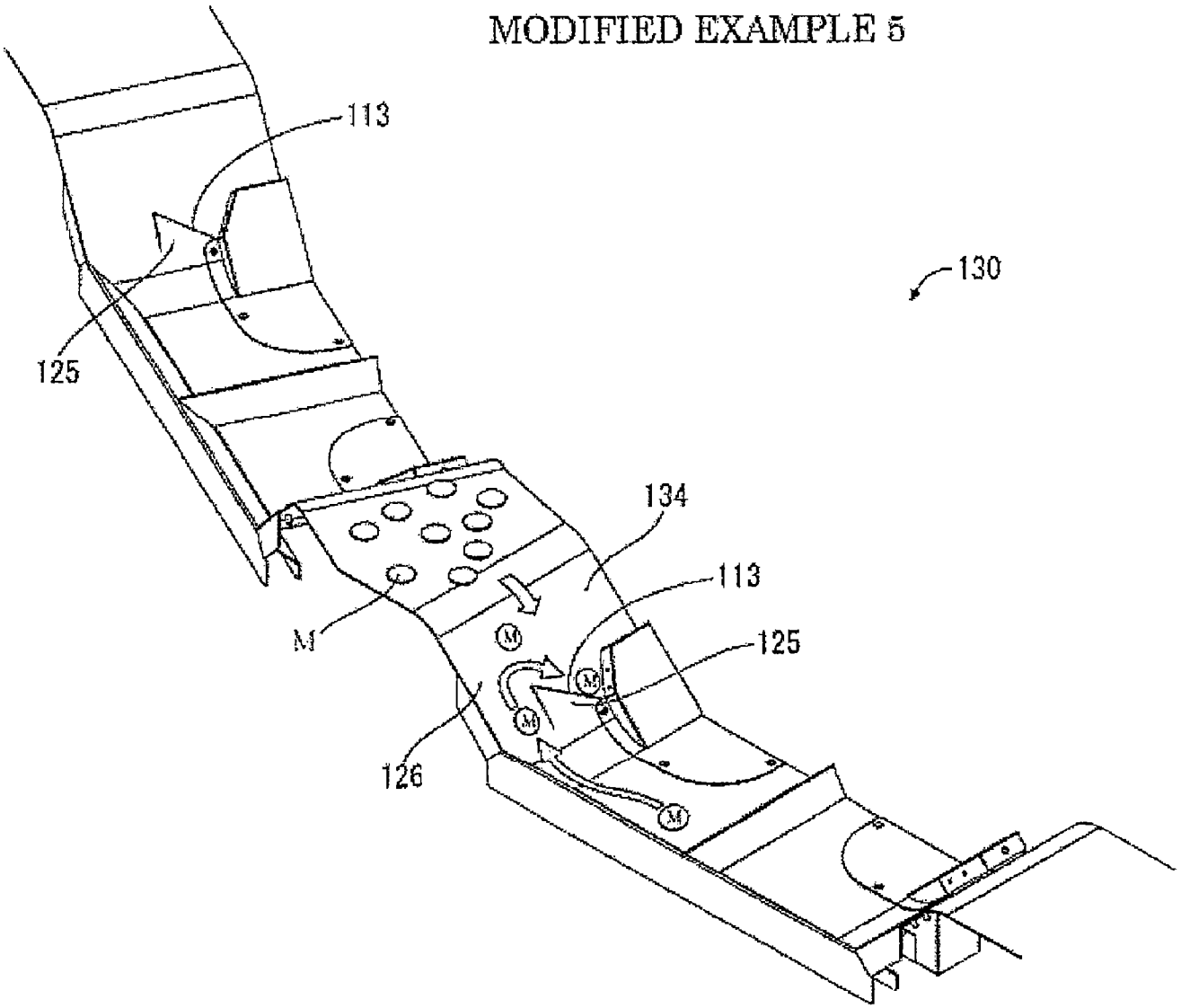
FIG. 28 is a perspective view illustrating a modified example 5 of another medal shooting mechanism of an embodiment of the present invention.

A modified example 5 of the above described medal shooting mechanism 100A will be hereinafter explained with reference to a figure. FIG. 28 is a perspective view illustrating a medal shooting mechanism of the present modified example. Only differences between the medal shooting mechanism of the present example and the above described medal shooting mechanism 100A are hereinafter explained, and the overlapping explanation will be hereinafter omitted.

In the above described embodiment, each sloped wall is made up of a sloped wall upper area and a sloped wall lower area, and a step making up a guide is formed along a boundary between the sloped wall upper area and the sloped wall lower area. The step is configured to be extended to a medal slot from a lateral portion of the sloped wall upper area that is located on the opposite side from the medal slot. In other words, the step is configured to be extended on the entire area of the sloped wall. On the other hand, according to the modified example 5, it is possible to configure the step to be extended to the medal slot from an inner position that is separated from the lateral portion of the sloped wall upper area located on the opposite side from the medal slot at distance greater than or equal to diameter dimension of the single medal. When the step is extended from the inner position that is separated from the lateral portion of the sloped wall upper area at distance of the diameter dimension of the single medal, it becomes possible to move the medal to the sloped wall upper area through a sloped plane on which a step is not formed.

The above configuration will be hereinafter explained in detail with reference to FIG. 28. The first sloped wall is formed by a first sloped wall upper area 134, a third sloped wall lower area 125, and a fourth sloped wall lower area 126. A first step 113 that makes up the second guide is formed along the boundary between the third sloped wall lower area 125 and the first sloped wall upper area 134. The fourth sloped wall lower area 126 and the first sloped wall upper area 134 form a plane, and no step is formed on the boundary between the fourth sloped wall lower area 126 and the first sloped wall upper area 134. It is possible to form the third sloped wall lower area 125 by an approximately wedge-shaped flat plate that is provided on the single plane formed by the fourth sloped wall lower area 126 and the first sloped wall upper area 134. In this case, thickness of the approximately wedge-shaped flat plate corresponds to the step width of the above described step 113. Therefore, the thickness is determined based on the step width of the above described first step 113. Furthermore, it is required for the fourth sloped wall lower area 126 to have horizontal dimension greater than diameter dimension of the medal M for the purpose of making the medal M move to the first sloped wall upper area 134 through the fourth sloped wall lower area 126.

With the configuration, a game player moves the medal from the first lower accumulating part 144 to the first sloped wall upper area 134 through the fourth sloped wall lower area 126, and further moves it to an upper position of the third sloped wall lower area 125 while the game player presses the medal M with one's finger. When the game player releases the medal M on the position, the medal M slidingly falls along the first sloped wall upper area 134, and is caught by the first step 113 that is made up of the upper side of the approximately wedge-shaped flat plate. Then, as described above, the medal M slidingly rolls into the first medal slot 138-1 along the first step 113. According to the configuration, no step is formed on the boundary between the fourth sloped wall lower area 126 and the first sloped wall upper area 134. Therefore, it becomes possible to move the medal M to the first sloped wall upper area 134 without making the first step 113 cross over the first step 113.

It is possible to form the third sloped wall lower area 125 by an approximately wedge-shaped plate with non-uniform thickness, instead of the approximately wedge-shaped flat plate. Specifically, it is possible to form the upper side of the approximately wedge-shaped plate to have thickness corresponding to the step width of the above described first step 113. On the other hand, it is possible to form the lower side of the approximately wedge-shaped plate to have thickness of substantially zero by forming the approximately wedge-shaped plate to have thickness gradually reducing from the upper side to the lower side. With the configuration, it is not required to form a step on the lower side of the third sloped wall lower area 125.

With the configuration, a game player may move the medal M from the first accumulating part 144 to the second sloped wall upper area 107 through the fourth sloped wall lower area 126 while the game player presses the medal M with one's finger, and may move it to the second sloped wall upper area 107 through the third sloped wall lower area 125 because no step is formed on the lower side of the third sloped wall lower area 125. When the game player moves the medal M to an upper position of the third sloped wall lower area 125 and then releases the medal M on the position, the medal M slidingly falls along the first sloped wall upper area 134, and is caught by the first step 113 that is made up of the upper side of the approximately wedge-shaped flat plate. Then, as described above, the medal M slidingly rolls into the first medal slot 138-1 along the first step 113.

Figure 30:
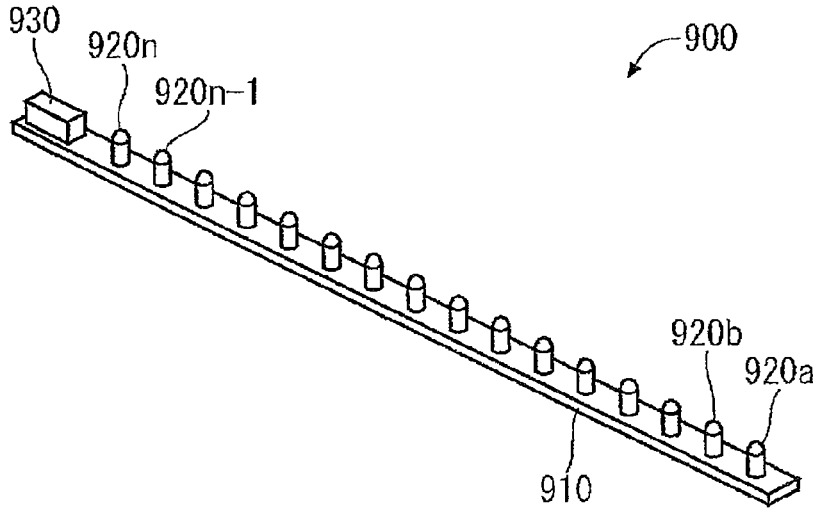
FIG. 30 is a perspective view illustrating a configuration of a medal movement simulation rendering unit of an embodiment of the present invention.
Figure 31:
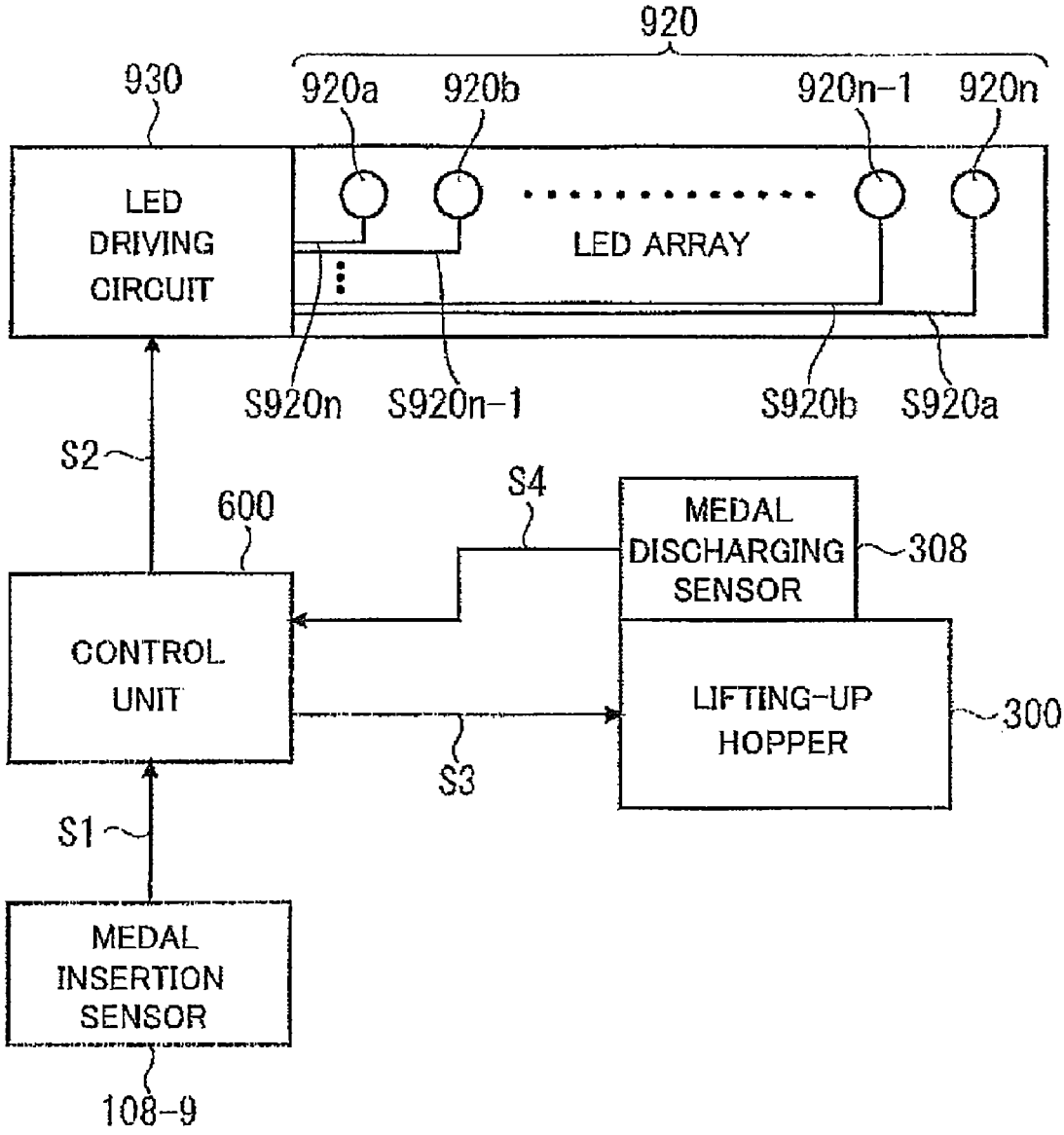
FIG. 31 is a block diagram illustrating an electrical configuration of the medal movement simulation rendering unit and its peripheral part of an embodiment of the present invention.

(1-3) Medal Movement Simulation Rendering Unit (1-3-1) Configuration of Medal Movement Simulation Rendering Unit FIG. 30 is a perspective view for illustrating a configuration of the medal movement simulation rendering unit 900 of an embodiment. On the other hand, FIG. 31 is a block diagram for illustrating relation of electrical connection between the medal movement simulation rendering unit 900 and the peripheral part thereof.

First, as illustrated in FIG. 30, the medal movement simulation rendering unit 900 includes an elongated stick shaped support member 910, a plurality of LEDs (light-emitting parts) 920*a*-920*n* (note that an arbitrary LED is hereinafter referred to as a LED 920) that are arranged to be separated from each other at predetermined intervals in the longitudinal direction of the support member 910, and a LED driving circuit 930 for driving the LEDs. Note that it is possible to use other light-emitting means instead of the LED 920.

For example, the support member 910 is a stick shaped member that is made of steel and includes a hollow space in the interior thereof. With the stick shaped member, it becomes possible to easily arrange the LEDs from the vicinity of the medal shooting mechanism 100 to the vicinity of the medal discharging part 330. In the present example, the support member 910 is configured to be a linear stick shaped member. Note that the cross-section of the support member 910 may be formed in a square shape, a rectangular shape, a polygonal shape other than the square shape and the rectangular shape, or a rounded shape such as a circular shape and an oval shape. In the present example, the cross-section of the support member 910 is configured to be formed in a rectangular shape, and each of the lateral surfaces of the support member 910 is configured to be a flat surface approximately without torsion. In addition, in the present example, the above described plurality of LEDs 920 are configured to be linearly arranged to be separated from each other at predetermined intervals on any of the lateral surfaces of the support member 910. Note that the side on which the plurality of LEDs 920 are provided is the surface that is disposed to be viewable for a game player while a game is played.

As described above, with a configuration that the LEDs 920 are disposed to be arranged on the support member 910 that is a linear stick shaped member, a linear light trajectory is traced by the consecutively lighting-up LEDs 920. Accordingly, it is possible to render the simulated movement of the medal, which gives a game player a sense of speed. Note that all the LEDs 920 to be arranged may be configured to emit light of the same color (e.g., red, blue, and green). Also, the LEDs emitting light of a variety of colors may be regularly or randomly selected and arranged in combination with each other.

The support member 910 is bridged between the vicinity of the medal shooting mechanism 100 (especially, first medal slot 108-1) and the vicinity of the medal discharging part 330 while the arranged LEDs 920 and the LED driving circuit 930 are disposed on the support member 910. Here, it is preferable that an end of the support member 910 is disposed to be adjacent to, especially, the medal slot 108-1 to be described (see FIG. 33) of the medal shooting mechanism 100, and the other end of the support member 910 is disposed to be adjacent to the medal discharging part 330. Accordingly, it is possible to arrange the LEDs 920 as if the LEDs 920 connect the vicinity of the medal shooting mechanism 100 and the vicinity of the medal discharging part 330. Also, it is possible to visually render a simulated scene that the medal moves from the medal shooting mechanism 100 to the medal discharging part 330 by sequentially lighting up the arranged LEDs 920. Note that the wiring for electrically connecting the LED driving circuit 930 and the LEDs 920 is accommodated in the hollow space formed in the support member 910.

Also, as illustrated in FIG. 31, the LED driving circuit 930 is electrically connected to the first control unit 600. The first control unit 600 is also electrically connected to a medal insertion sensor (sensor) 108-9 provided in the medal shooting mechanism 100, the lifting-up hopper 300, and a medal discharge sensor 332 provided in the medal discharging part 330, respectively. Note that wiring such as a cable harness may be used for a respective connection The medal insertion sensor 108-9 is a sensor for detecting a medal that is inserted into the medal slot 108-1 of the medal shooting mechanism 100. The medal insertion sensor 108-9 may be a non-contact type sensor using magnetism and/or light, and a contact type sensor using an on/off switch. A configuration of the medal insertion sensor 108-9 and its periphery is hereinafter explained with reference to FIG. 32.

Figure 32:
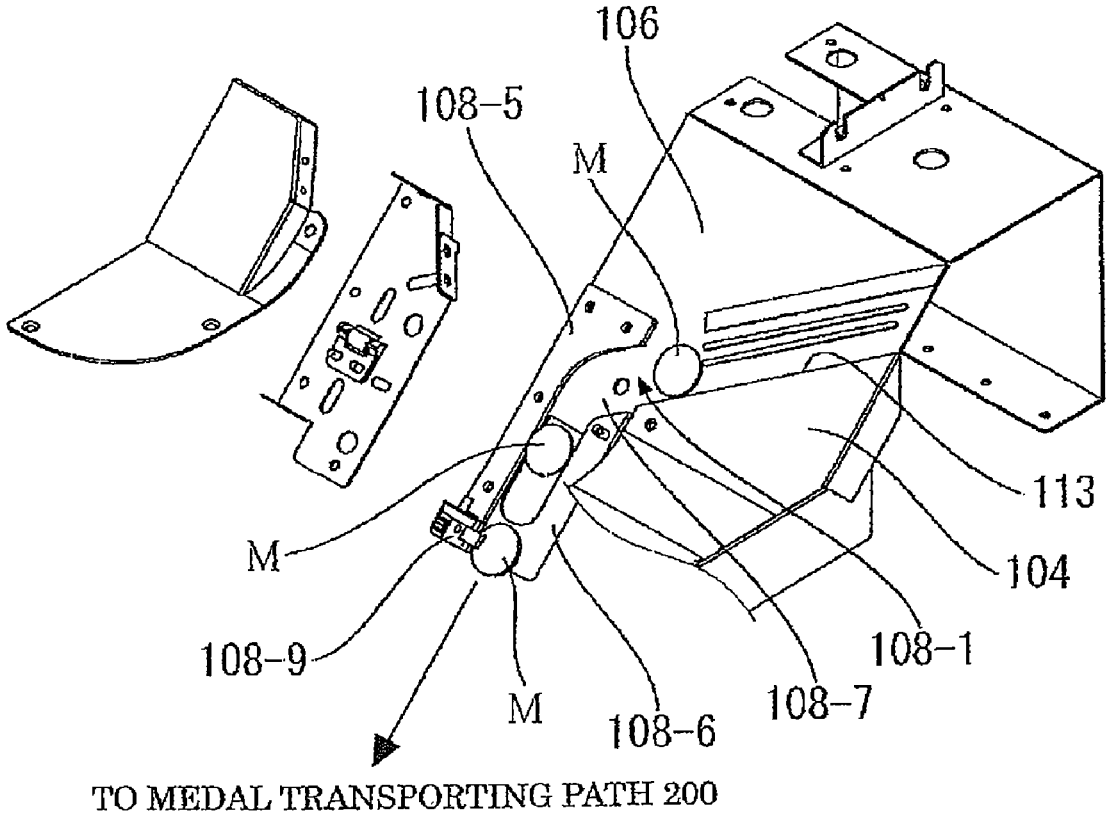
FIG. 32 is an exploded view illustrating a configuration of a medal shooting sensor and its periphery in a medal shooting mechanism of an embodiment of the present invention.

As illustrated in FIG. 32, a medal M, which is lifted up to a first sloped wall upper area 106 by a game player, is inserted into the medal slot 108-1 while the medal M slidingly rotates on a first guide 113 that is formed by a step between a plate member making up a first sloped lower area 104 and a plate member making up the first sloped wall upper area 106 under the gravity. Then, the medal M passes through a medal insertion path 108-7 that is made up of a first medal guide plate 108-5, a second medal guide plate 108-6, and the plate member making up the first sloped wall upper area 106, and is transported to a medal transporting path 200 (see FIG. 2). The medal insertion sensor 108-9 is provided in the intermediate portion of the medal insertion path 108-7 that connects the medal slot 108-1 and the medal transporting path 200, and detects that the medal M passes through the portion based on contact or non-contact of the medal M with respect to the portion. Also, when the medal insertion sensor 108-9 detects insertion of the medal M, it generates a medal insertion detection signal S1, and inputs the medal insertion detection signal S1 into the first control unit 600 (see FIG. 2).

The first control unit 600 generates a LED driving circuit control signal S2 for driving the LED driving circuit 930 based on the timing when the medal insertion detection signal S1 is inputted into the first control unit 600, and inputs the LED driving circuit control signal S2 into the LED driving circuit 930. Also, the LED driving circuit 930 causes the LEDs 920*a*-920*n* to sequentially light up based on the timing when the LED driving circuit control signal S2 is inputted into the LED driving circuit 930.

The lifting-up hopper 300 discharges the medal M that is set in the medal discharging part 330 to the medal discharging path 400 based on the control by the first control unit 600 (see FIG. 2). Note that a lifting-up hopper control signal S3 outputted from the first control unit 600 is used for controlling the lifting-up hopper 300. Also, after the medal discharge, the next medal is promptly set in the medal discharging part 330.

The medal discharge sensor 332 (see FIG. 33) is a sensor for detecting whether the medal M is discharged from the medal discharging part 330. In the similar way to the medal insertion sensor 108-9, the medal discharge sensor 332 may be a non-contact type sensor using magnetism and/or light, or a contact type sensor with an on/off switch. The medal discharge sensor 332 is provided at the outlet (not illustrated in the figure) of the medal discharging part 330, and detects the medal M discharged from the outlet based on contact or non-contact of the medal M with respect to the outlet. Also, when the medal discharge sensor 332 detects discharge of the medal M, it generates a medal discharge detection signal S4, and inputs the medal discharge detection signal S4 into the first control unit 600 (see FIG. 2).

Figure 33:
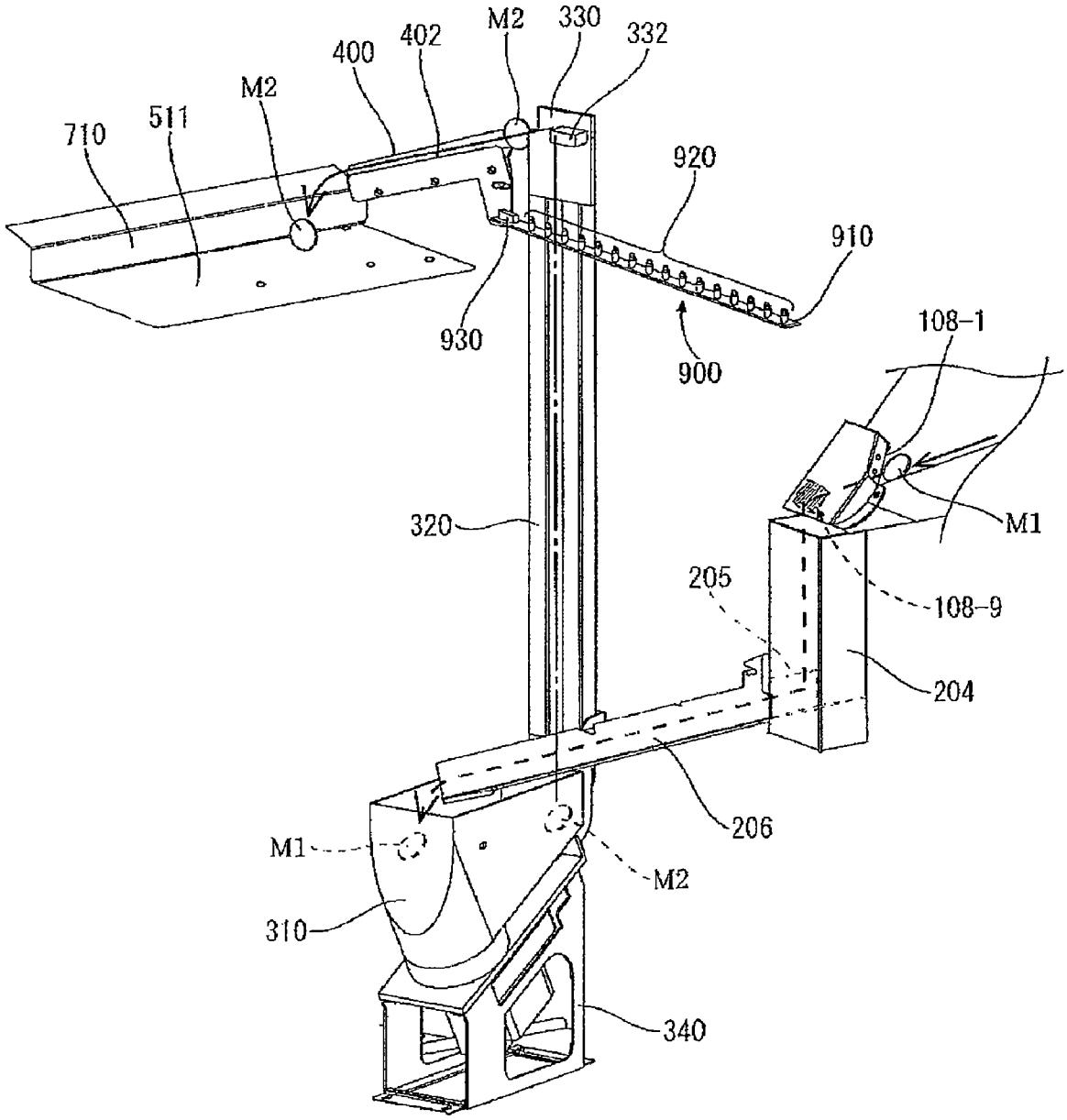
FIG. 33 is a diagram for illustrating movement of a medal in a station of an embodiment of the present invention.
Figure 34:
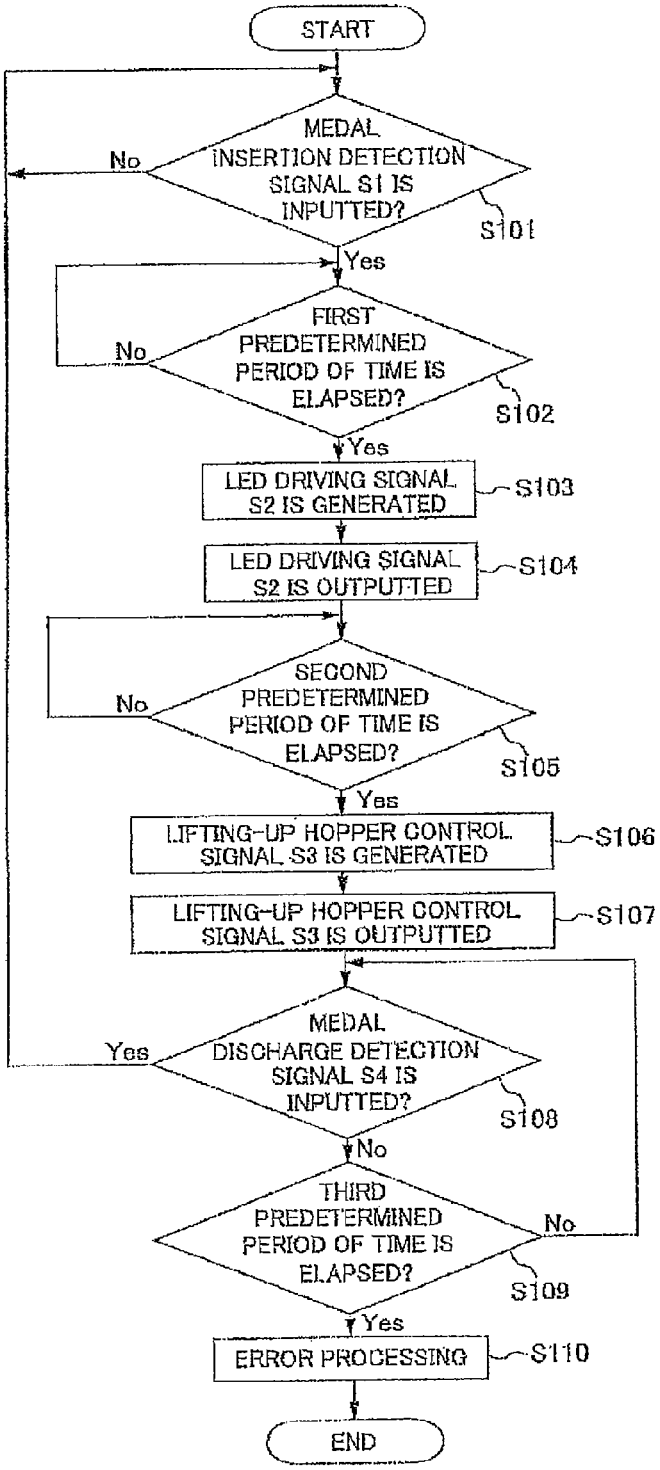
FIG. 34 is a flowchart illustrating an operation of a control unit when simulated movement of a medal is rendered in an embodiment of the present invention.
Figure 35:
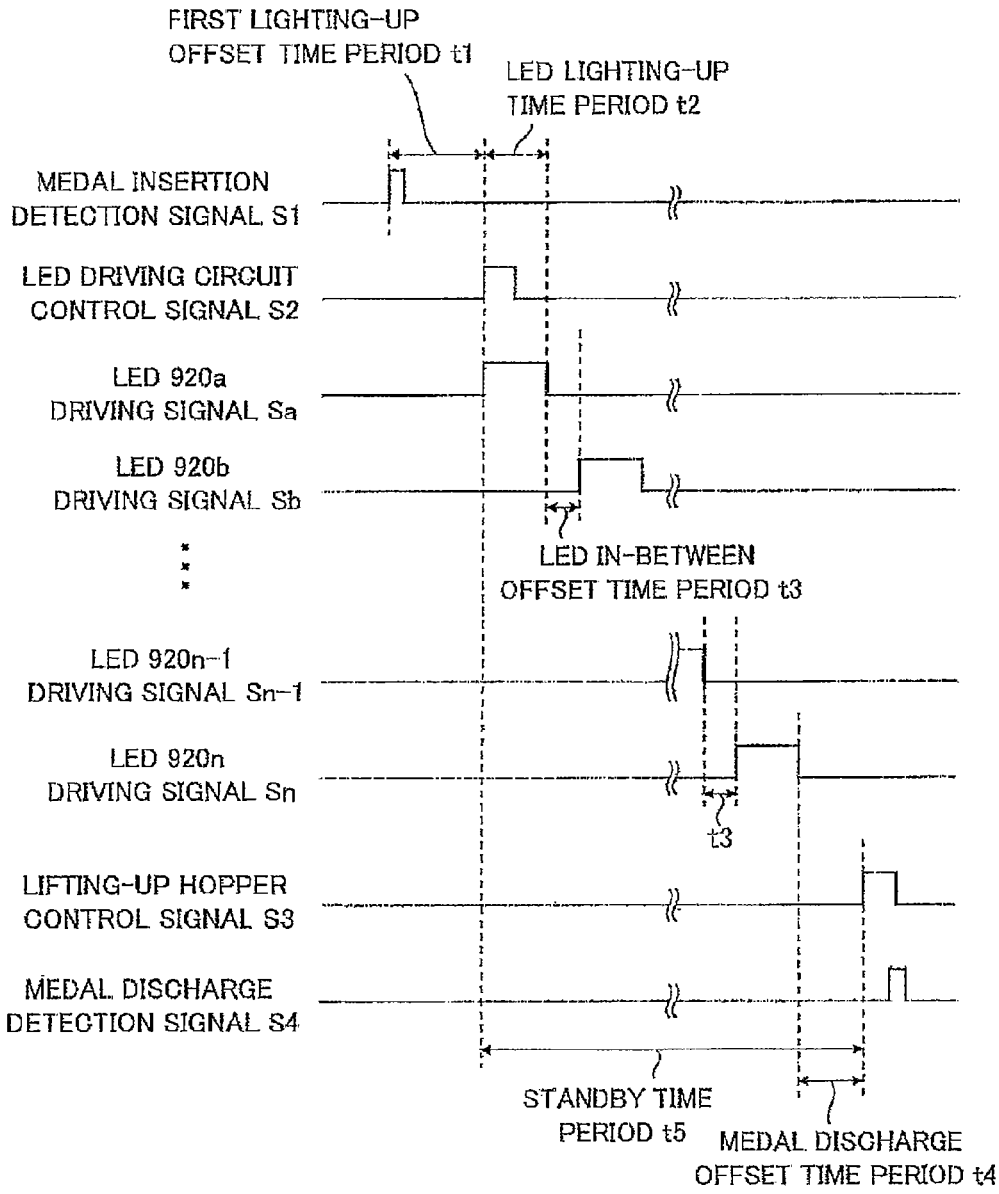
FIG. 35 is a waveform diagram of a signal to be inputted/outputted among the medal movement simulation rendering unit, its peripheral part, and a control unit of an embodiment of the present invention.

(1-3-2) Operation of Medal Movement Simulation Rendering Unit and Peripheral Part Thereof Next, an operation of the medal movement simulation rendering unit 900 and its peripheral part will be explained in detail with reference to FIGS. 31-35. FIG. 33 is a diagram for illustrating movement of a medal from medal insertion to medal discharge. FIG. 34 is a flowchart for illustrating an operation of the first control unit 600 from medal insertion to medal discharge. FIG. 35 is a waveform diagram of a signal inputted/outputted among the medal movement simulation rendering unit 900, its peripheral part, and the first control unit 600 from medal insertion to medal discharge. Note that the peripheral part includes the first control unit 600, the medal insertion sensor 108-9, the lifting-up hopper 300, and the medal discharge sensor 332.

As illustrated in FIG. 33, first, a medal M1 inserted in the medal slot 108-1 enters the medal transporting path 200 via the medal insertion path 108-7 as explained with reference to FIG. 32. Note that at this time, a medal M2, which has been accumulated in the medal accumulating part 310 of the lifting-up hopper 300, is set in the medal discharging part 330. With a medal accumulating part 310 for accumulating a medal to be discharged from the medal discharging part 330, it is possible to discharge the medal M2, which is different from the medal M1 inserted into the medal shooting mechanism 100, from the medal discharging part 330. As a result, it is possible to arbitrarily set the positional relation between the medal shooting mechanism 100 and the medal discharging part 330. Accordingly, flexibility of designing the game device (especially, the station ST) is enhanced. In addition, with a configuration that the medal M1 inserted into the medal shooting mechanism 100 is accumulated in the medal accumulating part 310 for accumulating the medal M2 to be discharged, it is possible to balance the number of incoming medal and the number of outgoing medal in the medal accumulating part 310. As a result, it is possible to save a step for supplying the medal in the medal accumulating part 310 while the game is played.

When the medal M1 passes through the medal insertion path 108-7, the medal insertion sensor 108-9 detects this. In addition, the medal insertion sensor 108-9 generates the medal insertion detection signal S1 at the timing when it detects the medal M1 as illustrated in FIG. 35, and outputs the medal insertion detection signal S1 to the first control unit 600 as illustrated in FIG. 31. Note that as illustrated in FIG. 33, the medal M1 inserted into the medal shooting mechanism 100 is transported to the medal accumulating part 310 of the lifting-up hopper 300 via the medal transporting path 200, and is then accumulated in the medal accumulating part 310.

Also, as illustrated in FIG. 34, the first control unit 600 stands by until the medal insertion detection signal S1 is inputted into the first control unit 600 from the medal insertion sensor 108-9 (Step S101). When the medal insertion detection signal S1 is inputted into the first control unit 600 from the medal insertion sensor 108-9 (Yes in Step S101), the first control unit 600 stands by until a first predetermined period of time (first lighting-up offset time period t1 in FIG. 35) is elapsed as illustrated in FIG. 35 (Yes in Step S102). Then, the first control unit 600 generates a LED driving circuit control signal S2 for driving the LED driving circuit 930 (Step S103), and outputs the LED driving circuit control signal S2 to the LED driving circuit 930 as illustrated in FIG. 31 (Step S104). Note that the first lighting-up offset time period t1 is a period of time that is elapsed when the medal M1 virtually moves from the medal slot 108-1 to the LED 920*a*.

Also, as illustrated in FIG. 34, the first control unit 600 stands by until a second predetermined period of time (standby time period t5 in FIG. 35) is elapsed after the first control unit 600 starts outputting the LED driving circuit control signal S2 (Step S105). It is possible to determine the standby time period t5 based on the following equation (equation 1) under the condition: a time period when each of the LEDs 920 is lighted up is set to be a LED lighting-up time period t2; a period of time that is elapsed until a subsequent LED 920 is lighted up after a previously lighted LED 920 is lighted out is set to be a LED in-between offset time period t3; and a period of time that is elapsed until the medal M2 is discharged after the last LED 920*n* is lighted up is set to be a medal discharge offset time period t4.

$$t5=t1+n\times t2+(n-1)\times t3+t4 \quad \text{(Equation 1)}$$

Note that in a real situation, there is a somewhat time-lag until a first LED driving signal S920*a* is outputted after the LED driving circuit control signal S2 is outputted. However, the first lighting-up offset time period t1 and the LED lighting-up time period t2 are sufficiently greater than the processing speed of the first control unit 600 and the operation speed of the LED driving circuit 930. Therefore, the time-lag is negligible.

When the LED driving circuit control signal S2 is inputted into the LED driving circuit 930, as illustrated in FIG. 35, first, the LED driving circuit 930 generates a LED driving signal S920*a* for driving a LED 920*a* that is closest to the medal shooting mechanism 100, and applies the LED driving signal S920*a* to the wiring that is connected to the LED 920*a*. Accordingly, the LED 920*a* is firstly lighted up. Note that the LED driving signal S920*a* and LED driving signals S920*b*-S920*n* to be described are rectangular signals having width of a predetermined period of time (LED lighting-up time period t2). Therefore, the LEDs 920*a*-920*n*, to which the above signals are respectively applied, are respectively lighted up for a period of time corresponding to the width of the predetermined period of time (LED lighting-up time period t2).

Next, as illustrated in FIG. 35, the LED driving circuit 930 generates a LED driving signal S920*b* for driving a LED 920*b* that is located in the second-closest position to the medal shooting mechanism 100, and applies the LED driving signal S920*b* to the wiring that is connected to the LED 920*b*. Accordingly, the LED 920*b* is subsequently lighted up. Note that as illustrated in FIG. 35, it is possible to set the timing when the LED driving signal S920*b* is generated to be a timing after a predetermined period of time (LED in-between offset time period t3) is elapsed since the signal fall timing of the LED driving signal S920*a*, for instance. In the similar to the above, it is possible to set the timing for generating each of the subsequent LED driving signals S920*c*-S920*n* to be a timing after a predetermined period of time (LED in-between offset time period t3) is elapsed since each of the signal fall timings of the previous LED driving signals S920*b*-S920*n*−1. Accordingly, each of the LEDs 920*a*-920*n* is lighted up so that the lighting-up time periods of the LEDs 920*a*-920*n* do not co-occur. With a configuration that the lighting-up time periods of the LEDs 920 do not co-occur, it is possible to further clearly express the simulated movement of the medal.

As illustrated in FIG. 35, subsequently, the LED driving circuit 930 sequentially generates the LED driving signals S920*c*-S920*n*, and causes the LED 920*c*-920*n* to light up with the LED driving signals S920*c*-S920*n*. Accordingly, it is possible to cause each of the LED 920*a*-920*n* to light up sequentially from the medal shooting mechanism 100 side to the medal discharging part 330 side. Note that the first control unit 600 and the LED driving circuit 930 function as light-emitting part driving means for driving the LEDs.

On the other hand, the first control unit 600 stands by for the second predetermined period of time (standby time period t5) as illustrated in FIG. 34 (Yes in Step S105), then generates a lifting-up hopper driving signal S3 as illustrated in FIG. 35 (Step S106), and outputs the lighting-up hopper driving signal S3 to the lifting-up hopper 300 as illustrated in FIG. 31 (Step S107). Note that the timing of outputting the lighting-up hopper driving signal S3 after the LED driving circuit control signal S2 is outputted is set to be a timing after a predetermined period of time is elapsed since the last LED 920*n* is lighted out. In other words, the end of the second predetermined period of time (standby time period t5) is set to be a time after the last LED 920*n* is lighted out.

Also, as illustrated in FIG. 34, after the lifting-up hopper driving signal S3 is outputted (Step S107), the first control unit 600 judges whether or not the medal discharge detection signal S4 is inputted into the first control unit 600 from the medal discharge sensor 332 during a third predetermined period of time (Steps S108-S109). When the third predetermined period of time is elapsed without input of the medal discharge detection signal S4 into the first control unit 600 (No in Step S108 and Yes in Step S109), the first control unit 600 performs an error processing that is configured to be performed when the medal M2 is not normally discharged (Step S110), and then ends the processing. On the other hand, when the medal discharge detection signal S4 is inputted into the first control unit 600 within the third predetermined period of time (Yes in Step S108), the current processing step returns to Step S101. Note that the error processing includes a processing for informing that an error caused by a jammed medal(s) occurs in other element(s), and a processing for displaying occurrence of an error in the display unit 700, for instance.

On the other hand, as illustrated in FIG. 33, when the lifting-up hopper driving signal S3 is inputted into the lifting-up hopper 300, the lifting-up hopper 300 outputs the medal M2 that is preliminarily set in the medal discharging part 330 to the medal discharging path 400. Accordingly, the medal M2, which is herein discharged, is different from the medal M1 inserted by a game player. Note that the first control unit 600 functions as discharging part driving means for causing the medal discharging part 330 of the lifting-up hopper 300 to discharge the medal M2 to the playing field 500 by driving the medal discharging part 330. However, the lifting-up hopper 300 may be included in the discharging part driving means.

The medal M2 discharged from the medal discharging part 330 of the lifting-up hopper 300 is discharged to the sub-table 511 on the pusher part 510 of the playing field 500 via the medal discharging path 400. The medal M2 discharged on the sub-table 511 hits the display unit 700 and/or its chassis lower part 710 and is then accumulated on the sub-table 511, or drops from the sub-table 511. Note that as described above, the medal discharge sensor 332 is provided at the outlet of the medal discharging part 330, and the medal discharge sensor 332 detects whether or not the medal M2 is normally discharged. When the medal discharge sensor 332 detects discharge of the medal M2, it generates the medal discharge detection signal S4 and inputs the medal discharge detection signal S4 into the first control unit 600.

As described above, it is possible to realize rendering as if the inserted medal M1 is actually discharged from the medal discharging path 400 with a configuration that each of the LEDs 920*a*-920*n* is lighted up sequentially from the medal shooting mechanism 100 side to the medal discharging part 330 side when the medal M1 is inserted by a game player and then another medal, that is, the medal M2, is discharged from the medal discharging part 330.

Also, in the present embodiment, if a subsequent medal M1 is inserted until a medal M2 is discharged since a previous medal M1 is inserted, it is also possible to provide, for instance, a counter (not illustrated in the figure) for constantly monitoring generation of the medal insertion detection signal S1 and generation of the medal discharge detection signal S4 for the purpose of preventing the generated medal insertion detection signal S1 from being ignored as a result of detection of the subsequent medal M1. In this case, the counter counts up when the medal insertion detection signal S1 is generated, and counts down when the medal discharge detection signal S4 is generated. Then, the first control unit 600 performs an operation for consecutively output the lifting-up hopper driving signal S3 until the counter reaches zero. Accordingly, even when the subsequent medal M1 is consecutively inserted until the medal M2 is discharged, it is possible to reliably discharge a medal(s) with the same number as the inserted medal(s) after delay of a predetermined period of time. Also, the medal movement simulation rendering unit 900 illustrated in FIG. 33 starts performing an operation every time when the medal insertion detection signal S1 is generated. When a new medal insertion detection signal S1 is generated before a series of operation is completed, the medal movement simulation rendering unit 900 starts performing a new operation while the current operation is continuously performed.

(1-3-3)

As described above, the game device (the station ST) of the present embodiment includes the medal shooting mechanism 100 into which the medal M, which is a game medium, is inserted, the medal insertion sensor 108-9 for detecting the medal M inserted into the medal shooting mechanism 100, the medal discharging part 330 for discharging the medal to the playing field 500, the plurality of LEDs 920 arranged from the vicinity of the medal shooting mechanism 100 to the vicinity of the medal discharging part 330, and the first control unit 600 and the LED driving circuit 930, which serve for causing the plurality of arranged LEDs 920 to light up sequentially from the medal shooting mechanism 100 side to the medal discharging part 330 side when insertion of the medal M into the medal shooting mechanism 100 is detected by the medal insertion sensor 108-9. Also, the first control unit 600 causes the medal discharging part 330 to discharge a medal by driving medal discharging part 330 after a predetermined period of time (first lighting-up offset time period t1+standby time period t5) is elapsed since insertion of the medal M into the medal shooting mechanism 100 is detected by the medal insertion sensor 108-9.

With a configuration that the plurality of LEDs 920, which are arranged from the vicinity of the medal shooting mechanism 100 to the vicinity of the medal discharging part 330, are caused to light up sequentially from the medal shooting mechanism 100 side to the medal discharging part 330 side when a medal is inserted, it is possible to visually express a scene that the inserted medal moves from the medal shooting mechanism 100 to the medal discharging part 330. Accordingly, it is possible to render the simulated movement of the medal object from the medal shooting mechanism 100 to medal discharging part 330, for example, when the medal inserted into the medal shooting mechanism 100 and the medal to be discharged from the medal discharging part 330 are different from each other. As a result, when a medal is shot to the playing field 500, a game player is not given a feeling that there is something wrong with the game regardless of whether or not the inserted medal and the medal to be discharged are the same. Also, when the medal inserted into the medal shooting mechanism 100 and the medal discharged from the medal discharging part 330 are the same, it is possible to render this with light, aside from the actual movement of the medal.

(1-3-4) Modified Example of Operation of Medal Movement Simulation Rendering Unit and Peripheral Part Thereof.

Figure 36:
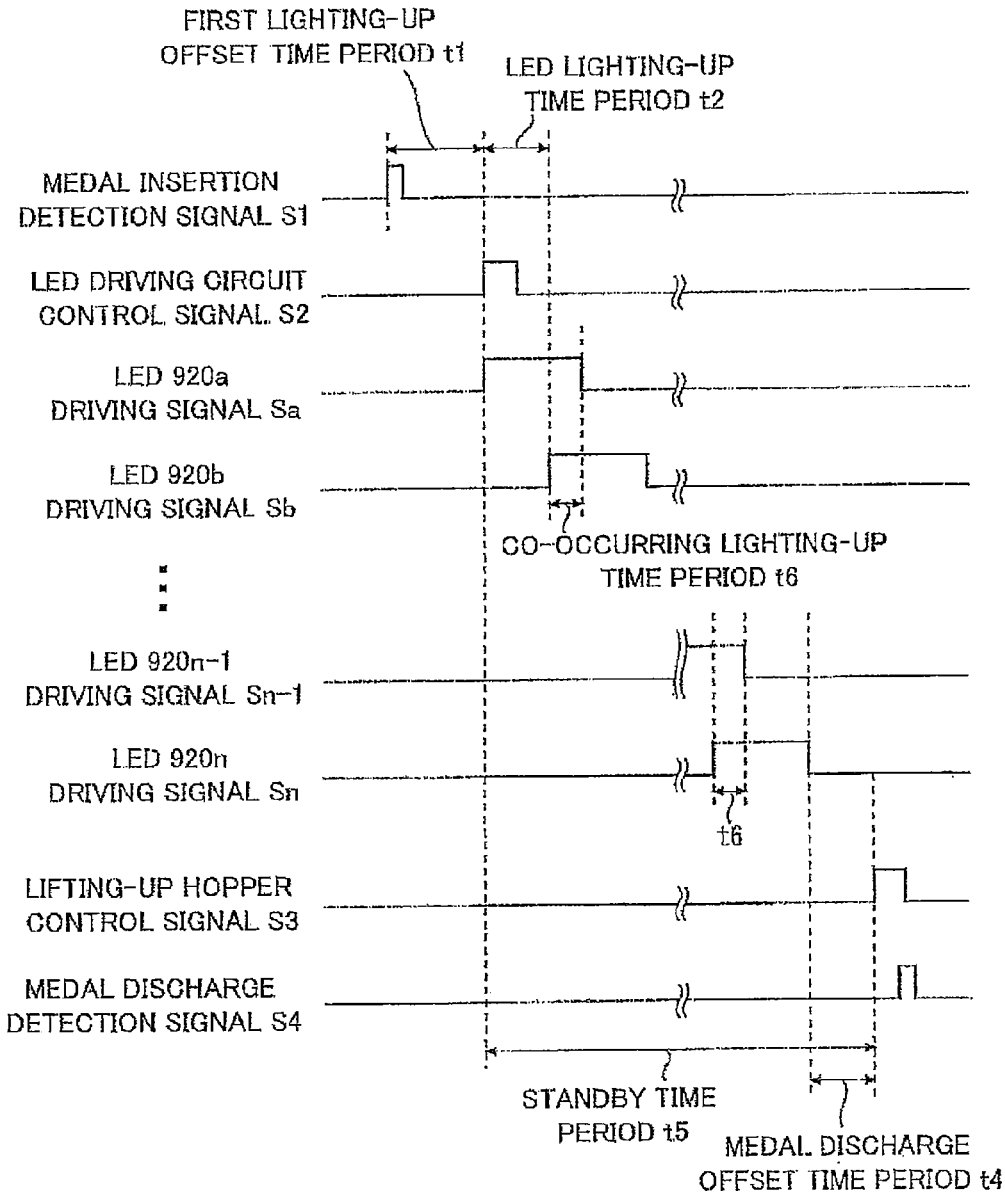
FIG. 36 is a diagram illustrating a modified example of an operation of the medal movement simulation rendering unit and its peripheral part of an embodiment of the present invention, and is a waveform diagram of a signal to be inputted/outputted among the medal movement simulation rendering unit, its peripheral part, and the control unit in the present modified example.

Next, a modified example of an operation of the medal movement simulation rendering unit 900 and its peripheral part will be explained. FIG. 36 is a waveform diagram of a signal to be inputted/outputted among the medal movement simulation rendering unit 900, its peripheral part, and the first control unit 600 from insertion of the medal to discharge of the medal. Note that as described above, the peripheral part includes the first control unit 600, the medal insertion sensor 108-9, the lifting-up hopper 300, and the medal discharge sensor 332.

As is clear from comparison between FIG. 36 and FIG. 35, according to the present modified example, for example, it is possible to set the timing when the LED driving signal S920*b* is generated to precede the signal fall timing of the LED driving signal S920*a* by a predetermined period of time (co-occurring lighting-up time period t6). In the similar way to this, it is possible to set the timing of generating each of the subsequent LED driving signals S920*c*-S920*n* to precede the signal fall timing of each of the preceding LED driving signals S920*b*-S920*n*−1 by a predetermined period of time (co-occurring lighting-up time period t6). Accordingly, each of the LEDs 920*a*-920*n* operates to light up concurrently with the other LED 920. In other words, each of the LEDs 920*a*-920*n* operates so that a subsequent LED 920 is lighted up before an immediately previously lighted-up LED 920 is lighted out. It is possible to express the simulated movement of the medal more smoothly by overlapping a lighting-up time period of each of the LEDs 920 with that of the other. It is possible to derive the above described standby time period t5 based on the following equation (equation 2) under the condition: a time period when each of the LEDs 920 is lighted up is set to be a LED lighting-up time period t2; a time period when one of the LEDs 920 is lighted up during lighting up of another of the LEDs 920 is set to be a co-occurring lighting-up time period t6; and a period of time that is elapsed until the medal M2 is discharged after the last LED 920*n* is lighted up is set to be a medal discharge offset time period t4.

$$t5=t1+n\times t2-(n-1)\times t6+t4 \quad \text{(Equation 2)}$$

Note that the other configurations and the other operations of the present example are almost the same as the above described embodiment. Therefore a detailed explanation thereof will be hereinafter omitted.

(1-3-5) Modified Examples of Configuration of Medal Movement Simulation Rendering Unit Next, modified examples of a configuration of the medal movement simulation rendering unit 900 of the present embodiment will be explained with some examples.

Figure 37:
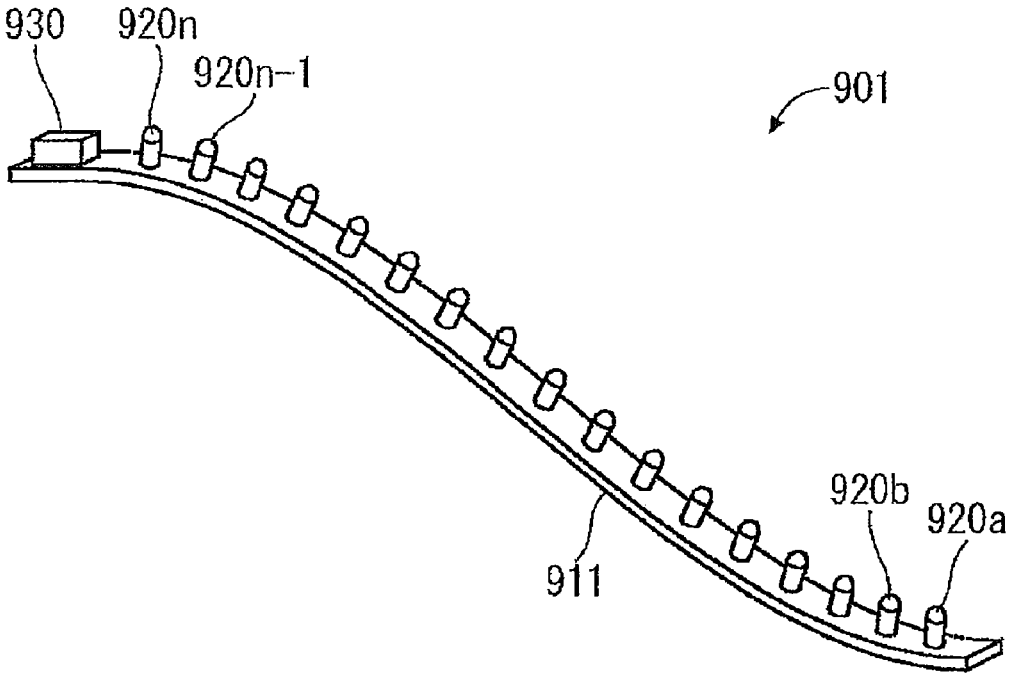
FIG. 37 is a perspective view illustrating a modified example 1 of a configuration of the medal movement simulation rendering unit of an embodiment of the present invention, illustrating an arrangement of LEDs.

(1-3-5-1) Modified Example 1 of Configuration of Medal Movement Simulation Rendering Unit First, a modified example 1 of a configuration of the medal movement simulation rendering unit 900 will be explained in detail with reference to the figures. FIG. 37 is a perspective view for illustrating a configuration of a medal movement simulation rendering unit 901 of the present modified example.

As illustrated in FIG. 37, compared to the medal movement simulation rendering unit 900 illustrated in FIG. 30, the medal movement simulation rendering unit 901 has a structure in which the support member 910 is replaced by a support member 911.

The support member 910 illustrated in FIG. 30 is made up of a linear elongated stick shaped member. On the other hand, the support member 911 of the present modified example is made up of a twisted elongated stick shaped member.

In the similar way to the support member 910, the support member 911 is, for instance, a stick shaped member that is made of steel and includes a hollow space in the interior thereof. Note that the cross-section of the support member 911 may be formed in a square shape, a rectangular shape, other polygonal shape, and a rounded shape such as a circular shape and an oval shape. In the present example, the support member 911 is configured to have a rectangular cross-section. In addition, in the present example, the above described plurality of LEDs 920 are configured to be arranged at predetermined intervals on any of the lateral surfaces of the support member 911. Note that the lateral surface on which the plurality of LEDs 920 are disposed is the surface that is disposed to be viewable for a game player when a game is played.

As described above, with a configuration that the LEDs 920 are disposed to be arranged on the support member 911 that is a twisted stick shaped member, a distorted light trajectory is traced by the consecutively lighting-up LEDs 920. Thus, it is possible to dynamically render the simulated movement of the medal.

Note that the other configurations and the other operations of the present example are almost the same as the above described embodiment. Therefore a detailed explanation thereof will be hereinafter omitted.

(1-3-5-2) Modified Example 2 of Configuration of Medal Movement Simulation Rendering Unit Next, the modified example 2 of a configuration of the medal movement simulation rendering unit 900 will be explained in detail with reference to the figures. FIG. 38(*a*) is a perspective view for illustrating a configuration of a medal movement simulation rendering unit 902 of the present modified example, and FIG. 38(*b*) is a diagram for illustrating arrangement of the LEDs 921*a*-921*n*, 922*a*-922*n*, 923*a*-923*n*, and 924*a*-924*n*, which are provided on the lateral surfaces 912-1 to 912-4 in FIG. 38(*a*), respectively. Note that as described above, an arbitrarily LED is explained as a LED 920.

As illustrated in FIG. 38(*a*), compared to the medal movement simulation rendering unit 900 illustrated in FIG. 30, the medal movement simulation rendering unit 902 is configured that the support member 910 is replaced by a support member 912 and the LEDs 920 are provided to be arranged on all the lateral surfaces of the support member 912. In other words, as illustrated in FIG. 38(*b*), the LEDs 921*a*-921*n* are provided to be arranged on the lateral surface 912-1, and the LEDs 922*a*-922*n* are provided to be arranged on the lateral surface 912-2, and the LEDs 923*a*-923*n* are provided to be arranged on the lateral surface 912-3, and the LEDs 924*a*-924*n* are provided to be arranged on the lateral surface 912-4. Note that the number of the LEDs 920 provided on each of the lateral surfaces 912-1 to 912-4 is the same.

In the similar way to the support member 910, the support member 912 is, for instance, a stick shaped member that is made of steel and includes a hollow space in the interior thereof. Note that the cross-section of the support member 912 may be formed in a square shape, a rectangular shape, and other polygonal shape. Also, the cross-section of the support member 912 may be formed in a rounded shape such as a circular shape and an oval shape. In this case, it is possible to produce a configuration that is equivalent to the present modified example by providing a plurality of lines of arranged LEDs 920 along the lateral surface.

Also, in the similar way to the above described embodiment, the LEDs 920, which are arranged on each of the lateral surfaces 912-1 to 912-4 of the support member 912, are consecutively lighted up and lighted out on each of the surfaces. In other words, when the medal is inserted into the medal shooting mechanism 100, the LED 921*a* disposed on the medal shooting mechanism 100 side of the lateral surface 912-1, the LED 922*a* disposed on the medal shooting mechanism 100 side of the lateral surface 912-2, the LED 923*a* disposed on the medal shooting mechanism 100 side of the lateral surface 912-3, and the LED 924*a* disposed on the medal shooting mechanism 100 side of the lateral surface 912-4 are simultaneously lighted up and lighted out, and the subsequent LEDs 920 are consecutively lighted up and lighted out toward the medal discharging part 330.

It is possible to realize the above operation by distributing the LED driving signals S920*a*-S920*n* of the above described embodiment to all of four corresponding LEDs (e.g., LEDs 921*a*, 922*a*, 923*a*, and 924*a*).

As described above, it is possible to increase the number of light trajectories traced by the consecutively lighting LEDs 920 by providing a plurality of lines of LEDs 920 arranged on the lateral surfaces of the support member 912. Thus, it is possible to render the simulated movement of the medal in a high-impact way.

Note that the other configurations and the other operations of the present example are almost the same as the above described embodiment. Therefore a detailed explanation thereof will be hereinafter omitted.

Figure 39:
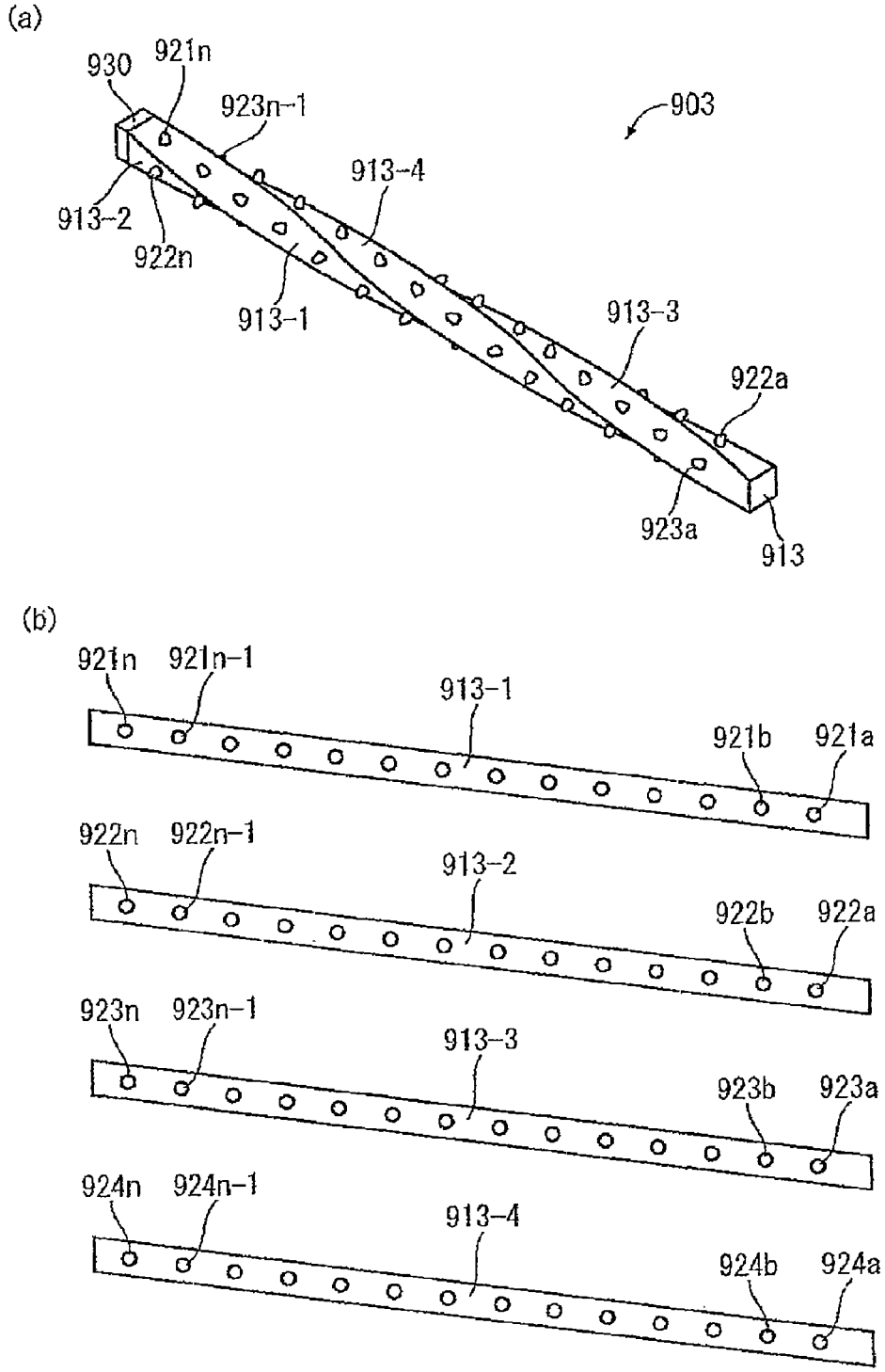
FIG. 39(*a*) is a perspective view illustrating a modified example 3 of a configuration of the medal movement simulation rendering unit of an embodiment of the present invention, and FIG. 39(*b*) is a diagram illustrating arrangement of LEDs disposed on each of the lateral surfaces in FIG. 39(*a*).

(1-3-5-3) Modified Example 3 of Configuration of Medal Movement Simulation Rendering Unit Next, a modified example 3 of a configuration of the medal movement simulation rendering unit 900 will be explained in detail with reference to the figures. FIG. 39(*a*) is a perspective view for illustrating a configuration of a medal movement simulation rendering unit 903 of the present modified example, and FIG. 39(*b*) is a diagram for illustrating arrangement of the LEDs 921*a*-921*n*, 922*a*-922*n*, 923*a*-923*n*, and 924*a*-924*n*, which are disposed on the lateral surfaces 913-1 to 913-4 in FIG. 39(*a*), respectively. Note that as described above, an arbitrary LED is explained as a LED 920.

As illustrated in FIG. 39(*a*), compared to the medal movement simulation rendering unit 900 illustrated in FIG. 2, the medal movement simulation rendering unit 903 is configured that the support member 910 is replaced by a support member 913 and the LEDs 920 are provided to be arranged on all the lateral surfaces of the support member 913. In other words, the support member 913 of the present modified example has a structure produced by twisting the support member 912 of the modified example 2. Accordingly, arrangement of the LEDs 920 disposed on each of the lateral surfaces 913-1 to 913-4 of the twisted support member 913 is also twisted along each of the lateral surfaces.

In the similar way to the support member 910, the support member 913 is, for instance, a stick shaped member that is made of steel and includes a hollow space in the interior thereof. Note that the cross-section of the support member 913 may be formed in a square shape, a rectangular shape, and other polygonal shape. Also, the cross-section of the support member 913 may be formed in a rounded shape such as a circular shape and an oval shape. In this case, it is possible to produce a configuration that is equivalent to the present modified example by providing a plurality of lines of arranged LEDs 920 along the lateral surfaces and by arranging each of the lines of arranged LEDs 920 in a spiral shape.

Also, in the similar way to the above described embodiment, the LEDs 920, which are arranged on each of the lateral surfaces 913-1 to 913-4 of the support member 913, are consecutively lighted up and lighted out on each of the surfaces. In other words, when the medal is inserted into the medal shooting mechanism 100, the LED 921*a* disposed on the medal shooting mechanism 100 side of the lateral surface 913-1, the LED 922*a* disposed on the medal shooting mechanism 100 side of the lateral surface 913-2, the LED 923*a* disposed on the medal shooting mechanism 100 side of the lateral surface 913-3, and the LED 924*a* disposed on the medal shooting mechanism 100 side of the lateral surface 913-4 are simultaneously lighted up and lighted out, and the subsequent LEDs 920 are consecutively lighted up and lighted out toward the medal discharging part 330.

It is possible to realize this type of operation by distributing the LED driving signals S920*a*-S920*n* of the above described embodiment to all of four corresponding LEDs (e.g., LEDs 921*a*, 922*a*, 923*a*, and 924*a*).

As described above, it is possible to increase the number of light trajectories traced by the consecutively lighting LEDs 920 by providing a plurality of lines of LEDs 920 arranged on the lateral surfaces of the support member 913. Accordingly, it is possible to render the simulated movement of the medal in a high-impact way. Furthermore, it is possible to further dynamically render the simulated movement of the medal by arranging the lines of the LEDs 920 in spirally crossing shape, for instance.

Note that the other configurations and the other operations of the present example are almost the same as the above described embodiment. Therefore, a detailed explanation thereof will be hereinafter omitted.

(1-3-6) Modified Example of Rendering of Simulated Medal Movement

Also, as described above, a configuration that the simulated medal movement is rendered with light is produced. However, the present invention is not limited to this, and in the similar way to the above described embodiment, it is possible to render the simulated medal movement only by providing a delay time (time-lag) from medal insertion to medal discharge. In this case, the first control unit 600 is configured to function as delay means for delaying a period of time, which is elapsed until the first control unit 600 causes the medal discharging part 330 of the lifting-up hopper 300 to discharge the medal M2 to the playing field 500 by driving the lighting-up hopper 300 after the medal M1 is inserted into the medal shooting mechanism 100 and the medal insertion detection signal S1 is generated, by a predetermined period of time.

As described above, it is possible to give a game player a sense that the medal moves from the medal slot 108-1 to the medal discharging part 330, for example, by discharging a medal from the medal discharging part 330 that is located in a separated position from the medal slot 108-1 after a predetermined period of time is elapsed. Accordingly, it is possible to render the simulated medal movement from the medal slot 108-1 to the medal discharging part 330, for example, when the medal M1 inserted into the medal slot 108-1 and the medal M2 to be discharged from the medal discharging part 330 are different from each other. As a result, a game player is not given a feeling that there is something wrong with the game regardless of whether the inserted medal M1 and the medal M2 to be discharged are the same when the medal is shot to the playing field 500. Here, it is possible to further effectively perform rendering of the simulated medal movement, for example, by producing changing sounds in a period of time that is elapsed from medal insertion to medal discharge by the medal discharging part 330. In this case, sounds may be produced continuously or intermittently. However, it is preferable that the sound pitch and/or the sound quality are/is gradually changed. With the configuration, a game player is given an impression that a situation changes, and thus it becomes easy to make the game player imagine the medal movement.

Also, in the present embodiment, it is possible to configure the first control unit 600, which is the delay means, to change and control the delay time.

It is possible to change rendering of medal movement and control the maximum number of medals that a single game player is allowed to consume per unit time, for instance, depending on a condition or a game status, by changing and controlling a predetermined period of time (delay time) that is elapsed from insertion of the medal M1 to discharge of the medal M2. In addition, when the simulated movement of the medal is further effectively performed, for example, by producing changing sounds in addition to the delay time, it is possible to change the moving speed of the medal to be rendered by controlling the playback speed (changing speed) of the sounds or the intervals at which the sounds are generated. As a result, it is possible to make a game player predict the time to be delayed. For example, when the delay time is prolonged, a game player is capable of predicting that the delay time is long by decreasing the playback speed of the sounds and by extending the intervals at which the sounds are produced. On the other hand, for example, when the delay time is shortened, a game player is capable of predicting that the delay time is short by increasing the playback speed of the sounds and by reducing the intervals at which the sounds are produced.

(1-4) Game Medium Discharge Mechanism

In the present game device, when an approximately disk shaped game medium is shot into the playing field 500, a game condition may be influenced by the position from which the game medium is shot. Therefore, it is possible to create a more appealing game property by making it possible to arbitrarily change the position from which a game player shoots the approximately disk shaped game medium.

Therefore, it is possible to configure the game medium discharge mechanism to include at least a discharge part that is configured to be allowed to rotate around a first shaft and includes a discharge guide for discharging a game medium, and a rotation control part for rotating the discharge part around the first shaft. With the configuration, it will be possible to positively influence a game condition by the game player's arbitrarily change of the position from which the approximately disk shaped game medium is shot.

It is further possible to configure the rotation control part to include at least an operating part that is configured to be allowed to rotate around a second shaft separated from the first shaft, and a transmission part for mechanically coupling the discharge part and the operating part and for mechanically transmitting rotation of the operating part to rotation of the discharge part. Rotational movement of the operating part is mechanically transmitted to rotational movement of the discharge part by mechanically transmitting a game player's operation for the operating part to the discharge part through the transmission part. This enables a game player to feel that the game player actually regulates the rotational movement of the discharge part for himself/herself. It is also possible to create a more appealing game property for a game player.

It is possible to configure the transmission part to include at least a first wire for mechanically coupling the discharge part and the operating part in order to transmit rotation of the operating part around the second shaft in a first rotational direction to rotation of the discharge part around the first shaft in the first rotational direction.

Moreover, it is possible to configure the transmission part to further include a second wire for mechanically coupling the discharge part and the operating part in order to transmit rotation of the operating part around the second shaft in a second rotational direction to rotation of the discharge part around the first shaft in the second rotational direction.

In other words, the wire is flexible and therefore it does not necessarily mechanically couples the discharge part and the operating part in a linear manner. For example, it is possible to mechanically couple the discharge part and the operating part in a non-linear manner by providing a non-linear shaped tube with stiffness and by inserting the wire in the interior of the tube.

The rotation control part is capable of controlling the discharge part so that a direction of the discharge part is fixed while external force is not applied to the operating part. For example, it is possible to configure a support part 412 for supporting a discharge part 410 not to receive any other forces excluding the force that is generated by an operating part 450 and is transmitted through a first wire structure 418 and a second wire structure 420. It is also possible to configure the support part 412 not to receive the force to bias it for making it maintain a specific rotational angle. The discharge part is configured not to receive any external forces excluding the force that is generated when a game player operates the operating part (i.e., when the operating part receives the external force from a game player) and is transmitted through the transmission part. In addition, an operating part main body 422 of the operating part 450 does not receive the force to bias it for making it maintain a specific rotational force. Therefore, even when a game player decides a direction of the discharge part by operating the operating part 450 and then releases the operating part, the discharge part 410 maintains its direction at the time.

In other words, the discharge part and the operating part do not receive the force to bias it for making it maintain a specific rotational angle. With the configuration, when the external force for rotating the operating part around the second shaft is received from a game player, the external force is transmitted to the discharge part through the transmission part. Accordingly, the discharge part rotates around the first shaft and thus its direction is changed. However, while the external force for rotating the operating part around the second shaft is not received from a game player, the discharge part does not receive the force for rotating around the second shaft. Accordingly, it is possible to fix the direction of the discharge part. With the configuration, a game player is allowed to operate the operating part only when he/she intends to change or regulate the direction of the discharge part. On the other hand, when a game player does not intend to do so, he/she is allowed to concentrate on shooting the game medium through the above described game medium shooting mechanism or performing other game operations.

Figure 40:
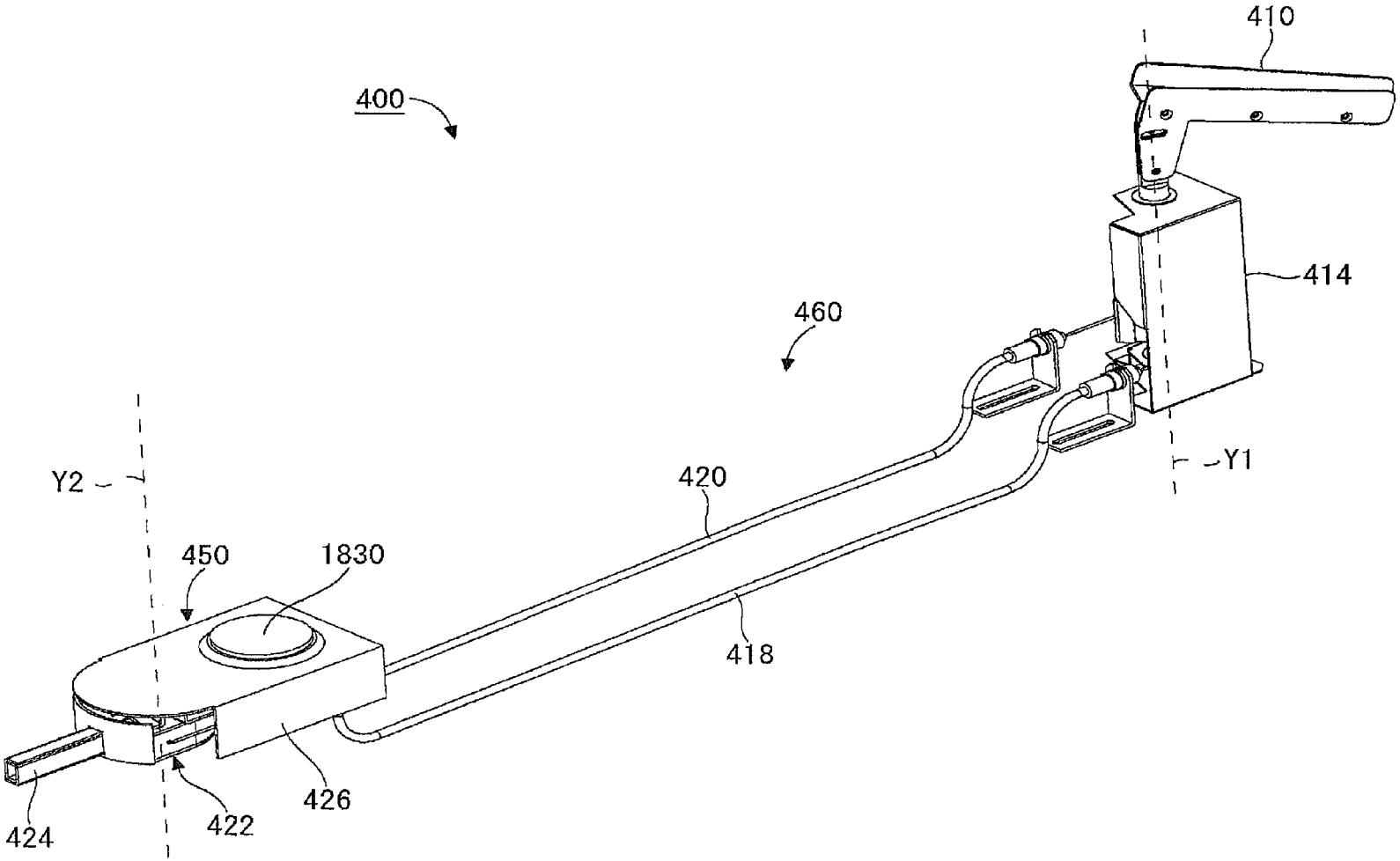
FIG. 40 is a perspective view illustrating the entire configuration of a game medium discharge mechanism of an embodiment of the present invention.
Figure 41:
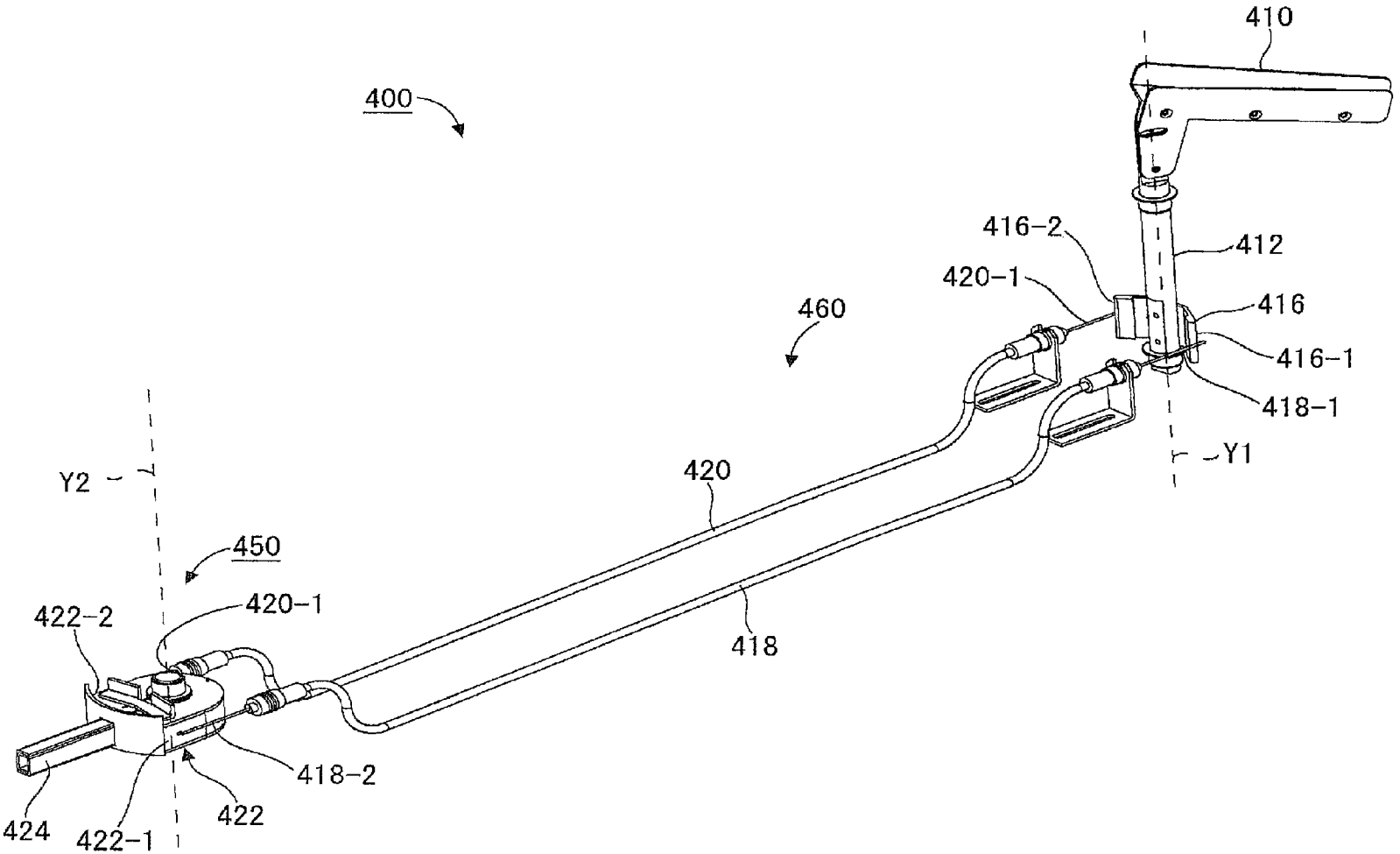
FIG. 41 is a partial exploded perspective view illustrating an internal configuration of the game medium discharge mechanism illustrated in FIG. 40.

Next, a configuration of a medal discharge path 400 in the above described game device 1 will be explained in detail with reference to the figures. FIG. 40 is a perspective view of illustrating the entire configuration of the medal discharge path 400. FIG. 41 is a partial exploded perspective view of illustrating the internal configuration of the medal discharge path 400 illustrated in FIG. 40.

The medal discharge path 400 includes the discharge part 410 having a guide portion along which the medal M rotationally moves, the support body 412 that is configured to support the discharge part 410 and is configured to be allowed to rotate around a first vertical axis Y1, and an attachment plate 416 firmly fixed to the support body 412. The support body 412 is formed to extend in the vertical direction. When the rotational force around the first vertical axis Y1 is applied to the attachment plate 416, the force is transmitted to the support body 412 to which the attachment plate 416 is firmly fixed, and the support body 412 and the discharge part 410 supported by the support body 412 rotate around the first vertical axis Y1.

Furthermore, the medal discharge path 400 includes the operating part 450 that is configured to be allowed to rotate around a second vertical axis Y2 that is separated away from the first vertical axis Y1. It is possible to configure the operating part 450 to include at least the operating part main body 422, which is configured to be allowed to rotate around the second vertical axis Y2, and a handle 424, which is firmly fixed to the operating part main body 422 and is gripped by a game player. It is configured that a game player is allowed to rotate the operating part main body 422 around the second vertical axis Y2 by gripping the handle 424.

Furthermore, the medal discharge path 400 includes a transmission part 460 for mechanically transmitting rotational movement of the operating part 450 to rotational movement of the discharge part 410. It is possible to realize the transmission part 460 with use of the first and second wire structures. The first wire structure 418 is made up of a flexible first wire and a first tube for containing the first wire. The second wire structure 420 is made up of a flexible second wire and a second tube for containing the second wire. The first and second tubes have appropriate stiffness so as to be capable of maintaining their own shape while they are flexible in a curving direction. With the configuration, even when another structure is interposed between the operating part 450 and the discharge part 410, it is possible to mechanically couple the operating part 450 and the discharge part 410 by circumventing the structure and fixing the tubes to a chassis frame of the game device or the like. The first edge portion 418-1 of the first wire is firmly fixed to a first edge portion 416-1 of the attachment plate 416. A second edge portion 418-2 of the first wire is firmly fixed to a first lateral portion 422-1 of the operating part main body 422. A first edge portion 420-1 of the second wire is firmly fixed to a second edge portion 416-2 of the attachment plate 416. A second edge portion 420-2 of the second wire is firmly fixed to a second lateral portion 422-2 of the operating part main body 422.

As illustrated in FIG. 40, a first cover member 414 for covering the attachment plate 416 and the support body 412 may be provided as needed. Also, a second cover member 426 for covering the operating part main body 422 may be provided. It is possible to provide a push button 1830 (to be described) in the cover member 426. The push button 1830 is not included in the present medal discharge path 400. Therefore, its explanation will be hereinafter omitted.

A game player rotates the handle 424, that is, the operating part main body 422 around the second vertical axis Y2. When the rotational direction is the clockwise direction when it is seen from the above of the operating part main body 422, the first wire of the first wire structure 418 is displaced in the interior of the first tube toward the operating part main body 422. On the other hand, the second wire of the second wire structure 420 is displaced in the interior of the second tube toward the attachment plate 416. As a result, the attachment plate 416, the support body 412, and the discharge part 410 rotate around the first vertical axis Y1 in the clockwise direction when it is seen from the above.

On the other hand, when the rotational direction is the counter-clockwise direction when it is seen from the above of the operating part main body 422, the second wire of the second wire structure 420 is displaced in the interior of the second tube toward the operating part main body 422. On the other hand, the first wire of the first wire structure 418 is displaced in the interior of the first tube toward the attachment plate 416. As a result, the attachment plate 416, the support body 412, and the discharge part 410 rotate around the first vertical axis Y1 in the counter-clockwise direction when it is seen from the above.

Therefore, the above described medal discharge path 400 makes it possible for a game player to arbitrarily change the position from which the approximately disk shaped game medium is shot.

According to the medal discharge path 400, the discharge part 410 disposed on the rear side of the game device 1 and the operating part 450 disposed on the front side of the game device 1 are disposed to be capable of rotating around the first vertical axis Y1, and the operating part 450 is disposed to be capable of rotating around the second vertical axis Y2. Also, the discharge part 410 and the operating part 450 are connected through the first wire structure 418 and the second wire structure 420. With the configuration, it is possible to mechanically transmit rotation of the operating part 450 around the second vertical axis Y2 to rotation of the discharge part 410 around the first vertical axis Y1 through the first wire structure 418 and the second wire structure 420. As a result, a game player is allowed to be arbitrarily change the position from which the approximately disk shaped game medium is shot, and thus it is possible to create a more appealing game property.

Also, a game player is allowed to regulate the direction of the discharge part 410 by operating the operating part 450. Therefore, this enables a game player to feel that he/she actually regulates the rotational movement of the discharge part 410 for himself/herself, and thus it is possible to create a more appealing game property for a game player.

Also, the discharge part 410 and the operating part 450 are coupled through the first wire structure 418 and the second wire structure 420. Here, the wire of the first wire structure 418 and the wire of the second wire structure 420 are flexibly formed: Therefore, it is not necessary to mechanically couple the discharge part 410 and the operating part 450 in a linear manner. For example, when a tube(s) is/are fixed in a non-linear shape and a wire is inserted in the interior of the tube, it is possible to mechanically couple the discharge part 410 and the operating part 450 in a non-linear manner.

Also, the support part 412 for supporting the discharge part 410 does not receive any other external forces excluding the force that is generated by the operating part 450 and is transmitted through the first wire structure 418 and the second wire structure 420, and the support part 412 does not receive the force for biasing it so as to make it maintain a specific rotational angle. Also, the operating part main body 422 of the operating part 450 does not receive the force for biasing it so as to make it maintain a specific rotational angle. Therefore, even when a game player decides the direction of the discharge part 410 by operating the operating part 450 and releases the operating part 450, the discharge part 410 maintains its direction at the time. With the configuration, a game player is allowed to operate the operating part 450 only when he/she intends to change or regulate the direction of the discharge part 410. On the other hand, if a game player does not intend to do so, he/she is allowed to concentrate on shooting of the game medium through the above described game medium shooting mechanism or performing other game operations.

(1-5) Playing Field

Next, a configuration of the playing field 500 of the above described game device 1 will be explained in detail with reference to the figures. FIG. 4 is a partial perspective view extracting configurations of the playing field 500 and its peripheral part. In addition, FIG. 5 is a diagram for illustrating reciprocation of the pusher part 510 in the playing field 500.

As illustrated above, the playing field 500 is made up of the main table (predetermined table) 501 and the pusher part (pusher means) 510 that is disposed on the main table 501 so as to be capable of sliding.

Figure 5:
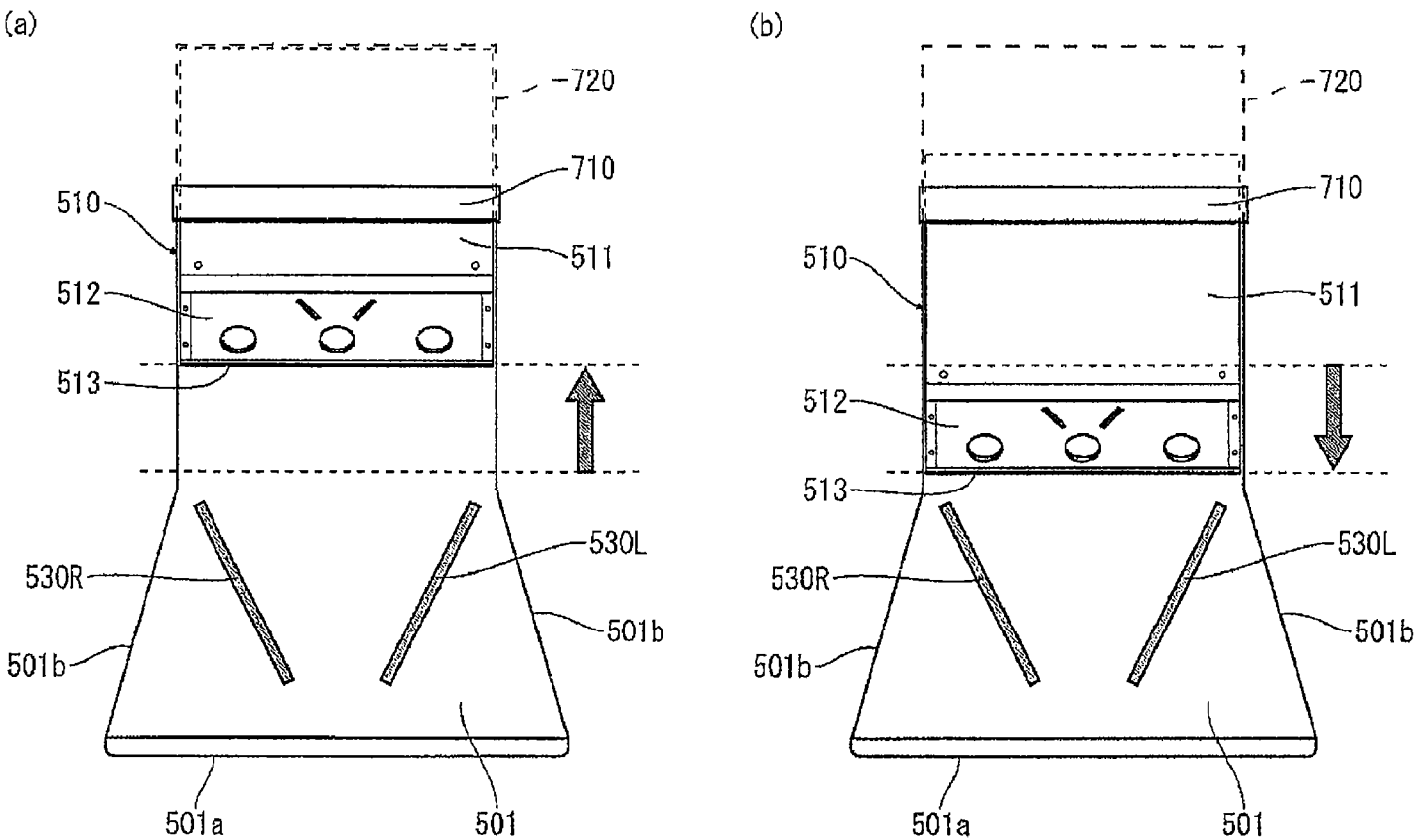
FIG. 5 is a diagram for illustrating reciprocation of a pusher part 510 on the playing field 500 illustrated in FIG. 4.

As illustrated in FIGS. 4 and 5, the pusher part 510 slides back and forth on the main table 501 so as to move in/out the housing part 720 disposed below the display 701 of the display unit 700. Note that FIG. 5(*a*) is a top view of the pusher part 510 that is retracted to the interior of the housing part 720 to the maximum extent, and FIG. 5(*b*) is a top view of the pusher part 510 that is protruded from the housing part 720 to the maximum extent.

As described above, the framework member 710 of the display unit 700 herein is abutted on the sub-table 511, which is the upper surface of the pusher part 510. Therefore, when the pusher part 510 moves in a direction that it moves in the housing part 720 (see (b)→(a) in FIG. 5), the medal(s) accumulated on the sub-table 511 that is the upper surface of the pusher part 510 is pushed on the sub-table 511 in a direction of the sloped table 512 by the framework member 710, and the medal(s) M on the sub-table 511 flow(s) in a direction that it/they head(s) to the sloped table 512 as a whole. As a result, a part of the medal(s) M on the sub-table 511, which exist(s) in the vicinity of the sloped table 512, drop(s) on the sloped table 512. Note that a part of the dropped medal(s) M enter(s) any of the award-winning apertures 515-1 to 515-3, which are formed in the sloped table 512, and the rest of the dropped medal(s) M drop(s) on the main table 501.

Also, drop prevention walls 521 are provided on the both sides of an area within which the pusher part 510 slides, and the medal(s) M is/are prevented from dropping from the both sides of the sub-table 511. Also, the pusher part 510 is disposed on the main table 501 without any gap. Note that the expression "without any gap" herein means that a gap greater than or equal to the width of the medal M does not exist. Therefore, when the pusher part 510 moves in a direction that it moves out of the housing part 720 (see a state of (a)→a state of (b) in FIG. 5), the medal(s) M accumulated on the main table 501 is/are pushed on the main table 501 in a direction of the front end 501*a* by the pushing wall 513 that makes up the front surface of the pusher part 510, and the medal(s) M on the main table 501, as a whole, flow(s) in a direction that it/they head to the front end 501*a*. As a result, a part of the medal(s) M on the main table 501, which exist(s) in the vicinity of the front end 501*a* drop(s) from the front end 501*a*. Also, a part of the medal(s) M on the main table 501, which exist(s) in the vicinity of the both side ends (side ends 501*b*) of the main table 501, drop(s) from the side ends 501*b* by the flow of the medal(s) M generated here. Note that the medal(s) M dropped form the side ends 501*b* is/are accumulated in a predetermined accumulating part (may be hopper) in the interior of the station ST.

Also, as illustrated in FIG. 4, the medal(s) M dropped from the front end 501*a* is/are received by a medal receiver 1001 that is provided below the front end 501*a*. The medal receiver 1001 is connected to a medal transporting path 1002 for transporting the medal M to the lifting-up hopper 1020 in the medal paying-out mechanism. In addition, the medal receiver 1001 is sloped toward a coupling part between the medal receiver 1001 and the medal transporting path 1002. Because of this, the medal(s) M received by the medal receiver 1001 flow(s) into the medal transporting path 1002. Also, the medal transporting path 1002 is sloped toward an accumulating part 1021 of the lifting-up hopper 1020 in the medal paying-out mechanism. Because of this, the medal(s) M flowed into the medal transporting path 1002 is/are continuously guided to the medal paying-out mechanism. Note that a separation bar 1010 (to be described) for stemming the ball B1 or the ball B2 is provided in the coupling part between the medal receiver 1001 and the medal transporting path 1002, and is configured to preventing the ball B1/B2 from entering the medal paying-out mechanism.

The medal paying-out mechanism is also provided with a medal counter (not illustrated in the figure) for counting the number of the medal M in addition to the above described lifting-up hopper 1020 and the medal paying-out part 1030. For example, the medal counter is provided at the entrance of the accumulating part 1021 in the lifting-up hopper 1020, and counts the number of the medal M to be released from the medal transporting path 1002 to the accumulating part 1021. The first control unit 600 illustrated in FIG. 2 is informed of the number of the medal M counted by the medal counter. The first control unit 600 pushes the medal(s) M, the number of which is the same as the number of the medal informed to the first control unit 600, from the medal paying-out part 1030 to the accumulating part 101 of the medal shooting mechanism 100 by driving the lifting-up hopper 1020 based on the number of the medal informed to the first control unit 600. Note that the lifting-up hopper 1020 includes a hopper driving part 1022 and a lifting-up part 1023, and the medal(s) M to be paid out is/are paid out from the medal paying-out part 1030 that is provided on the end of the lifting-up part 1023 when the hopper driving part 1022 performs an operation based on the control by the first control unit 600. Note that the medal receiver 1001, the medal transporting path 1002, and the medal paying-out mechanism including the lifting-up hopper 1020, the medal paying-out part 1030, and the medal counter, function as paying-out means for paying out the medal(s) M fallen from the front end 501*a* of the main table 501 to a game player.

Also, the ball B1 and/or the ball B2 supplied from the satellite SA also exist(s) on the main table 501. The ball B1 or the ball B2 moves on the main table 501 in accordance with the flow of the medal(s) M, which is generated by reciprocation of the pusher part 510, and then drop(s) from the front end 501*a*. As described above, the ball transporting path 1040 is provided below the front end 501*a*. The ball transporting path 1040 includes the ball receiver 1041 for receiving only the fallen ball B1 or the fallen ball B2 and for passing the medal M, a ball stopper 1042 for halting the movement of the ball received by the ball receiver 1041 until a predetermined condition is satisfied, and the ball outlet 1043. Therefore, the ball B1 or the ball B2 received by the ball receiver 1041 is discharged from the ball outlet 1043 after its movement is halted by the ball stopper 1042 until a predetermined timing comes. Accordingly, the ball B1 or the ball B2 is set in the ball transporting part 1910 (see FIG. 1) that stands by at the ball outlet 1043. Note that the station ST illustrated in FIG. 1 and the station ST illustrated in FIG. 4 or FIG. 5 are illustrated to be horizontally reversed for convenience of explanation, but their configurations are almost the same as each other.

(1-6) Guide Part and Guide Part Moving Mechanism

Note that as illustrated in FIG. 4, the main table 501 is provided with the guide parts (first and second flow control means) 530R and 530L for controlling the flow of the medal M, the ball B1, and the ball B2. In addition, guide part moving mechanism (moving means) 540 (see FIG. 8) for moving up and down the guide parts 530R and 530L with respect to the main table 501 is provided below the main table 501. Configurations of the guides 530R and 530L and the guide part moving mechanism 540 will be hereinafter explained in detail with reference to the figures.

(1-6-1) Guide Part

Figure 6:
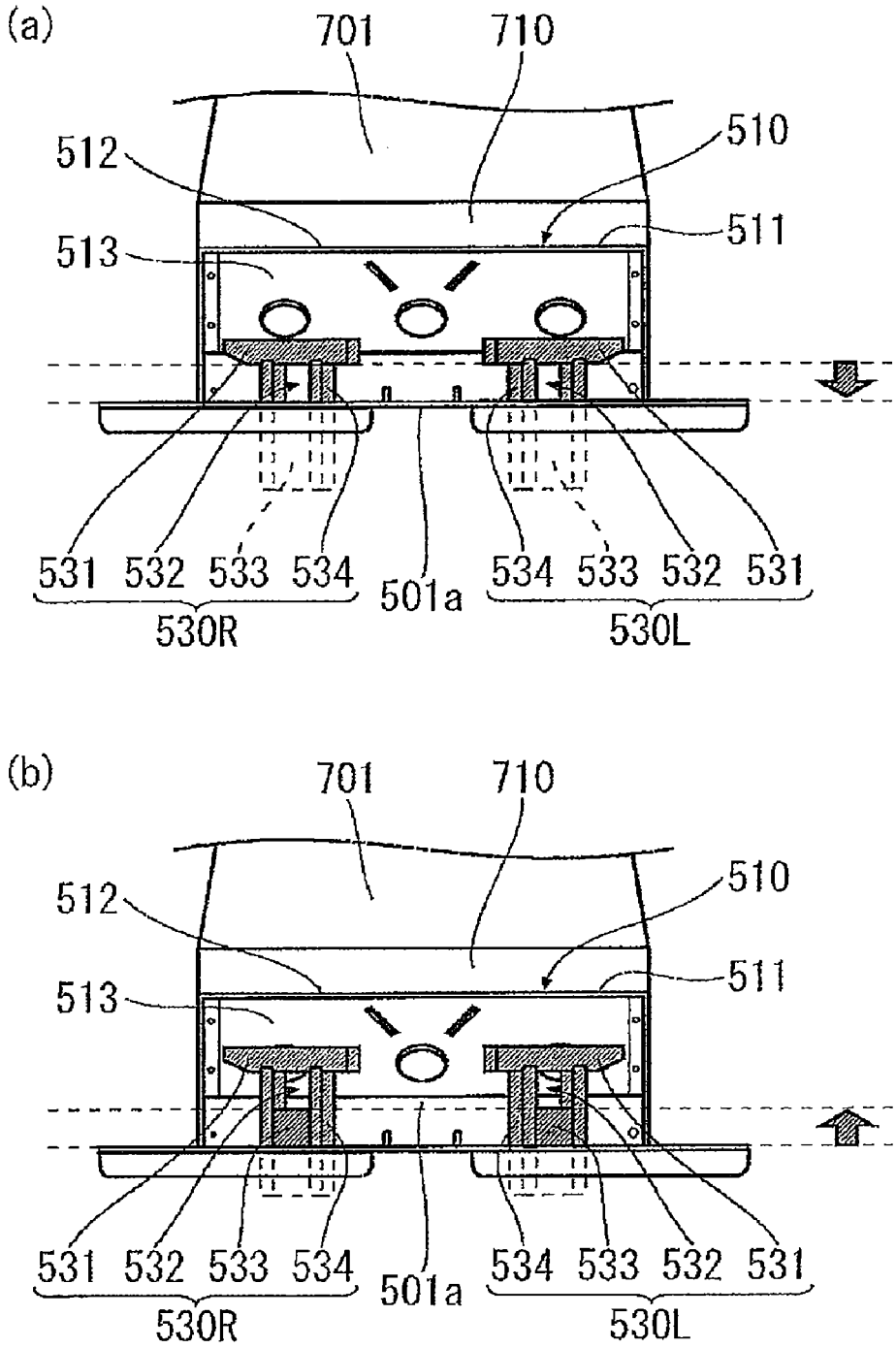
FIG. 6 is a front view of the playing field 500 of an embodiment of the present invention, which is seen from the front side (game player's side).

First, configurations of the guide parts 530R and 530L of the present embodiment will be explained in detail with reference to the figures. FIG. 6 is a front view of the playing field 500 that is seen from the front side (i.e., game player's side). Note that in FIG. 6, FIG. 6(*a*) is a diagram for illustrating the guide parts 530R and 530L that are retracted in a lowest predetermined position, and FIG. 6(*b*) is a diagram for illustrating the guide parts 530R and 530L that are protruded in a highest predetermined position. In addition, FIG. 7 is a diagram for illustrating the flow of the medal M and the ball B1/B2 on the main table 501. Note that in FIG. 7, FIG. 7(*a*) is a top view for illustrating the flow of the medal M and the ball B1/B2 when the guide parts 530R and 530L are retracted in the lowest predetermined position (see FIG. 6(*a*)), and FIG. 7(*b*) is a top view for illustrating the flow of the medal M and the ball B1/B2 when the guide parts 530R and 530L are protruded in the highest predetermined position (see FIG. 6(*b*)).

As illustrated in FIGS. 4-7, each of the guide parts 530R and 530L includes a ball guide plate 531 (second guide plate) for controlling the flow of the ball B1 and the ball B2, a medal guide plate (first guide plate) 533 for controlling the flow of the medal M, and a support portion 534 for supporting the ball guide plate (second guide plate) 531 and the medal guide plate 533. In addition, the ball guide plate 531 and the medal guide plate 533 are supported in upper and lower positions by the support portion 534 so that a through-hole 532 with a predetermined shape is formed between the ball guide plate 531 and the medal guide plate 533.

The guide parts 530R and 530L with the above configurations are provided to be arranged in a V shape, for instance. Note that arrangement of the guide parts 530R and 530L is not limited to this, and the guide parts 530R and 530L may be arranged in any shape as long as width of a gap formed between ends of the guide parts 530R and 530L on a game player's side is at least greater than the diameter of the medal M, the ball B1 and the ball B2. Therefore, the guide part 530R and the guide part 530L may be arranged in parallel to each other, for instance.

Also, the rear end of the guide part 530R (i.e., opposite end from the game player's side) is disposed to be adjacent to the side end 501*b* of the main table 501 on the right side of the figure through a gap less than the radius of the ball B1 and the radius of the ball B2. In a similar way to this, for example, the rear end of the guide part 530L is disposed to be adjacent to the side end 501*b* of the main table 501 on the left side of the figure through a gap less than the radius of the ball B1 and the radius of the ball B2. Accordingly, it is possible to prevent the ball B1 or the ball B2 flowing from the rear side of the main table 501 from entering an area excluding the area located between the guide parts 530R and 530L, and it is possible to produce a configuration of preventing the ball B1 or the ball B2 from dropping from the side ends 501*b* of the main table 501. In other words, it is possible to set the front end 501*a* as the only side from which the ball B1 and the ball B2 drop.

Also, the guide parts 530R and 530L are provided to be capable of moving up and down with respect to the upper surface of the main table 501. Note that the guide part moving mechanism 540, which is an element for moving up and down the guide parts 530R and 530L with respect to the upper surface of the main table 501, will be explained in the following paragraphs.

As illustrated in FIG. 6(*a*), when the guide parts 530R and 530L are moved in the lowest position, the upper ends of the medal guide plates 533 of the guide parts 530R and 530L are positioned in a height position equal to or less than that of the upper surface of the main table 501. In other words, when the guide parts 530R and 530L are moved in the lowest position, the medal guide plate 533 is accommodated below the main table 501. Note that even in this case, the entire through-hole 532 formed between the medal guide plate 533 and the ball guide plate 531 is not blocked by the main table 501.

Under the condition that the medal guide plate 533 is thus retracted below the main table 501, the flow of the medal M on the main table 501 is not blocked by the medal guide plate 533. Therefore, as illustrated in FIG. 7(*a*), the medal M is allowed to pass through the through-hole 532 and flow in an arbitrary direction. In other words, the medal M is allowed to flow to the side ends 501*b* side of the main table 501. As a result, the number of the medal M fallen from the side ends 501*b* is more than that in a case that the guide parts 530R and 530L are moved in the highest position, for instance. Note that the blockage of the flow of the medal M by the support portion 534 is ignored for convenience of explanation.

Also, as illustrated in FIG. 7(*a*), when the guide parts 530R and 530L are moved in the lowest position, the flow of the ball B1 or the ball B2 is restricted by the ball guide plate 531 because the ball guide plate 531 is protruded above the main table 501. In other words, the ball B1 and the ball B2 are guided in the direction of the front end 501*a* so as not to drop from the side ends 501*b* of the main table 501.

On the other hand, as illustrated in FIG. 6(*b*), when the guide parts 530R and 530L are moved in the highest position, the upper ends of the medal guide plates 533 of the guide parts 530R and 530L are protruded from the upper surface of the main table 501

Under the condition, the flow of the medal(s) M on the main table 501 is blocked by the medal guide plate 533. Therefore, as illustrated in FIG. 7(*b*), the direction in which the medal M flows is restricted to the direction toward the front end 501*a*. As a result, it is possible to reduce the number of the medal M fallen from the side ends 501*b* compared to a case that the guide parts 530R and 530L are moved in the lowest position, for instance. Note that the blockage of the flow of the medal M by the support portion 534 is ignored for convenience of explanation.

Also, as illustrated in FIG. 7(*b*), even when the guide parts 530R and 530L are moved in the highest position, the flow of the ball B1 or the ball B2 is restricted by the ball guide plate 531 because the ball guide plate 531 is protruded above the main table 501. In other words, the ball B1 and the ball B2 are guided in the direction of the front end 501*a* so as not to drop from the side ends 501*b* of the main table 501.

As described above, in the present embodiment, it is possible to set the direction in which the medal(s) M flow(s) to be relatively free while the flow of the ball B1 is restricted to the direction of the front end 501*a* by moving the guide parts 530R and 530L to the lowest position, in other words, by accommodating the medal guide plates 533 of the guide parts 530R and 530L below the main table 501. Consequently, it is possible to increase ratio of the medal(s) M fallen from the side ends 501*b* in the medal(s) M fallen from the main table 501. On the other hand, it is possible to restrict the flow of the medal(s) M together with the flow of the ball B1 to the direction of the front end 501*a* by moving the guide parts 530R and 530L to the highest position, in other words, by protruding the medal guide plates 533 of the guide parts 530R and 530L above the main table 501. As a result, it is possible to concentrate the flow of the medal(s) M to the direction of the front end 501*a*, and it is possible to cause a lot of medals M to drop from the front end 501*a*. Furthermore, it is possible to reduce ratio of the medal(s) M fallen from the side ends 501*b*.

Based on the above, in the present embodiment, it is possible to control ratio of the medal(s) M to be paid out to a game player and the medal(s) M to be recovered by the station ST (this situation is referred to as "dropping on the dealer's side"), which is referred to as "paid-out ratio," by controlling the position of the guide parts 530R and 530L with respect to the main table 501. Also, in the present embodiment, it is possible to restrict an end, from which the other game medium (here, the ball B1 and the ball B2) to be used when a game is progressed drop, to be the front end 501*a* without depending on the positions of the guide parts 530R and 530L with respect to the main table 501. Therefore, it is also possible to prevent an element for recovering this from being formed in a large size and from being complicated.

(1-6-2) Guide Part Moving Mechanism

Figure 8:
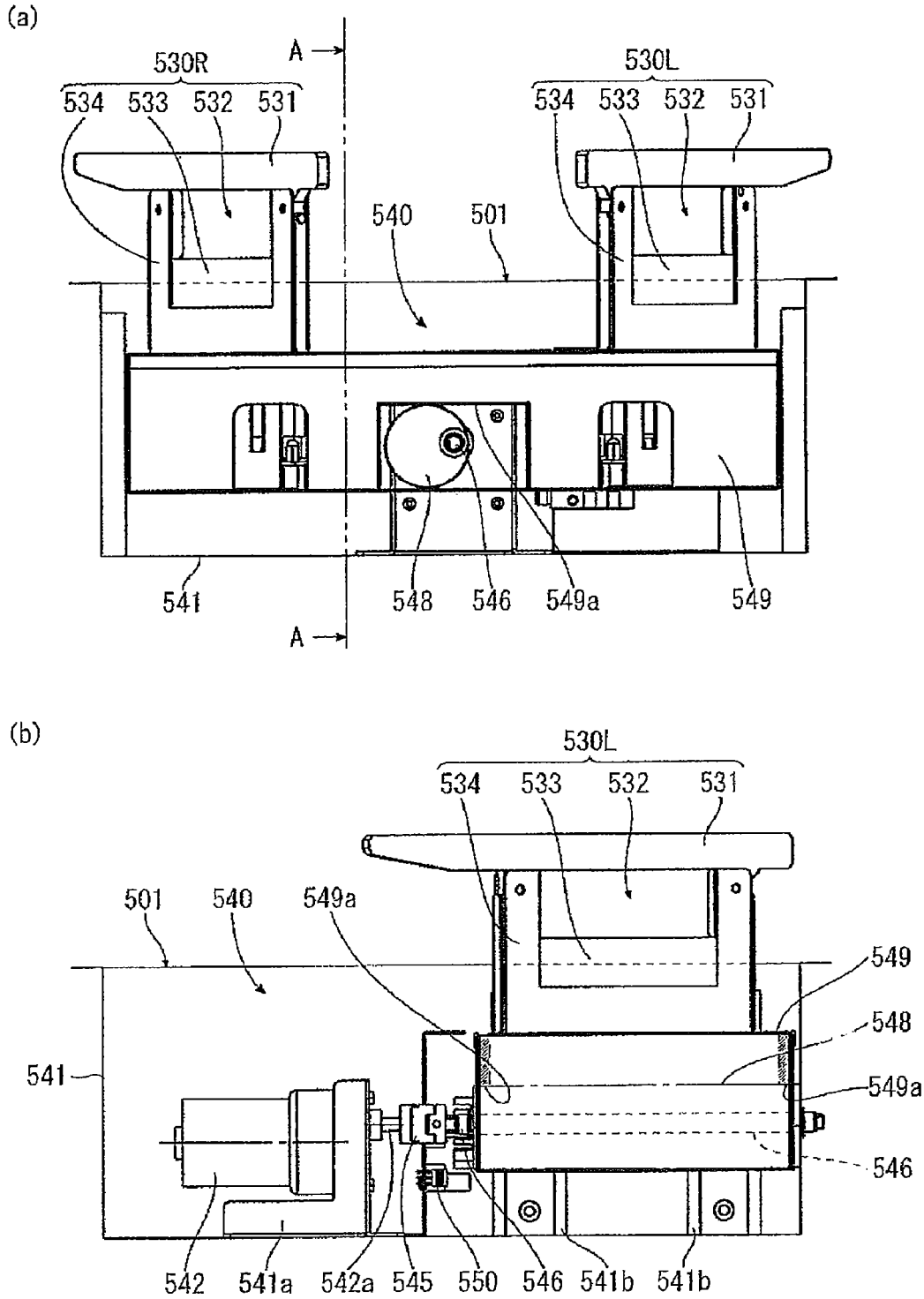
FIG. 8 is a diagram illustrating a configuration of a guide part moving mechanism 540 of an embodiment of the present invention.

Next, a configuration of the guide part moving mechanism 540, which is an element for moving up and down the above described guide parts 530R and 530L with respect to the main table 501, will be explained in detail with reference to the figures. FIG. 8 is a diagram for illustrating a configuration of the guide part moving mechanism 540. Note that FIG. 8 also illustrates configurations of the guide parts 530R and 530L. Also, in FIG. 8, FIG. 8(*a*) is a front view and FIG. 8(*b*) is a cross-sectional view in line A-A of FIG. 8(*a*).

As illustrated in FIGS. 8(*a*) and 8(*b*), the guide part moving mechanism 540 includes a container 541, a motor 542, a coupling part 545, a rotary shaft part 546, an eccentric cam 548, and a sliding base 549.

In the above elements, the container 541 is a box shaped container for accommodating the main elements of the guide part moving mechanism 540. For example, the container 541 is embedded immediately below the main table 501. In addition, a motor fixing part 541*a* (to be described) for fixing the motor 542, and a guide rail 541*b* for supporting the sliding base 549 (to be described) so that the sliding base 549 is capable of sliding in the vertical direction, are formed on the inner lateral surface of the container 541. Note that the term "vertical direction" means a vertical direction to be defined under the condition that the main table 501 is defined to be horizontally positioned.

The sliding base 549 is a base to which the support portions 534 of the guide parts 530R and 530L are fixed. Therefore, when the sliding base 549 slides up and down in the vertical direction so as to be along the guide rail 541*b*, the amount of portions of the guide parts 530R and 530L protruded from the main table 501 is increased/decreased.

The motor 542, the coupling part 545, the rotary shaft part 546, and the eccentric cam 548 make up driving means for sliding the sliding base 549 along the guide rail 541*b*.

For example, in the driving means, the motor 542 generates rotation based on the control by the first control unit 600 (see FIG. 2). The rotary shaft part 546 is coupled to the rotary shaft 542*a* of the motor 542 through the coupling part 545. Therefore, rotation generated in the motor 542 is transmitted to the rotary shaft part 546 through the coupling part 545. Note that the coupling part 545 is a member for directly transmitting rotation generated in the motor 542 to the rotary shaft part 546, and is also a member for absorbing mechanical stress between the rotary shaft 542*a* of the motor 542 and the rotary shaft part 546. It is possible to form the coupling part 545 by an elastic body such as rubber.

The eccentric cam 548 is fixed to the rotary shaft part 546 to which rotation of the motor 542 is transmitted. The eccentric cam 548 is formed in a columnar shape, for instance, and is fixed to the rotary shaft part 546 while the rotary shaft part 546 is inserted into and engaged with the eccentric cam 548 in a position, which is not the center, on the top/bottom surfaces of the eccentric cam 548. Note that "the top/bottom surfaces of the eccentric cam 548" indicate circular-shaped surfaces, respectively, when the eccentric cam 548 is formed in a cylindrical shaped, for instance.

In addition, a lateral surface of the eccentric cam 548 is abutted on a part of the sliding base 549 so as to be capable of sliding. For example, in an example illustrated in FIG. 8, an opening 549*a* is provided in the lateral wall of the sliding base 549, and the brim of the opening 549*a* is abutted on the lateral surface of the eccentric cam 548. Therefore, as is clear from FIGS. 8(*a*) and 8(*b*), when the eccentric cam 548 rotates around the rotary shaft part 546, the sliding base 549 abutted on the lateral surface of the eccentric cam 548 slides up and down along the guide rail 541*b*. Accordingly, the amount of the portions of the guide parts 530R and 530L protruded from the main table 501 is increased/decreased.

Figure 9:
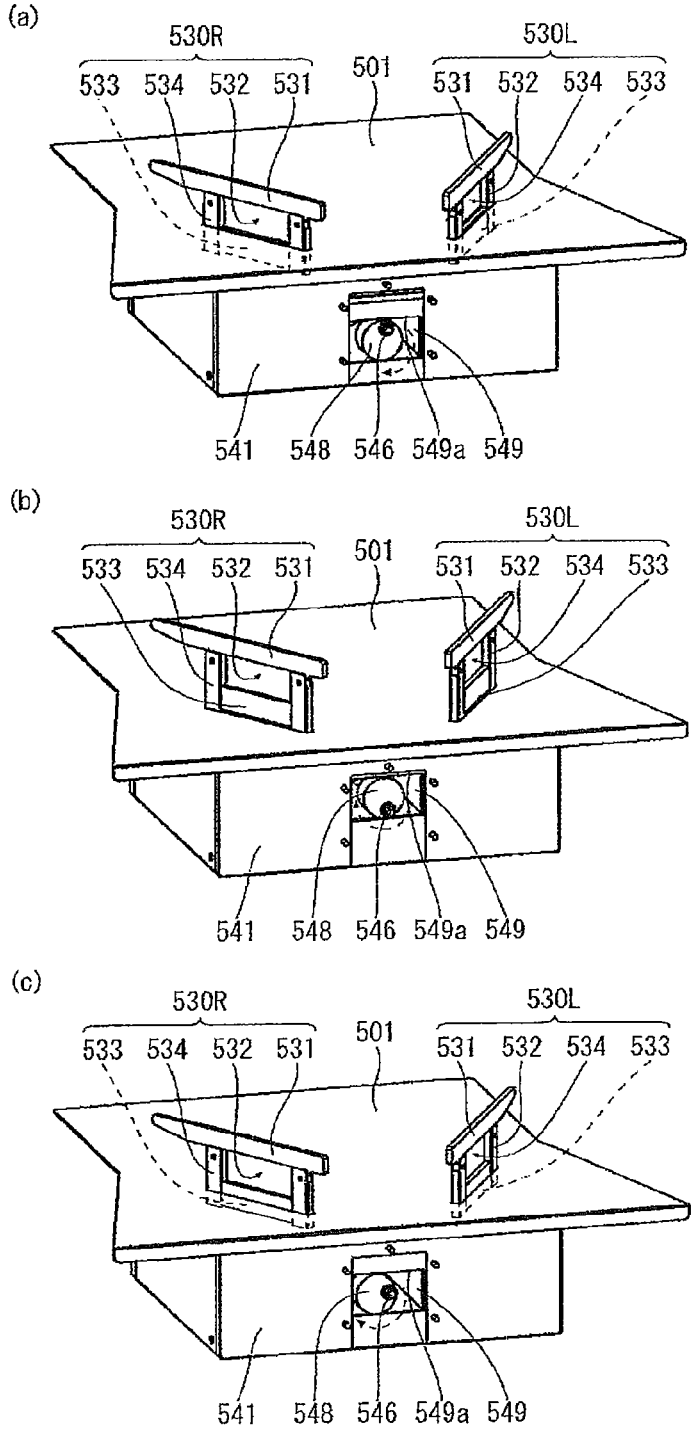
FIG. 9 is a diagram for illustrating protruding/retracting movement of guide parts 530L and 530R of an embodiment of the present invention.

For example, as illustrated in FIG. 9(*a*), when a part of the lateral surface of the eccentric cam 548, which is located closest to the rotary shaft part 546, is abutted on the upper brim of the opening 549*a*, the guide parts 530R and 530L are positioned in the lowest position. Under the condition, the upper ends of the medal guide plates 533 of the guide parts 530R and 530L are located in the height position less than or equal to that of the upper surface of main table 501. As a result, the medal M is capable of passing through the through-hole 532.

Also, for example, as illustrated in FIG. 9(*b*), when a part of the lateral surface of the eccentric cam 548, which is located farthest from the rotary shaft part 546, is abutted on the upper brim of the opening 549*a*, the guide parts 530R and 530L are positioned in the highest position. Under the condition, the upper ends of the medal guide plates 533 of the guide parts 530R and 530L are sufficiently protruded from the upper surface of the main table 501. As a result, the flow of the medal(s) M passing through the through-holes 532 is sufficiently blocked by the medal guide plates 533, and the number of the medal M fallen from the side ends 501*b* of the main table 501 is reduced.

Also, for example, as illustrated in FIG. 9(*c*), when a part of the lateral surface of the eccentric cam 548, which is positioned between the part of its lateral surface closest to the rotary shaft part 546 and the part of its the lateral surface farthest to the rotary shaft part 546, is abutted on the upper brim of the opening 549*a*, the guide parts 530R and 530L are positioned in an intermediate position between the highest position and the lowest position. Under the condition, the upper ends of the medal guide plates 533 of the guide parts 530R and 530L are slightly protruded from the upper surface of the main table 501. As a result, the flow of the medal(s) M passing through the through-hole 532 is restricted by the medal guide plate 533 to some extent, and the number of the medal M fallen from the side ends 501*b* of the main table 501 is reduced.

Also, a position detection sensor 550, for instance, is provided in the sliding base 549. For example, the position detection sensor 550 is a resistance-value detection type sensor with variable resistance. The value detected by the position detection sensor 550 is inputted into the first control unit 600 (see FIG. 2), for instance. Therefore, the first control unit 600 specifies the protruded amount of the portions of the guide parts 530R ad 530L by specifying distance from the bottom surface of the container 541 based on the inputted resistance value, or directly specifies the protruded amount of the portions of the guide parts 530R and 530L, for instance. Note that the first control unit 600 controls the protruded amount of the portions of the guide parts 530R and 530L by driving the motor 542 based on the specified protruded amount of the portions of the guide parts 530R and 530L. Also, in the present example, the position detection sensor 550 is configured to be the resistance-value detection type sensor. However, the present invention is not limited to this, and may be an optical sensor, for instance. Furthermore, in the present invention, the paid-out ratio may be configured to be periodically changed by causing the motor 542 to rotate at a low speed without providing the above described position detection sensor. In this case, it is also possible to configure the paid-out ratio to periodically change depending on the progress of a game, for example, by using a stepping motor as the motor 542 and by causing the motor 542 to gradually rotate depending on steps to be proceeded in accordance with the predetermined number of paid out medals, the predetermined number of fallen medals, or the predetermined sum of the both.

(1-6-3)

As described above, according to the present embodiment, it is possible to control the flow of the medal(s) M, for instance, to be advantageous for a game player with the guide parts 530R and 530L by providing the guide parts 530R and 530L (especially the medal guide plates 533) for changing the flow of the medal(s) M, a tangible game medium/media, in the game device 1 for pushing and moving the medal(s) M accumulated on the main table 501. Note that according to the present embodiment, it is also possible to control the flow of the medal(s) M to be disadvantageous for a game player with the guide parts 530R and 530L.

Also, it is possible to change the flow of the medal(s) M by further providing the guide part moving mechanism 540 for causing the guide parts 530R and 530L to protrude from the main table 501 and to retract below the predetermined table. As a result, it is possible to switch among a game status advantageous for a game player, a game status disadvantageous for a game player, and a normal game status with a mechanical element.

Also, it is possible to make up the medal guide plates 533 of the guide parts 530R and 530L for controlling the flow of the medal(s) M with a plate member, for instance. When the plate member is used, it is possible to realize the flow of the medal(s) M with a simple configuration of causing the plate member to protrude above the main table 501 and to retract below the main table 501. As a result, it is possible to realize the game device 1 for switching the game statuses with a mechanical element at low cost.

Also, it is possible to reliably guide the medal(s) M in a desired direction with the combination of the medal guide plates 533 that are disposed in parallel to each other or in a V-shape. In other words, it is possible to accurately and reliably guide the flow of the medal(s) M to the direction of the front end 501*a* with a configuration that the medal(s) M is/are flowed between the medal guide plates 533 that are combined to be disposed in parallel to each other or in a V-shape.

Also, it is possible to configure a game status to be advantageous for a game player when the flow of the medal(s) M is controlled by the guide parts 530R and 530L by providing the medal receiver 1001, the medal transporting path 1002, and the medal paying-out mechanism including the lifting-up hopper 1020, the medal paying-out part 1030, and the medal counter, at the front end 501*a* that is positioned in a direction that the medal(s) M is/are guided by the guide parts 530R and 530L.

Also, it is possible to combine a game (e.g., a pusher game using the medal(s) M) and another kind of game (e.g., a bingo game) by providing the ball guide plates 531 for controlling the flow of the ball B1 and the ball B2, which are formed in a different shape from the medal M and are tangible game media, in the guide parts 530R and 530L. In other words, it is possible to combine plural kinds of games, and thus it is possible to realize a more complex game property.

Also, it is possible to make up the ball guide plate 531 for controlling the flow of the ball B1 and the ball B2 with a plate member, for instance. In addition, it is possible to reduce the area on the main table 501, which is occupied by elements for controlling the flow of the medal(s) M, and the ball B1/B2 (i.e., the medal guide plate 533 and the ball guide plate 531) by providing the ball guide plate on the medal guide plate 533. Here, it is possible to prevent the flow of the medal(s) M from being restricted by the ball guide plate 531 by forming the through-hole 532 with a gap, which is greater than or equal to the thickness of the medal M, between the medal guide plate 533 and the ball guide plate 531.

Also, it is possible to realizably guide the ball B1 and the ball B2 in a desired direction with the combination of the ball guide plates 531 that are disposed in parallel to each other or in a V shape. In other words, it is possible to accurately and reliably restrict the flow of the ball B1 and the ball B2 with a configuration that the ball B1 and the ball B2 are flowed between the ball guide plates 531 that are combined to be disposed in parallel to each other or in a V shape.

Note that in the above described embodiment, the ball B1/B2 or the medal(s) M is/are configured to be guided to the front end 501*a* of the main table 501 while the guide parts 530L and 530R are protruded from the main table 501 by the combination of the guide parts 530L and 530R that are disposed in a V shape as illustrated in the figure. However, the present invention is not limited to this. With the combination of the guide parts 530L and 530R that are disposed in reversed-V shape in the figure, the ball B1/B2 or the medal(s) M may be configured to be guided to the side ends 501*b* of the main table 501 while the guide parts 530L and 530R are protruded from the main table 501. It is also possible to manipulate the paid-out ratio in the station ST with the above configuration. Also, in the above described embodiment, the case that both of the medal guide plate 533 and the ball guide plate 531 are provided in the guide parts 530L and 530R is exemplified. However, the present invention is not limited to this. A configuration may be provided that the medal guide plate 533 and the ball guide plate 531 are provided to be independent from each other. Furthermore, a configuration without the ball guide plate may be provided. In this case, it is possible to vary the paid-out ratio with a configuration that at least the medal guide plate 533 is protruded/retracted from the main table 501.

(1-7) Barrier Regulation Mechanism 2000

As described above, it is effective for realizing a more appealing game device to control ratio of the medal(s) M to be paid out to a game player and the medal(s) M to be recovered by the station ST (i.e., dropping on the dealer's side), which is referred to as paid-out ratio. Therefore, it is preferable to provide a mechanism for regulating the medal(s) dropped on the dealer's side on the both side portions of the main table 501 in addition to the above described guide parts 530R and 530L and the above described guide part moving mechanism 540. It is possible to realize a mechanism for regulating the medal(s) M dropped on the dealer's side with use of a barrier regulation mechanism 2000 to be described. FIG. 2 illustrates a position in which the barrier regulation mechanism 2000 is disposed.

It is possible to configure the barrier regulation mechanism 2000 to be capable of regulating the range in which barriers are extended on the both end portions of the main table 501 by regulating height of barriers for preventing the disk shaped game medium from being dropped on the dealer's side. The paid-out ratio will be increased by increasing the range of the extended barriers for blocking the dropping of the disk shaped game medium on the dealer's side. On the other hand, the paid-out ratio will be reduced by reducing the range in which the barriers are extended on the both end portions of the main table 501. The regulation of the paid-out ratio greatly influences a game property. Therefore, it is preferable to realize the barrier regulation mechanism 2000 that is allowed to highly elaborately regulate the range in which the barriers are extended.

Therefore, it is possible to configure the barrier regulation mechanism 2000 to include at least a support member, a first barrier member, and an operating member. Here, the first barrier member is attached to the support member so as to be capable of being relatively displaced in the vertical direction, includes first and second end portions that are separated from each other and a top side, the height level of which monotonically increases toward the second end portion from the first end portion, and provides a barrier with respect to the horizontal movement of the game medium. The operating member is attached to the support member so as to be capable of being relatively displaced in the horizontal direction. At the same time as this, the operating member is also attached to the first barrier member so as to be capable of being relatively displaced two-dimensionally for the purpose of converting the relative displacement in the horizontal direction with respect to the support member into the relative displacement in the vertical direction of the first barrier member.

The support member is provided so as not to be displaced with respect to the main table 501. In addition, the first barrier member is attached to the support member so as to be capable of being relatively displaced in the vertical direction. On the other hand, the operating member is attached to the support member so as to be capable of being relatively displaced in the horizontal direction. Furthermore, the operating member is attached to the first barrier member so as to be capable of being relatively displaced two-dimensionally for the purpose of converting the relative displacement in the horizontal direction with respect to the support member into the relative displacement in the vertical direction of the first barrier member. Therefore, the relative displacement in the vertical direction of the first barrier member with respect to the support member is generated by operating the operating member so as to be relatively displaced in the horizontal direction with respect to the support member. The first barrier member has a top side, the height level of which increases toward its second end portion from its first end portion. The first barrier member is disposed so that a part of the top side exists above the level of the main table 501 and the rest of the top side exists below the level of the main table 501. The part of the top side existing above the level of the main table 501 and the part of the top side existing below the level of the main table 501 will be changed when the first barrier member is displaced in the vertical direction with respect to the support member that is not displaced with respect to the main table 501. For example, when the level of the first barrier member goes up, the part of the top side existing above the level of the main table 501 is enlarged. On the other hand, the part of the top side existing below the level is reduced. When the level of the first barrier member goes down, the part of the top side existing above the level of the main table 501 is reduced. On the other hand, the part of the top side existing below the level is enlarged. With the configuration, an administrator of a game device is capable of highly elaborately regulating height of the first barrier member with respect to the main table 501 by operating the operating member. As a result, it is possible to highly elaborately regulate the range in which the first barrier member is extended on the both side portions of the main table 501.

It is preferable that the height level of the top side is continuously increased toward the second end portion form the first end portion. With the configuration, the amount of displacement in the vertical direction of the first barrier member with respect to the support member is continuously changed with respect to the change in the amount of displacement in the horizontal direction of the operating member with respect to the support member. As a result, the range of the part of the top side existing above the level of the main table 501 is continuously changed with respect to the change in the amount of displacement in the horizontal direction of the operating member with respect to the support member. This makes it possible to continuously and finely regulate the range in which the first barrier member is extended on the side portion of the main table 501. As a result, this makes it easy to highly elaborately regulate the range in which the first barrier member is extended on the side portion of the main table 501.

The height level of the top side is preferably increased at a constant rate toward the second end portion from the first end portion. With the configuration, change in the amount of displacement in the vertical direction of the first barrier member with respect to the support member is generated at a constant rate with respect to the change in the amount of displacement in the horizontal direction of the operating member with respect to the support member. As a result, the range in which the part of the top side existing above the level of the main table 501 is changed at a constant rate with respect to the change in the amount of displacement in the horizontal direction of the operating member with respect to the support member. This makes it possible to finely regulate the range in which the first barrier member is extended on the side portion of the main table 500 at a constant rate. As a result, this makes it easy to highly elaborately regulate the range in which the first barrier member is extended on the side portion of the main table 501.

It is possible to configure the first barrier member to be attached to the operating member so as to be capable of two-dimensionally and relatively displaced through a first engaging mechanism that includes at least a first guide part extended in a sloped direction and a first guided part configured to be displaced in accordance with the first guide part.

The sloped direction of the first engaging mechanism is closer to perpendicular, compared to the slope of the top side. With the configuration, it is possible to increase the amount of change in the range in which the first barrier member is extended on the side portion of the main table 501, compared to the amount of displacement in the horizontal direction of the operating member.

It is possible to make up the first guide part of the first engaging mechanism with a slit and make up the first guided part with a protrusion. In other words, it is possible to configure the protrusion that is configured to be engaged with the slit to be displaced along the slit. With the simple structure, the relative displacement in the horizontal direction of the operating member with respect to the support member is converted into the relative displacement in the vertical direction of the first barrier member with respect to the support member. As a result, it is possible to realize the first engaging mechanism that is capable of changing the amount of change in the range in which the first barrier member is extended on the side portion of the main table 501.

It is possible to form the first barrier member to be attached to the support member so as to be capable of being relatively displaced in the vertical direction through a second engaging mechanism that includes at least a second guide part extended in the vertical direction and a second guided part configured to be displaced in accordance with the second guide part. It is possible to make up the second guide part with a slit and make up the second guided part with a protrusion. In other words, it is possible to configure a second protrusion that is configured to be engaged with the slit to be displaced along the slit. With the simple structure, the first barrier member is allowed to be relatively displaced in the vertical direction with respect to the support member.

The configuration that the sloped direction of the top side of the first barrier is more gentle than the sloped direction of the second guide part of the second engaging mechanism makes it possible to configure the amount of change in the range in which the first barrier is extended to be gentle with respect to the amount of movement in the vertical direction by the second engaging mechanism. As a result, it is possible to accurately regulate the range in which the first barrier is extended with respect to the input of the operating member in the horizontal direction and the movement of the second engaging mechanism in the vertical direction.

It is possible to configure the operating member to be attached to the support member so as to be capable of being relatively displaced in the horizontal direction through a third engaging mechanism that includes at least a third guide part extended in the horizontal direction and a third protrusion configured to be displaced in accordance with the third guide part. It is possible to make up the third guide part with a slit and make up the second guided part with a protrusion. In other words, it is possible to configure a third protrusion that is configured to be engaged with the slit to be displaced along the slit. With the simple structure, the operating member is allowed to be relatively displaced in the horizontal direction with respect to the support member.

Figure 42:
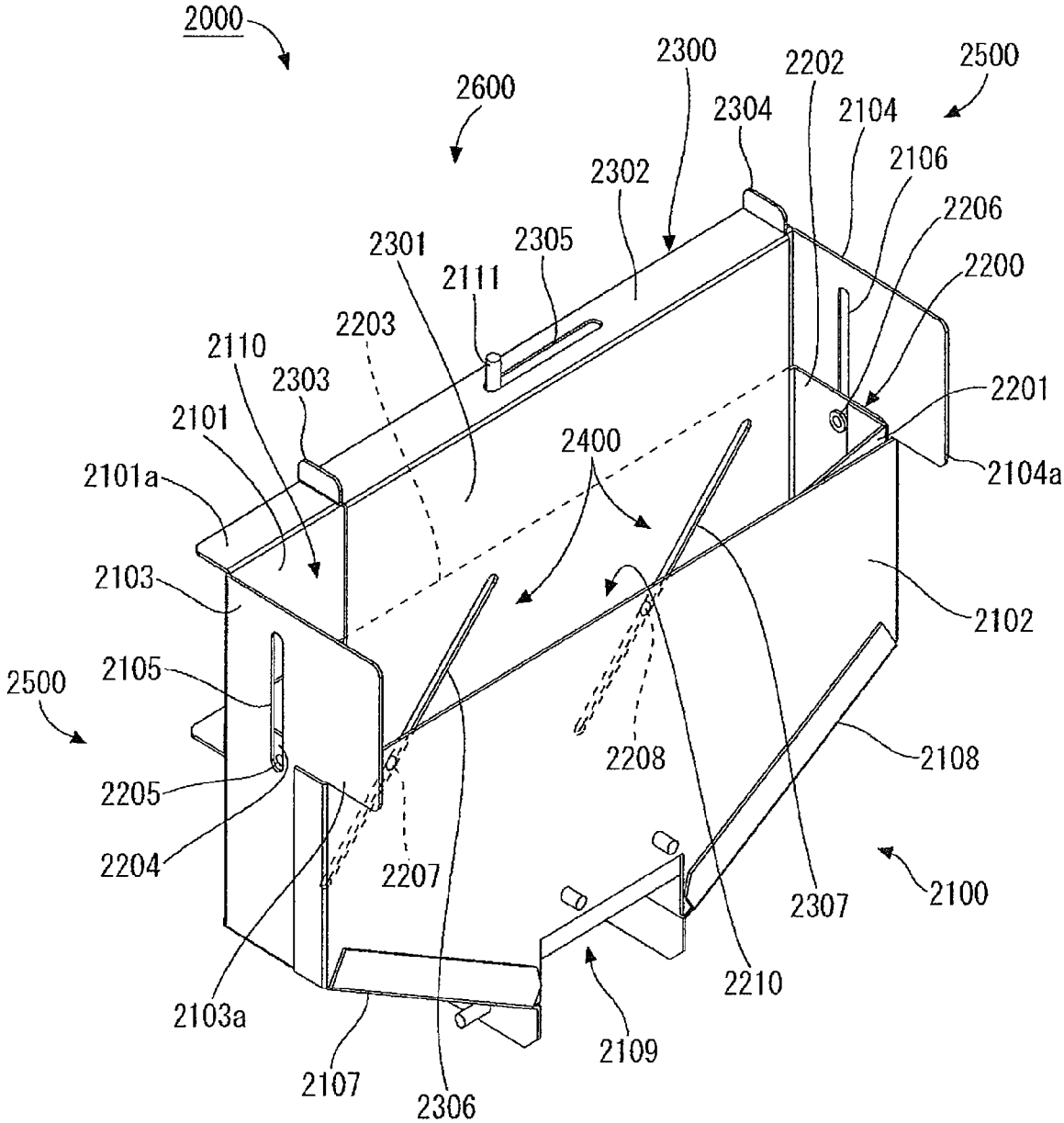
FIG. 42 is a perspective view illustrating a barrier height regulation mechanism of an embodiment of the present invention, in which height of a barrier is set to be the lowest.
Figure 43:
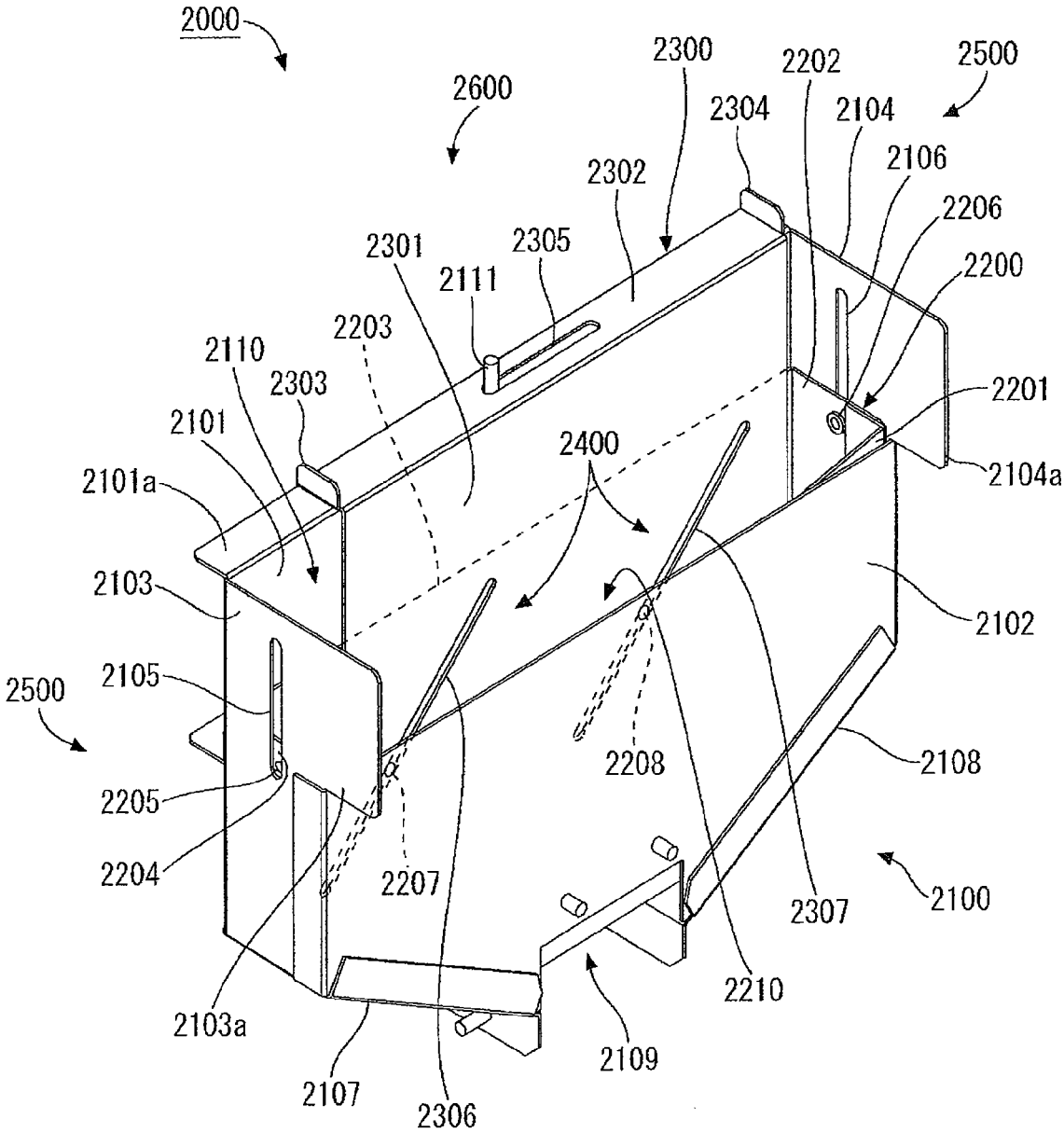
FIG. 43 is a perspective view illustrating the barrier height regulation mechanism if an embodiment of the present invention, in which height of the barrier is set to be an intermediate level.
Figure 44:
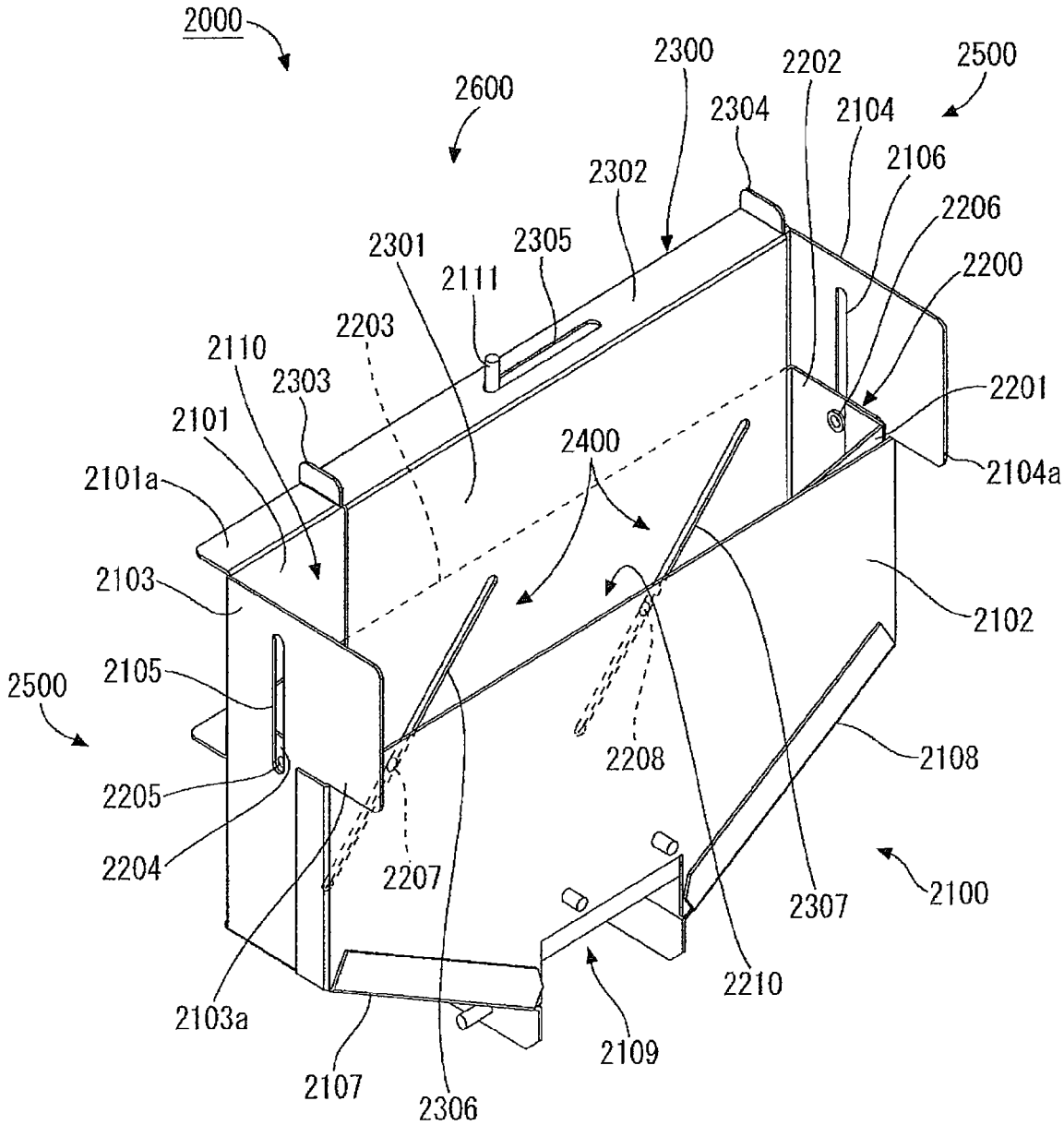
FIG. 44 is a perspective view illustrating the barrier height regulation mechanism of an embodiment of the present invention, in which height of the barrier is set to be the highest.

The barrier regulation mechanism 2000 will be hereinafter specifically explained with reference to FIGS. 42 to 44. FIG. 42 is a perspective view of a barrier regulation mechanism in which height of a barrier is set to be the lowest level. FIG. 43 is a perspective of the barrier regulation mechanism in which height of the barrier is set to be the intermediate level. FIG. 44 is a perspective view of the barrier regulation mechanism in which height of the barrier is set to be the highest level.

As illustrated in FIGS. 42 to 44, the barrier regulation mechanism 2000 includes a support member 2100, a barrier member 2200, and an operating member 2300. As illustrated in FIG. 2, the barrier regulation mechanisms 2000 are disposed on the both side portions of the main table 501.

(1-7-1) Support Member 2100

The support member 2100 is provided not to be displaced with respect to the main table 501. The support member 2100 is a frame shaped member, and includes an opening part 2110 in its interior. The opening part 2110 is formed to be communicated with an opening part 2109 in the lower part of the support member 2100. The opening part 2110 recovers the game medium (medal M) fallen from the lateral side of the main table 501 through an opening part 2210 of the barrier member 2200 to be described. The medal M, which entered the opening part 2110, further falls down from the opening part 2109 that is formed below the opening part 2110, and is recovered by a recovery mechanism (not illustrated in the figure). Note that the medal M fallen from the opening part 2109 may be configured to be recovered by the above described medal paying-out mechanism that includes the lifting-up hopper 1020 and the medal paying-out part 1030.

The support member 2100 includes a sidewall 2101 that is disposed outside from the main table 510, a sidewall 2102 that is disposed inside from the main table 501, a sidewall 2103 that couples the sidewall 2101 and the sidewall 2102 on the front side of the main table 501, and a sidewall 2104 that couples the sidewall 2101 and the sidewall 2102 on the rear side of the main table 501. An area surrounded by the sidewalls 2101-2104 forms the opening part 2110.

The sidewall 2101 includes a folded portion 2101*a* that is continuously formed from its top side and is externally extended in the horizontal direction. A protrusion 2111 is formed on the upper surface of the folded portion 2101*a* and extends in an approximately vertically-upward direction. The bottom side of the sidewall 2101 includes a flat portion formed to be shorter than the top side and a sloped portion continuously formed from the both sides of the flat portion, and is formed in a trapezoidal shape. Also, the flat portion of the bottom side is formed slightly above the bottom ends of the sloped portions on the both sides. The shape of the bottom side of the sidewall 2101 is the same as that of the bottom side of the sidewall 2102. Therefore, it is preferable to refer to the shape of the bottom side of the sidewall 2102 illustrated in FIGS. 42 to 44 for confirming the shape of the bottom side of the sidewall 2101.

A lateral side of the sidewall 2102, that is, a side of the sidewall 2102 extending in the vertical direction (Y direction), is formed to be shorter than a lateral side of the sidewall 2101, that is, a side of the sidewall 2101 extending in the vertical direction. The top side of the sidewall 2102 is disposed below the top side of the sidewall 2101. The bottom side of the sidewall 2102 is formed in the same shape as the bottom side of the sidewall 2101. In other words, the bottom side of the sidewall 2102 includes a flat portion formed shorter than the top side and sloped portions continuously formed from the both sides of the flat portion, and is formed in a trapezoidal shape. Also, the flat portion of the bottom side is formed slightly above the bottom ends of the sloped portions on the both sides. In a plan view seen from the lateral side, the bottom side of the sidewall 2101 and the bottom side of the sidewall 2102 are disposed to correspond to each other. In other words, in a plan view seen from the lateral side, the flat portion of the bottom side of the sidewall 2101 and the flat portion of the bottom side of the sidewall 2102 corresponds to each other at the same height. Also, in a plan view from the lateral side, the sloped portions on the both sides of the bottom side of the sidewall 2101 also correspond to the sloped portions of the bottom side of the sidewall 2102 at the same height. The lateral side of the sidewall 2101 is longer than the lateral side of the sidewall 2102. Therefore, the top side of the sidewall 2102 is disposed below the top side of the sidewall 2101.

The support members 2100 are disposed on the both lateral sides of the main table 501 so that height of the top side of the sidewall 2102 approximately corresponds to that of the main table 501. Note that height of the top side of the sidewall 2102 of the support member 2100 may be slightly lower than that of the main table 501.

The sidewall 2103 couples the sidewall 2101 and the sidewall 2102 on the front side of the main table 501. Height of the top side of the sidewall 2103 corresponds to that of the top side of the sidewall 2101. The bottom side of the sidewall 2103 couples the sidewall 2101 and the sidewall 2102 at the height of the upper ends of the sloped portions of the bottom sides of the sidewall 2101 and the sidewall 2102. A slit 2105 is formed on the upper portion of the sidewall 2103 and is extended in the vertical direction. The slit 2105 is formed to penetrate the sidewall 2103 from the front side to the rear side of the main table 501. A protrusion 2205 (to be described) of the barrier member 2200 is engaged with the slit 2105 so as to be movable within the slit 2105 in the vertical direction (Y direction).

The sidewall 2104 is configured to be almost the same as the sidewall 2103. In other words, the sidewall 2104 couples the sidewall 2101 and the sidewall 2102 on the rear side of the main table 501. Height of the top side of the sidewall 2104 corresponds to that of the top side of the sidewall 2101. The bottom side of the sidewall 2104 couples the sidewall 2101 and the sidewall 2102 at the height of the upper ends of the sloped portions of the bottom sides of the sidewall 2101 and the sidewall 2102. A slit 2106 is formed on the upper portion of the sidewall 2104 and is extended in the vertical direction. The slit 2106 is formed to penetrate the sidewall 2103 from the front side to the rear side of the main table 501. A protrusion 2206 (to be described) of the barrier member 2200 is engaged with the slit 2106 so as to be movable within the slit 2106 in the vertical direction (Y direction).

A first extending portion 2103*a* is formed in an upper portion of the sidewall 2103 which is positioned lateral to the slit 2105, and is extended toward the main table 501. A second extending portion 2104*a* is formed in an upper portion of the sidewall 2104 which is positioned lateral to the slit 2106, and is extended toward the main table 501.

A flange part 5010 (see FIG. 2) is disposed between the extending portion 2103*a* and the extending portion 2104*a* at the height of the extending portion 2103*a* and the extending portion 2104*a*, and is extended to make contact with the top side of the sidewall 2102 at the same height as the main table 501. The flange part 5010 functions as a path surface for communicating the main table 501 with the top side of the sidewall 2102 and the opening part 2110. The extending portions 2103*a* and 2104*a* are disposed on the front side and the rear side of the flange part 5010, regulates a path of the medal M that goes to the opening part 2110 from the main table 501 by way of the upper surface of the flange part 5010, and prevents the medal M from falling from the flange part 5010.

The flange part 5010 is fixed to the lateral surface of the main table 501. The support member 2100 is fixed to the flange part 5010, and is thus provided not to be displaced with respect to the main table 501.

A bottom surface 2107 is coupled to a front side's sloped portion of the bottom side of the sidewall 2101, the bottom side of the sidewall 2103, and a front side's sloped portion of the bottom side of the sidewall 2102. The bottom surface 2107 is sloped downward from the front side to the rear side. A bottom surface 2108 is coupled to a rear side's sloped portion of the bottom surface of the sidewall 2101, the bottom surface of the sidewall 2103, and a rear side's sloped portion of the bottom surface of the sidewall 2102. The bottom surface 2108 is sloped downward from the rear side to the front side. The opening part 2109 is formed between the bottom surface 2107 and the bottom surface 2108 so as to be communicated with the opening part 2110.

The bottom surface 2107 and the bottom surface 2108 are disposed to be sloped downward to the opening part 2109 from the front side and the rear side, respectively. According to the configuration, the medal M fallen into the opening part 2110 is allowed to directly fall down from the opening part 2109, and is also allowed to smoothly fall down through the opening part 2109 after it falls down to the bottom surface 2107 and the bottom surface 2108. When the medal M fallen into the opening part 2110 falls down to the bottom surface 2107, the medal M smoothly and slidingly falls along the bottom surface 2107 toward the opening part 2109 from the front side, because the bottom surface 2107 is sloped downward from the front side to the opening part 2109. When the medal M fallen into the opening part 2110 falls to the bottom surface 2108, the medal M smoothly and slidingly falls along the bottom surface 2108 toward the opening part 2106 from the rear side, because the bottom surface 2108 is sloped downward from the rear side to the opening part 2109. Thus, it is possible to smoothly move the medal M fallen into the opening part 2110 to the opening part 2109 and drop it down through the opening part 2109 by sloping the bottom surface 2107 and the bottom surface 2108 downward to the opening part 2109. As a result, it is possible to smoothly recover the medal M dropped on the dealer's side.

Note that as illustrated in FIGS. 42 to 44, it is possible to form the support member 2100 by integrally forming the sidewall 2101, the sidewall 2103, the sidewall 2104, the bottom surface 2107 and the bottom surface 2108 by means of the folding process of a metal plate made of stainless or the like and then by welding the sidewall 2102 with respect to the integrally formed part including the sidewall 2101, the sidewall 2103, the sidewall 2104, the bottom surface 2107, and the bottom surface 2108. Alternatively, the support member 2100 may be formed by separately forming the sidewall 2101, the sidewall 2102, the sidewall 2103, the sidewall 2104, the bottom surface 2107 and the bottom surface 2108 with a metal plate made of stainless or the like and then by welding them with each other.

(1-7-2) Barrier Member 2200

The barrier member 2200 is attached to the support member 2100 so as to be capable of being relatively displaced in the vertical direction.

The barrier member 2200 includes a sidewall 2201 that is made up of a sidewall disposed inside from the main table 501, a sidewall 2203 that is disposed outside from the main table 501, a sidewall 2204 that couples the sidewall 2201 and the sidewall 2203 to each other on the front side of the main table 501, and a sidewall 2202 that couples the sidewall 2201 and the sidewall 2203 to each other on the rear side of the main table 501.

The barrier member 2200 is surround by the sidewall 2201, the sidewall 2202, the sidewall 2203, and the sidewall 2204, and thus forms a frame shaped member. The opening part 2210 is formed in the area surround by the sidewall 2201, the sidewall 2202, the sidewall 2203, and the sidewall 2204. The opening part 2210 is formed to penetrate in the vertical direction.

The barrier member 2200 is accommodated in the interior of the opening part 2110 of the support member 2100 so as to make contact with each of the sidewalls 2101 to 2104 of the support member 2100 from inside. The opening part 2210 of the barrier member 2200 is formed to communicate with the opening part 2109 of the support member 2100. The medal M on the main table 501 falls down from the opening part 2109 of the support member 2100 through the opening part 2210 of the barrier member 2200.

The sidewall 2201 slidably makes contact with the inner side of the sidewall 2101 in the interior of the opening part 2110 of the support member 2100. The top side of the sidewall 2201 includes a first end portion (i.e., a front side end portion) and a second end portion (i.e., a rear side end portion). The first end portion and the second end portion are separated from each other. The top side of the sidewall 2201 is formed so that its height level is continuously and monotonically increased toward the second end portion from the first end portion (i.e., toward the rear side end portion from the front side end portion). More specifically, the top side is formed so that its height level is increased at a predetermined rate toward the second end portion from the first end portion. When the top side is formed so that its height level is increased at a predetermined rate, the horizontal displacement of the operating member 2300 and the displacement of the sidewall 2201 linearly correspond to each other. Therefore, when scales for indicating the amount of the sidewall 2201 protruding upward from the main table 501 (the amount of protrusion) are provided in a folded portion 2302 of the operating member 2300, the scales are equally spaced apart and thus it will be easy to regulate the amount of protrusion. When scales are provided in the folded portion 2302, a fiducial marker is provided for preventing displacement with respect to the main table 501, and the scales in the folded portion 2302 are configured to be aligned with the marker depending on a predetermined amount of protrusion. Note that scales may be provided for preventing displacement with respect to the main table 501, and a marker may be provided in the folded portion 2302.

Here, the top side is formed to have height level linearly increasing toward the second end portion from the first end portion. However, it may be formed in a curved shape to have height level increasing at a predetermined rate. Also, the top side may be formed to have height level increasing toward the second end portion from the first end portion in a polygonal line shape. Also, the top side may be formed to have height level that increases toward the center part with the highest level and then decreases toward the second end portion. Also, the top side may be formed to have height level having a plurality of peaks. The top side may not be necessarily formed in the above described shape, and may be changed in a variety of shapes as long as it is formed as a barrier for regulating movement of the medal M from the main table 501 to the opening part 2210. Also, as described above, the first end portion is referred to as the front side, and the second end is referred to as the rear side. However, the positional relation may be reversed, and thus the first end portion may be referred to as the rear side and the second end portion may be referred to as the front side.

The sidewall 2201 is formed to have the top side with height level monotonically increasing toward the second end portion from the first end portion. Therefore, it is possible to dispose the top side so that a part of the top side exists above the level of the main table 501 (the top side of the sidewall 2101) and the rest of the top side exists below the level of the main table 501. The part of the top side existing above the level of the main table 501 and the part of the top side that existing below the level of the main table 501 are changed by the vertical displacement of the sidewall 2201 with respect to the support member 2100 that is not displaced with respect to the main table 501.

As illustrated in the conditional shift from FIG. 43 to FIG. 44, when the level of the sidewall 2201 goes up, a part of the top side existing above the level of the main table 501 is enlarged. On the other hand, a part of the top existing below the level is reduced. As a result, the amount of medals dropped on the dealer's side will be decreased and the paid-out ratio will be increased.

As illustrated in the conditional shift from FIG. 43 to FIG. 42, when the level of the sidewall 2102 goes down, a part of the top side existing above the level of the main table 501 is reduced. On the other hand, a part of the top side existing below the level is enlarged. As a result, the amount of medals dropped on the dealer's side will be increased and the paid-out ratio will be reduced.

With the configuration, it is possible for an administrator of the game device to highly elaborately regulate the height of the sidewall 2102 with respect to the main table 501 by operating the operating member 2300. As a result, it is possible to highly elaborately regulate the range in which the sidewall 2102 is extended on the both side portions of the main table 501.

Note that if the height level of the sidewall 2201 falls in the range of height level close to the thickness of the medal M, the medal M may also cross the part of the sidewall 2201 extending above the main table 501 in the anteroposterior direction and fall into the opening part 2210. In either case, it is possible to accurately regulate the amount of the medal(s) M falling into the opening part 2210 (the amount of medals dropped on the dealer's side) by changing the area in which the sidewall 2201 appears above the main table 501 based on the movement of the sidewall 22101 in the up-to-down direction.

In a case that the top side of the sidewall 2201 is formed in a flat shape, even if the sidewall 2201 is moved up and down, the sidewall 2201 either uniformly exists above the level of the main table 501 along the anteroposterior direction or does not exist above the level of the main table 501 at all. It may be possible to regulate the amount of medals dropped on the dealer's side by regulating the height of the part of the barrier 2201 existing above the main table 5501 if the height level of the part of the barrier 2201 existing above the main table 501 falls in the range of the height level close to the thickness of the medal M. However, it is undeniable that the range of regulating the amount of medals dropped on the dealer's side will be quite narrow. Compared to this, in the present embodiment, the top side of the sidewall 2201 is configured to have height monotonically increasing toward the second end portion from the first end portion. Therefore, it is possible to linearly regulate the range functioning as a barrier between the main table 501 and the opening part 2210.

The sidewall 2202 is continuously formed to a side of the sidewall 2201 positioned on the rear side, and is also formed to be approximately perpendicular to the sidewall 2201. The sidewall 2202 slidably makes contact with the inner side of the sidewall 2104 within the opening part 2110 of the support member 2100. The protrusion 2206 functioning as the second guided part is formed on the outer surface of the sidewall 2202, and is protruded toward the rear side of the main table 501. The protrusion 2206 is disposed to be engaged with the slit 2106 functioning as the second guide part formed in the sidewall 2104 of the support member 2100. The protrusion 2206 is attached to be capable of being relatively displaced in the vertical direction (Y direction in FIG. 43) within the slit 2106.

The slit 2106 functioning as the second guide part and the protrusion 2206 functioning as the second guided part make up the second engaging mechanism 2500. The barrier member 2200 is attached to be capable of being relatively displaced in the vertical direction with respect to the support member 2100 through the second engaging mechanism 2500.

The sidewall 2204 is continuously formed to a side of the sidewall 2201 on the front side, and is also formed to be approximately perpendicular to the sidewall 2201. The sidewall 2204 slidably makes contact with the inner side of the sidewall 2103 within the opening part 2110 of the support member 2100. The protrusion 2205 functioning as the second guided part is formed on the outer surface of the sidewall 2202, and is protruded toward the front side of the main table 501. The protrusion 2205 is disposed to be engaged with the slit 2105 functioning as the second guide part formed in the sidewall 2103 of the support member 2100. The protrusion 2205 is attached to be capable of being relatively displaced in the vertical direction within the slit 2105.

The slit 2105 functioning as the second guide part and the protrusion 2205 functioning as the second guided part make up the second engaging mechanism 2500. The barrier member 2200 is attached to be capable of being relatively displaced with respect to the support member 2100 through the second engaging mechanism 2500. Specifically, when the protrusion 2205 moves up and down within the slit 2105, accordingly the barrier member 2200 is relatively displaced with respect to the support member 2100.

It is preferable to make up the second engaging mechanism 2500 with the protrusion 2205 and the slit 2105, both of which are positioned on the front side, and the protrusion 2206 and the slit 2106, both of which are positioned on the rear side. When the second engaging mechanism 2500 is made up of the protrusion 2205 and the slit 2105, both of which are positioned on the front side, and the protrusion 2206 and the slit 2106, both of which are positioned on the rear side, it is possible to smoothly move the barrier member 2200 up and down with respect to the support member 2100. Also, it is possible to make up the second engaging mechanism 2500 with either the combination of the protrusion 2205 and the slit 2105 or the combination of the protrusion 2206 and the slit 2106. When it is formed by either the combination of the protrusion 2205 and the slit 2105 or the combination of the protrusion 2206 and the slit 2106, it is also possible to smoothly move the barrier member 2200 with respect to the support member 2100 if stiffness of the barrier member 2200 is high and friction to be generated between the support member 2100 and the barrier member 2200 is low.

The sidewall 2203 couples an outer side of the sidewall 2202 and an outer side of the sidewall 2204, and is opposed to the sidewall 2201. The sidewall 2203 is disposed to slidably make contact with the inner surface of the sidewall 2101 within the opening part 2110 of the support member 2100. Also, the sidewall 2203 is interposedly supported between the sidewall 2101 of the support member 2100 and a sidewall 2301 of the operating member 2300, and is disposed to slidably make contact with the sidewall 2101 of the support member 2100 and the sidewall 2301 of the operating member 2300.

A protrusion 2207 and a protrusion 2208, both of which function as the first guided members, are formed on the inner surface of the sidewall 2301, and are also protruded to the main table 501. The protrusion 2207 and the protrusion 2208 are formed to have approximately the same height level. The protrusion 2207 is disposed to be engaged with a slit 2306 functioning as the first guide part provided to be sloped in the sidewall 2301 of the operating member 2300. The protrusion 2208 is disposed to be engaged with a slit 2307 functioning as the first guide part provided to be sloped in the sidewall 2301 of the operating member 2300. The protrusion 2207 and the slit 2306, both of which are positioned on the front side, and the protrusion 2208 and the slit 2307, both of which are positioned on the rear side, make up the first engaging mechanism 2400. The barrier member 2200 is attached to be capable of being two-dimensionally and relatively displaced with respect to the operating member 2300 through the first engaging mechanism 2400.

When the slits 2306 and 2307 of the operating member 2300 are moved along the horizontal direction (X direction), the protrusions 2207 and 2208 of the barrier member 2200 are moved along the sloped direction of the slits 2306 and 2307 and are accordingly moved along the Y direction with respect to the operating member 2300 and the support member 2100.

When the slits 2306 and 2307 of the operating member 2300 are moved along the X direction to the rear side (i.e., when they are moved from the position in FIG. 43 to the position in FIG. 42), the protrusions 2207 and 2208 of the barrier member 2200 are moved downward along the Y direction with respect to the operating member 2300 and the support member 2100. In other words, when the operating member 2300 is moved along the X direction to the rear side, the barrier member 2200 is accordingly moved downward along the Y direction.

When the slits 2306 and 2307 of the operating member 2300 are moved along the X direction to the front side (i.e., when they are moved from the position in FIG. 43 to the position in FIG. 44), the protrusions 2207 and 2208 of the barrier member 2200 are moved upward in the Y direction with respect to the operating member 2300 and the support member 2100. In other words, when the operating member 2300 is moved along the X direction toward the front side, the barrier member 2200 is accordingly moved upward in the Y direction.

As described above, movement of the operating member 2300 in the horizontal direction (X direction) is converted into movement of the barrier member 2200 in the vertical direction (Y direction).

(1-7-3) Operating Member 2300

The operating member 2300 is attached to the support member 2100 so as to be capable of moving in the horizontal direction. A slit 2305 (third guide part) of the operating member 2300 is engaged with the protrusion 2111 (third guided part) of the support member 2100, and accordingly the operating member 2300 is attached to be capable of being displaced in the horizontal direction (X direction) with respect to the support member 2100.

The operating member 2300 includes the sidewall 2301 and the folded portion 2302. Here, the sidewall 2301 slidably makes contact with the inner surface of the sidewall 2203 of the barrier member 2200, and the folded portion 2302 is continuously formed from the top side of the sidewall 2301 and is horizontally extended outside.

The sidewall 2301 is disposed in the inner side of the sidewall 2101 within the opening part 2110 of the support member 2100, and makes contact with the inner surface of the sidewall 2203 of the barrier member 2200. The slits 2306 and 2307 are formed in the sidewall 2301, and are extended in the sloped direction. The slits 2306 and 2307 are formed in parallel to each other. The protrusion 2207 is engaged with the slit 2306, and the protrusion 2208 is engaged with the slit 2307. As described above, the protrusions 2207 and the slit 2306, both of which are positioned on the front side, and the protrusion 2208 and the slit 2307, both of which are positioned on the rear side, make up the first engaging mechanism 2400.

The folded portion 2302 is continuously formed from the top side of the sidewall 2301, and is extended outside. The folded portion 2302 is integrally formed with the sidewall 2301 with use of a metal plate made of stainless or the like, and is then completed by means of the folding process. A knob portion 2304 is formed on the rear side end portion of the folded portion 2302. The knob portion is continuously extended from the front side end portion and is extended upward approximately in a vertical direction. A knob portion 2303 is formed on the front side end portion of the folded portion 2302. The knob portion 2303 is continuously formed from the rear side end portion and is extended upward approximately in the vertical direction.

The knob portions 2303 and 2304 are elements for allowing an administrator or the like of the game device 1 to move the operating member 2300 in the anteroposterior direction. It is possible to smoothly move the operating member 2300 by moving the operating member 2300 in the X direction while either the knob portion 2303 or the knob portion 2304, or both of the knob portion 2303 and the knob portion 2304 are held. Also, the slit 2305 (third guide part) is formed in the folded portion 2302, and is anteroposteriorly extended between the knob portion 2303 and the knob portion 2304. The protrusion 2111 (third guided part) of the support member 2100 is engaged with the slit 2305. The protrusion 2111 is capable of anteroposteriorly moving within the slit 2305. The protrusion 2111 functioning as the third guided part and the slit 2305 functioning as the third guide part make up a third engaging mechanism 2600. The operating member 2300 is attached to be capable of being relatively displaced in the horizontal direction with respect to the support member 2100 through the third engaging mechanism 2600 (the protrusion 2111 and the slit 2305).

When the operating member 2300 is moved along the slit 2305 in the X direction with respect to the protrusion 2111 of the support member 2100, the slits 2306 and 2307 are accordingly moved in the X direction with respect to the support member 2100. When the slits 2306 and 2307 are moved in the X direction with respect to the support member 2100, the protrusions 2207 and 2208 are moved along the sloped direction of the slits 2306 and 2307, and are accordingly moved in the Y direction with respect to the operating member 2300 and the support member 2100. Here, the protrusions 2205 and 2206 of the barrier member 2200 are moved along the slits 2105 and 2106 of the support member 2100 in the Y direction, respectively.

When moved to the rear side both along the X direction and the slit 2305 of the operating member 2300 with respect to the protrusion 2111 of the support member 2100, the slits 2306 and 2307 are moved to the rear side along the X direction with respect to the support member 2100 (From FIG. 43 to FIG. 42). When the slits 2306 and 2307 are moved to the rear side along the X direction with respect to the support member 2100, the protrusions 2207 and 2208 are moved downward along the sloped direction of the slits 2306 and 2307, and are accordingly moved downward in the Y direction with respect to the operating member 2300 and the support member 2100. Here, the protrusions 2205 and 2206 of the barrier member 2200 are moved downward along the slits 2105 and 2106 of the support member 2100, respectively.

When moved to the front side both along the X direction and the slit 2305 of the operating member 2300 with respect to the protrusion 2111 of the support member 2100, the slits 2306 and 2307 are moved to the front side along the X direction with respect to the support member 2100 (From FIG. 43 to FIG. 44). When the slits 2306 and 2307 are moved to the front side along the X direction with respect to the support member 2100, the protrusions 2207 and 2208 are moved upward along the sloped direction of the slits 2306 and 2307, and are accordingly moved upward in the Y direction with respect to the operating member 2300 and the support member 2100. Here, the protrusions 2205 and 2206 of the barrier member 2200 are moved upward along the slits 2105 and 2106 of the support member 2100, respectively.

As described above, movement of the operating member 2300 in the horizontal direction (X direction) is converted into movement of the barrier member 2200 in the vertical direction (Y direction).

The slit 2306 and 2307 are closer to vertical than the slope of the top side of the sidewall 2102. With the configuration, it is possible to increase the amount of change in the range in which the sidewall 2102 is extended on the side portion of the main table 501, compared to the horizontal displacement of the operating member 2300.

(1-7-4) Operation of Barrier Regulation Mechanism

In a state illustrated in FIG. 44, when the operating member 2300 is moved rearward in the X direction with respect to the support member 2100, the operating member 2300 is moved along the slit 2305 to the rearward in the X direction with respect to the protrusion 2111 of the support member 2100, and the slits 2306 and 2307 are accordingly moved to the rear side along the X direction with respect to the support member 2100. When the slits 2306 and 2307 are moved rearward in the X direction with respect to the support member 2100, the protrusions 2207 and 2208 are accordingly moved downward along the sloped direction of the slits 2306 and 2307.

Here, the protrusion 2205 is engaged with the slit 2105 on the front side, and the protrusion 2206 is engaged with the slit 2106 on the rear side. Accordingly, the barrier member 2200 is only allowed to move along the Y direction. Therefore, when the protrusions 2207 and 2208 are moved downward along the sloped direction of the slits 2306 and 2307, the barrier member 2200 is moved downward along the Y direction. The protrusions 2205 and 2206 are moved downward along the slits 2105 and 2106, respectively. As a result, the range in which the top side of the sidewall 2201 is extended on the side portion of the main table 501 will be reduced from the front side.

FIG. 42 illustrates a case that the operating member 2300 is maximally moved rearward in the X direction with respect to the support member 2100. When it is maximally moved rearward in the X direction, the range in which the top side of the sidewall 2101 is extended on the side portion of the main table 501 will be minimized. Here, the amount of the medal(s) M that fall(s) into the opening part 2210 from the main table 501 and is/are then recovered by the station ST (i.e., the amount of medals dropped on the dealer's side) will be maximized and the amount of the medal(s) M to be paid out to a game player will be minimized. Accordingly, the paid-out ratio will be minimized.

In a state illustrated in FIG. 43, when the operating member 2300 is moved frontward in the X direction with respect to the support member 2100, the operating member 2300 is moved along the slit 2305 to the frontward in the X direction with respect to the protrusion 2111 of the support member 2100, and the slits 2306 and 2307 are accordingly moved to the front side along the X direction with respect to the support member 2100. When the slits 2306 and 2307 are moved frontward in the X direction with respect to the support member 2100, the protrusions 2207 and 2208 are moved upward along the sloped direction of the slits 2306 and 2307.

Here, as described above, the barrier member 2200 is only allowed to move along the Y direction. Therefore, when the protrusions 2207 and 2208 are moved upward along the sloped direction of the slits 2306 and 2307, the barrier member 2200 is accordingly moved upward along the Y direction. The protrusions 2205 and 2206 are moved upward along the slits 2105 and 2106, respectively. As a result, the range in which the top side of the sidewall 2201 is extended on the side portion of the main table 501 will be increased from the rear side.

FIG. 44 illustrates a case that the operating member 2300 is maximally moved frontward in the X direction with respect to the support member 2100. When it is maximally moved frontward in the X direction, the range in which the top side of the sidewall 2101 is extended on the side portion of the main table 501 will be maximized. Here, the amount of the medal(s) M that fall(s) into the opening part 2210 from the main table 501 and is/are then recovered by the station ST (i.e., the amount of medal(s) dropped on the dealer's side) will be minimized and the amount of the medal M to be paid out to a game player will be minimized. Accordingly, the paid-out ratio will be maximized.

As described above, movement of the operating member 2300 in the horizontal direction (X direction) with respect to the support member 2100 is converted into movement of the barrier member 2200 in the vertical direction (Y direction) with respect to the support member 2100. As a result, the range in which the top side of the sidewall 2201 is extended on the side portion of the main table 501 will be changed.

Therefore, when the operating member 2300 is moved in the horizontal direction, the support member 2100 is accordingly moved in the vertical direction. Thus, this makes it possible to highly elaborately and easily regulate the range in which the top side of the sidewall 2201 is extended on the side portion of the main table 501. Accordingly, it is possible to highly elaborately and easily regulate the ratio (the paid-out ratio) of the amount of the medal(s) M to be paid out to a game player and the mount of the medal(s) M to be recovered by the station ST (the amount of medal(s) dropped on the dealer's side).

(1-8) Ball Shooting Mechanism 1800

As described above with reference to FIGS. 3 and 4, the game device in accordance with the present invention uses an approximately disk shaped game medium and an approximately spherical shaped game medium. It is possible to use the medal M as the approximately disk shaped game medium, and it is possible to use the ball B1/B2 as the approximately spherical shaped game medium. Plural kinds of drawings are performed with the approximately spherical shaped game medium. It is possible to realize one of the drawings with a game medium transporting path selection mechanism to be explained. An area of the playing field 500, which is positioned close to the above described medal shooting mechanism 100, will be hereinafter referred to as "front side area," and an area of the playing field 500, which is positioned away from the medal shooting mechanism 100, will be hereinafter referred to as "rear side area."

It is possible to configure a game property in supplying the playing field 500 with the approximately spherical shaped game medium so that an advantageous condition is provided to a game player when the game medium is supplied to a position in the pushing direction of the pusher part 510 (i.e., the front side area on the playing field 500), and on the other hand, a disadvantageous condition is provided to a game player when the game medium is supplied to a position in the opposite direction to the pushing direction on the playing field 500 (i.e., the rear side area on the playing field 500). With the configuration, one of a plurality of drawings with use of the approximately spherical shaped game medium will be realized by using a mechanism for selecting paths for transporting the approximately spherical shaped game medium to the rear side area and the front side area of the playing field 500.

<1> In other words, the game medium transporting path selection mechanism is a game medium path selection mechanism configured to be applied to a game device including a playing field that includes a surface for disposing an approximately spherical game medium and a pusher part, and includes a first guide part, a second guide part, a third guide part, and a path switching drawing mechanism. Here, the first guide part has a first starting point and a first ending point, and is configured to transport the game medium from the first starting point to the first ending point. The second guide part has a second starting point and a second ending point, and is configured to transport the game medium from the second starting point to the second ending point and guide the game medium to a first position on the playing field, which is separated from the end portion of the pusher part in the pushing direction at a first distance. The third guide part has a third starting point and a third ending point, and is configured to transport the game medium from the third starting point to the third ending point and guide the game medium to a second position on the playing field, which is separated from the end portion at a second distance greater than the first distance. The path switching drawing mechanism is configured to switch either a first connection path from the first ending point to the second starting point or a second connection path from the first ending point to the third starting point by drawing.

Here, the second ending point may exist in the front side area of the playing field 500, for instance. The third ending point may exist in the rear side area of the playing field 500, for instance. With the configuration, if a transporting path between the first ending point in the first guide part and the second starting point in the second guide part is selected by the path switching drawing mechanism, the game medium will be transported along the first guide part and the second guide part, and will be supplied to the front side area of the playing field 500. This is a game condition that is advantageous for a game player. On the other hand, if a transporting path between the first ending point in the first guide part and the third starting point in the third guide part is selected by the path switching drawing mechanism, the game medium will be transported along the first guide part and the third guide part, and will be supplied to the rear side area of the playing field 500. This is a game condition disadvantageous for a game player.

For example, the first position is located on the playing field 500 and is separated from the end portion in the pushing direction side of the pusher part 510 (i.e., front end 501*a*) at the first distance. The first position is also located in the front side area close to the end portion. For example, the second position is located on the playing field 500 and is separated from the end portion (i.e., front end 501*a*) at the second distance that is greater than the first distance. The second position is also located in the rear side area away from the end portion. For example, it is possible to set the first position to be a position on the main table 501, which is separated from the front end 501*a* at the first distance. For example, it is possible to set the second position to be a position on the main table 501, which is separated from the front end 501*a* at the second distance (greater than the first distance). Also, it is possible to set the first position to be a position on the main table 501, which is in the vicinity of the front end 501*a* (i.e., the front side position). It is also possible to set the second position to be a position on the main table 501, which is opposite from the front end 501*a* (i.e., the rear side position).

Switching of paths depends on a drawing for deciding which of a transporting path from the first ending point of the first guide part to the second starting point of the second guide part and a transporting path from the first ending point in the first guide part to the second starting point in the second guide part the path switching drawing mechanism guides the game medium to.

According to the above described configuration, it is possible to perform a drawing for transporting the approximately spherical shaped game medium to a position on the playing field that is advantageous or disadvantageous for a game player (i.e., a drawing for selecting a transporting position of the game medium on the playing field) by switching between the path (path made up of the first and second guide parts) for transporting the approximately spherical shaped game medium to the first position on the playing field that realizes a game condition advantageous for a game player, and the path (path made up of the first and third guide parts) for transporting the approximately spherical shaped game medium to a position on the playing field that realizes a game condition disadvantageous for a game player. It is possible to realize one of the plural kinds of drawings using the approximately spherical shaped game medium with use of the path switching drawing mechanism.

<2> The game medium transporting path selection mechanism may further include an interlocking and releasing mechanism for interlocking and releasing the game medium existing in the first starting point, and an operating part for performing an operation of interlocking and releasing the game medium.

Switching of the paths is performed by a path switching drawing mechanism 1810. However, which of a second guide part 1825 and a third guide part 1826 the path switching drawing mechanism 1810 carries the game medium to may be configured to depend on the timing when the game medium is released by an interlocking and releasing mechanism 1809. Here, the path switching drawing mechanism 1810 is configured to automatically switch between the transporting paths depending on the timing when the game medium reaches a first ending point 1804. For example, it is possible to realize this configuration by configuring the path switching drawing mechanism 1810 to automatically switch between the transporting paths at a constant period. In this case, the timing when the game medium is released by the interlocking and releasing mechanism 1809 depends on interlocking and releasing operations with the operating part 1830. The operations are performed by a game player. As a result, it is possible to configure switching between the transporting paths to be dependent on a game player's operation. When the game medium is released by the interlocking and releasing mechanism 1809, the game medium rotationally moves along a sloped rail portion 1801. Then, the game medium falls to either a first rotationally moving portion 1820 or a second rotationally moving portion from a circular arc shaped bottom portion 1804. It is possible to influence the drawing result of a transporting position of the game medium by the timing when the game medium is released by the interlocking and releasing mechanism 1809. In other words, it is possible to configure the drawing result of a transporting position of the game medium to be dependent on the timing when the game medium is released by the interlocking/releasing mechanism 1809. Also, the operating part 1830 for performing interlocking and releasing of the interlocking/releasing mechanism 1809 is provided, and a game player operates the operating part 1830. Therefore, it is possible to configure the timing when the game medium is released by a game player's operation to influence the drawing result of a transporting position of the game medium. In other words, it is possible to configure the drawing result of a transporting position of the game medium to be dependent on the timing when the game medium is released by a game player's operation.

Typically, the game medium transporting path selection mechanism may have the following schematic configuration. That is, the game medium transporting path selection mechanism may be configured to include at least the sloped rail portion 1801, a reciprocation receiving part 1820, the second guide part 1825, and the third guide part 1826. The sloped rail portion 1801 corresponds to the first guide part, and the reciprocation receiving part 1820 corresponds to the above described path switching drawing mechanism.

The sloped rail portion 1801 functioning as the first guide part includes a starting end portion 1802, an ending end portion 1803 with the height level lower than that of the starting end portion 1802, and the circular arc shaped bottom portion 1804 with the height level lower than that of the ending end portion 1803, which is positioned in the vicinity of the ending end portion 1803. Also, it is possible to configure the sloped rail portion 1801 to finally guide the approximately spherical shaped game medium to the circular arc shaped bottom portion 1804 by rotationally moving the game medium toward the ending end portion 1803 from the starting end portion 1802 by means of gravity.

It is possible to configure the reciprocation receiving part 1820 functioning as the path switching drawing mechanism to reciprocate a vicinity area 1804*b* of a first side portion 1804*a* of the circular arc shaped bottom portion 1804 along a direction in which the sloped rail portion 1801 is extended. It is also possible to configure the reciprocation receiving part 1820 to increase probability of receiving the game medium rotationally fallen from the first side portion 1804*a* of the circular arc shaped bottom portion 1804 in a first area within the vicinity area 1804 that is adjacent to the first side portion 1804*a* and increase probability of dropping the game medium rotationally fallen from the first side portion 1804*a* without receiving it in an area within the vicinity area 1804*b* that is different from the first area.

It is possible to set the reciprocation of the reciprocation receiving part 1820 to be automatic swinging movement in a constant period. In this case, it is possible to configure the drawing result to be dependent on the timing when a game player shoots the game medium into the sloped rail portion 1801 in a drawing using the approximately spherical shaped game medium. Also, it is possible to set the reciprocation to be irregular or random swinging movement. In this case, it is possible to configure a drawing to be more like gambling by reducing the extent that the result of a drawing with the approximately spherical shaped game medium depends on the timing when a game player shoots the game medium into the sloped rail portion 1801.

When the reciprocation receiving part 1820 is positioned in an area within the vicinity area 1804*b* that is different from the first area, probability that the game medium rotationally falls sideways from the first side portion 1804*a* of the circular arc shaped bottom portion 1804 will be increased, and probability that the game medium fallen without being received by the reciprocation receiving part 1804 is transported to the second position via the third guide part 1826 will be increased.

The circular arc shaped bottom portion 1804 is preferably configured to further include a first sloped portion 1804-1 that is sloped toward the first side portion 1804*a*. According to the configuration, it is possible to configure the game medium (B1/B2) finally guided to the circular arc shaped bottom portion 1804 to rotationally fall toward the first side portion from the first sloped portion 1804-1.

The sloped rail portion 1801 preferably includes a curved portion having approximately constant curvature with the circular arc shaped bottom portion 1804 as a center. It is possible to configure the game medium (B1/B2) to dampingly swing around the circular arc shaped bottom portion 1804 and to have little kinetic energy finally at the circular arc shaped bottom portion 1804 with the lowest height level, because the sloped rail portion 1801 includes the curved portion having approximately constant curvature with the circular arc shaped bottom portion 1804 as a center. With the configuration, it is possible to configure the game medium (B1/B2) shot from the starting end portion 1892 of the sloped rail portion 1801 to be finally guided to the circular arc shaped bottom portion 1804.

<3> A game medium transporting position drawing mechanism in accordance with the present invention is a game medium transporting position drawing mechanism that is configured to be applied to the game device 1 including a disposition surface (501, 511) of the approximately spherical shaped game medium B1/B2 and the pusher part 510. The game medium transporting position drawing mechanism includes the starting end portion 1802, the ending end portion 1803 with the height level lower than that of the starting end portion 1802, and the circular arc shaped bottom portion 1804 that is positioned in the vicinity of the ending end portion 1803 and has the height level lower than that of the ending end portion 1803. Also, the game medium transporting position drawing mechanism further includes the sloped rail portion 1801 functioning as the first guide part, first and second rotationally discharging parts, the second guide part 1825, and the third guide part 1826. Here, the sloped rail portion 1801 is configured to rotationally move the game medium from the starting end portion 1802 to the ending end portion 1803 by means of gravity and finally guide the game medium to the circular arc shaped bottom portion 1804. The first and second rotationally discharging parts are disposed in the vicinity of the first side portion 1804*a* of the circular arc shaped bottom portion 1804 and rotationally discharge the game medium rotationally fallen from the first side portion 1804*a* of the circular arc shaped bottom portion 1804. The second guide part 1825 is communicated with the first rotationally discharging part and is configured to guide the game medium to the first position on the playing field 500, which is separated from an end portion of the pusher part 510 in the pushing direction (i.e., the front end 501*a*) at a first distance. The third guide part 1826 is communicated with the second rotationally discharging part and is configured to guide the game medium to the second position on the playing field 500, which is separated from the end portion (i.e., the front end 501*a*) at a second distance greater than the first distance.

For example, the first position is located on the playing field 500, and is separated from the end portion in the pushing direction of the pusher part 510 (i.e., the front end 501*a*) at the first distance. The first position is also located in the front side area close to the end portion. For example, the second position is located on the playing field 500, and is separated from the end portion (i.e., the front end 501*a*) at the second distance greater than the first distance. The second position is also located in the rear side area away from the end portion. For example, it is possible to set the first position to be a position on the main table 501, which is separated from the front end 501*a* at the first distance. For example, it is possible to set the second position to be a position on the main table 501, which is separated from the front end 501*a* at the second distance (greater than the first distance). Also, it is possible to set the first position to be a position in the vicinity of the front end 501*a* of the main table 501 (i.e., a front side position), and it is possible to set the second position to be a position on the opposite side from the front end 501*a* of the main table 501 (i.e., a rear side position).

The sloped rail portion 1801 includes the circular arc shaped bottom portion 1804 with the height level lower than that of the starting end portion 1802 and that of the ending end portion 1803. The game medium is finally guided to the circular arc shaped bottom portion 1804. In other words, once the game medium starts rotationally moving toward the ending end portion 1803 from the starting end portion 1802 by means of gravity, the game medium reciprocates between the starting end portion side and the ending end portion side in the vicinity of the circular arc shaped bottom portion 1804 (i.e., dampingly moves) and is finally guided to the circular arc shaped bottom portion 1804. After this, the game medium falls into either the reciprocation receiving part 1820 functioning as the first rotationally discharging part or the reciprocation receiving part 1820 functioning as the second rotationally discharging part. The first rotationally discharging part rotationally discharges the game medium to the second guide part 1825, and guides it to the first position on the playing field 500. The second rotationally discharging part rotationally discharges the game medium to the third guide part 1826, and guides it to the second position on the playing field 500. To which of the first and second positions the game medium is supplied depends on to which of the first rotationally discharging part 1820 and the second rotationally discharging part the game medium rotationally falls from the first side portion of the circular arc shaped bottom portion 1804. Therefore, it is possible to draw either the option of transporting the approximately spherical shaped game medium to the first position on the playing field 500, which realizes a game condition advantageous for a game player, or the option of transporting the approximately spherical shaped game medium to the second position on the playing field 500, which realizes a game condition disadvantageous for a game player, depending on whether or not the game medium rotationally falls into the reciprocation receiving part 1820 (i.e., depending on into which of the first rotationally discharging part 1820 and the second rotationally discharging part the game medium rotationally falls).

<4> The game medium transporting position drawing mechanism may includes the reciprocation receiving part 1820. It is possible to configure the reciprocation receiving part 1820 to reciprocate the vicinity area 1804*b* of the first side portion 1804*a* of the circular arc shaped bottom portion 1804 along a direction in which the sloped rail portion 1801 is extended. It is also possible to configure the reciprocation receiving part 1820 to receive the game medium rotationally fallen from the first side portion 1804*a* of the circular arc shaped bottom portion 1804 in the first area within the vicinity area 1804*b* that is adjacent to the first side portion 1804*a*, and drop the game medium rotationally fallen from the first side portion 1804*a* without receiving it in an area within the vicinity area 1804*b* that is different from the first area. Here, it is possible to configure the second guide part 1825 to transport the game medium within the reciprocation receiving part 1820 to the first position when the reciprocation receiving part 1820 is positioned in the second area within the vicinity area 1804*b*, which is different from the first area. Also, it is possible to configure the third guide part 1826 to transport the game medium, which rotationally fell sideways from the first side portion 1804*a* of the circular arc shaped bottom portion 1804 and then fell down without being received by the reciprocation receiving part 1820, to the second position when the reciprocation receiving part 1820 is positioned in the area within the vicinity area 1804*b*, which is different from the first area.

In the above described configuration, the reciprocation receiving part 1820 receives the game medium transported from the first side portion 1804*a* of the circular arc shaped bottom portion 1804 and rotationally discharging the game medium to the second guide part 1825 when the reciprocation receiving part 1820 is positioned s in the first area. Thus the reciprocation receiving part 1820 makes up the first rotationally discharging part. Also, a path of the game medium that falls down without being received by the reciprocation receiving part 1820 and is rotationally discharged to the third guide part 1826 (i.e., the vicinity area 1804*b* in which the reciprocation receiving part 1820 does not exist) makes up the second rotationally discharging part.

<5> The circular arc shaped bottom portion 1804 is preferably configured to further include the first sloped portion 1804-1 that is sloped toward the first side portion 1804*a*. In the configuration, it is possible to configure the game medium (B1/B2) finally guided to the circular arc shaped bottom portion 1804 to rotationally fall from the first sloped portion 1804-1 to the first side portion 1804*a*.

<6> The sloped rail portion preferably includes a curved portion having approximately constant curvature with the circular arc shaped bottom portion as a center. The sloped rail portion 1801 preferably includes a curvature portion having approximately constant curvature with the circular arc shaped bottom portion 1804 as a center. It is possible to configure the game medium (B1/B2) to dampingly swing around the circular arc shaped bottom portion 1804 and finally have little kinetic energy at the circular arc shaped bottom portion 1804 with the lowest height level, because the sloped rail portion 1801 includes a curved portion having approximately constant curvature with the circular arc shaped bottom portion 1804 as a center. With the configuration, it is possible to configure the game medium (B1/B2) shot from the starting end portion 1802 of the sloped rail portion 1801 to be finally guided to the circular arc shaped bottom portion 1804.

<7> The game medium transporting position drawing mechanism preferably further includes a first control mechanism that is provided in the starting end portion and is configured to control interlocking and releasing operations of the game medium so that the game medium rotationally moves along the sloped rail portion toward the ending end portion. When the game medium is released by the first control mechanism, the game medium rotationally moves along the sloped rail portion 1801, and then the game medium falls from the circular arc shaped bottom portion 1804 to either the first rotationally moving portion or the second rotationally moving portion. It is possible to influence the drawing result of a transporting position of the game medium by the timing when the game medium is released by the first control mechanism. In other words, it is possible to make the drawing result of a transporting position of the game medium to be dependent on the timing when the game medium is released by the first control mechanism.

The game medium transporting position drawing mechanism preferably further includes a first operating part for operating the first control mechanism. It is possible to determine the timing when the game medium is released by the first control mechanism by a game player's operation of the first operating part. Therefore, it is possible to configure the timing when the game medium is released by a game player's operation to influence the drawing result of a transporting position of the game medium. In other words, it is possible to configure the drawing result of a transporting position of the game medium to be dependent on the timing when the game medium is released by a game player's operation.

The first operating part is preferably separated from the first control mechanism, and is configured to be electrically or mechanically functionally-coupled to the first control mechanism and perform remote control of interlocking and releasing operations. In this case, it is possible to perform remote control of the first control mechanism by the first operating part, and it is also possible to dispose the first control mechanism and the first operating part to be separated from each other. Therefore, it is not necessarily required to dispose a position of shooting the game medium into the sloped rail portion 1801 and a playing position of a game player to be adjacent to each other, and accordingly it is possible to arbitrary designate arrangement of the sloped rail portion 1801 and the first operating part.

<8> The reciprocation is preferably automatic swinging movement in a constant period. In this case, it is possible to configure a drawing using the approximately spherical shaped game medium so that the drawing result depends on the timing when a game player shoots the game medium into the sloped rail portion. Also, it is possible to configure the reciprocation to be irregular or random swinging movement. In this case, it is possible to configure a drawing using the approximately spherical shaped game medium to be more like gambling by reducing the extent that the drawing depends on the timing when a game player shoots the game medium into the sloped rail portion.

Figure 45:
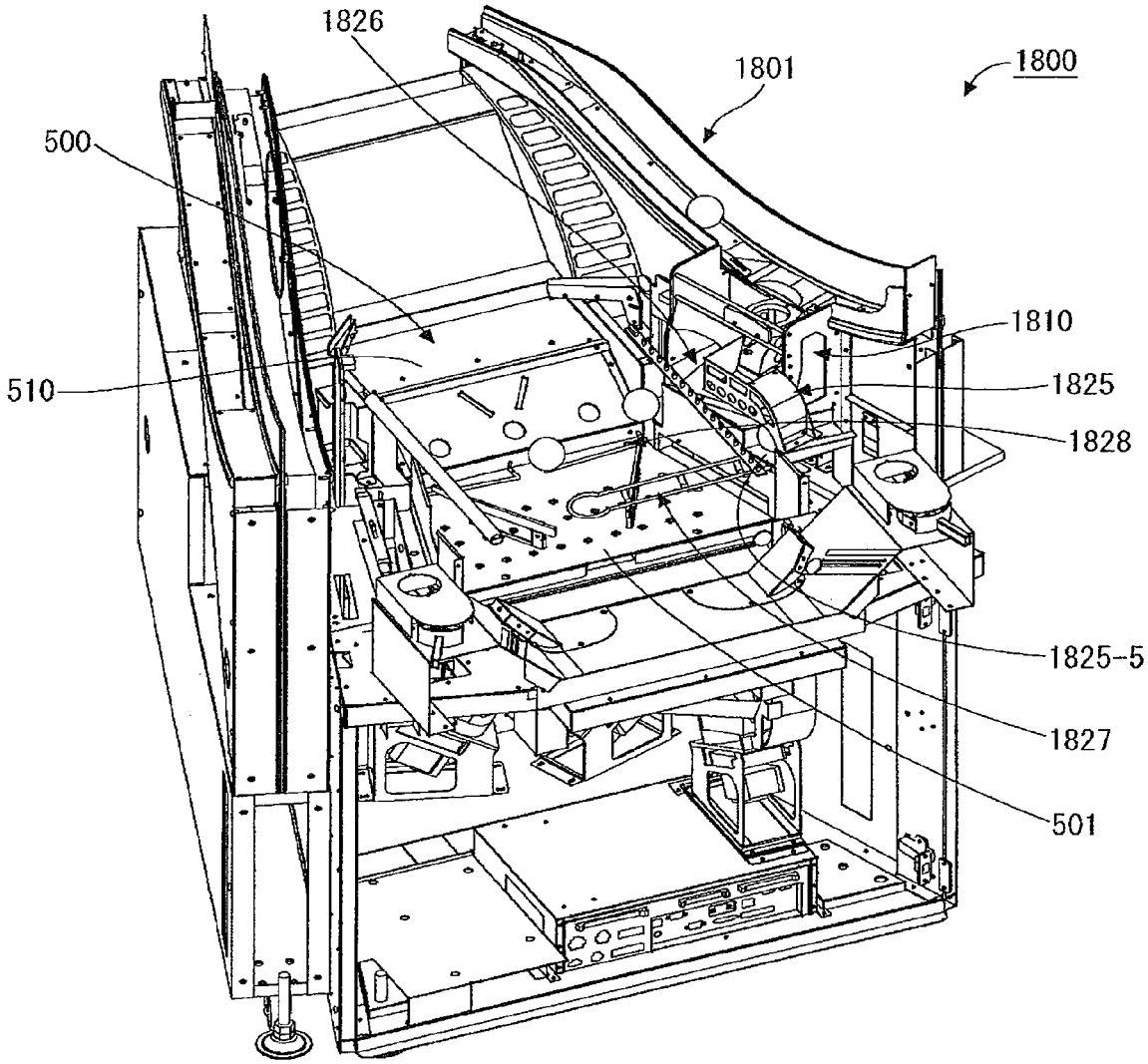
FIG. 45 is a diagram illustrating the entire configuration of a game medium transporting position drawing mechanism of an embodiment of the present invention.

The ball shooting mechanism 1800 in accordance with an embodiment of the present invention will be hereinafter specifically explained with reference to FIGS. 45 and 46. FIG. 45 is a diagram of illustrating the entire configuration of the ball shooting mechanism 1800. FIG. 45 is a diagram of illustrating main elements of the ball shooting mechanism 1800.

It is possible to realize the approximately spherical shaped game medium by the ball B1/B2. The ball shooting mechanism 1800 includes the sloped rail portion 1801 functioning as the first guide part, and the ball shooting position drawing mechanism 1810 functioning as the path switching drawing mechanism. In other words, it is possible to realize the above described sloped rail portion by the sloped rail portion 1801. The sloped rail portion 1801 includes the starting end portion 1802, the ending end portion 1803 with the height level lower than that of the starting end portion 1802, the circular arc shaped bottom portion 1804 that is positioned in the vicinity of the ending end portion 1803 and has the height level lower than that of the ending end portion 1803, a sloped portion 1805 for coupling the starting end portion 1802 and the circular arc shaped bottom portion 1804, a first sidewall 1806 that is formed to be continuously extended from the starting end portion 1802 to the ending end portion 1803, a second sidewall 1807 that is formed to extended from the starting end portion 1802 to the ending end portion 1803 excluding the vicinity of the circular arc shaped bottom portion 1804, and an end wall 1808 that is positioned in the ending end portion 1803. The first sidewall 1806 and the second sidewall 1807 are provided to reliably transport the ball B1/B2 from the starting end portion 1802 to the circular arc shaped bottom portion 1804 while the ball B1/B2 is constrained in a direction perpendicular to a direction in which the sloped rail portion 1801 is extended (i.e., a lateral part direction of the sloped rail portion 1801). Also, the circular arc shaped bottom portion 1804 includes the first side portion 1804*a* that is exposed toward the playing field 500 (i.e., toward the main table 501), and the first sloped portion 1804-1 that is sloped to the first side portion 1804*a*.

The interlocking/releasing operation control mechanism 1809 is provided in the starting end portion 1802, and functions as an interlocking and releasing mechanism for controlling interlocking and releasing operations of the ball B1/B2. Specifically, it is possible to form the interlocking/releasing operation control mechanism 1809 by a ball blocking pin that is protruded upward from a hole formed in the starting end portion 1802. The ball blocking pin is formed to be capable of being protruded from the hole and retracted into the hole.

Also, the interlocking/releasing operating part 1830 is provided that is separated from the interlocking/releasing operation control mechanism 1809 and is electrically or mechanically functionally-coupled to the interlocking/releasing operation control mechanism 1809. The interlocking/releasing operating part 1830 is also configured to perform remote control of interlocking and releasing operations. For example, as illustrated in FIG. 40, it is possible to provide the interlocking/releasing operating part 1830 in the operating part 450 of the medal discharging path 400. Specifically, it is possible to realize the interlocking/releasing operating part 1830 by the push button 1830.

The ball B1/B2 is interlocked with the ball blocking pin and is halted at the starting end portion 1802 until a game player pushes the push button 1830. When a game player pushes the push button 1830, the ball blocking pin is retracted into the hall. Accordingly the ball B1/B2 is released and rotationally falls along the sloped portion 1805 from the starting end portion 1802 by means of gravity. When rotating along the sloped portion 1805, the ball B1/B2 obtains the kinetic energy. Therefore, the ball B1/B2 passes through the circular arc shaped bottom portion 1804, hits the end wall 1808 of the ending end portion 1803, rotates in the opposite direction, and passes through the circular arc shaped bottom portion 1804 in the opposite direction. After this, the kinetic energy of the ball B1/B2 will be zero at the lower area of the sloped portion 1805. Then, the ball B1/B2 starts rotating in a forward direction (i.e., toward the ending end portion 1803). The ball B1/B2 dampingly swings around the circular arc shaped bottom portion 1804, because the sloped rail portion 1801 includes a curved portion having approximately constant curvature with the circular arc shaped bottom portion 1804 as a center. Finally, little kinetic energy of the ball B1/B2 will be left at the circular arc shaped bottom portion 1804 with the lowest height level. The ball B1/B2 that has little kinetic energy rotationally falls from the first sloped portion 1804-1 to the first side portion 1804*a*, because the circular arc shaped bottom portion 1804 includes the first sloped portion 1804-1 that is sloped toward the first side portion 1804*a* (side portion on the playing field 500 side) of the above described sloped rail portion 1801.

Figure 46:
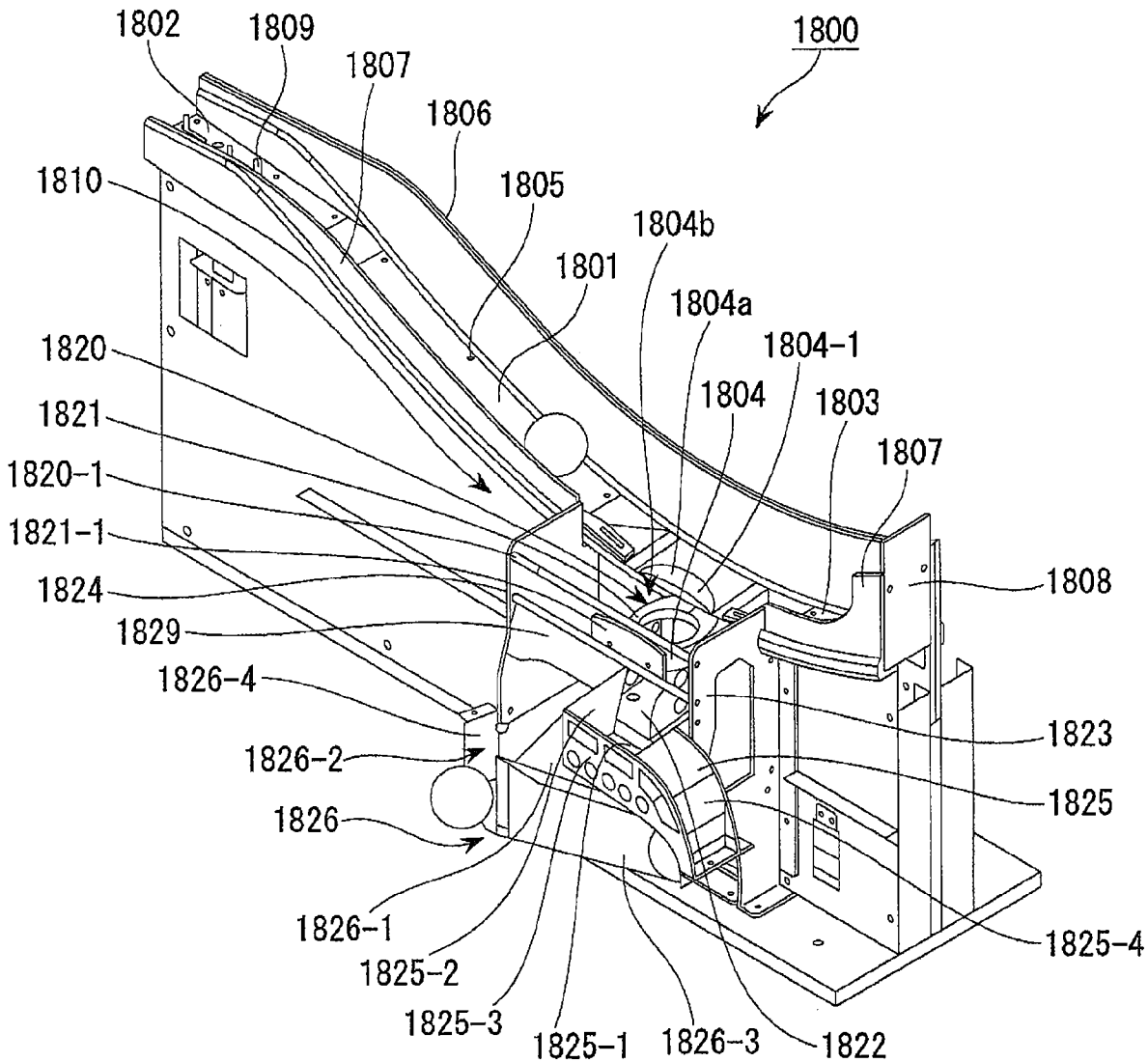
FIG. 46 is a diagram illustrating main elements of the game medium transporting position drawing mechanism illustrated in FIG. 45.

As illustrated in FIGS. 45 and 46, the reciprocation receiving part 1820 is disposed in the vicinity area 1804*b* of the circular arc shaped bottom portion 1804. Here, the vicinity area 1804*b* is an area abutting along the portion of the sloped rail portion 1801 on the main table 501 side, and is divided in the anteroposterior direction by a sidewall 1823 and a sidewall 1824. The vicinity area 1804*b* is made up of a first area adjacent to the first side portion 1804*a* of the circular arc shaped bottom portion 1804, an area that is extended to the sidewall 1823 on the front side of the first area, and an area that is extended to the sidewall 1824 on the rear side of the first area. The reciprocation receiving part 1820, which automatically swings the first area adjacent to the first side portion 1804 of the circular arc shaped bottom portion 1804, the area that is extended to the sidewall 1823 on the front side of the first area, and the area that is extended to the sidewall 1824 on the rear side of the first area, along the extended direction of the sloped rail portion 1801 at a constant period, receives the ball B1/B2 fallen from the first side portion 1804*a* of the circular arc shaped bottom portion 1804 in the first area within the vicinity area 1804*b* that is adjacent to the first side portion 1804*a* with high probability. In other words, when the reciprocation receiving part 1820 is in the first area adjacent to the circular arc shaped bottom portion 1804, the reciprocation receiving part 1820 easily receives the ball B1/B2 rotationally fallen from the circular arc shaped bottom portion 1804.

The reciprocation receiving part 1820 is configured to drop the ball B1/B2 rotationally falling from the first side portion 1804*a* of the circular arc shaped bottom portion 1804 with high probability without receiving it in the area within the vicinity area 1804*b* that is different from the first area (i.e., the area extended to the sidewall 1823 on the front side of the first area or the area extended to the sidewall 1824 on the rear side of the first area). The ball B1/B2 not received by the reciprocation receiving part 1820 falls on a rotationally moving surface 1826-1 of a second transporting path 1826 (the third guide part), and is supplied to the rear side of the main table 501 through a fourth transporting path 1828. The inner space of the reciprocation receiving part 1820 is communicated with a first transporting path 1825 (the second guide part). The second area is different from the first area. In the present embodiment, the second area is an area including a position that the reciprocation receiving part 1820 is located closest to the sidewall 1823. The reciprocation receiving part 1820 is capable of receiving the ball B1/B2 from the circular arc shaped bottom portion 1804 in the first area with high probability, and is capable of rotationally discharging the ball B1/B2 to the first transporting path 1825 (the second guide part) in the second area. It is possible to configure the reciprocation receiving part 1820 to function as the first rotationally discharging part for rotationally discharging the ball B1/B2 from the circular arc shaped bottom portion 1804. Also, it is possible to configure the first area without the reciprocation receiving part 1820 to function as the second rotationally discharging part for rotationally discharging the ball B1/B2 to the rotationally moving surface 1826-1 of the second transporting path 1826 without receiving it.

It is possible to configure the reciprocation receiving part 1820 to receive the ball B1/B2 from the circular arc shaped bottom portion 1804 in a plurality of anteroposterior positions in the first area, not in a predetermined single position. Also, it is possible to configure the reciprocation receiving part 1820 to rotationally discharge the ball B1/B2 to the first transporting path 1825 in a plurality of anteroposterior positions in the second area, not in a predetermined single position.

Note that the reciprocation receiving part 1820 may be configured to receive the ball B1/B2 from the circular arc shaped bottom portion 1804 in a predetermined single position corresponding to the first area. Also, the reciprocation receiving part 1820 may be configured to rotationally discharge the ball B1/B2 to the first transporting path 1825 in a predetermined single position corresponding to the second area.

The reciprocation receiving part 1820 is made up of a ball receiving hole 1821 and a ball receiving container 1822. The ball receiving hole 1821 is a frame shaped member including a hole through which the ball B1/B2 is capable of passing, and includes a rail engaging portion 1821-1 in one of lateral surfaces. The ball receiving container 1822 receives the ball B1/B2 through the ball receiving hole 1821, and contains it in the space delimited by two sidewalls opposed to the sidewalls 1823 and 1824 and a bottom portion. The bottom portion is slightly sloped in the direction of the first transporting path 1825. In other words, the bottom portion is slightly sloped toward the main table 501. Force for rotationally falling toward the main table 501 is applied to the ball B1/B2 that entered the ball receiving container 1822 by the slope of the bottom portion. The inner space of the ball receiving container 1822 is communicated with the first transporting path 1825, and the bottom portion of the ball receiving container 1822 is sloped toward the first transporting path 1825. Therefore, the ball that rotationally entered the ball receiving hole 1821 is rotationally discharged toward the first transporting path 1825 via the ball receiving container 1822. A rail 1820-1 is provided between the sidewall 1823 on the front side and a wall 1824 on the rear side. The rail engaging portion 1821-1 of the ball receiving hole 1821 is engaged with the rail 1820-1, and the reciprocation receiving part 1820 reciprocates along the rail 1820-1.

The first transporting path 1825 is communicated with a third transporting path 1827. The third transporting path 1827 is extended to a position on the front side of the main table 501, and supplies the ball B1/B2 to the front side of the main table 501. This produces a game condition advantageous for a game player.

The first transporting path 1825 (the second guide part) includes a rotationally moving surface 1825-1, a wall 1825-2 provided on the rear side end portion of the rotationally moving surface 1825-1, a sidewall 1825-3 provided on the main field side of the rotationally moving surface 1825-1, and a cover 1825-4 for covering the front side of the rotationally moving surface 1825-1. Here, the rotationally moving surface 1825-1 is extended to be sloped downward from a starting point to the front side while the starting point is set as a part of the area in which the reciprocation receiving part 1820 reciprocates, which is located on the sidewall 1823 side, more specifically, the area adjacent to the second area on the main table side. As illustrated in FIG. 45, the first transporting path 1825 further includes a rotationally moving surface 1825-5 that is provided on the tip side of the rotationally moving surface 1825-1 at the height level lower than that of the rotationally moving surface 1825-1. While the rear side end portion of the rotationally moving surface 1825-1 is set to be a starting point and the rotationally moving surface 1825-5 is set to be an ending point, the first transporting path 1825 transports the ball B1/B2 that the first transporting path 1825 received from the reciprocation receiving part 1820 toward the front side from the rear side. The ball B1/B2 transported by the first transporting path 1825 is transferred to the third transporting path 1827.

The third transporting path 1827 is made up of a rail portion extended to the center part of the main table 501 and a ball receiving ring that is continuously formed in the tip of the rail portion Here, the starting point of the third transporting path 1827 is set to be the ending point of the rotationally moving surface 1825-5 on the front side of the main table 501, and the ending portion thereof is set to be the ball receiving ring. The third transporting path 1827 is sloped downward (i.e., toward the main table 501) from the rail portion to the ball receiving ring. The rail interval of the rail portion is configured so that the ball B1/B2 moves on the rail portion without falling to the main table 501 and is transported to the ball receiving ring. The ball B1/B2 that reached the ball receiving ring passes through the ball receiving ring and falls to the main table 501.

The second transporting path 1826 (the third guide part) includes the rotationally moving surface 1826-1 and a discharge hole 1826-2. The rotationally moving surface 1826-1 is extended below the area in which the reciprocation receiving part 1820 reciprocates and below the first transporting path 1825. The discharge hole 1826-2 is opened to the main table 501 on the rear side of the main table 501 at the height level higher than that of the main table 501. The rotationally moving surface 1826-1 is entirely sloped downward to the discharge hole 1826-2. A sidewall 1826-3 is provided on the front side of the rotationally moving surface 1826-1, and is extended from the front side to the rear side so as to be sloped from the sloped rail portion 1801 side to the main table 501 side. A sidewall 1826-4 is provided on the rear side of the rotationally moving surface 1826-1, and is protruded toward the main table 501 while it is adjacent to lower part of the wall 1824. The ball B1/B2 is transported to the discharge hole 1826-2 by means of the rotationally moving surface 1826-1, the sidewalls 1826-3 and 1826-4. The second transporting path 1826 transports the ball B1/B2 while a part below the area in which the reciprocation receiving part 1820 reciprocates (i.e., a part below the side portion of the sloped rail portion 1801) is set to be the starting point and the discharge hole 1826-2 is set to be the ending point.

The fourth transporting path 1828 is made up of a rail portion on the rear side of the main table 501, which is extended from a part below the discharge hole 1826-2 of the second transporting path 1826 to the center part on the rear side of the main table 501. The fourth transporting path 1828 transports the ball B1/B2 while a part below the discharge hole 1826-2 of the second transporting path 1826 is set to be the starting point and the center part of the rear side of the main table 501 is set to be the ending point.

Specifically, it is possible to configure the reciprocation receiving part 1820 to reciprocate between the sidewalls 1823 and 1824 (i.e., in the vicinity area 1804*b*) at an approximately constant period. The vicinity area 1804*b* in which reciprocation is performed is made up of a first area adjacent to the first side portion 1804*a* of the circular arc shaped bottom portion 1804, an area extended to the sidewall 1823 on the front side of the first area, and an area extended to the sidewall 1824 on the rear side of the first area. With the configuration, the ball B1/B2 is received by the reciprocation receiving part 1820 with high probability if the reciprocation receiving part 1820 in motion of reciprocation is positioned in the first area adjacent to the first sloped portion 1804-1 when the ball B1/B2 rotationally falls from the first sloped portion 1804-1. As illustrated in FIG. 46, the reciprocation receiving part 1820 is communicated with the first transporting path 1825. As illustrated in FIG. 45, the ball B1/B2 is supplied to the front side of the main table 501 via the first transporting path 1825 and the third transporting path 1827. This produces a game condition advantageous for a game player.

On the other hand, if the reciprocation receiving part 1820 in motion of reciprocation is not capable of receiving the ball B1/B2 when the ball B1/B2 rotationally falls from the first sloped portion 1804-1, the ball B1/B2 falls to the rotationally moving surface 1826-1 of the second transporting path 1826 that is extended at the height level lower than the height level at which the reciprocation receiving part 1820 reciprocates. Then, the ball B1/B2 is supplied to the rear side of the main table 501 via the second transporting path 1826 and the fourth transporting path 1828. This produces a game condition disadvantageous for a game player.

A drawing performed by the ball shooting drawing mechanism 1810 switches between a path for transporting the ball B1/B2 to a position on the front side of the playing field 500 (i.e., the path made up of the sloped rail portion 1801, the reciprocation receiving part 1820, and the first transporting path 1825), which realizes a game condition advantageous for a game player, and a path for transporting the ball B1/B2 to the rear side of the playing field 500 (i.e., the path made up of the sloped rail portion 1801 and the second transporting path 1826), which realizes a game condition disadvantageous for a game player. With the configuration, it is possible to perform a drawing for transporting the ball B1/B2 to either a position advantageous for a game player or a position disadvantageous for a game player on the playing field 500 (i.e., a drawing for selecting a transporting position of the ball B1/B2 on the playing field 500). It is possible to realize one of plural kinds of drawings using the approximately spherical shaped game medium with the ball shooting drawing mechanism 1810.

The sloped rail portion 1801 includes the circular arc shaped bottom portion 1804 with the height level lower than that of the starting end portion 1802 and that of the ending end portion 1803. The game medium is finally guided to the circular arc shaped bottom portion 1804. In other words, the game medium, which started rotationally moving from the starting end portion 1802 toward the ending end portion 1803 by means of gravity, reciprocates between the starting end portion side and the ending end portion side in the vicinity of the circular arc shaped bottom portion 1804 (i.e., dampingly moves), and is finally either received by the reciprocation receiving part 1820 after it falls from the circular arc shaped bottom portion 1804, or falls from the circular arc shaped bottom portion 1804 without being received by the reciprocation receiving part 1820. The ball B1/B2 received by the reciprocation receiving part 1820 is guided to the front side of the playing field 500 via the first transporting path 1825. On the other hand, the ball B1/B2 fallen without being received by the reciprocation receiving part 1820 is then received by the second transporting path 1826, and is guided to the rear side of the playing field 500. Which of the front side and the rear side of the playing field the ball B1/B2 is supplied to depends on whether or not the ball B1/B2 from the first side portion 1804*a* of the circular arc shaped bottom portion 1804 is received by the reciprocation receiving part 1820. Therefore, it is possible to perform a drawing of selecting either an option of transporting the ball B1/B2 to the front side of the playing field 500, which realizes a game condition advantageous for a game player, or an option of transporting the ball B1/B2 to the rear side of the playing field 500, which realizes a game condition disadvantageous for a game player, depending on into which of the rotationally moving portions the ball B1/B2 rotationally falls from the first side portion 1804*a* of the circular arc shaped bottom portion 1804, with use of the sloped rail portion 1801 including the circular arc shaped bottom portion 1804 disposed at the height level lower than that of the starting end portion 1802 and that of the ending end portion 1803, the reciprocation receiving part 1820 disposed in the vicinity of the first side portion of the circular arc shaped bottom portion 1804, the first transporting path 1825 communicated with the reciprocation receiving part 1820, and the second transporting path 1826 for receiving the ball B1/B2 fallen without being received by the reciprocation receiving part 1820. In other words, it is possible to perform a drawing of selecting a transporting position of the ball B1/B2 on the playing field 500 depending on whether or not the ball B1/B2 from the first side portion 1804*a* of the circular arc shaped bottom portion 1804 is received by the reciprocation receiving part 1820. It is possible to realize one of the plural types of drawings using the approximately spherical shaped game medium with the sloped rail portion 1801 and the reciprocation receiving part 1820.

Switching of paths is performed by the ball shooting drawing mechanism 1810. However, which of the first transporting path 1825 and the second transporting path 1826 the ball shooting mechanism 1810 transports the ball B1/B2 to is capable of being configured to be dependent on the timing when the ball B1/B2 is released by the interlocking/releasing operation control mechanism 1809. Here, the ball shooting drawing mechanism 1810 is configured to automatically switch between the transporting paths depending on the timing when the ball B1/B2 reaches the end wall 1808. It is possible to configure the timing when the ball B1/B2 is released by the interlocking/releasing operation control mechanism 1809 to influence the drawing result of a transporting position of the ball B1/B2. In other words, it is possible to configure the drawing result of a transporting position of the game medium to be dependent on the timing when the ball B1/B2 is released by the interlocking/releasing operation control mechanism 1809.

In this case, it is possible to configure the timing when the ball B1/B2 is released by the interlocking/releasing operation control mechanism 1809 so that a game player's operation of the interlocking/releasing operating part 1830, which depends on interlocking and releasing operations of the interlocking/releasing operating part 1830, influences the drawing result of a transporting position of the ball B1/B2. In other words, it is possible to configure the drawing result of a transporting position of the ball B1/B2 to be dependent on a game player's operation.

As described above, in the present embodiment, switching of the transporting paths of the ball B1/B2 is configured not to be directly operated by a game player, and the timing when the ball B1/B2 is released by the interlocking/releasing control mechanism 1809 is configured to be operated by a game player. Furthermore, switching of the transporting paths (i.e., selection of the transporting position) is configured to be dependent on a game player's operation, and the transporting path of the ball B1/B2 is configured to be drawn by the ball shooting drawing mechanism 1810. Thus, the switching of the transporting paths (i.e., selection of the transporting position) is configured to have contingency. Accordingly, it is possible to configure switching of the transporting paths of the ball B1/B2 (selection of the transporting position) to have contingency, while it is configured to be dependent on a game player's operation. With the configuration, it is possible to realize one of plural kinds of drawings using the approximately spherical shaped game medium with the path switching drawing mechanism.

As described above, according to the present invention, with the drawing mechanism having contingency of rotational moving direction of the ball B1/B2, it is possible to switch between the option of transporting the ball B1/B2 to the first position on the playing field 500, which is close to the end portion (the front end 501*a*) in the pushing direction of the pusher part 510, and the option of transporting the ball B1/B2 to the second position on the playing field 500, which is away from the end portion, and therefore it is possible to switch the option of producing a game condition advantageous for a game player and the option of producing a game condition disadvantageous for a game player by performing a drawing.

(1-9) Game

Next, a game to be provided for a game player in the present embodiment will be hereinafter specifically exemplified in detail with reference to the figures. As described above, in the present embodiment, in addition to a pusher game, a digital drawing game and two types of bingo games are provided with plural types of game media (the medal M and the balls B1 and B2). Note that in the present invention, the ball B1 is also referred to as a first drawing object, and the ball B2 is also referred to as a second drawing object. Also, in the present embodiment, a bingo game with the ball B1 or the ball B2 is exemplified. However, the present invention is not limited to this, and is allowed to be applied to any types of drawing games with a drawing medium such as the ball B1 and the ball B2 (this is also referred to as a first drawing game).

(1-9-1) Digital Drawing Game

First, a digital drawing game to be provided to a game player in the present embodiment will be explained in detail with reference to the figures. Note that in the present embodiment, a digital drawing game is exemplified that any of a plurality of prizes and a non-prize-winning option is given when an electrical drawing is performed. For example, the prizes may include a big bonus A prize, a big bonus B prize, a ball B1 prize A, a ball B1 prize B, a ball B2 prize A, a ball B2 prize B, a small prize A, a small prize B, and the like. Note that "electrical drawing" means a series of operations for generating a random number by means of software and specifying a prize that is preliminarily correspondingly allocated to the generated random number.

FIG. 47(*a*) is a diagram of illustrating an example of a screen shot to be displayed for a game player while a digital drawing game in accordance with the present embodiment is performed. FIG. 47(*b*) is a diagram of illustrating an example of image patterns to be used in the digital drawing game in accordance with the present embodiment. FIG. 47(*c*) is a table of illustrating notification range that is allocated to each of prizes in the digital drawing game in accordance with the present embodiment.

First, as illustrated in FIG. 47(*a*), in the digital drawing game in accordance with the present embodiment, a variable display part made up of seven spaces w1 to w7 is displayed on the display 701. Any of the image patterns illustrated in FIG. 47(*b*) is selectively displayed in each of the spaces w1 to w7.

For example, as illustrated in FIG. 47(*b*), the image patterns to be displayed in each of the spaces w1 to w7 include a big bonus A image pattern that is correspondingly allocated to the big bonus A prize, a big bonus B image pattern that is correspondingly allocated to the big bonus B prize, a ball B1 prize A image pattern that is correspondingly allocated to the ball B1 prize A, a ball B1 prize B image pattern that is correspondingly allocated to the ball B1 prize B, a ball B2 prize A image pattern that is correspondingly allocated to the ball B2 prize A, a ball B2 prize B image pattern that is correspondingly allocated to the ball B2 prize B, a small bonus A image pattern that is correspondingly allocated to the small bonus A prize, and a small bonus B image pattern that is correspondingly allocated to the small bonus B prize.

Here, it is possible to set the big bonus A prize to be a prize (this is also referred to as a fifth prize) for paying out the predetermined number of medal(s) M (e.g., 30 medals) to the playing field 500 of the station ST and for setting the game condition to be a normal game condition, for instance. It is possible to set the big bonus B prize to be a prize (this is also referred to as a sixth prize) for paying out the predetermined number of medal(s) M (e.g., 30 medals) to the playing field 500 of the station ST and for setting the game condition to be a probability change game condition, for instance.

It is possible to set the ball B1 prize A to be a prize (this is also referred to as a third prize) for paying out the non-metal ball B1 to the ball shooting mechanism 1800 (specifically, the sloped rail portion 1801) of the station ST with the ball carrier 1520, for instance. It is possible to set the ball B1 prize B to be a prize for paying out the non-metal ball B1 to the ball shooting mechanism 1600 (specifically, the saucer 1610) of the satellite SA with the ball carrier 1520.

It is possible to set the ball B2 prize A to be a prize (this is also referred to as a fourth prize) for paying out the metal ball B2 to the ball shooting mechanism 1800 (specifically, the sloped rail portion 1801) of the station ST with the ball carrier 1520, for instance. It is possible to set the ball B2 prize B to be a prize for paying out the metal ball B2 to the ball shooting mechanism 1600 (specifically, the saucer 1610) of the station ST with the ball carrier 1520, for instance.

It is possible to set the small bonus A prize to be a prize for paying out the predetermined number of medal(s) M (e.g., 8 medals) to the playing field 500 of the station ST, for instance. It is possible to set the small bonus B prize to be a prize for paying out the predetermined number of medal(s) M (e.g., 3 medals) to the playing field 500 of the station ST, for instance.

Also, in the variable display part, lines L1 to L3 are formed by the combination of three of the spaces w1 to w7, for instance. In the present embodiment, if any of the above described prizes is rewarded as a result of the electric drawing, the image pattern that is correspondingly allocated to the rewarded prize is displayed in all the spaces arranged in any of the lines L1 to L3. Therefore, when the image patterns arranged in any of the lines L1 to L3 are matched, it is possible for a game player to know that he/she wins a prize corresponding to the image pattern.

Also, it is possible to configure drawing of the prizes and the non-prize-winning option to be performed by the first control unit 600 in the station ST, for instance. In this case, the first control unit 600 performs an operation of generating a random number with a predetermined range of numbers (e.g., range between 0 and 4095) and specifying one of the prizes or the non-prize-winning option, which is correspondingly allocated to the prize-winning range including the number. Here, FIG. 47(*c*) illustrates an example of correspondence between the prize-winning range and the prizes or the non-prize-winning option in the normal mode (this is also referred to as a first game condition) and the probability change mode (this is also referred to as a second game condition), respectively. Note that the drawing may be performed by the second control unit in the satellite SA (not illustrated in the figure).

Also, in the present embodiment, the present game condition is displayed in the lower right part of the display 701, for instance. Furthermore, in the present embodiment, information of indicating the remaining number of performing the digital drawing game (this is referred to as stock) is displayed in the lower left part of the display 701.

Figure 48:
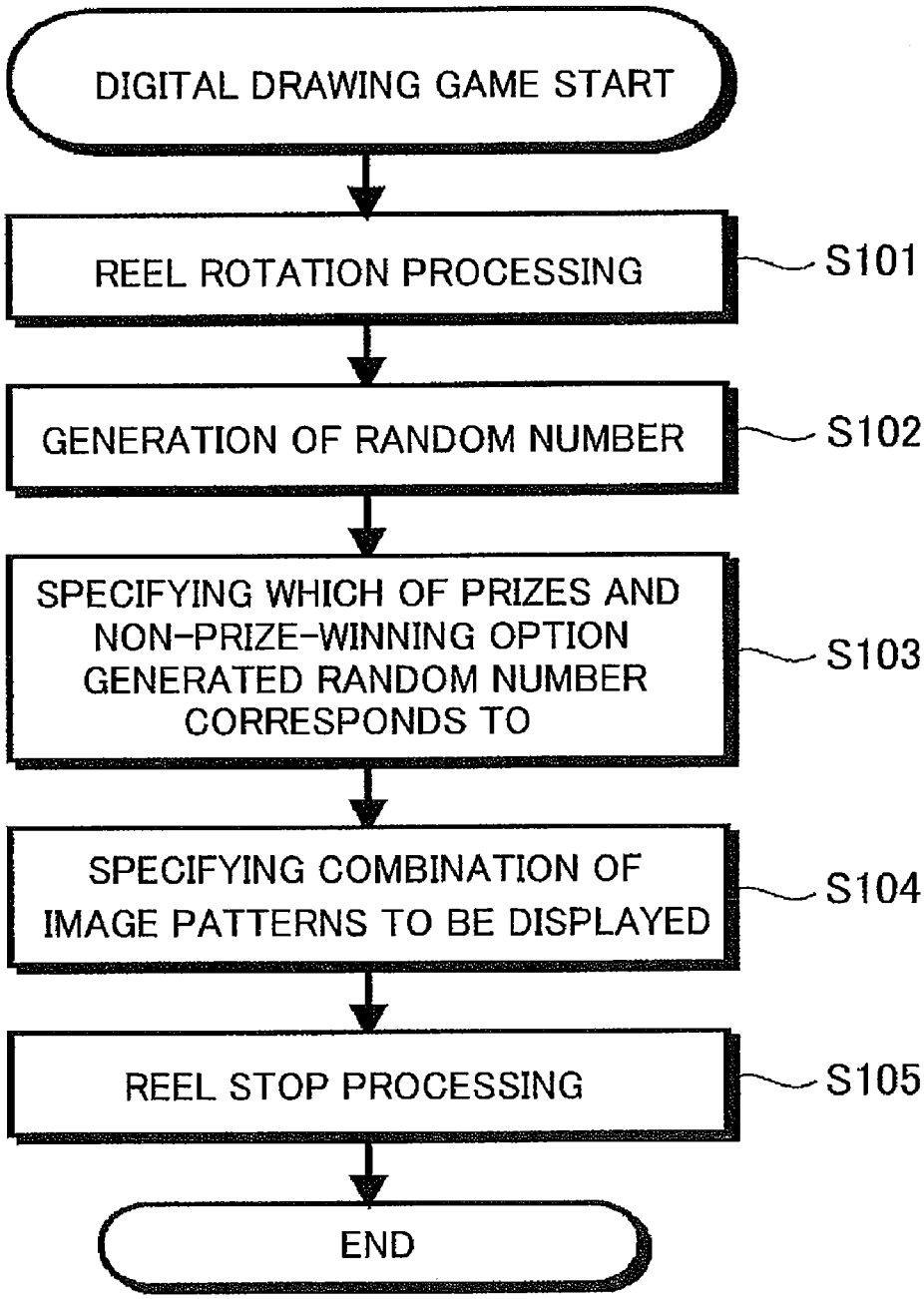
FIG. 48 is a flowchart illustrating a main flow of the digital drawing game in accordance with an embodiment of the present invention.

Next, the main flow of the digital drawing game will be hereinafter explained in detail with reference to the figures. FIG. 48 is a flowchart of illustrating the main flow of the digital drawing game in accordance with the present embodiment. Note that in the present explanation, a case is exemplified that the digital drawing game is performed in the first control unit 600 of the station ST.

As illustrated in FIG. 48, when the digital drawing game is started, the first control unit 600 in the station ST starts processing for randomly or regularly changing the image patters displayed in the spaces w1 to w7 into any of the image patterns illustrated in FIG. 47(*b*) (this is referred to as reel rotation processing) (Step S101).

Next, the first control unit 600 generates a random number based on predetermined algorithm (Step S102). Next, the first control unit 600 specifies which of the prizes and the non-prize-winning option the generated random number is correspondingly allocated to, for example, with the correspondence illustrated in FIG. 47(*c*) (Step S103). In other words, which of the prizes and the non-prize-winning option is rewarded as the result of a drawing is specified.

Next, the first control unit 600 specifies the combination of the image patterns to be displayed in the spaces w1 to w7 on the variable display part based on the rewarded prize or the non-prize-winning option, or based on the generated random number (Step S104).

Next, the first control unit 600 performs processing for stopping variable display of the image patterns in the spaces w1 to w7 (this is referred to as reel stop processing) so that the specified combination of the image patterns is displayed in the spaces w1 to w7 (step S105).

(1-9-2) Bingo Game

Next, a bingo game to be provided to a game player in the present embodiment will be hereinafter explained in detail with reference to the figures. Note that in the present embodiment, as described above, two types of bingo games, that is, a bingo game using the non-metal ball B1 and a bingo game using the metal ball B2 are provided to a game player.

Figure 49:
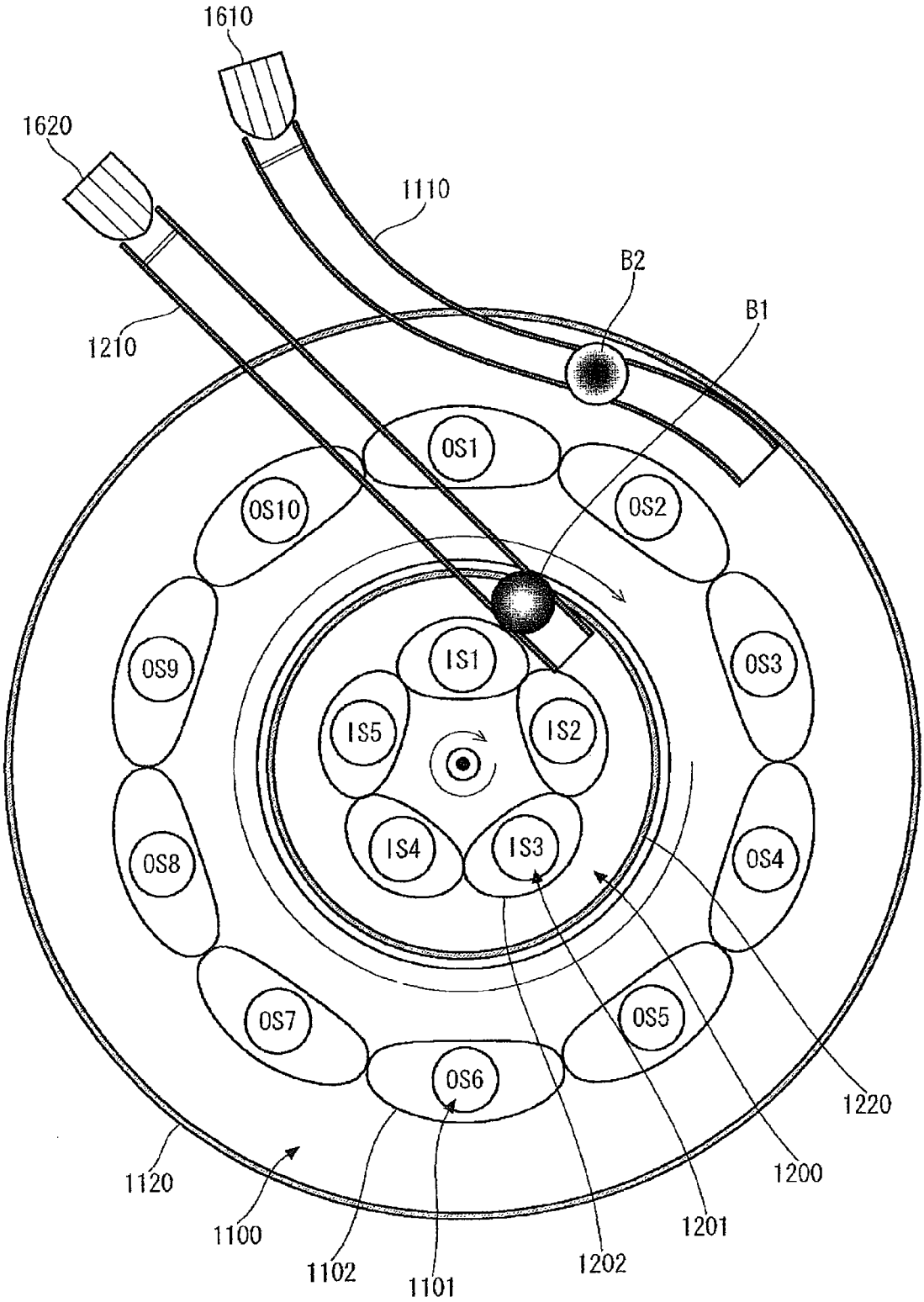
FIG. 49 is a top view of an outer bingo stage 1100 and an inner bingo stage 1200, which are used in performing a drawing in a bingo game in accordance with an embodiment of the present invention.

FIG. 49 is a top view of the outer bingo stage 1100 and the inner bingo stage 1200, which are used in performing a drawing in a bingo game in accordance with the present invention. As described above, the saucer 1610 or 1620 in the ball shooting mechanism 1600 shoots the ball B1/B2, which is set therein, to the ball shooting path 1110 or 1210 in the timing of a game player's instruction. The shot ball B1/B2 is accelerated when it goes down the ball shooting path 1110 or 1210, and is then shot into the outer bingo stage 1100 or the inner bingo stage 1200.

A guard rail 1120 is provided in the outer periphery of the outer bingo stage 1100 for preventing the shot ball B1 from jumping out of the bingo stage 1100. Also, in the present embodiment, the outer bingo stage 1100 is provided with totally 10 prize-winning spots 1101 (OS1 to OS10), for instance. Furthermore, a dent 1102 is provided in the surrounding of each of the prize-winning spots 1101 for the purpose of making the ball B1 smoothly enter any of the prize-winning spots 1101. Therefore, the shot ball B1 goes around the outer bingo stage 1100 by means of inertia, and then enters any of the prize-winning spots 1101 (OS1 to OS10) as if it were sucked into the prize-winning spot by the aid of the dent 1102. Each of the prize-winning spots 1101 is provided with a sensor (not illustrated in the figure). When the ball B1 entered any of the prize-winning spots 1101, which of the prize-winning spots 1101 the ball B1 entered into is informed to the second control unit by the sensor.

In a similar way, a guard rail 1220 is provided in the outer periphery of the inner bingo stage 1200 for preventing the shot ball B2 from jumping out of the inner bingo stage 1200. Also, in the present embodiment, the inner bingo stage 1200 is provided with totally five prize-winning spots 1201 (IS1 to IS5), for instance. Furthermore, a dent 1202 is provided in the surrounding of each of the prize-winning spots 1201 for making the ball B2 smoothly enter any of the prize-winning spots 1201. Therefore, the shot ball B2 goes around the inner bingo stage 1200 by means of inertia, and then enters any of the prize-winning spots 1201 (IS1 to IS5) as if it were sucked into the prize-winning spot by the dent 1202. Each of the prize-winning spots 1201 is provided with a sensor. When the ball B2 entered any of the prize-winning spots 1201, which of the prize-winning spots 1201 the ball B2 entered into is informed to the second control unit by the sensor.

Note that prizes a prize to be rewarded for any of the numbers 1 to 9, or a prize (this is referred to as a jackpot challenge prize) for giving a game player a chance to play a game (this is referred to as a jackpot game) for challenging a special prize to be described (this is referred to as a jackpot prize), is allocated to totally 10 prize-winning spots 1101 (OS1 to OS10), respectively. Note that in the present invention, the prize to be rewarded for any of the numbers 1 to 9 is also referred to as a first prize, and the prize for rewarding any other prizes such as the jackpot challenge prize and the jackpot prize is also referred to as a second prize.

Also, in the present embodiment, the outer bingo stage 1100 (this is referred to as a first drawing field), which includes a rotational disk (this is also referred to as a first rotational disk) configured to rotate around a predetermined rotational axis and a plurality of prize-winning spots 1101 (these are also referred to as first prize-winning spots) which are provided in the first rotational plate and allows the ball B1 to enter, is exemplified as an element for drawing either the first prize or the second prize with the ball B1 that is a first drawing medium. In addition, the inner bingo stage 1200 (this is also referred to as a second drawing field), which includes a rotational disk (this is also referred to as a second rotational disk) configured to rotate around a rotational axis that is the same as the first rotational axis and a plurality of prize-winning spots 1201 (these are also referred to as second prize-winning spots) which are provided in the second rotational disk and allows the ball B2 to enter, is exemplified as an element for drawing either the first prize or the second prize with the ball B2 that is a second drawing medium. However, the present invention is not limited to this, and is allowed to be applied to any configurations in which any of the prizes is allowed to be drawn with the first or second drawing medium.

When the second control unit of the satellite SA is informed of entrance of the ball B1 from a sensor provided in each of the prize-winning spots 1101, the second control unit specifies which of the numbers 1 to 9 and the jackpot challenge prize is allocated to the corresponding prize-winning spot 1101, and rewards the specified number or the specified jackpot challenge prize. Here, when any of the numbers is allocated to the corresponding prize-winning spot, the second control unit informs the first control unit 600 of the station ST of the number to be rewarded. Also, when the jackpot is allocated to the corresponding prize-winning spot, the second control unit provides jackpot game to a game player to be rewarded. Note that the jackpot prize means a prize for paying out relatively large amount of medals M (e.g., hundreds of medals) to the playing field 500 where the game player to be rewarded is positioned. For example, it is possible to set the jackpot game for drawing a jack pot prize to be a mechanical drawing game or an electric drawing game. Note that in the present invention, not the jackpot challenge prize but the jackpot prize may be allocated to any of the prize-winning spots 1101.

Also, any two of the numbers 1 to 9 or the jackpot challenge prize are allocated to totally five prize-winning spots 1201 (IS1 to IS5), respectively. When the second control unit in the satellite SA is informed of entrance of the ball B2 from a sensor that is provided in each of the prize-winning spots 1201, the second control unit specifies which of the numbers 1 to 9 and the jackpot challenge prize is allocated to the corresponding prize-winning spot 1201, and rewards the specified number or the specified jackpot challenge prize. Here, when any of the numbers is allocated to the corresponding prize-winning spot, the second control unit informs the first control unit 600 in the station ST of all the numbers to be rewarded. Also, when the jackpot is allocated to the corresponding prize-winning spot, the second control unit provides a jackpot game to a game player to be rewarded.

The relation between the prizes (i.e., the first prize and the second prize) and the prize-winning spots 1101 and 1201 are controlled by the second control unit in the satellite SA. In other words, the second control unit functions as prize correspondingly allocating means for correspondingly allocating the first prize or the second prize to the first and second prize-winning spots 1101 and 1201, respectively.

Figure 50:
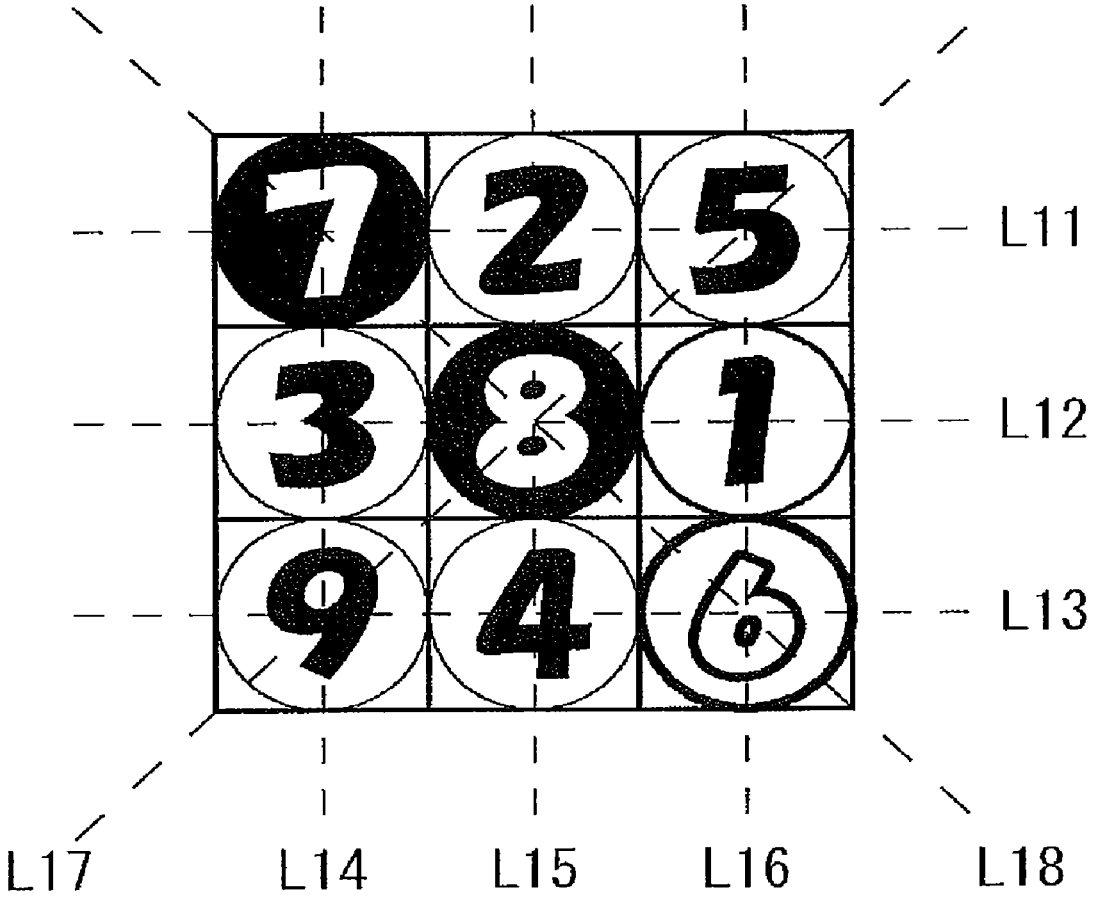
FIG. 50 is a diagram illustrating an example of a bingo table to be used in the bingo game in accordance with an embodiment of the present invention.

Also, FIG. 50 is a diagram of illustrating an example of a bingo table to be used in a bingo game in accordance with the present embodiment. The bingo table in accordance with the present embodiment has a configuration of totally 9 spaces arranged in a 3×3 matrix, and any of the numbers 1 to 9 is allocated to each of the spaces as a character. Note that the bingo table of the present invention is not limited to the configuration, and it is possible to use a bingo table with a variety of configurations such as a configuration of totally 16 spaces arranged in a 4×4 matrix and a configuration of totally 25 spaces arranged in a 5×5 matrix.

Also, in the bingo table, totally 8 lines L11 to L18 are formed by the combination of the spaces arranged in the vertical, horizontal, and oblique directions. A variety of prizes (e.g., paying out of the medal(s) M or paying out of the ball B1/B2) are allocated to each of the lines L11 to L18. When the number to be rewarded is informed by the second control unit, the first control unit 600 specifies the space to which the number is allocated, and highlights the specified space. Also, when all the spaces arranged in a single or plurality of line(s) in the lines L11 to L18 are set to be the numbers to be rewarded, the prizes allocated to the corresponding line(s) are specified, and the specified prizes are rewarded. Then, a variety of distributions (e.g., paying out the medal(s) M or paying out of the ball B1/B2) are performed in accordance with the rewarded prize. Note that in the present example, the numbers 1 to 9 are used in the bingo game as the object for a drawing. However, the present invention is not limited to this, and it is possible to use a variety of characters such as image patterns (e.g., animals and people) and alphabets as the object of a drawing.

Also, this type of bingo table is generated by the second control unit in the satellite SA with respect to each of the stations ST, and is delivered to each of the stations ST. The flow will be hereinafter explained with reference to FIG. 51.

Figure 51:
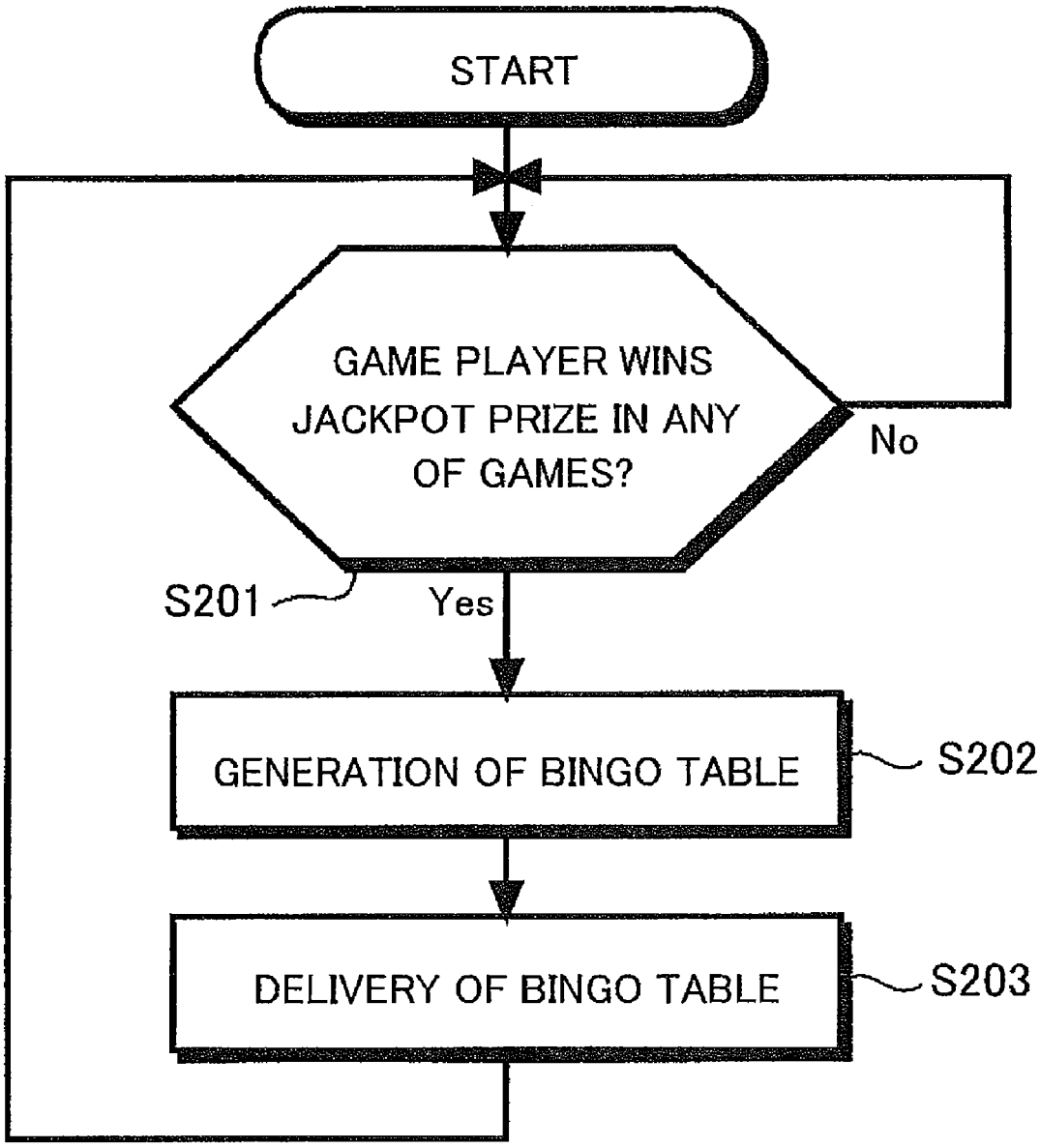
FIG. 51 is a flowchart illustrating an operation of a second control unit when the second control unit generates and delivers a bingo table in an embodiment of the present invention.

As illustrated in FIG. 51, the second control unit in the satellite SA constantly monitors whether or not any of game players wins the Jackpot prize to be described (Step S201). When any of game players wins the jackpot prize (Yes in Step S201), the second control unit generates a bingo table for each of the stations ST (Step S202), and delivers it to each of the stations ST (Step S203). Note that the first control unit 600 in each of the stations SA, which received the bingo table, converts the receiving bingo table into an image and displays the image in a predetermined area of the display 701 in the display unit 700.

(1-9-3) Entire Game

Next, a series of flow performed in the entire game including the above described digital drawing game and the above described bingo game will be hereinafter explained in detail with respect to the figures. FIGS. 52 to 60 are flowcharts of illustrating operations of the first control unit 600 and the second control unit in the flow.

First, in the present operations, when the pusher part 510 slidingly moves into/out of the housing part 720 provided in the display unit 700, the medal(s) M accumulated on the sub-table 511 that makes up the upper part of the pusher part 510 falls from the sub-table 511 to the sloped table 512 of the pusher part 510. Here, when the fallen medal(s) M enters any of the award-winning apertures 515-1, 515-2, and 515-3 provided in the sloped table 512, this is detected by a sensor (not illustrated in the figure) provided in each of the award-winning apertures 515-1, 515-2, and 515-3. When the sensor detects entrance of the medal M, the sensor generates a signal for informing it and transmits the signal to the first control unit 600 in the station ST. Note that the sensor for detecting entrance of the medal M into the award-winning apertures 515-1, 515-2, and 515-3 may be a contact type sensor using an on/off switch or the like, and a non-contact type sensor using the infrared ray or the like. Also, it is preferable to provide the sensor in the vicinity of the award-winning apertures 515-1, 515-2, and 515-3.

Figure 52:
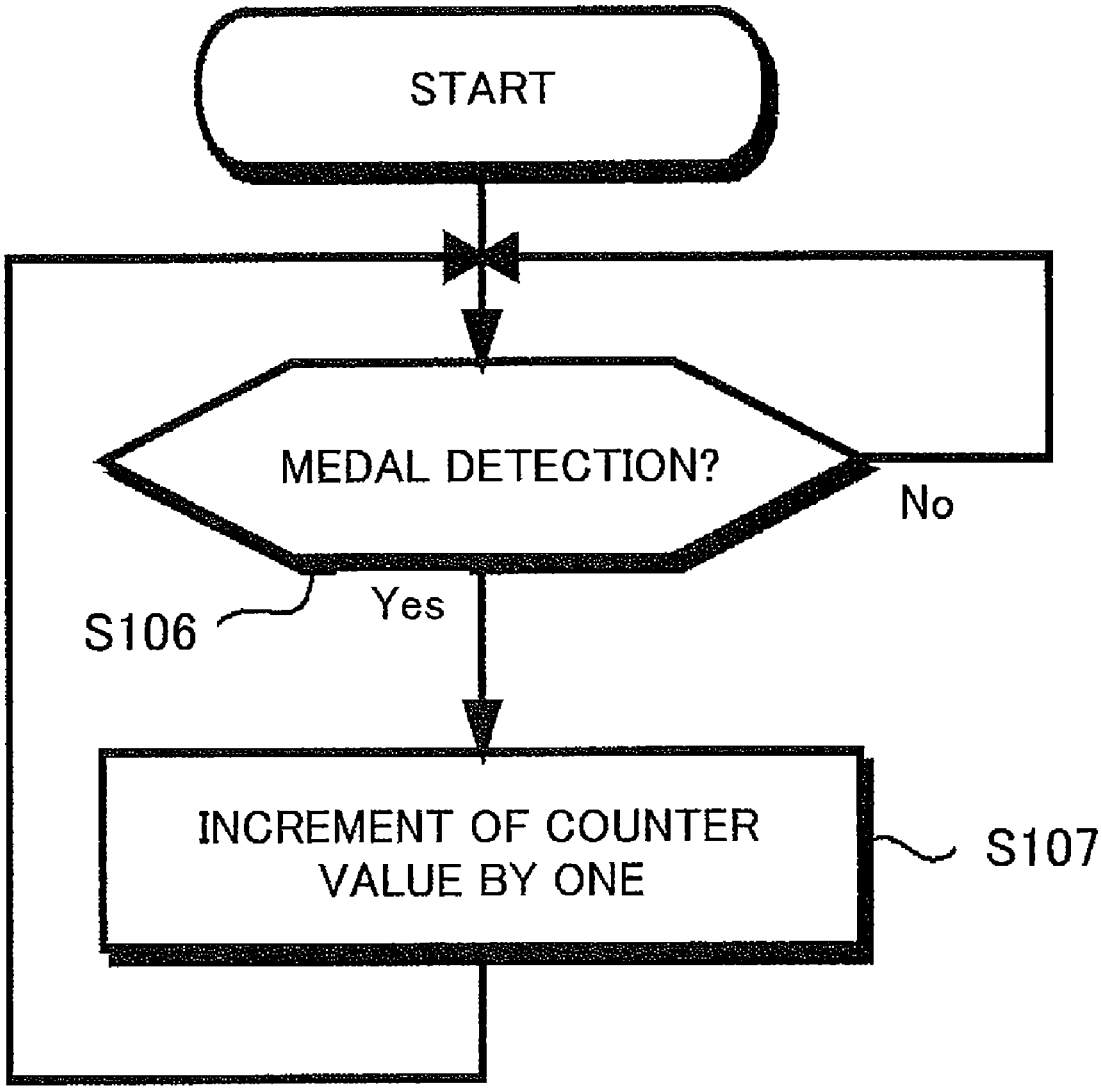
FIG. 52 is a flowchart illustrating an operation of a first control unit 600 when a series of game in accordance with an embodiment of the present invention is performed (1).

As illustrated in FIG. 52, when entrance of the medal M is detected in any of the award-winning apertures 515-1, 515-2, and 515-3 (Step S131), the first control unit 600 in each of the stations ST increments value of a counter (not illustrated in the figure) by one (Step S132). Note that the counter may be a counter formed as a kind of software in the first control unit 600 or a counter to be embedded as hardware. The counter will be hereinafter referred to as an award-winning aperture counter.

Figure 53:
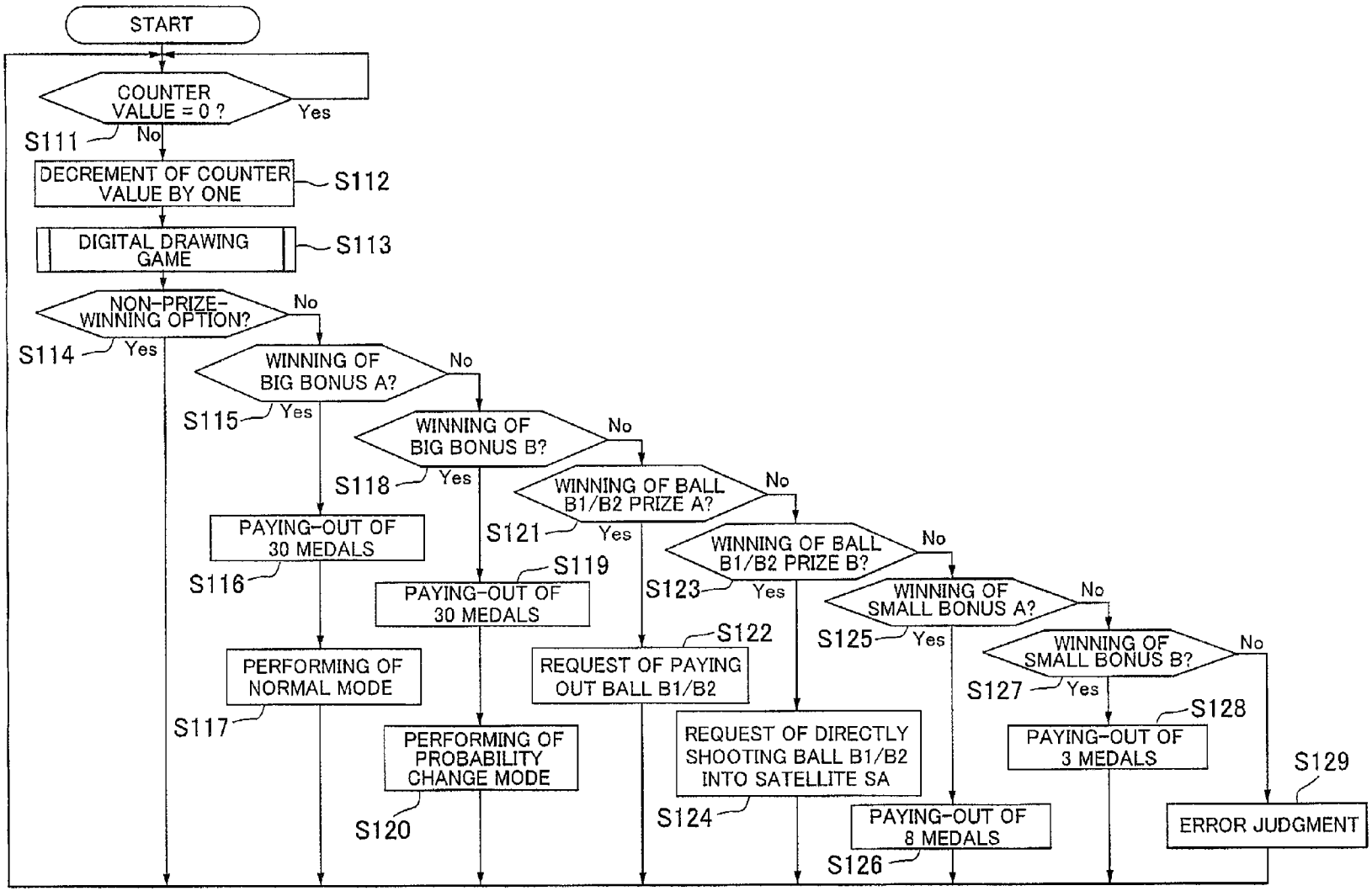
FIG. 53 is a flowchart illustrating an operation of the first control unit 600 when a series of game in accordance with an embodiment of the present invention is performed (2).

Also, as illustrated in FIG. 53, the first control unit 600 constantly monitors value of the award-winning aperture counter (Step S111). Now, when the count value is equal to or greater than zero (No in Step S111), the first control unit 600 decrements the count value by one (Step S112) and then performs the above described digital drawing game once (Step S113). Thus, the first control unit 600 performing Step S113 and each of elements to be controlled and driven in Step S113 function as second drawing game performing means for performing the digital drawing game that is the second drawing game. Here, the step is also referred to as an eighth step, a tenth step, a twelfth step, or a fifteenth step.

Next, the first control unit 600 judges whether or not the drawing result of the digital drawing game is the non-prize-winning option (Yes in Step S114). As a result, if the drawing result is the non-prize-winning option (Yes in Step S114), the first control unit 600 returns to Step S111.

On the other hand, if the judgment in Step S114 results in that the drawing result is not the non-prize-winning option (No in Step S114), the first control unit 600 subsequently judges whether or not the big bonus A is rewarded for the drawing result (Step S115). As a result, if the big bonus A is rewarded for the drawing result (Yes in Step S115), the first control unit 600 pays out the number of medal(s) M to be rewarded (e.g., 30 medals) to the playing field 500, for example, by driving the lifting-up hopper 300 and the medal discharging part 330, which are illustrated in FIG. 2 (Step S116), and at the same time as this, sets the digital drawing game to be performed in the normal mode in the subsequent games (Step S117), and then returns to Step S111. Note that the medals M to be rewarded may be directly paid out to a game player, for example, by driving the lifting-up hopper 1020 and the medal paying-out part 1030, which are illustrated in FIG. 1. Also, as described above, probability of winning each of the prizes in the normal mode is lower than that in the probability change mode (see FIG. 47(*c*)). Also, in the normal mode, for example, the medal guide plates 533 of the guide parts 530R and 530L provided in the main table 501 of the playing field 500 are accommodated below the upper surface of the main table 501. Furthermore, in the normal mode, for example, the medal guide plate 516 (see FIG. 4), which is provided to be allowed to move in/out of the sloped table 512 of the pusher part 510, is accommodated below the upper surface of the sloped table 512. Here, the medal guide plate 516 is an element for guiding the medal(s) M fallen from the sub-table 511 to the sloped table 512 so that the medal(s) M easily enters any of the award-wining apertures (e.g., the award-wining aperture 515-2) provided in the sloped table 512. It is possible to easily realize the detailed configuration by applying the guide parts 530R and 530L provided in the main table 501, for instance. Therefore, detailed explanation thereof will be hereinafter omitted.

On the other hand, if the judgment in Step 115 results in that the big bonus A is not rewarded for the drawing result (No in Step 115), the first control unit 600 subsequently judges whether or not the big bonus B is rewarded for the drawing result (Step S118). As a result, if the big bonus B is rewarded for the drawing result (Yes in Step S118), the first control unit 600 pays out the number of medal(s) M to be rewarded (e.g., 30 medals) to the playing field 500, for example, by driving the lifting-up hopper 300 and the medal discharging part 330, which are illustrated in FIG. 2 (Step S119), and at the same time as this, sets the digital drawing game to be performed in the probability change mode in the subsequent games (Step S120), and then returns to Step S111. Note that the medal(s) M to be rewarded may be directly paid out to a game player, for example, by driving the lifting-up hopper 1020 and the medal paying-out part 1030, which are illustrated in FIG. 1. Also, as described above, probability of winning each of the prizes in the probability change mode is higher than that in the normal mode (see FIG. 47(*c*)). Also, in the probability change mode, for example, the medal guide plates 533 of the guide parts 530R and 530L provided in the main table 501 of the playing field 500 are protruded from the upper surface of the main table 501. Furthermore, in the probability change mode, for example, the medal guide plate 516 (see FIG. 4) provided to be allowed to move in/out of the sloped table 512 of the pusher part 510 is protruded from the upper surface of the sloped table 512.

On the other hand, the judgment in Step S118 results in that the big bonus B is not rewarded for the drawing result (No in Step S118), the first control unit 600 subsequently judges whether or not either the ball B1 prize A or the ball B2 prize A is rewarded for the drawing result (Step S121). As the result, if either the ball B1 prize A or the ball B2 prize A is rewarded for the drawing result (Yes in Step S121), the first control unit 600 requests the satellite SA to pay out the ball B1/B2 to be rewarded to the station ST that includes this first control unit 600 (Step S122), and then returns to Step S111.

On the other hand, if the judgment in Step S121 results in that neither the ball B1 prize A nor the ball B2 prize A is rewarded for the drawing result (No in Step S121), the first control unit 600 judges whether or not either the ball B1 prize B or the ball B2 prize B is rewarded for the drawing result (Step S123). As a result, if either the ball B1 prize B or the ball B2 prize B is rewarded for the drawing result (Yes in Step S123), the first control unit 600 requests for directly paying out the ball B1/B2 to be rewarded to the ball shooting mechanism 1600 in the satellite SA (Step S124), and then returns to Step S111.

On the other hand, if the judgment in Step S123 results in that neither the ball B1 prize B nor the ball B2 prize B is rewarded for the drawing result (No in Step S123), the first control unit 600 judges whether or not the small bonus A prize is rewarded for the drawing result (Step S125). As a result, if the small bonus A prize is rewarded for the drawing result (Yes in Step S125), the first control unit 600 pays out the number of medal(s) M to be rewarded (e.g., 8 medals) to the playing field 500, for example, by driving the lifting-up hopper 300 and the medal discharging part 330, which are illustrated in FIG. 2 (Step S126), and then returns to Step S111. Note that the medal(s) M to be rewarded may be directly paid out to a game player, for example, by driving the lifting-up hopper 1020 and the medal paying-out part 1030, which are illustrated in FIG. 1.

On the other hand, if the judgment in Step S125 results in that the small bonus A prize is not rewarded for the drawing result (No in Step S125), the first control unit 600 judges whether or not the small bonus B prize is rewarded for the drawing result (Step S127). As a result, if the small bonus B prize is rewarded for the drawing result (Yes in Step S127), the first control unit 600 pays out the number of medal(s) M to be rewarded (e.g., 2 medals) to the playing field 500, for example, by driving the lifting-up hopper 300 and the medal discharging part 330, which are illustrated in FIG. 2 (Step S128), and then returns to Step S111. Note that the medal(s) M to be rewarded may be directly paid out to a game player, for example, by driving the lifting-up hopper 1020 and the medal paying-out part 1030, which are illustrated in FIG. 1.

Also, if the judgment in Step S125 results in that the small bonus B prize is not rewarded for the drawing result (No in Step S127), the first control unit 600 determines that this is an error (Step S129) and then returns to Step S111. Here, the first control unit 600 may be configured to transmit an error notification and the like to a predetermined administrative server, and may be configured to display an error message in the display 701.

Figure 54:
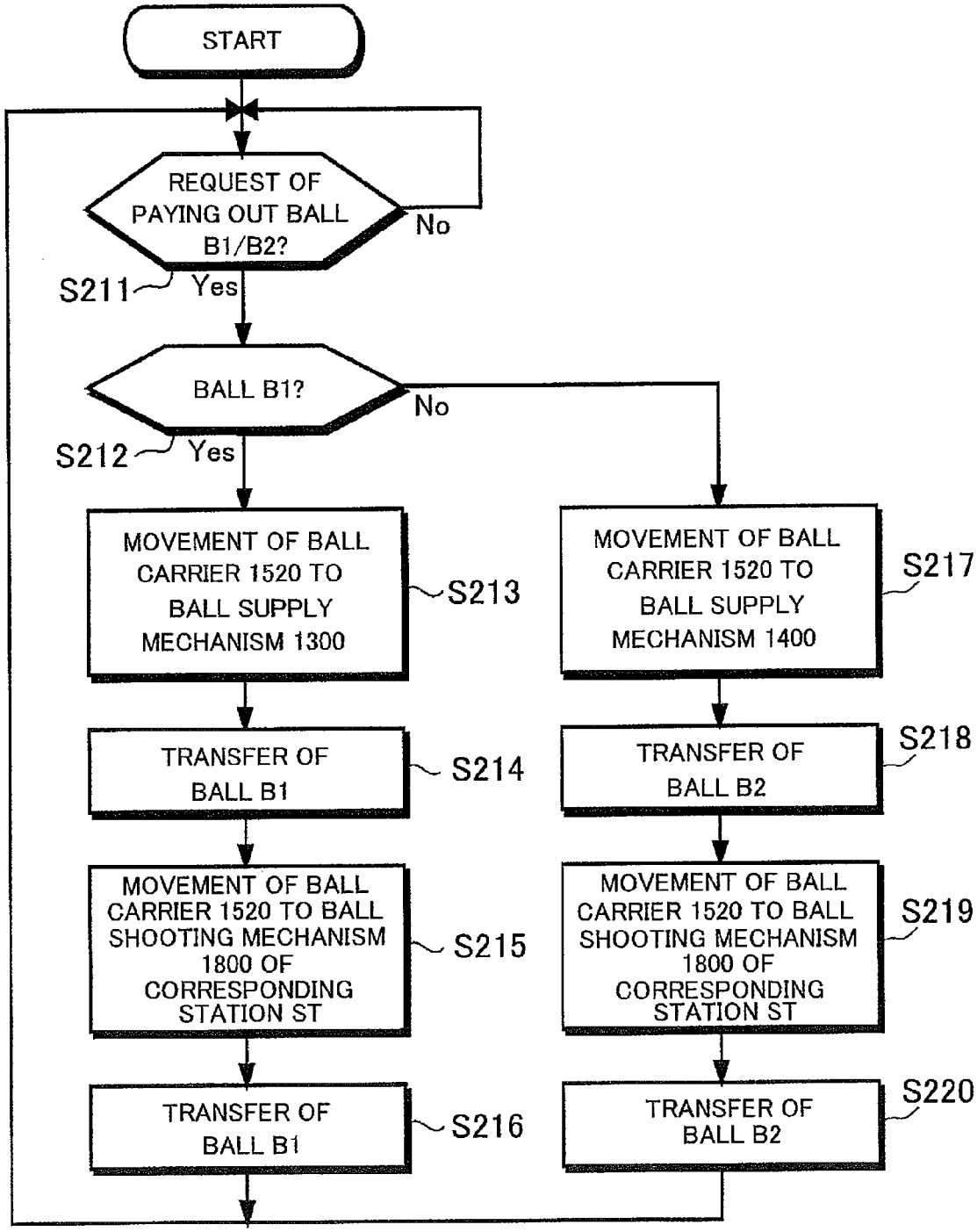
FIG. 54 is a flowchart illustrating an operation of a second control unit when a series of game in accordance with an embodiment of the present invention is performed (1).

On the other hand, as illustrated in FIG. 54, the second control unit in the satellite SA constantly monitors whether or not the first control unit 600 requested for paying out the ball B1/B2 to be rewarded to the station ST including this first control unit 600 in Step S122 of FIG. 53 (Step S211). If the first control unit 600 requested for paying out the ball B1/B2 to be rewarded to the station ST including this first control unit 600 (Yes in Step S211), the second control unit judges which of the ball B1 and B2 is the requested ball (Step S212).

If the judgment in Step S212 results in that the requested ball is the ball B1 (Yes in Step S212), the second control unit moves the ball carrier 1520 (see FIG. 3) in the ball transporting path 1500 functioning as a predetermined transporting path for transporting a ball to the ball supply mechanism 1300 (see FIG. 3) along the ring shaped member 1550 (Step 213) and then discharges the ball B1 from the ball supply mechanism 1300. Thus the second control unit performs the control of transferring the ball B1 from the ball supply mechanism 1300 to the ball carrier 1520 (Step S214)

Next, the second control unit moves the ball carrier 1520 to the ball shooting mechanism 1800 in the corresponding station ST along the ring shaped member 1550 (Step S215), and then tilts the ball carrier 1520 toward the ball shooting mechanism 1800. Thus, the second control unit performs the control of transferring the ball B1 from the ball carrier 1520 to the sloped rail portion 1801 (see FIG. 2 or FIG. 46) in the ball shooting mechanism 1800 (Step S216). After this, the second control unit returns to Step S211. Note that, when the ball B1 transferred to the sloped rail portion 1801 is interlocked by the interlocking/releasing operation control mechanism 1809 (see FIG. 46) provided in the sloped rail portion 1801, the ball B1 is temporarily halted at the starting end portion 1802 (see FIG. 46) that is the upper end thereof.

On the other hand, if the judgment in Step S212 results in that the requested ball is the ball B2 (No in Step S212), the second control unit moves the ball carrier 1520 to the ball supply mechanism 1400 (see FIG. 3) along the ring shaped member 1550 (Step S217), and then discharges the ball B2 from the ball supply mechanism 1400. Thus the second control unit performs the control of transferring the ball B2 from the ball supply mechanism 1400 to the ball carrier 1520 (Step S218).

Next, the second control unit moves the ball carrier 1520 to the ball shooting mechanism 1800 in the corresponding station ST along the ring shaped member 1550 (Step S219), and then tilts the ball carrier 1520 toward the ball shooting mechanism 1800. Thus the second control unit performs the control of transferring the ball B2 from the ball carrier 1520 to the sloped rail portion 1801 in the ball shooting mechanism 1800 (Step S220). After this, the second control unit returns to Step S211. Note that, when the ball B2 transferred to the sloped rail portion 1801 is interlocked by the interlocking/releasing operation control mechanism 1809 provided in the sloped rail portion 1801, the ball B2 is temporarily halted at the starting end portion 1802 that is the upper end thereof. Thus, the first control unit 600 performing Steps S114 to S129 and the second control unit performing Steps S211 to S220, and each of elements to be controlled and driven in Steps S114 to S129 and Steps S211 to S222, function as paying-out means for paying out the ball B1 (i.e., the first drawing medium) or the ball B2 (i.e., the second drawing medium) to the playing field 500 (i.e., the accumulating part) based on the drawing result of the digital drawing game (i.e., the second drawing game). Also, this step is also referred to as a ninth step or a thirteenth step.

Figure 55:
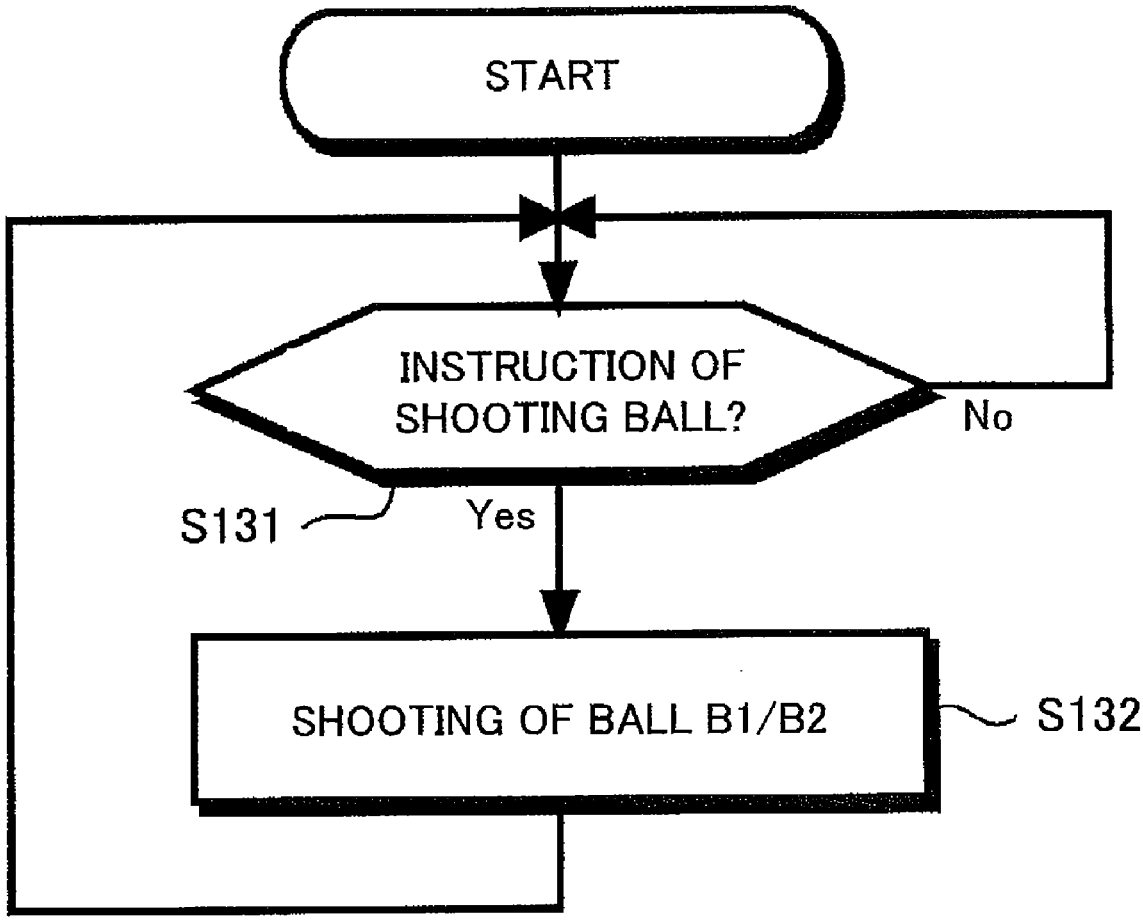
FIG. 55 is a flowchart illustrating an operation of the first control unit 600 when a series of game in accordance with an embodiment of the present invention is performed (3).

Also, as explained in FIG. 55, the first control unit 600 in the station ST constantly monitors whether or not the push button 1830 in the operating part 450 (see FIG. 40 or FIG. 41) was pushed by a game player (Step S131). If the push button 1830 in the operating part 450 is pushed (Yes in Step S131), the first control unit 600 controls the interlocking/releasing operation control mechanism 1809, which protrudes from the sloped rail portion 1801 in the ball shooting mechanism 1800, to be accommodated in the interior of the sloped rail portion 1801 (Step S132). Accordingly, the ball B1/B2 standing by at the starting end portion 1802 in the ball shooting mechanism 1800 goes down the sloped rail portion 1801 by means of gravity and enters the ball shooting position drawing mechanism 1810 (see FIG. 46), and is supplied to the main table 501 in the playing field 500 therethrough.

Figure 56:
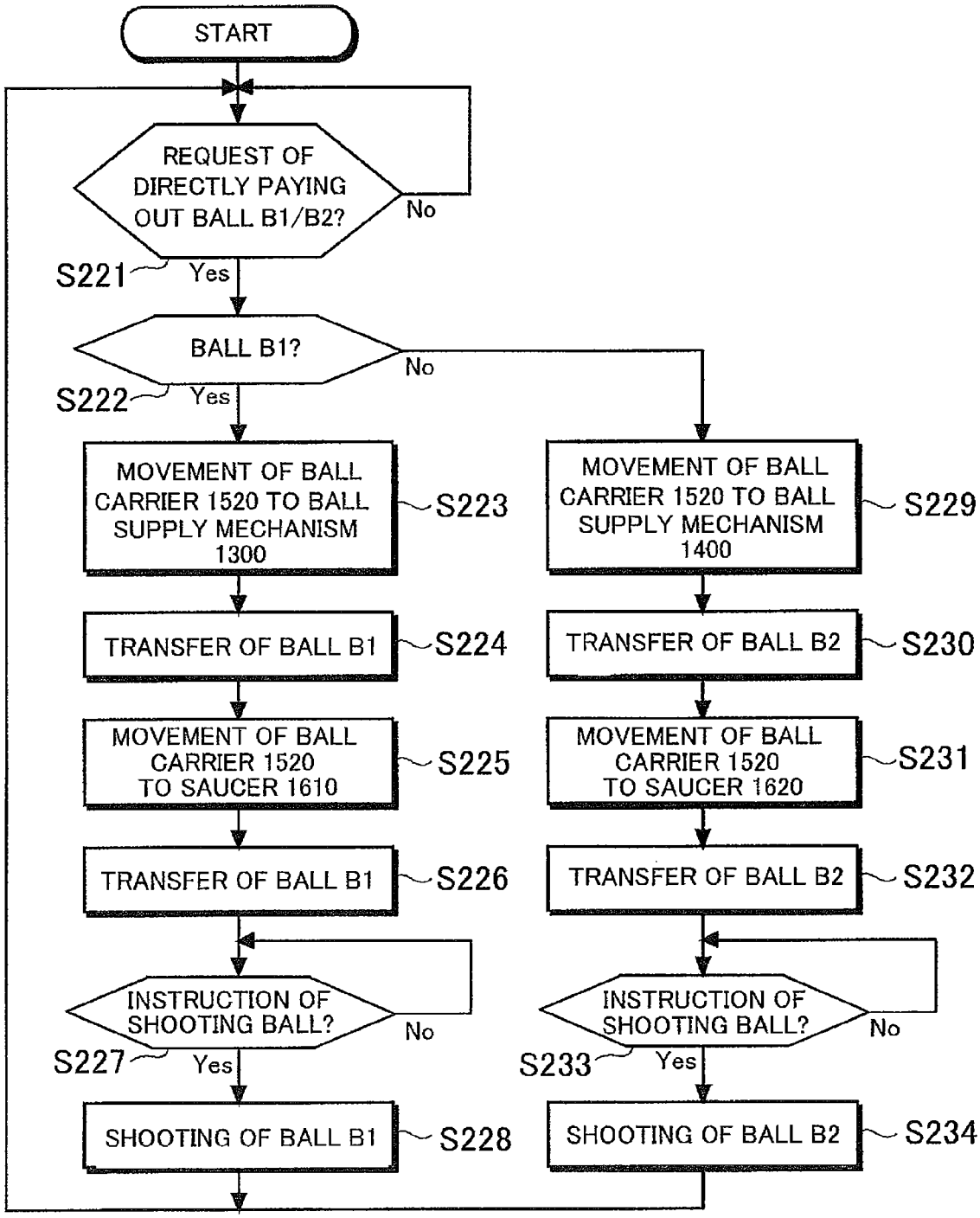
FIG. 56 is a flowchart illustrating an operation of the second control unit when a series of game in accordance with an embodiment of the present invention is performed (2).

Also, as illustrated in FIG. 56, the second control unit in the satellite SA constantly monitors whether or not the first control unit 600 requested for directly paying out the ball B1/B2 to be rewarded to the ball shooting mechanism 1600 in the satellite SA in Step S124 in FIG. 53 (Step S221). If the first control unit 600 requested for directly paying out the ball B1/B2 to be rewarded to the ball shooting mechanism 1600 in the satellite SA (Yes in Step S221), the second control unit judges which of the ball B1 or the ball B2 is the requested ball (Step S222). Thus, the second control unit performing Step S222 and each of elements to be controlled and driven in Step S222 function as drawing medium specifying means for specifying into which of the ball B1 (i.e., the first drawing medium) and the ball B2 (i.e., the second drawing medium) the drawing medium is classified. Here, this step is also referred to as a first step.

If the judgment in Step S222 results in that the requested ball is the ball B1 (Yes in Step S222), the second control unit moves the ball carrier 1520 to the ball supply mechanism 1300 along the ring shaped member 1550 (Step S223) and then discharges the ball B1 from the ball supply mechanism 1300. Thus the second control unit performs the control of transferring the ball B1 from the ball supply mechanism 1300 to the ball carrier 1520 (Step S224).

As described above, the second control unit performing Steps S223 and S224 and each of elements to be controlled and driven in Steps S223 and S224 function as supply means for supplying the ball B1 (i.e., the first drawing medium) to the ball carrier 1520 in the ball transporting path 1500 (i.e., the predetermined transporting path). Here, this step is also referred to as an eleventh step or a sixteenth step.

Next, the second control unit moves the ball carrier 1520 to the saucer 1610 (see FIG. 3) in the ball shooting mechanism 1600 along the ring shaped member 1550 (Step S225), and then tilts the ball carrier 1520 toward the saucer 1610. Thus the second control unit performs the control of transferring the ball B1 from the ball carrier 1520 to the saucer 1610 (Step S226).

Next, the second control unit monitors whether or not the push button 1830 of the operating part 450 (see FIG. 40 or FIG. 41) in the corresponding station ST was pushed by a game player (Step S227). Note that the pushed state of the push button 1830 is informed to the second control unit in the satellite SA from the first control unit 600 in the station ST through a predetermined network.

If the push button 1830 of the operating part 450 was pushed in Step S227 (Yes in Step S227), the second control unit performs the control of transferring the ball B1 from the saucer 1610 of the ball shooting mechanism 1600 to the ball shooting path 1110 (see FIG. 3) by tilting the saucer 1610 toward the ball shooting path 1110 (Step S228). Then, the second control unit returns to Step S221. Note that the ball B1 transferred to the ball shooting path 1110 goes down the ball shooting path 1110 by means of gravity, and is supplied to the outer bingo stage 1100 (see FIG. 3) in the satellite SA. Thus, the second control unit performing Steps S225 to S228 and each of elements to be controlled and driven in Steps S225 to S228 function as first feeding means for feeding the ball B1 (i.e., the first drawing medium) to the outer bingo stage 1100 (i.e., the first drawing field). Here, this step is also referred to as a second step.

On the other hand, if the judgment in Step S222 results in that the requested ball is the ball B2 (No in Step S222), the second control unit moves the ball carrier 1520 to the ball supply mechanism 1400 along the ring shaped member 1550 (Step S229) and then discharges the ball B2 from the ball supply mechanism 1400. Thus the second control unit performs the control of transferring the ball B2 from the ball supply mechanism 1400 to the ball carrier 1520 (Step S230). As described above, the second control unit performing Steps S229 and S230 and each of elements to be controlled and driven in Steps S229 and S230 function as supply means for supplying the ball B2 (i.e., the second drawing medium) to the ball carrier 1520 in the ball transporting path 1500 (i.e., the predetermined transporting path). Here, these steps are also referred to as an eleventh step or a sixteenth step.

Next, the second control unit moves the ball carrier 1520 to the saucer 1620 (see FIG. 3) in the ball shooting mechanism 1600 along the ring shaped member 1550 (Step S231), and then tilts the ball carrier 1520 toward the saucer 1620. Thus, the second control unit performs the control of transferring the ball B2 from the ball carrier 1520 to the saucer 1620 (Step S232)

Next, the second control unit monitors whether or not the push button 1830 of the operating part 450 in the corresponding station ST was pushed by a game player (Step S233). Note that the pushed state of the push button 1830 is informed to the second control unit in the satellite SA from the first control unit 600 in the station ST through a predetermined network.

If the push button 1830 of the operating part 450 was pushed in Step S233 (Yes in Step S233), the second control unit performs the control of transferring the ball B2 from the saucer 1620 in the ball shooting mechanism 1600 to the ball shooting path 1210 (see FIG. 3) by tilting the saucer 1620 toward the ball shooting path 1210 (Step S234). Then, the second control unit returns to Step S221. Note that the ball B2 transferred to the ball shooting path 1210 goes down the ball shooting path 1210 by means of gravity, and is supplied to the inner bingo stage 1200 (see FIG. 3) in the satellite SA. Thus, the second control unit performing Steps S231 to S234 and each of elements to be controlled and driven in Steps S231 to S234 function as second feeding means for feeding the ball B2 (i.e., the second drawing medium) to the inner bingo stage 1200 (i.e., the second drawing field). Here, this step is also referred to as a fifth step.

Also, as described above, while the game is performed, the ball B1/B2 fallen from the main table 501 (also referred to as the accumulating part) by the movement of the pusher part 510 is received by the ball receiver 1041 (see FIG. 4) in the ball transporting path 1040 (see FIG. 4). Then, the ball B1/B2 passes through the ball stopper 1042 (see FIG. 4) and is set in the ball transporting part 1910 (see FIG. 1) standing by at the ball outlet 1043 (see FIG. 4). Here, falling of the ball and the type of the fallen ball (i.e., which of the ball B1 and the ball B2 is the fallen ball) are detected by a sensor (not illustrated in the figure) disposed between the ball receiver 1041 and the ball outlet 1043 (preferably in the vicinity of the ball outlet 1043). The detected result is inputted into the first control unit 600. Note that the pusher part 510 for dropping the ball B1 and/or the ball B2 from the main table 501 and its control mechanism (specifically, a power unit, which is not illustrated in the figure, and the first control unit 600 for controlling this), and the ball transporting path 1040 for guiding the ball B1 and/or the ball B2 fallen from the main table 501 to the ball transporting path 1500 and the ball transporting mechanism 1900 function as supply means for supplying the first drawing medium and/or the second drawing medium to a predetermined transporting path. Furthermore, a sensor for detecting which of the ball B1 and the ball B2 is the fallen ball, and the first control unit 600 function as a part of medium type specifying means for specifying into which of the first drawing medium and the second drawing medium the drawing medium is classified.

Figure 57:
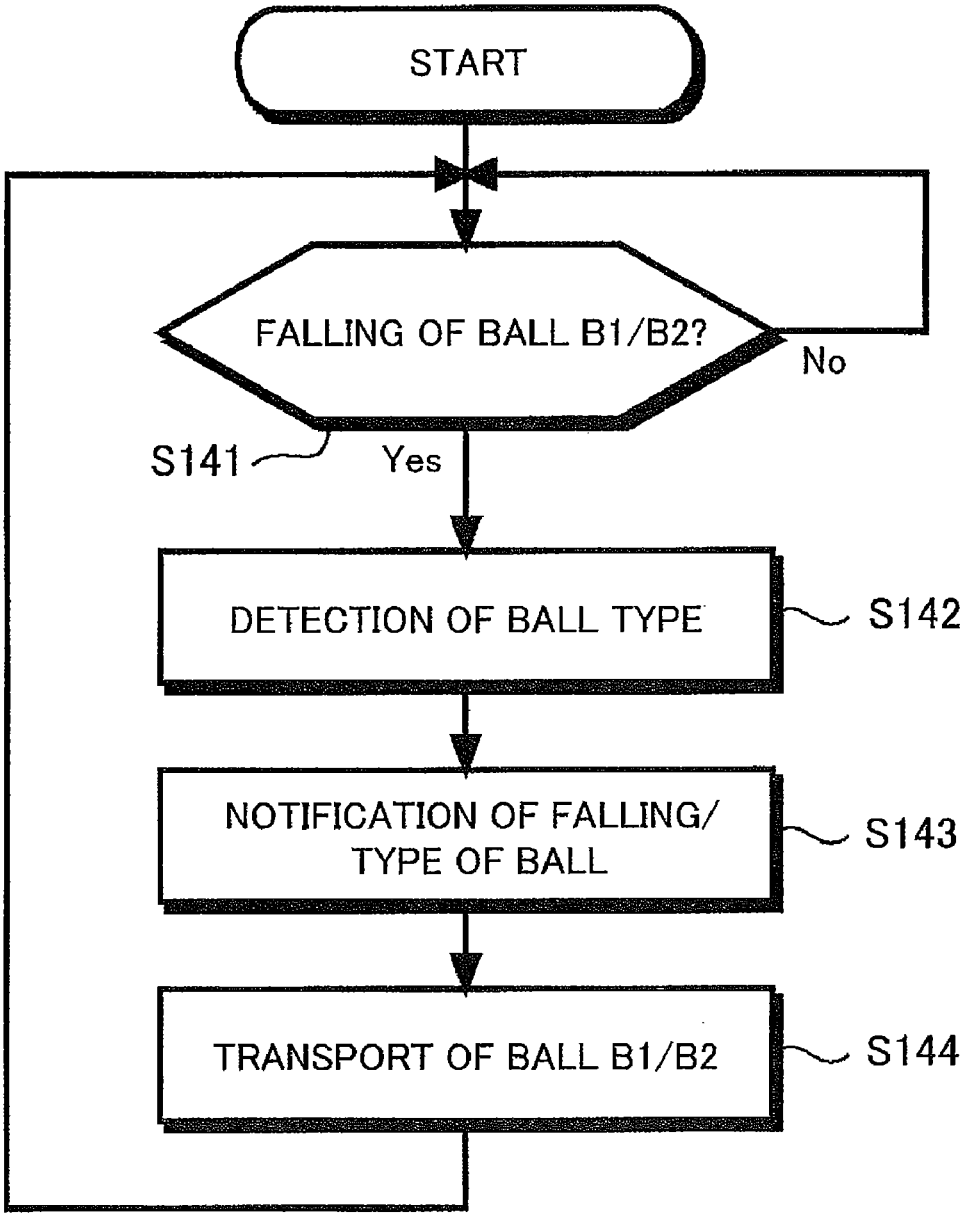
FIG. 57 is a flowchart illustrating an operation of the first control unit 600 when a series of game in accordance with an embodiment of the present invention is performed (4).

On the other hand, as illustrated in FIG. 57, the first control unit 600 in the station ST constantly monitors whether or not the ball B1/B2 fell from the main table 501 in the playing field 500 (Step S141). If falling of the ball B1/B2 from the main table 501 was informed (Yes in Step S141), the first control unit 600 specifies into which of the ball B1 or the ball B2 the fallen ball is classified based on the information informed from the sensor (Step S142).

Next, the first control unit 600 informs the second control unit in the satellite SA of falling of the ball and the type of the fallen ball (Step S143), and transports the ball B1/B2 that is set in the ball transporting part 1910 to the upper end of the ball transporting part traveling slope 1901 by performing the control of making the ball transporting part 1910 in the ball transporting mechanism 1900 go up the ball transporting part traveling slope 1901 (Step S144).

Figure 58:
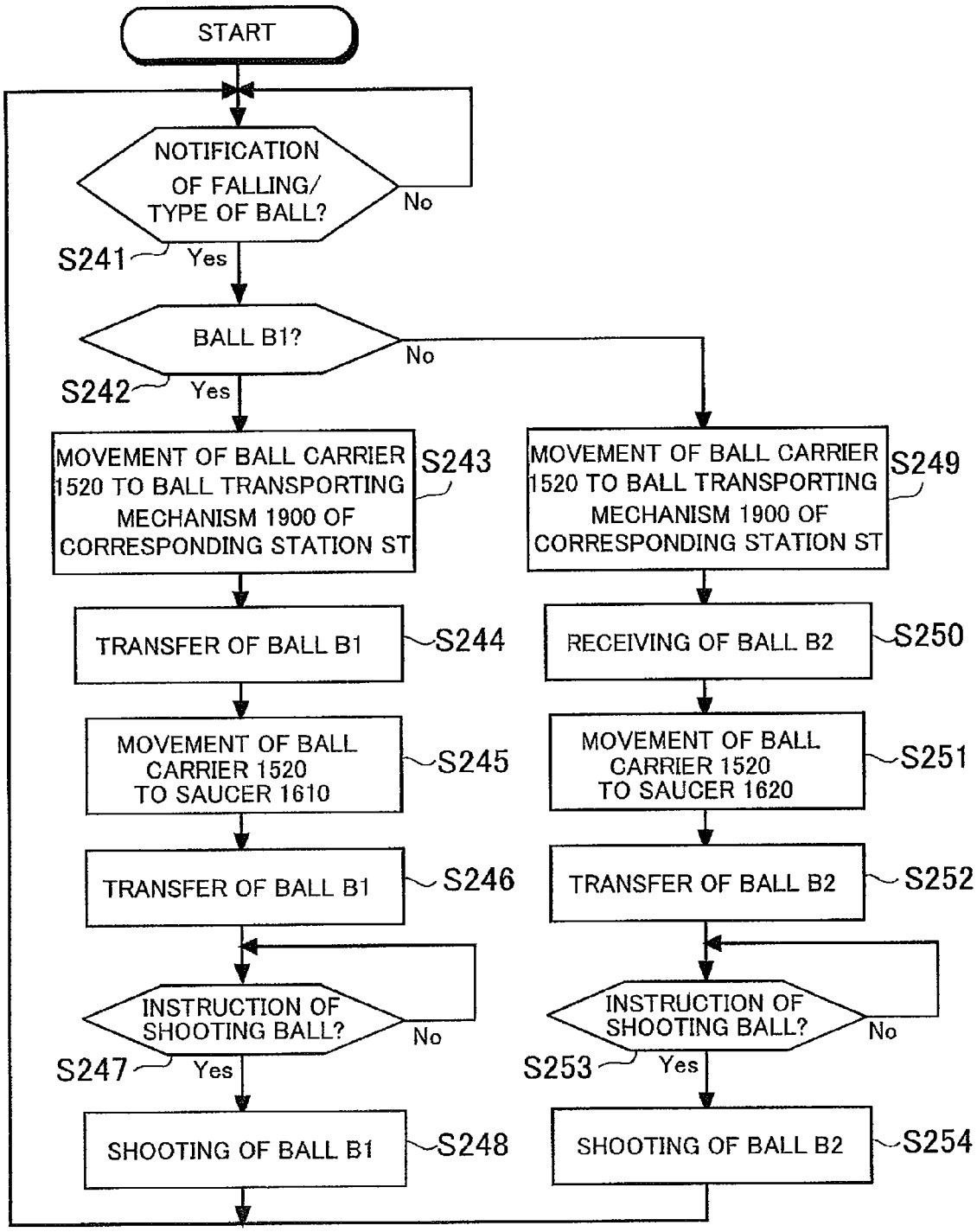
FIG. 58 is a flowchart illustrating an operation of the second control unit when a series of game in accordance with an embodiment of the present invention is performed (3).

On the other hand, as illustrated in FIG. 58, the second control unit in the satellite SA constantly monitors whether or not falling of the ball and the type of the fallen ball were informed from the first control unit 600 (Step S241). If falling of the ball and the type of the fallen ball were informed from the first control unit 600, the second control unit judges into which of the ball B1 and the ball B2 the fallen ball is classified (Step S242). Thus, the second control unit performing Step S242 and each of elements to be controlled and driven in Step S242 function as drawing medium specifying means for specifying into which of the ball B1 (i.e., the first drawing medium) and the ball B2 (i.e., the second drawing medium) the drawing medium is classified. Here, this step is also referred to as a first step.

If the judgment in Step S242 results in that the fallen ball is the ball B1 (Yes in Step S242), the second control unit moves the ball carrier 1520 (see FIG. 3) to the ball transporting mechanism 1900 in the station ST along the ring shaped member 1550 (Step S243), and then discharges the ball B1 from the ball transporting part 1910. Thus the second control unit performs the control of transferring the ball B1 from the ball transporting mechanism 1900 to the ball carrier 1520 (Step S244). As described above, the second control unit performing Steps S243 and S244 and each of elements to be controlled and driven in Steps S243 and S244 function as supply means for supplying the ball B1 (i.e., the first drawing medium) to the ball carrier 1520 in the ball transporting path 1500 (i.e., the predetermined transporting path). Note that the first control unit 600 may be configured to perform the control of discharging the ball B1 from the ball transporting part 1910.

Next, the second control unit moves the ball carrier 1520 to the saucer 1610 (see FIG. 3) in the ball shooting mechanism 1600 along the ring shaped member 1550 (Step S245) and then tilts the ball carrier 1520 toward the saucer 1610. Thus the second control unit performs the control of transferring the ball B1 from the ball carrier 1520 to the saucer 1610 (Step S246).

Next, the second control unit monitors whether or not the push button 1830 of the operating part 450 (see FIG. 40 or FIG. 41) in the corresponding station ST was pushed by a game player (Step S247). Note that the pushed state of the push button 1830 is informed to the second control unit in the satellite SA from the first control unit 600 in the station ST through a predetermined network.

If the push button 1830 of the operating part 450 was pushed in Step S247 (Yes in Step S247), the second control unit performs the control of transferring the ball B1 from the saucer 1610 in the ball shooting mechanism 1600 to the ball shooting path 1110 (see FIG. 3) by tilting the saucer 1610 toward the ball shooting path 1110 (Step S248). Then, the second control unit returns to Step S241. Note that the ball B1 transferred to the ball shooting path 1110 goes down the ball shooting path 1110 by means of gravity and is supplied to the outer bingo stage 1100 (see FIG. 3) in the satellite SA. Thus, the second control unit performing Steps S245 to S248 and each of elements to be controlled and driven in Steps S245 to S248 function as first feeding means for feeding the ball B1 (i.e., the first drawing medium) to the outer bingo stage 1100 (i.e., the first drawing field). Here, this step is also referred to as a second step.

On the other hand, if the judgment in Step S242 results in that the fallen ball is the ball B2 (Yes in Step S242), the second control unit moves the ball carrier 1520 to the ball transporting mechanism 1900 in the station ST along the ring shaped member 1550 (Step S249), and then discharges the ball B2 from the ball transporting part 1910. Thus the second control unit performs the control of transferring the ball B1 from the ball transporting mechanism 1900 to the ball carrier 1520 (Step S250). As described above, the second control unit performing Steps S249 and S250 and each of elements to be controlled and driven in Steps S249 and S250 function as supply means for supplying the ball B2 (i.e., the second drawing medium) to the ball carrier 1520 in the ball transporting path 1500 (i.e., the predetermined transporting path). Note that the first control unit 600 may be configured to perform the control of discharging the ball B2 from the ball transporting part 1910.

Next, the second control unit moves the ball carrier 1520 to the saucer 1620 (see FIG. 3) in the ball shooting mechanism 1600 along the ring shaped member 1550 (Step S251), and then tilts the ball carrier 1520 toward the saucer 1620. Thus the second control unit performs the control of transferring the ball B2 from the ball carrier 1520 to the saucer 1620 (Step S252).

Next, the second control unit monitors whether or not the push button 1830 of the operating part 450 in the corresponding station ST was pushed by a game player (Step S253). Note that the pushed state of the push button 1830 is informed to the second control unit in the satellite SA from the first control unit 600 in the station ST through a predetermined network.

If the push button 1830 of the operating part 450 was pushed in Step S253 (Yes in Step S253), the second control unit performs the control of transferring the ball B2 from the saucer 1620 in the ball shooting mechanism 1600 to the ball shooting path 1210 (see FIG. 3) by tilting the saucer 1620 toward the ball shooting mechanism 1210 (Step S254). Then, the second control unit returns to Step S241. Note that the ball B2 transferred to the ball shooting path 1210 goes down the ball shooting path 1210 by means of gravity, and is supplied to the inner bingo stage 1200 (see FIG. 3) in the satellite SA. Thus, the second control unit performing Steps S251 to S254 and each of elements to be controlled and driven in Steps S251 to S254 function as second feeding means for feeding the ball B2 (i.e., the second drawing medium) to the inner bingo stage 1200 (i.e., the first drawing field). Here, this step is also referred to as a fifth step.

Also, as described above, the ball B1 shot into the outer bingo stage 1100 in the above described Step S228 or S248 goes around the outer bingo stage 1100, and enters any of the prize-winning spots 1101. Entrance of the ball B1 into any of the prize-winning spots 1101 is detected by a sensor provided in each of the prize-winning spots 1101, and is informed to the second control unit. In a similar way to this, as described above, the ball B2 shot into the inner bingo stage 1200 in the above described Step S234 or S254 goes around the inner bingo stage 1200 and enters any of the prize-winning spots 1201. Entrance of the ball B2 into any of the prize-winning spots 1201 is detected by a sensor provided in each of the prize-winning spots 1201, and is informed to the second control unit. Note that the sensor for detecting entrance of the ball B1 and the second control unit function as a part of first reward determining means for rewarding the first prize or the second prize that is correspondingly allocated to the first prize-winning spot into which the ball B1 (i.e., the first drawing medium) entered, and the sensor for detecting entrance of the ball B2 and the first control unit 600 function as a part of second reward determining means for rewarding the first prize or the second prize that is correspondingly allocated to the second prize-winning spot into which the ball B2 (i.e., the second drawing medium) entered.

Figure 59:
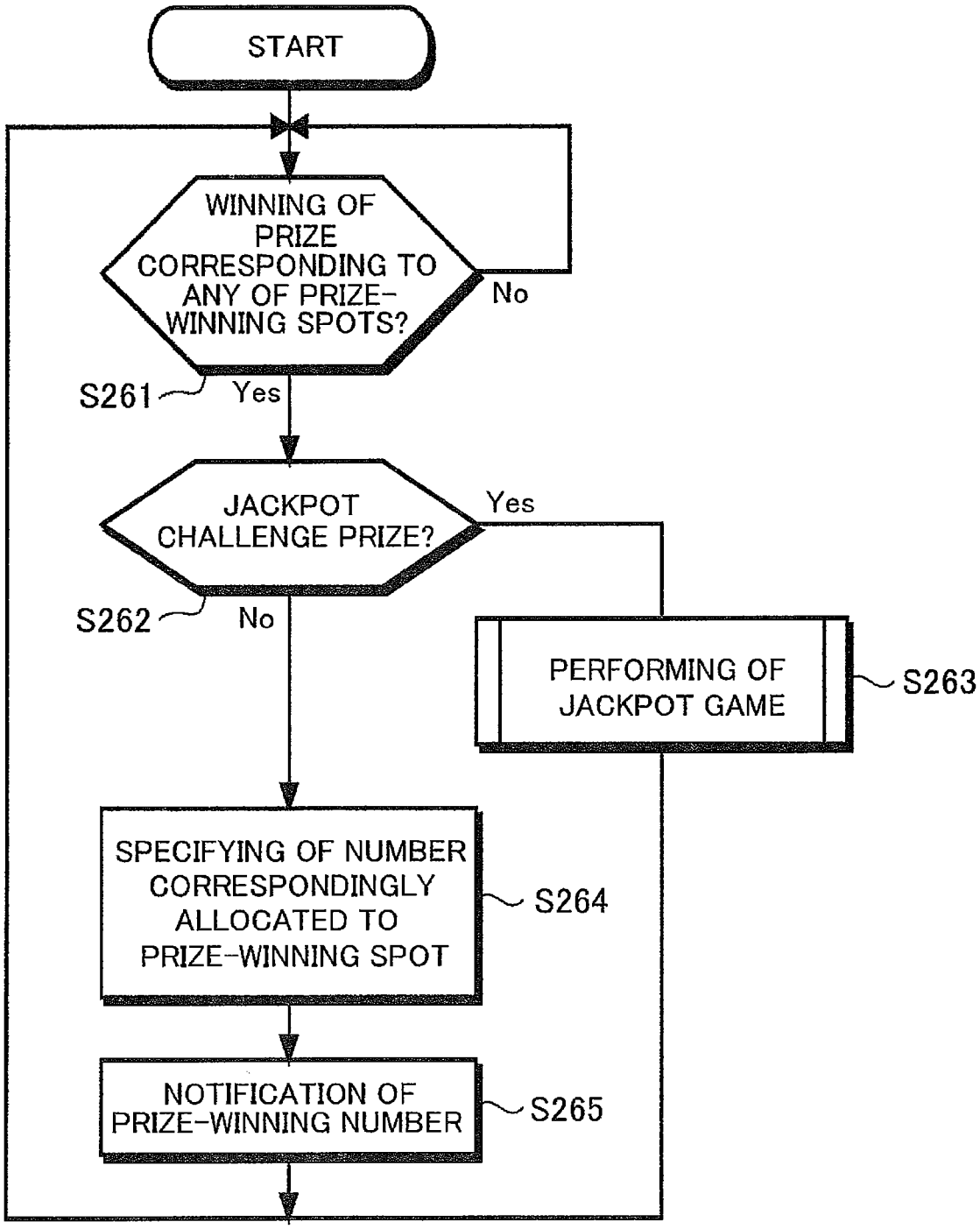
FIG. 59 is a flowchart illustrating an operation of the second control unit when a series of game in accordance with an embodiment of the present invention is performed (4).

On the other hand, as illustrated in FIG. 59, the second control unit in the satellite SA constantly monitors whether or not the ball B1/B2 entered any of the prize-winning spots 1101 or 1201, that is, whether or not a prize corresponding to any of the prize-winning spots 1101 or 1201 was rewarded (Step S261). If rewarding a prize corresponding to any of the prize-winning spots was informed (Yes in Step S261), the second control unit judges whether or not the prize allocated to the prize-winning spot 1101 or 1201 into which the ball B1/B2 entered is the jackpot challenge prize (Step S262). If the judgment results in that the allocated prize is the jackpot challenge prize (Yes in Step S262), the second control unit performs the jackpot game (Step S263) and then returns to Step S261. Note that the prize-winning spot 1101 or 1201 into which the ball B1/B2 entered is also specified in Step S261. Here, this step is also referred to as a third step or a sixth step.

On the other hand, if the judgment in Step S262 results in that any of the numbers 1 to 9 is allocated to the prize-winning spot 1101 or 1201 for which a prize is rewarded (No in Step S252), the second control unit specifies the number allocated to the prize-winning spot 1101 or 1201 for which a prize is rewarded (Step S264), informs this/these to the first control unit 600 in the station ST (Step S265), and then returns to Step S261. Thus, the second control unit performing Steps S261 to S265 and each of elements to be controlled and driven in Steps S261 to S265 function as first reward determining means and second reward determining means. Here, if the ball B1 enters any of the plurality of prize-winning spots 1101, the first reward determining means rewards the first prize or the second prize that is correspondingly allocated to the prize-winning spot 1101. If the ball B2 enters any of the plurality of prize-winning spots 1201, the second reward determining means rewards the first prize or the second prize that is correspondingly allocated to the prize-winning spot 1201. Here, these steps are also referred to as a fourth step or a seventh step.

Figure 60:
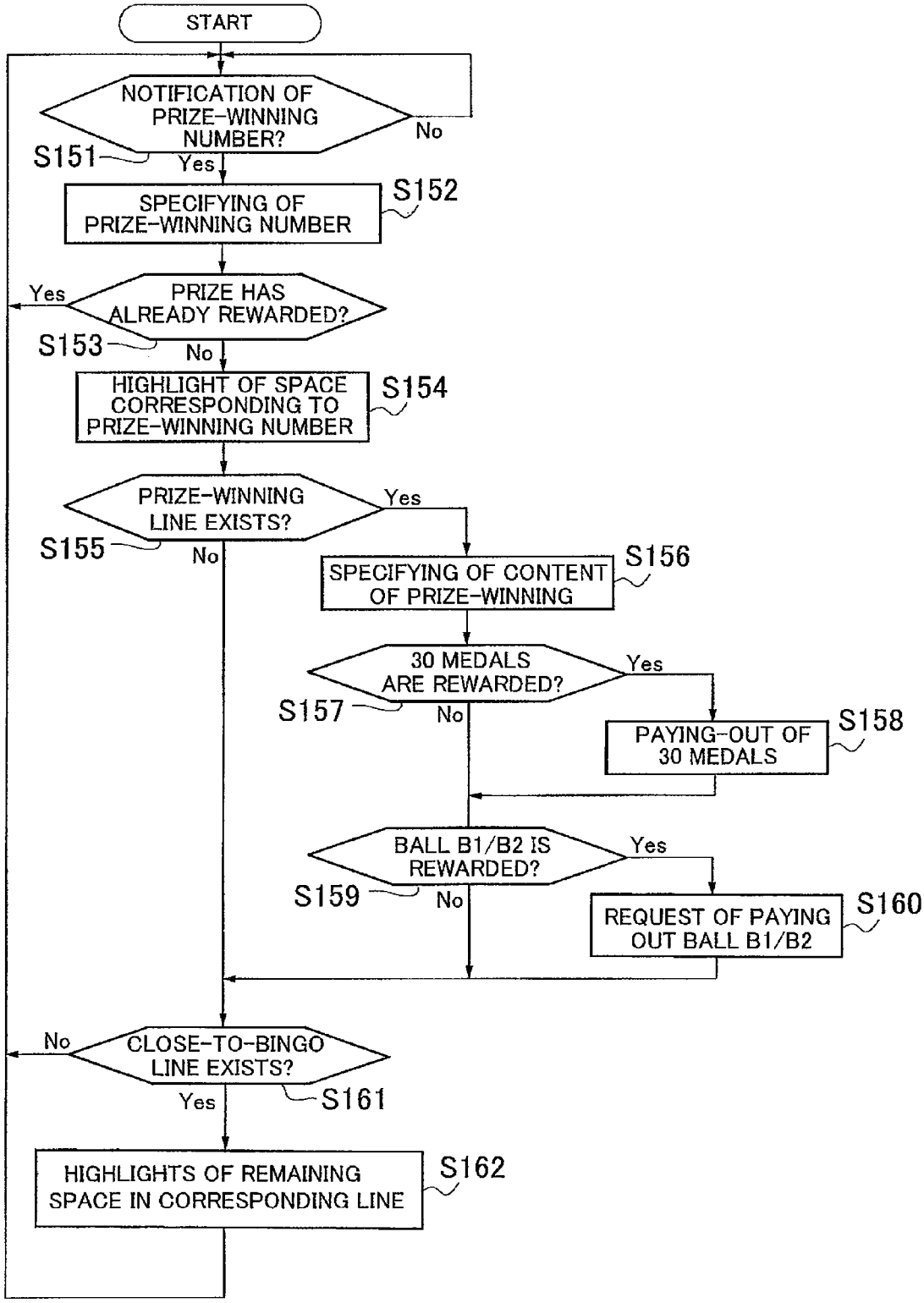
FIG. 60 is a flowchart illustrating an operation of the first control unit 600 when a series of game in accordance with an embodiment of the present invention is performed (5).

On the other hand, as illustrated in FIG. 60, the first control unit 600 in the station ST constantly monitors whether or not the prize-winning number was informed from the second control unit in the satellite SA in Step S265 in FIG. 59 (Step S151). If the prize-winning number was informed (Yes in Step S151), the first control unit 600 specifies the informed prize-winning number (Step S152), and judges whether or not the prize winning number has already been rewarded (Step S153). If the judgment results in that the number has already been rewarded (Yes in Step S153), the first control unit 600 returns to Step S151.

On the other hand, if the informed prize-winning number has not been rewarded yet (No in Step S153), the first control unit 600 highlights the space that is correspondingly allocated to the prize-winning number in the bingo table displayed in the display 701 (Step S154).

Next, the first control unit 600 judges whether or not a line in which all the spaces are rewarded (this is referred to as a reward line) exists in the lines L11 to L18 in the bingo table (Step S155). If the judgment results in that the reward line exists (Yes in Step S155), the first control unit 600 specifies the reward content of the prize allocated to the reward line (Step S156).

Next, the first control unit 600 judges whether or not paying out the predetermined number of medal(s) M (e.g., 30 medals), for instance, is included in the specified reward content (Step S157). If the judgment results in that paying out the predetermined number of medal(s) M is not included (No in Step S157), the first control unit 600 proceeds to Step S159. On the other hand, if the judgment in Step S157 results in that paying out 30 medals M is included (Yes in Step S157), the first control unit 600 pays out 30 medals M to the playing field 500 by driving the lifting-up hopper 300 and the medal discharging part 330, which are illustrated in FIG. 2, for instance (Step S158), and then proceeds to Step S159. Note that the medal(s) M to be rewarded may be directly paid out to a game player by driving the lifting-up hopper 1020 and the medal discharging part 1030, which are illustrated in FIG. 1, for instance.

In Step S159, the first control unit 600 judges whether or not paying out a single or plurality of ball(s) B1/B2 is included in the specified reward content (Step S159). If the judgment results in that paying out a single or plurality of ball(s) B1/B2 is not included (No in Step S159), the first control unit 600 proceeds to Step S161. On the other hand, if paying out a single or plurality of ball(s) B1/B2 is included (Yes in Step S159), the first control unit 600 requests the second control unit in the satellite SA to pay out a single or plurality of ball(s) B1/B2 (Step S160), and then proceeds to Step S161. Note that the second control unit requested to pay out a single or plurality of ball(s) B1/B2 supplies the ball B1/B2 to the corresponding station ST or the ball shooting mechanism 1600 by performing an operation that is almost the same as the operation in FIG. 54 or FIG. 56 once or more than once.

In Step S161, the first control unit 600 judges whether or not a line in which one of the spaces is not rewarded but the rest of the spaces are all rewarded (this is referred to as a close-to-bingo line) exists in the lines L11 to L18 in the bingo table (Step S161). If the judgment results in that the close-to-bingo line exists (Yes in Step S161), the first control unit 600 highlights the remaining space (i.e., the space that has not been rewarded yet) in the corresponding line (Step S162), and then returns to Step S151. Thus, the first control unit 600 performing Steps S151 to S162, the second control unit that generates a bingo table and delivers the bingo table to each of the stations ST, and each of elements to be driven under their controls function as bingo game performing means for performing a bingo game. Here, these steps are also referred to as an eighteenth step.

With the above described operations, a series of games including the digital drawing game and the bingo game are provided to a game player.

Note that the case is exemplified that any of the numbers 1 to 9 or the jackpot challenge prize is preliminarily allocated to each of the prize-winning spots 1101 and 1201 as described above. However, the present invention is not limited to this. For example, the position of the prize-winning spots 101 and 1201 (i.e., any of OS1 to OS10 and IS1 to IS5) to which the jackpot challenge prize (or the jackpot prize) is allocated, and the number thereof may be changed by the function of software in accordance with a condition. For example, if the game condition of the digital drawing game in the station ST where a game player challenging a bingo game is seated is the normal mode, the jackpot challenge prize may be allocated to the prize-winning spot 1101 (OS1) and the prize-winning spot 1201 (IS1). On the other hand, if the game condition of the digital drawing game is in the probability change mode, the jackpot challenge prize may be allocated to the prize-winning spots 1101 (OS2 and OS6) and the prize-winning spots 1201 (IS1 and IS3). In this case, the correspondence between the jackpot challenge prize or the number and the prize-winning spots 1101 or 1201 is generated and controlled by the second control unit in the satellite SA. Also, in this case, which of the normal mode and the probability change mode the present game condition is in is informed by the first control unit 600. Note that this operation is also referred to as a fourteenth step or a seventeenth step.

Also, in the present embodiment, for the purpose of sequentially controlling the flow of the non-metal ball B1 and the metal ball B2, sensors for detecting existence and passage of the ball and the type of the ball may be disposed on a transporting path of the ball B1 and/or the ball B2 at a predetermined interval(s). Furthermore, sensors for detecting existence or passage of the ball and the type of the ball may be disposed in the ball carrier 1520 and the ball transporting part 1910 at a predetermined interval(s) for almost the same reason.

Furthermore, in the present embodiment, the case is exemplified that two types of bingo games are provided with the non-metal ball B1 and the metal ball B2. However, the present invention is not limited to this. It is possible to configure that not only two types of bingo games but also plural types (excluding two types) of bingo games are provided to a game player, for example, by using a plurality of balls with different colors. In this case, a sensor for distinguishing the type of the ball is made up of, for instance, a color sensor.

(1-10) Modified Example 1 of Game

Next, a modified example 1 to be provided to a game player in the present embodiment will be explained in detail with reference to the figures. In the present modified example 1, a case will be exemplified that the ball B1 prize A, the ball B1 prize B, the ball B2 prize A and the ball B2 prize B to be drawn in the digital drawing game are replaced by a ball prize A and a ball prize B and the types of the ball to be paid out are switched depending on a game condition. In other words, in the digital drawing game of the present modified example 1, the ball prize A and the ball prize B are drawn regardless of the types of the ball. Here, if the game condition is in the normal mode, the non-metal ball B1 is paid out to a game player to whom the ball prize A or the ball prize B is rewarded. On the other hand, if the game condition is in the probability change mode, for instance, the metal ball B2 is paid out to a game player to whom the ball prize A or the ball prize B is rewarded.

(1-10-1) Digital Drawing Game

First, a digital drawing game to be provided to a game player in the present modified example 1 will be hereinafter explained in detail with reference to the figures. Note that in the present modified example 1, prizes such as the big bonus A prize, the big bonus B prize, the ball prize A, the ball prize B, the small bonus A prize, and the small bonus B prize are included in the target prizes to be drawn.

FIG. 61(*a*) is a diagram of illustrating an example of image patterns to be used in the digital drawing game of the present modified example 1. FIG. 61(*b*) is a table of illustrating notification range allocated to each of the prizes in the digital drawing game of the present modified example 1. Note that a screen to be displayed for a game player during the digital drawing game of the present modified example 1 is almost the same as the example described above with reference to FIG. 47(*a*). Therefore, this will be hereinafter used as a reference.

As illustrated in FIG. 61(*a*), the image patterns to be displayed in each of the spaces w1 to w7 in the variable display part of the present modified example 1 include a big bonus A image pattern correspondingly allocated to the big bonus A prize, a big bonus B image pattern correspondingly allocated to the big bonus B prize, a ball prize A image pattern correspondingly allocated to the ball prize A, a ball prize B image pattern correspondingly allocated to the ball prize B, a small bonus A image pattern correspondingly allocated to the small bonus A prize, and a small bonus B image pattern correspondingly allocated to the small bonus B prize, for instance.

Here, the big bonus A prize, the big bonus B prize, the small bonus A prize, and the small bonus B prize are almost the same as the above. Therefore, detailed explanation thereof will be hereinafter omitted.

Also, it is possible to set the ball prize A to be, for instance, a prize for paying out the ball B1/B2 to the ball shooting mechanism 1800 (specifically, the sloped rail portion 1801) in the station ST with the ball carrier 1520 depending on a game condition. It is possible to set the ball prize B to be, for instance, a prize for paying out the ball B1/B2 to the ball shooting mechanism 1600 (specifically, the saucer 1610 or 1620) in the satellite SA with the ball carrier 1520 depending on a game condition.

The other configurations and operations to be performed during the digital drawing game are almost the same as the content explained above with reference to FIGS. 47 and 48. Therefore, detailed explanation thereof will be hereinafter omitted.

(1-10-2) Bingo Game

A bingo game to be provided to a game player in the present modified example 1 is almost the same as that described above. Therefore, detailed explanation thereof will be hereinafter omitted.

(1-10-3) Entire Game

Figure 62:
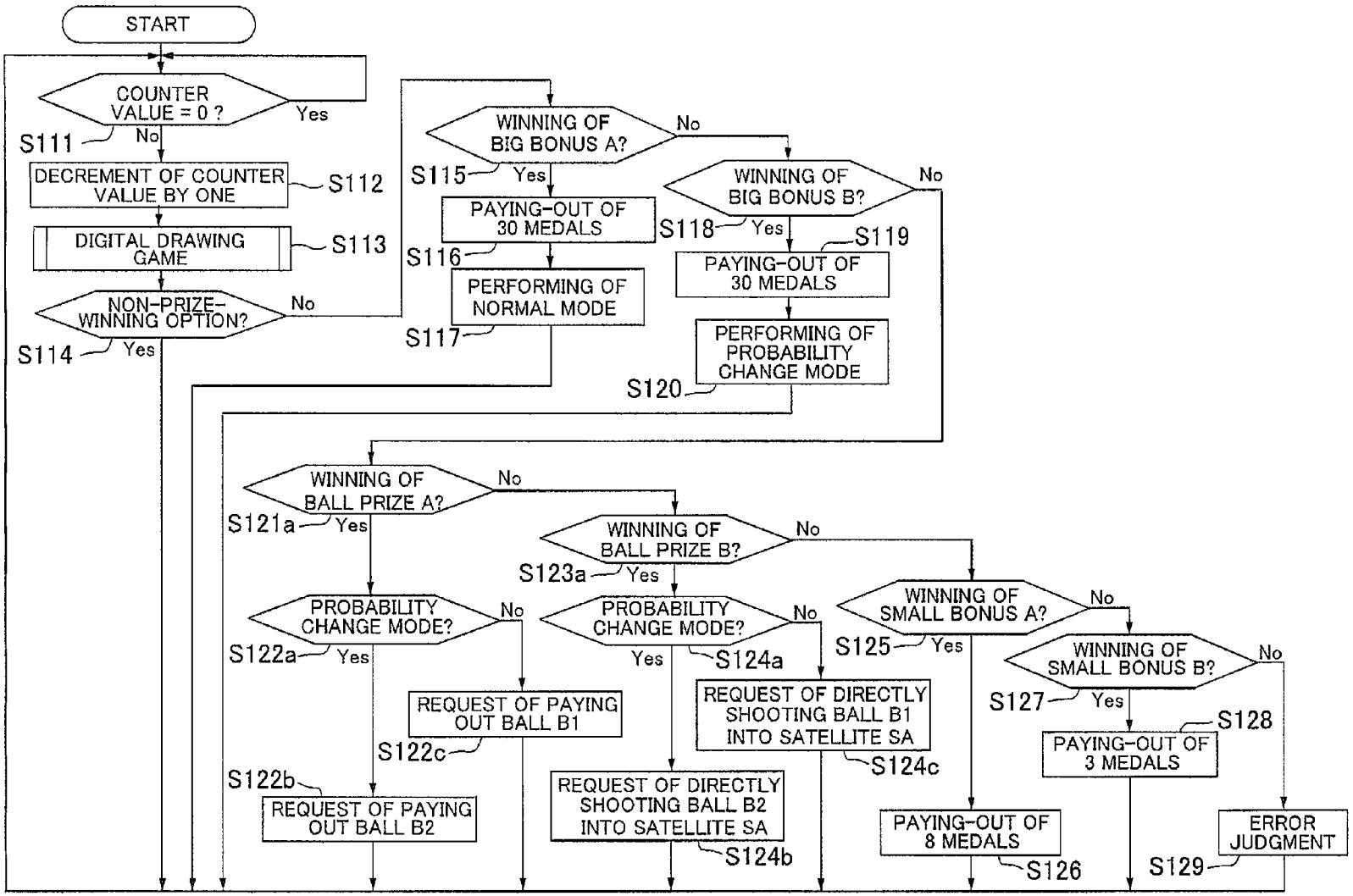
FIG. 62 is a flowchart illustrating an operation of the first control unit 600 when a series of game in accordance with the modified example 1 of an embodiment of the present invention is performed.

Next, the entire flow of a series of games including the above described digital drawing game and the above described bingo game will be hereinafter explained in detail with reference to the figures. FIG. 62 is a flowchart of illustrating operations of the first control unit 600 and the second control unit in the games. Note that the operations described above with reference to FIG. 52 and FIGS. 55 to 60 are almost the same as those in the present modified example 1. Therefore, the operations in the present modified example I will be hereinafter explained with referring to those in FIG. 52 and FIGS. 55 to 60.

In the similar way to the above, according to the present operation, when the pusher part 510 slidingly moves in/out of the housing part 720 provided in the display unit 700, the medal(s) M accumulated on the sub-table 511 forming the upper part of the pusher part 510 fall(s) from the sub-table 511 to the sloped table 512 of the pusher part 510. Here, when the fallen medal M enters any of the award-winning apertures 515-1, 515-2, and 515-3 provided in the sloped table 512, this is detected by a sensor (not illustrated in the figure) provided in each of the award-winning apertures 515-1, 515-2, and 515-3. When the sensor detects entrance of the medal M, the sensor generates a signal for informing this, and transmits the signal to the first control unit 600 in the station ST. Note that the sensor for detecting the entrance of the medal M into each of the award-winning apertures 515-1, 515-2, and 515-3 may be a contact type sensor using an on/off switch or the like, or a non-contact type sensor using the infrared ray or the like. Also, the sensor is preferably disposed in the vicinity of each of the award-winning apertures 515-1, 515-2, and 515-3.

As explained with reference to FIG. 52, when entrance of the medal M is detected in any of the award-winning apertures 515-1, 515-2, and 515-3 (Step S131), the control unit 600 in each of the stations ST increments value of the award-winning aperture counter (not illustrated in the figure) by one (Step S132).

Also, as illustrated in FIG. 62, the first control unit 600 constantly monitors value of the award-winning aperture counter (Step S111). In response to this, when the count value is equal to or greater than zero (No in Step S111), the first control unit 600 decrements the count value by one (Step S112), and then performs the above described digital drawing game once (Step S113). Thus, the first control unit 600 performing Step S113 and each of elements to be controlled and driven in Step S113 function as second drawing game performing means for performing the digital drawing game (i.e., the second drawing game).

Next, the first control unit 600 judges whether or not the drawing result of the digital drawing game is the non-prize-winning option (Yes in Step S114). If the judgment results in that the drawing result is the non-prize-winning option (Yes in Step S114), the first control unit 600 returns to Step S111.

On the other hand, if the judgment in Step S114 results in that the drawing result is not the non-prize-winning option (No in Step S114), the first control unit 600 subsequently judges whether or not the drawing result is winning of the big bonus A (Step S115). If the judgment results in that the drawing result is winning of the big bonus A (Yes in Step S115), the first control unit 600 pays out the number of medal(s) M to be rewarded (e.g., 30 medals) to the playing field 500, for instance, by driving the lifting-up hopper 300 and the medal discharging part 330, which are illustrated in FIG. 2 (Step S116), and at the same time as this, sets the digital drawing game to be performed in the normal mode in the subsequent games (Step S117), and then returns to Step S11. Note that the medal(s) M to be rewarded may be directly paid out to a game player, for instance, by driving the lifting-up hopper 1020 and the medal paying-out part 1030, which are illustrated in FIG. 1. Also, as described above, winning probability of winning each of the prizes in the normal mode is lower than that in the probability change mode (see FIG. 61(*b*)). Also, in the normal mode, for example, the medal guide plates 533 of the guide parts 530R and 530L provided in the main table 501 in the playing field 500 is accommodated below the upper surface of the main table 501. Furthermore, in the normal mode, for example, the medal guide plate 516 (see FIG. 4), which is provided to be allowed to move in/out of the sloped table 512 of the pusher part 510, is accommodated below the upper surface of the sloped table 512. Here, the medal guide plate 516 is an element for guiding the medal(s) M fallen from the sub-table 511 to the sloped table 512 so that the medal(s) M easily enters any of the award-wining apertures (e.g., the award-wining aperture 515-2) provided in the sloped table 512. It is possible to easily realize the detailed configuration, for instance, by applying the guide parts 530R and 530L provided in the main table 501. Therefore, detailed explanation thereof will be hereinafter omitted.

On the other hand, if the judgment in Step S15 results in that the drawing result is not winning of the big bonus A (No in Step 115), the first control unit 600 subsequently judges whether or not the drawing result is winning of the big bonus B (Step S118). If the judgment results in that the drawing result is winning of the big bonus B (Yes in Step S118), the first control unit 600 pays out the number of medal(s) M to be rewarded (e.g., 30 medals) to the playing field 500, for example, by driving the lifting-up hopper 300 and the medal discharging part 330, which are illustrated in FIG. 2 (Step S119), and at the same time as this, sets the digital drawing game to be performed in the probability change mode in the subsequent games (Step S120), and then returns to Step S111. Note that the medal(s) M to be rewarded may be directly paid out to a game player, for example, by driving the lifting-up hopper 1020 and the medal paying out part 1030, which are illustrated in FIG. 1. Also, as described above, winning probability of winning each of the prizes in the probability change mode is higher than that in the normal mode (see FIG. 61(*b*)). Also, in the probability change mode, for example, the medal guide plates 533 of the guide parts 530R and 530L provided in the main table 501 in the playing field 500 is protruded from the upper surface of the main table 501. Furthermore, in the probability change mode, for example, the medal guide plate 516 (see FIG. 4) provided to be allowed to move in/out of the sloped table 512 of the pusher part 510 is protruded from the upper surface of the sloped table 512.

On the other hand, if the judgment in Step S118 results in that the drawing result is not winning of the big bonus B (No in Step S118), the first control unit 600 subsequently judges whether or not the drawing result is the ball prize A (Step S121*a*). If the judgment results in that the drawing result is winning of the ball prize A (Yes in Step S121*a*), the first control unit 600 judges whether or not the present game condition is in the probability change mode (Step S122*a*). If the judgment results in that the present game condition is in the probability change mode (Yes in Step S122*a*), the first control unit 600 requests the satellite SA to pay out the ball B2 to the station ST that includes this first control unit 600 (Step S122*b*), and then returns to Step S111. Also, if the judgment in Step S122*a* results in that the present game condition is not in the probability change mode (No in Step S122*a*), the first control unit 600 requests the satellite SA to pay out the ball B1 to the station ST that includes this first control unit 600 (Step S122*c*) and then returns to Step S111.

On the other hand, if the judgment in Step S121*a* results in that the drawing result is not winning of the ball prize A (No in Step S121*a*), the first control unit 600 judges whether or not the drawing result is winning of the ball prize B (Step S123*a*). If the judgment results in that the drawing result is winning of the ball prize B (Yes in Step S123*a*), the first control unit 600 judges whether or not the present game condition is in the probability change mode (Step S124*a*). If the judgment results in that the present game condition is in the probability change game (Yes in Step S124*a*), the first control unit 600 requests for directly paying out the ball B2 to the ball shooting mechanism 1600 in the satellite SA (Step S124*b*), and then returns to Step S111. Also, if the judgment in Step S124*a* results in that the present game condition is not in the probability change game (No in Step S124*a*), the first control unit 600 requests for directly paying out the ball B1 to the ball shooting mechanism 1600 in the satellite SA (Step S124*c*), and then returns to Step S111.

On the other hand, if the judgment in Step S123*a* results in that the drawing result is not winning of the ball prize B (No in Step 123*a*), the first control unit 600 judges whether or not the drawing result is winning of the small bonus A prize (Step S125). If the judgment results in that the drawing result is winning of the small bonus A prize (Yes in Step S125), the first control unit 600 pays out the number of medal(s) M to be rewarded (e.g., 8 medals) to the playing field 500, for example, by driving the lifting-up hopper 300 and the medal discharging part 330, which are illustrated in FIG. 2 (Step S126), and then returns to Step S111. Note that the medal(s) M to be rewarded may be directly paid out to a game player, for example, by driving the lifting-up hopper 1020 and the medal paying-out part 1030, which are illustrated in FIG. 1.

On the other hand, if the judgment in Step S125 results in that the drawing result is not winning of the small bonus A prize (No in Step S125), the first control unit 600 judges whether or not the drawing result is winning of the small bonus B (Step S127). If the judgment results in that the drawing result is winning of the mall bonus B prize (Yes in Step S127), the first control unit 600 pays out the number of medal(s) M to be rewarded (e.g., two medals) to the playing field 500, for example, by driving the lifting-up hopper 300 and the medal discharging part 330, which are illustrated in FIG. 2 (Step S128), and then returns to Step S111. Note that the medal(s) M to be rewarded may be directly paid out to a game player, for example, by driving the lifting-up hopper 1020 and the medal paying-out part 1030, which are illustrated in FIG. 1.

Also, if judgment in Step S127 results in that the drawing result is not winning of the small bonus B prize (No in Step S127), the first control unit 600 determines that this as an error (Step S129), and then returns to Step S111. Here, the first control unit 600 may be configured to transmit an error notification and the like to a predetermined administrative server, and may be configured to display an error message in the display 701.

On the other hand, the second control unit in the satellite SA, as illustrated in FIG. 54, constantly monitors whether or not the first control unit 600 requested for paying out the ball B1/B2 to be rewarded to the station ST that includes this first control unit 600 in Step S122*b* or Step 122*c* in FIG. 62 (Step S211). If the first control unit 600 requested for paying out the ball B1/B2 to be rewarded to the station ST that includes this first control unit 600 (Yes in Step S211), the second control unit judges which of the ball B1 and the ball B2 is the requested ball (Step S212).

If the judgment in Step S212 results in that the requested ball is the ball B1 (Yes in Step S212), the second control unit moves the ball carrier 1520 (see FIG. 3) in the ball transporting path 1500 functioning as a predetermined transporting path for transporting a ball to the ball supply mechanism 1300 (see FIG. 3) along the ring shaped member 1550 (Step 213), and then discharges the ball B1 from the ball supply mechanism 1300. Thus the second control unit performs the control of transferring the ball B1 from the ball supply mechanism 1300 to the ball carrier 1520 (Step S214).

Next, the second control unit moves the ball carrier 1520 to the ball shooting mechanism 1800 in the corresponding station ST along the ring shaped member 1550 (Step S215), and then tilts the ball carrier 1520 toward the ball shooting mechanism 1800. Thus the second control unit performs the control of transferring the ball B1 from the ball carrier 1520 to the sloped rail portion 1801 (see FIG. 2 or FIG. 46) in the ball shooting mechanism 1800 (Step S216). After this, the second control unit returns to Step S211. Note that, when the ball B1 transferred to the sloped rail portion 1801 is interlocked by the interlocking/releasing operation control mechanism 1809 (see FIG. 46) provided in the sloped rail portion 1801, the ball B1 is temporarily halted at the starting end portion 1802 (see FIG. 46) that is the upper end thereof.

On the other hand, if the judgment in Step S212 results in that the requested ball is the ball B2 (No in Step S212), the second control unit moves the ball carrier 1520 to the ball supply mechanism 1400 (see FIG. 3) along the ring shaped member 1550 (Step S217), and discharges the ball B2 from the ball supply mechanism 1400. Thus the second control unit performs the control of transferring the ball B2 from the ball supply mechanism 1400 to the ball carrier 1520 (Step S218).

Next, the second control unit moves the ball carrier 1520 to the ball shooting mechanism 1800 in the corresponding station ST along the ring shaped member 1550 (Step S219), and then tilts the ball carrier 1520 toward the ball shooting mechanism 1800. Thus the second control unit performs the control of transferring the ball B2 from the ball carrier 1520 to the sloped rail portion 1801 in the ball shooting mechanism 1800 (Step S220). After this, the second control unit returns to Step S211 Note that, when the ball B2 transferred to the sloped rail portion 1801 is interlocked with the interlocking/releasing operation control mechanism 1809 provided in the sloped rail portion 1801, the ball B2 is temporarily halted at the starting end portion 1802 that is the upper end thereof. Thus, the first control unit 600 performing Steps S114 to S129, the second control unit performing Steps S211 to S220, and each of elements to be controlled and driven in Steps S114 to S129 and Steps S211 to S222, function as paying-out means for paying out the ball B1 (i.e., the first drawing medium) or the ball B2 (i.e., the second drawing medium) to the playing field 500 (i.e., the accumulating part) based on the drawing result in the digital drawing game (i.e., the second drawing game).

Also, as explained with reference to FIG. 55, the first control unit 600 in the station ST constantly monitors whether or not the push button 1830 of the operating part 450 (see FIG. 40 or FIG. 41) was pushed by a game player (Step S131). If the push button 1830 of the operating part 450 was pushed (Yes in Step S131), the first control unit 600 controls the interlocking/releasing operation control mechanism 1809, which protrudes from the sloped rail portion 1801 in the ball shooting mechanism 1800, to be accommodated in the interior of the sloped rail portion 1801 (Step S132). Accordingly, the ball B1/B2 standing by at the starting end portion 1802 in the ball shooting mechanism 1800 goes down the sloped rail portion 1801 by means of gravity and enters the ball shooting position drawing mechanism 1810 (see FIG. 46), and is supplied to the main table 501 in the playing field 500 therethrough.

Also, as explained with reference to FIG. 56, the second control unit in the satellite SA constantly monitors whether or not the first control unit 600 requested for directly paying out the ball B1/B2 to be rewarded to the ball shooting mechanism 1600 in the satellite SA in Step S124*b* or S124*c* in FIG. 62 (Step S221). If the first control unit 600 requested for directly paying out the ball B1/B2 to be rewarded to the ball shooting mechanism 1600 in the satellite SA (Yes in Step S221), the second control unit judges which of the ball B1 and the ball B2 is the requested ball (Step S222). Thus, the second control unit performing Step S222 and each of elements to be controlled and driven in Step S222 function as drawing medium specifying means for specifying into which of the ball B1 (i.e., the first drawing medium) and the ball B2 (i.e., the second drawing medium) the drawing medium is classified.

If the judgment in Step S222 results in that the requested ball is the ball B1 (Yes in Step S222), the second control unit moves the ball carrier 1520 to the ball supply mechanism 1300 along the ring shaped member 1550 (Step S223), and then discharges the ball B1 from the ball supply mechanism 1300. Thus the second control unit performs the control of transferring the ball B1 from the ball supply mechanism 1300 to the ball carrier 1520 (Step S224). As described above, the second control unit performing Steps S223 and S224 and each of elements to be controlled and driven in Steps S223 and S224 function as supply means for supplying the ball B1 (i.e., the first drawing medium) to the ball carrier 1520 in the ball transporting path 1500 (i.e., the predetermined transporting path).

Next, the second control unit moves the ball carrier 1520 to the saucer 1610 (see FIG. 3) in the ball shooting mechanism 1600 along the ring shaped member 1550 (Step S225), and then tilts the ball carrier 1520 toward the saucer 1610. Thus the second control unit performs the control of transferring the ball B1 from the ball carrier 1520 to the saucer 1610 (Step S226).

Next, the second control unit monitors whether or not the push button 1830 of the operating part 450 (see FIG. 40 or FIG. 41) in the corresponding station ST was pushed by a game player (Step S227). Note that the pushed state of the push button 1830 is informed to the second control unit in the satellite SA from the first control unit 600 in the station ST through a predetermined network.

If the push button 1830 of the operating part 450 was pushed in Step S227 (Yes in Step S227), the second control unit performs the control of transferring the ball B1 from the saucer 1610 in the ball shooting mechanism 1600 to the ball shooting path 1110 (see FIG. 3) by tilting the saucer 1610 toward the ball shooting path 1110 (Step S228). Then, the second control unit returns to Step S221. Note that the ball B1 transferred to the ball shooting path 1110 goes down the ball shooting path 1110 by means of gravity, and is supplied to the outer bingo stage 1100 (see FIG. 3) in the satellite SA. Thus, the second control unit performing Steps S225 to S228 and each of elements to be controlled and driven in Steps S225 to S228 function as first feeding means for feeding the ball B1 (i.e., the first drawing medium) to the outer bingo stage 1100 (i.e., the first drawing field).

On the other hand, if the judgment in Step S222 results in that the requested ball is the ball B2 (No in Step S222), the second control unit moves the ball carrier 1520 to the ball supply mechanism 1400 along the ring shaped member 1550 (Step S229), and then discharges the ball B2 from the ball supply mechanism 1400. Thus the second control unit performs the control of transferring the ball B2 from the ball supply mechanism 1400 to the ball carrier 1520 (Step S230). Thus, the second control unit performing Steps S229 and S230 and each of elements to be controlled and driven in Steps S229 and S230 function as supply means for supplying the ball B2 (i.e., the second drawing medium) to the ball carrier 1520 in the ball transporting path 1500 (i.e., the predetermined transporting path).

Next, the second control unit performs moves the ball carrier 1520 to the saucer 1620 (see FIG. 3) in the ball shooting mechanism 1600 along the ring shaped member 1550 (Step S231), and then tilts the ball carrier 1520 toward the saucer 1620. Thus the second control unit performs the control of transferring the ball B2 from the ball carrier 1520 to the saucer 1620 (Step S232).

Next, the second control unit monitors whether or not the push button 1830 of the operating part 450 in the corresponding station ST was pushed by a game player (Step S233). Note that the pushed state of the push button 1830 is informed to the second control unit in the satellite SA from the first control unit 600 in the station ST through a predetermined network.

If the push button 1830 of the operating part 450 was pushed in Step S233 (Yes in Step S233), the second control unit performs the control of transferring the ball B2 from the saucer 1620 in the ball shooting mechanism 1600 to the ball shooting path 1210 (see FIG. 3) by tilting the saucer 1620 toward the ball shooting path 1210 (Step S234). Then, the second control unit returns to Step S221. Note that the ball B2 transferred to the ball shooting path 1210 goes down the ball shooting path 1210 by means of gravity, and is supplied to the inner bingo stage 1200 (see FIG. 3) in the satellite SA. Thus, the second control unit performing Steps S231 to S234 and each of elements to be controlled and driven in Steps S231 to S234 function as second feeding means for feeding the ball B2 (i.e., the second drawing medium) to the inner bingo stage 1200 (i.e., the second drawing field).

Also, as described above, the ball B1/B2 fallen from the main table 501 (also referred to as the accumulating part) by the movement of the pusher part 510 while the game is performed is received by the ball receiver 1041 (see FIG. 4) in the ball transporting path 1040 (see FIG. 4). Then, the ball B1/B2 passes through the ball stopper 1042 (see FIG. 4) and is set in the ball transporting part 1910 (see FIG. 1) standing by at the ball outlet 1043 (see FIG. 4). Here, falling of the ball and the type of the fallen ball (i.e., which of the ball B1 and the ball B2 is the fallen ball) are detected by a sensor (not illustrated in the figure) disposed between the ball receiver 1041 and the ball outlet 1043 (preferably in the vicinity of the ball outlet 1043). The detected result is inputted into the first control unit 600. Note that the pusher part 510 for dropping the ball B1 and/or the ball B2 from the main table 501 and its control mechanism (Specifically, a power unit, which is not illustrated in the figure, and the first control unit 600 for controlling this), and the ball transporting path 1040 for guiding the ball B1 and/or the ball B2 fallen from the main table 501 to the ball transporting path 1500 and the ball transporting mechanism 1900, function as supply means for supplying the first drawing medium and/or the second drawing medium to a predetermined transporting path. Furthermore, the sensor for detecting which of the ball B1 and the ball B2 is the fallen ball, and the first control unit 600, function as a part of medium type specifying means for specifying into which of the first drawing medium and the second drawing medium the drawing medium is classified.

On the other hand, as explained with reference to FIG. 57, the first control unit 600 in the station ST constantly monitors whether the ball B1/B2 fell from the main table 501 in the playing field 500 (Step S141). If falling of the ball B1/B2 from the main table 501 was informed (Yes in Step S141), the first control unit 600 specifies into which of the ball B1 and the ball B2 the fallen ball is classified based on the information informed from the sensor (Step S142).

Next, the first control unit 600 informs the second control unit in the satellite SA of falling of the ball and the type of the fallen ball (Step S143), and transports the ball B1/B2 that is set in the ball transporting part 1910 to the upper end of the ball transporting part traveling slope 1901 by performing the control of making the ball transporting part 1910 in the ball transporting mechanism 1900 go up the ball transporting part traveling slope 1901 (Step S144).

On the other hand, as explained with reference to FIG. 58, the second control unit in the satellite SA constantly monitors whether or not falling of the ball and the type of the fallen ball were informed from the first control unit 600 (Step S241). When falling of the ball and the type of the fallen ball were informed from the first control unit 600, the second control unit judges which of the ball B1 and the ball B2 is the fallen ball (Step S242). Thus, the second control unit performing Step S242 and each of elements to be controlled and driven in Step S242 function as drawing medium specifying means for specifying into which of the ball B1 (i.e., the first drawing medium) and the ball B2 (i.e., the second drawing medium) the drawing medium is classified.

If the judgment in Step S242 results in that the fallen ball is the ball B1 (Yes in Step S242), the second control unit performs moves the ball carrier 1520 (see FIG. 3) to the ball transporting mechanism 1900 in the station ST along the ring shaped member 1550 (Step S243), and then discharges the ball B1 from the ball transporting part 1910. Thus the second control unit performs the control of transferring the ball B1 from the ball transporting mechanism 1900 to the ball carrier 1520 (Step S244).

As described above, the second control unit performing Steps S243 and S244 and each of elements to be controlled and driven in Steps S243 and S244 function as supply means for supplying the ball B1 (i.e., the first drawing medium) to the ball carrier 1520 in the ball transporting path 1500 (i.e., the predetermined transporting path). Note that the first control unit 600 may be configured to perform the control of discharging the ball B1 from the ball transporting part 1910.

Next, the second control unit moves the ball carrier 1520 to the saucer 1610 (see FIG. 3) in the ball shooting mechanism 1600 along the ring shaped member 1550 (Step S245), and then tilts the ball carrier 1520 toward the saucer 1610. Thus the second control unit performs the control of transferring the ball B1 from the ball carrier 1520 to the saucer 1610 (Step S246).

Next, the second control unit monitors whether or not the push button 1830 of the operating part 450 (see FIG. 40 or FIG. 41) in the corresponding station ST was pushed by a game player (Step S247). Note that the pushed state of the push button 1830 is informed to the second control unit in the satellite SA from the first control unit 600 in the station ST through a predetermined network.

If the push button 1830 of the operating part 450 was pushed in Step S247 (Yes in Step S247), the second control unit performs the control of transferring the ball B1 from the saucer 1610 in the ball shooting mechanism 1600 to the ball shooting path 1110 (see FIG. 3) by tilting the saucer 1610 toward the ball shooting path 1110 (Step S248). Then, the second control unit returns to Step S241. Note that the ball B1 transferred to the ball shooting path 1110 goes down the ball shooting path 1110 by means of gravity and is supplied to the outer bingo stage 1100 (see FIG. 3) in the satellite SA. Thus, the second control unit performing Steps S245 to S248 and each of elements to be controlled and driven in Steps S245 to S248 function as first feeding means for feeding the ball B1 (i.e., the first drawing medium) to the outer bingo stage 1100 (i.e., the first drawing field).

On the other hand, if the judgment in Step S242 results in that the fallen ball is the ball B2 (Yes in Step S242), the second control unit moves the ball carrier 1520 to the ball transporting mechanism 1900 in the station ST along the ring shaped member 1550 (Step S249), and then discharges the ball B2 from the ball transporting part 1910. Thus the second control unit performs the control of transferring the ball B2 from the ball transporting mechanism 1900 to the ball carrier 1520 (Step S250). Thus, the second control unit performing Steps S249 and S250 and each of elements to be controlled and driven in Steps S249 and S250 function as supply means for supplying the ball B2 (i.e., the second drawing medium) to the ball carrier 1520 in the ball transporting path 1500 (i.e., the predetermined transporting path). Note that the first control unit 600 may be configured to perform the control of discharging the ball B2 from the ball transporting part 1910.

Next, the second control unit moves the ball carrier 1520 to the saucer 1620 (see FIG. 3) in the ball shooting mechanism 1600 along the ring shaped member 1550 (Step S251), and then tilts the ball carrier 1520 toward the saucer 1620. Thus the second control unit performs the control of transferring the ball B2 from the ball carrier 1520 to the saucer 1620 (Step S252).

Next, the second control unit monitors whether or not the push button 1830 of the operating part 450 in the corresponding station ST was pushed by a game player (Step S253). Note that the pushed state of the push button 1830 is informed to the second control unit in the satellite SA from the first control unit 600 in the station ST through a predetermined network.

When the push button 1830 of the operating part 450 was pushed in Step S253 (Yes in Step S253), the second control unit performs the control of transferring the ball B2 from the saucer 1620 in the ball shooting mechanism 1600 to the ball shooting path 1210 (see FIG. 3) by tilting the saucer 1620 toward the ball shooting mechanism 1210 (Step S254). Then, the second control unit returns to Step S241. Note that the ball B2 transferred to the ball shooting path 1210 goes down the ball shooting path 1210 by means of gravity, and is supplied to the inner bingo stage 1200 (see FIG. 3) in the satellite SA. Thus, the second control unit performing Steps S251 to S254 and each of elements to be controlled and driven in Steps S251 to S254 function as second feeding means for feeding the ball B2 (i.e., the second drawing medium) to the inner bingo stage 1200 (i.e., the first drawing field).

Also, as described above, the ball B1 shot into the outer bingo stage 1100 in the above described Step S228 or S248 goes around the outer bingo stage 1100, and then enters any of the prize-winning spots 1101. Entrance of the ball B1 into any of the prize-winning spots 1101 is detected by the sensor provided in each of the prize-winning spots 1101, and is informed to the second control unit. In a similar way to this, as described above, the ball B2 shot into the inner bingo stage 1200 in the above described Step S234 or S254 goes around the inner bingo stage 1200, and then enters any of the prize-winning spots 1201. Entrance of the ball B2 into any of the prize-winning spots 1201 is detected by the sensor provided in each of the prize-winning spots 1201, and is informed to the second control unit. Note that the sensor for detecting entrance of the ball B1 and the second control unit function as a part of first reward determining means for rewarding the first prize or the second prize that is correspondingly allocated to the first prize-winning spot into which the ball B1 (i.e., the first drawing medium) entered, and the sensor for detecting entrance of the ball B2 and the first control unit 600 function as a part of second reward determining means for rewarding the first prize or the second prize that is correspondingly allocated to the second prize-winning spot into which the ball B2 (i.e., the second drawing medium) entered.

On the other hand, as explained with reference to FIG. 59, the second control unit in the satellite SA constantly monitors whether or not the ball B1/B2 entered any of the prize-winning spots 1101 or 1201, that is, whether or not a prize corresponding to any of the prize-winning spots 1101 or 1201 was rewarded (Step S261). If rewarding a prize corresponding to any of the prize-winning spots was informed (Yes in Step S261), the second control unit judges whether or not the prize allocated to the prize-winning spot 1101 or 1201 into which the ball B1/B2 entered is the jackpot challenge prize (Step S262). If the judgment results in that the allocated prize is the jackpot challenge prize (Yes in Step S262), the second control unit performs the jackpot game (Step S263) and then returns to Step S261. Note that the prize-winning spot 1101 or 1201 into which the ball B1/B2 entered is also specified in Step S261.

On the other hand, if the judgment in Step S262 results in that any of the numbers 1 to 9 is allocated to the prize-winning spot 1101 or 1201 for which a prize is rewarded (No in Step S252), the second control unit specifies the number allocated to the prize-winning spot 1101 or 1201 for which a prize is rewarded (Step S264), informs this/these to the first control unit 600 in the station ST (Step S265), and then returns to Step S261. Thus, the second control unit performing Steps S261 to S265 and each of elements to be controlled and driven in Steps S261 to S265 function as first reward determining means and second reward determining means. Here, if the ball B1 enters any of the plurality of prize-winning spots 1101, the first reward determining means rewards the first prize or the second prize that is correspondingly allocated to the prize-winning spot 1101. If the ball B2 enters any of the plurality of prize-winning spots 1201, the second reward determining means rewards the first prize or the second prize that is correspondingly allocated to the prize-winning spot 1201.

On the other hand, as explained with reference to FIG. 60, the first control unit 600 in the station ST constantly monitors whether or not the prize-winning number was informed from the second control unit in the satellite SA in Step S265 in FIG. 59 (Step S151). If the prize-winning number was informed (Yes in Step S151), the first control unit 600 specifies the informed prize-winning number (Step S152), and judges if the prize-winning number has already been rewarded (Step S153). If the judgment results in that the number has already been rewarded (Yes in Step S153), the first control unit 600 returns to Step S151.

On the other hand, if the informed prize-winning number has not been rewarded yet (No in Step S153), the first control unit 600 highlights the space that is correspondingly allocated to the prize-winning number in the bingo table displayed in the display 701 (Step S154).

Next, the first control unit 600 judges whether or not a line in which all the spaces are rewarded (this is referred to as a reward line) exists in the lines L11 to L18 on the bingo table (Step S155). If the judgment results in that the reward line exists (Yes in Step S155), the first control unit 600 specifies the reward content of the prize allocated to the reward line (Step S156).

Next, the first control unit 600 judges whether or not paying out the predetermined number of medal(s) M (e.g., 30 medals), for instance, is included in the specified reward content (Step S157). If the judgment results in that paying out the predetermined number of medal(s) M is not included (No in Step S157), the first control unit 600 proceeds to Step S159. On the other hand, if the judgment in Step S157 results in that paying out 30 medals M is included (Yes in Step S157), the first control unit 600 pays out 30 medals M to the playing field 500 by driving the lifting-up hopper 300 and the medal discharging part 330, which are illustrated in FIG. 2, for instance (Step S158), and then proceeds to Step S159. Note that the medal(s) M to be rewarded may be directly paid out to a game player by driving the lifting-up hopper 1020 and the medal paying-out part 1030, which are illustrated in FIG. 1, for instance.

In Step S159, the first control unit 600 judges whether or not paying out a single or plurality of ball(s) B1/B2 is included in the specified reward content (Step S159). If the judgment results in that paying out a single or plurality of ball(s) B1/B2 is not included (No in Step S159), the first control unit 600 proceeds to Step S161. On the other hand, if the judgment results in that paying out a single or plurality of ball(s) B1/B2 is included (Yes in Step S159), the first control unit 600 requests the second control unit in the satellite SA to pay out a single or plurality of ball(s) B1/B2 (Step S160), and then proceeds to Step S161. Note that the second control unit requested to pay out a single or plurality of ball(s) B1/B2 supplies the ball B1/B2 to the corresponding station ST or the ball shooting mechanism 1600 by performing an operation that is almost the same as the operation illustrated in FIG. 54 or FIG. 56 once or more than once.

In Step S161, the first control unit 600 judges whether or not a line in which one of the spaces is not rewarded but the rest of the spaces are all rewarded (this is referred to as a close-to-bingo line) exists in the lines L11 to L18 in the bingo table (Step S161). If the judgment results in that the close-to-bingo line exists (Yes in Step S161), the first control unit 600 highlights the remaining space (i.e., the space that has not been rewarded yet) in the corresponding line (Step S162), and then returns to Step S151. Thus, the first control unit 600 performing Steps S151 to S162, the second control unit that generates a bingo table and delivers the bingo table to each of the stations ST, and each of elements to be driven under their controls function as bingo game performing means for performing a bingo game.

With the above described operations, a series of games including the digital drawing game and the bingo game are provided to a game player.

Note that the case is exemplified that any of the numbers 1 to 9 or the jackpot challenge prize is preliminarily allocated to each of the prize-winning spots 1101 and 1201 as described above. However, the present invention is not limited to this. For example, the position of the prize-winning spots 101 and 1201 (i.e., any of OS1 to OS10 and IS1 to IS5) to which the jackpot challenge prize (or the jackpot prize) is allocated, and the number thereof may be changed by the function of software in accordance with a condition. For example, if the game condition of the digital drawing game in the station ST where a game player challenging a bingo game is seated is the normal mode, the jackpot challenge prize may be allocated to the prize-winning spot 1101 (OS1) and the prize-winning spot 1201 (IS1). On the other hand, if the game condition of the digital drawing game is in the probability change mode (i.e., the mode in which winning probability of winning a prize or dividend probability is set to be high), the jackpot challenge prize may be allocated to the prize-winning spots 1101 (OS2 and OS6) and the prize-winning spots 1201 (IS1 and IS3), in other words, control of increasing the number of the prize-winning spots 1101 and 1102 to which the jackpot challenge prize is allocated may be performed. In this case, correspondence between the jackpot challenge prize or the number and the prize-winning spots 1101 or 1201 is generated and controlled by the second control unit in the satellite SA. Also, in this case, which of the normal mode and the probability change mode the present game condition is in is informed by the first control unit 600.

Also, in the present modified example 1, for the purpose of sequentially controlling the flow of the non-metal ball B1 and the metal ball B2, sensors for detecting existence or passage of the ball and the type of the ball may be disposed on a transporting path of the ball B1 and/or the ball B2 at a predetermined interval(s). Furthermore, sensors for detecting existence or passage of the ball and the type of the ball may be disposed in the ball carrier 1520 and the ball transporting part 1910 at a predetermined interval(s) for almost the same reason.

Moreover, in the present modified example 1, the case is exemplified that two types of bingo games are provided with the non-metal ball B1 and the metal ball B2. However, the present invention is not limited to this. It is possible to configure that not only two types of bingo games but also plural types (excluding two types) of bingo games are provided to a game player, for example, by using a plurality of balls with different colors. In this case, a sensor for distinguishing the type of the balls is made up of, for instance, a color sensor.

(1-11) Modified Example 2 of Game

Next, a modified example 2 of a game to be provided to a game player in the present embodiment will be explained in detail with reference to the figures. In the present modified example 2, two types of bingo games not with two types of balls (i.e., the non-metal ball B1 and the metal ball B2) but with only one type of ball (i.e., a ball B) will be provided. Therefore, in the second modified example 2, either the ball supply mechanism 1300 or the ball supply mechanism 1400 will be used. In other words, it is possible to eliminate either the ball supply mechanism 1300 or the ball supply mechanism 1400. In the present modified example 2, a case is exemplified that only the ball supply mechanism 1300 is used. Also, in the present modified example 2, it is not necessary to provide a sensor for detecting the material (either metal or non-metal) which the ball B is made from.

(1-11-1) Digital Drawing Game

First, a digital drawing game to be provided to a game player in the present modified example 2 will be hereinafter explained in detail with reference to the figures. Note that in the present modified example 2, the prizes to be drawn include the big bonus A prize, the big bonus B prize, the ball prize A, the ball prize B, the small bonus A prize, and the small bonus B prize, for instance.

A screen to be displayed for a game player in the digital drawing game to be provided in the present modified example 2 is almost the same as the above described example with reference to FIG. 47(*a*). Also, the image pattern of each of the prizes and winning probability (winning range) of winning each of the prizes, which are used in the digital drawing game to be provided to a game player in the present modified example 2, are almost the same as the above described example with reference to FIGS. 80(*a*) and 80(*b*). Therefore, in the present modified example 2, detailed explanation thereof will be hereinafter omitted by referring to them.

(1-11-2) Bingo Game

Furthermore, a bingo game to be provided to a game player in the present modified example 2 is almost the same as the above described one. Therefore, detailed explanation thereof will be hereinafter omitted.

(1-11-3) Entire Game

Next, the entire flow of a series of games including the above described digital drawing game and the above described bingo game will be hereinafter explained in detail with reference to the figures. FIGS. 63 to 69 are flowcharts of illustrating operations of the first control unit 600 and the second control unit in the games. Note that the above described operations with reference to FIG. 52 to 59 are almost the same as those in the present modified example 2. Therefore, the operations in the present modified example 2 will be hereinafter explained by referring to those of FIGS. 52 to 59.

In the similar way to the above, in the present operation, when the pusher part 510 slidingly moves in/out of the housing part 720 provided in the display unit 700, the medal(s) M accumulated on the sub-table 511 forming the upper part of the pusher part 510 fall(s) from the sub-table 511 to the sloped table 512 of the pusher part 510. Here, when the fallen medal M enters any of the award-winning apertures 515-1, 515-2, and 515-3 provided in the sloped table 512, this is detected by a sensor (not illustrated in the figure) provided in each of the award-winning apertures 515-1, 515-2, and 515-3. When the sensor detects entrance of the medal M, the sensor generates a signal for informing this, and transmits the signal to the first control unit 600 in the station ST. Note that the sensor for detecting the entrance of the medal M into the award-winning apertures 515-1, 515-2, and 515-3 may be a contact type sensor using an on/off switch or the like, or a non-contact type sensor using the infrared ray or the like. Also, the sensor is preferably disposed in the vicinity of the award-winning apertures 515-1, 515-2, and 515-3.

As explained with reference to FIG. 52, when entrance of the medal M is detected in any of the award-winning apertures 515-1, 515-2, and 515-3 (Step S131), the control unit 600 in each of the stations ST increments the count value of the award-winning aperture counter (not illustrated in the figure) by one (Step S1132).

Figure 63:
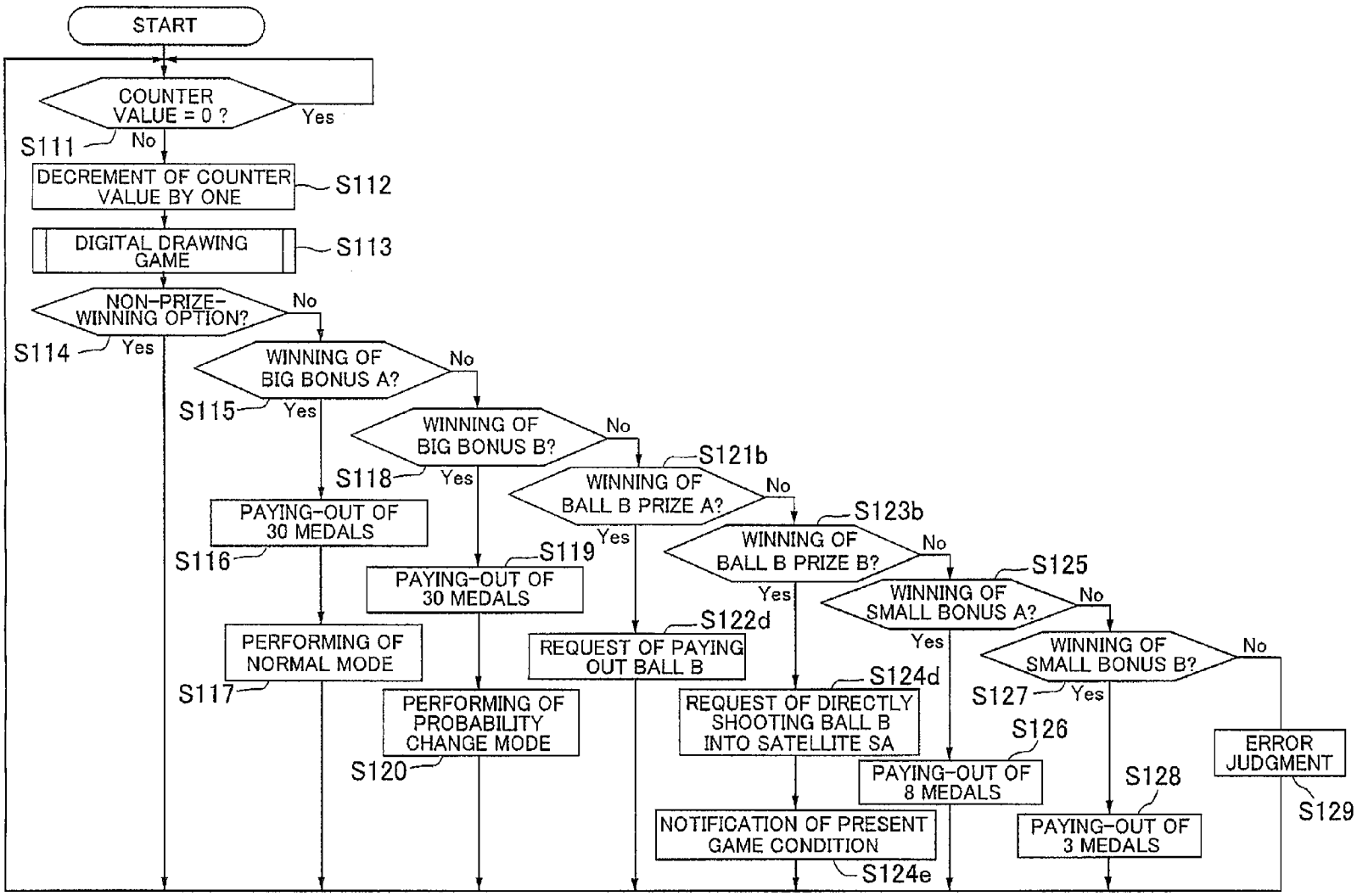
FIG. 63 is a flowchart illustrating an operation of the first control unit 600 when a series of game in accordance with a modified example 2 of an embodiment of the present invention is performed (1).

Also, as illustrated in FIG. 63, the first control unit 600 constantly monitors the count value of the award-winning aperture counter (Step S111). Here, if the count value is equal to or greater than zero (No in Step S111), the first control unit 600 decrements the count value by one (Step S112), and then performs the above described digital drawing game once (Step S113).

Next, the first control unit 600 judges whether or not drawing result of the digital drawing game is the non-prize-winning option (Yes in Step S114). If the judgment results in that the drawing result is the non-prize-winning option (Yes in Step S114), the first control unit 600 returns to Step S111.

On the other hand, if the judgment in Step S114 results in that the drawing result is not the non-prize-winning option (No in Step S114), the first control unit 600 subsequently judges whether or not the drawing result is winning of the big bonus A (Step S115). If the judgment results in that the drawing result is winning of the big bonus A (Yes in Step S115), the first control unit 600 pays out the number of medal(s) M to be rewarded (e.g., 30 medals) to the playing field 500 by driving the lifting-up hopper 300 and the medal discharging part 330, which are illustrated in FIG. 2, for instance (Step S116), and the at the same time as this, sets the digital drawing game to be performed in the normal mode in the subsequent games (Step S117), and then returns to Step S111. Note that the medal(s) M to be rewarded may be directly paid out to a game player by driving the lifting-up hopper 1020 and the medal paying-out part 1030, which are illustrated in FIG. 1, for instance. Also, as described above, winning probability of winning each of the prizes in the normal mode is lower than that in the probability change mode (see FIG. 61(*b*)). Also, in the normal mode, for example, the medal guide plates 533 of the guide parts 530R and 530L provided in the main table 501 in the playing field 500 are accommodated below the upper surface of the main table 501. Furthermore, in the normal mode, for example, the medal guide plate 516 (see FIG. 4), which is provided to be allowed to move in/out of the sloped table 512 of the pusher part 510, is accommodated below the upper surface of the sloped table 512. Here, the medal guide plate 516 is an element for guiding the medal(s) M fallen from the sub-table 511 to the sloped table 512 so that the medal(s) M easily enters any of the award-wining apertures (e.g., the award-wining aperture 515-2) provided in the sloped table 512. It is possible to easily realize the detailed configuration by applying the guide parts 530R and 530L provided in the main table 501, for instance. Therefore, detailed explanation thereof will be hereinafter omitted.

On the other hand, if the judgment in Step S115 results in that the drawing result is not winning of the big bonus A (No in Step 115), the first control unit 600 subsequently judges whether or not the drawing result is winning of the big bonus B (Step S118). If the judgment results in that the drawing result is winning of the big bonus B (Yes in Step S118), the first control unit 600 pays out the number of medal(s) M to be rewarded (e.g., 30 medals) to the playing field 500, for example, by driving the lifting-up hopper 300 and the medal discharging part 330, which are illustrated in FIG. 2 (Step S19), and at the same time as this, sets the digital drawing game to be performed in the probability change mode in the subsequent games (Step S120), and then returns to Step S111. Note that the medal(s) M to be rewarded may be directly paid out to a game player, for example, by driving the lifting-up hopper 1020 and the medal paying-out part 1030, which are illustrated in FIG. 1. Also, as described above, winning probability of winning each of the prizes in the probability change mode is higher than that in the normal mode (see FIG. 61(*b*)). Also, in the probability change mode, for example, the medal guide plates 533 of the guide parts 530R and 530L provided in the main table 501 in the playing field 500 are protruded from the upper surface of the main table 501. Furthermore, in the probability change mode, for example, the medal guide plate 516 (see FIG. 4) provided to be allowed to move in/out of the sloped table 512 of the pusher part 510 is protruded from the upper surface of the sloped table 512.

On the other hand, if the judgment in Step S118 results in that the drawing result is not winning of the big bonus B (No in Step S118), the first control unit 600 subsequently judges whether or not the drawing result is winning of the ball prize A (Step S121*b*). If the judgment results in that the drawing result is winning of the ball prize A (Yes in Step S121*b*), the first control unit 600 requests the satellite SA to pay out the ball B to be rewarded to the station ST that includes this first control unit 600 (Step S122*d*), and then returns to Step S111.

On the other hand, if the judgment in Step S121*b* results in that the drawing result is neither the ball B1 prize A nor the ball B2 prize A (No in Step S121*b*), the first control unit 600 judges whether or not the drawing result is winning of the ball prize B (Step S123*b*). If the judgment results in that the drawing result is winning of the ball prize B (Yes in Step S123*b*), the first control unit 600 requests for directly paying out the ball B to the ball shooting mechanism 1600 in the satellite SA (Step S124*d*), and at the same time as this, informs the present game condition in the digital drawing game (Step S124*e*), and then returns to Step S11.

On the other hand, if the judgment in Step S123*b* results in that the drawing result is not the ball prize B (No in Step 123*b*), the first control unit 600 judges whether or not the drawing result is winning of the small bonus A prize (Step S125). If the judgment results in that the drawing result is winning of the small bonus A prize (Yes in Step S125), the first control unit 600 pays out the number of medal(s) M to be rewarded (e.g., 8 medals) to the playing field 500, for example, by driving the lifting-up hopper 300 and the medal discharging part 330, which are illustrated in FIG. 2 (Step S126), and then returns to Step S111. Note that the medal(s) M to be rewarded may be directly paid out to a game player, for example, by driving the lifting-up hopper 1020 and the medal paying-out part 1030, which are illustrated in FIG. 1.

On the other hand, if the judgment in Step S125 results in that the drawing result is not winning of the small bonus A prize (No in Step S125), the first control unit 600 judges whether or not the drawing result is winning of the small bonus B prize (Step S127). If the judgment results in that the drawing result is winning of the small bonus B prize (Yes in Step S127), the first control unit 600 pays out the number of medal(s) M to be rewarded (e.g., two medals) to the playing field 500, for example, by driving the lifting-up hopper 300 and the medal discharging part 330, which are illustrated in FIG. 2 (Step S128), and then returns to Step S111. Note that the medal(s) M to be rewarded may be directly paid out to a game player, for example, by driving the lifting-up hopper 1020 and the medal paying-out part 1030, which are illustrated in FIG. 1.

Also, if the judgment in Step S127 results in that the drawing result is not the small bonus B prize (No in Step S127), the first control unit 600 determines that this is an error (Step S129), and then returns to Step S111. Here, the first control unit 600 may be configured to transmit an error notification and the like to a predetermined administrative server, and may be configured to display an error message in the display 701.

Figure 64:
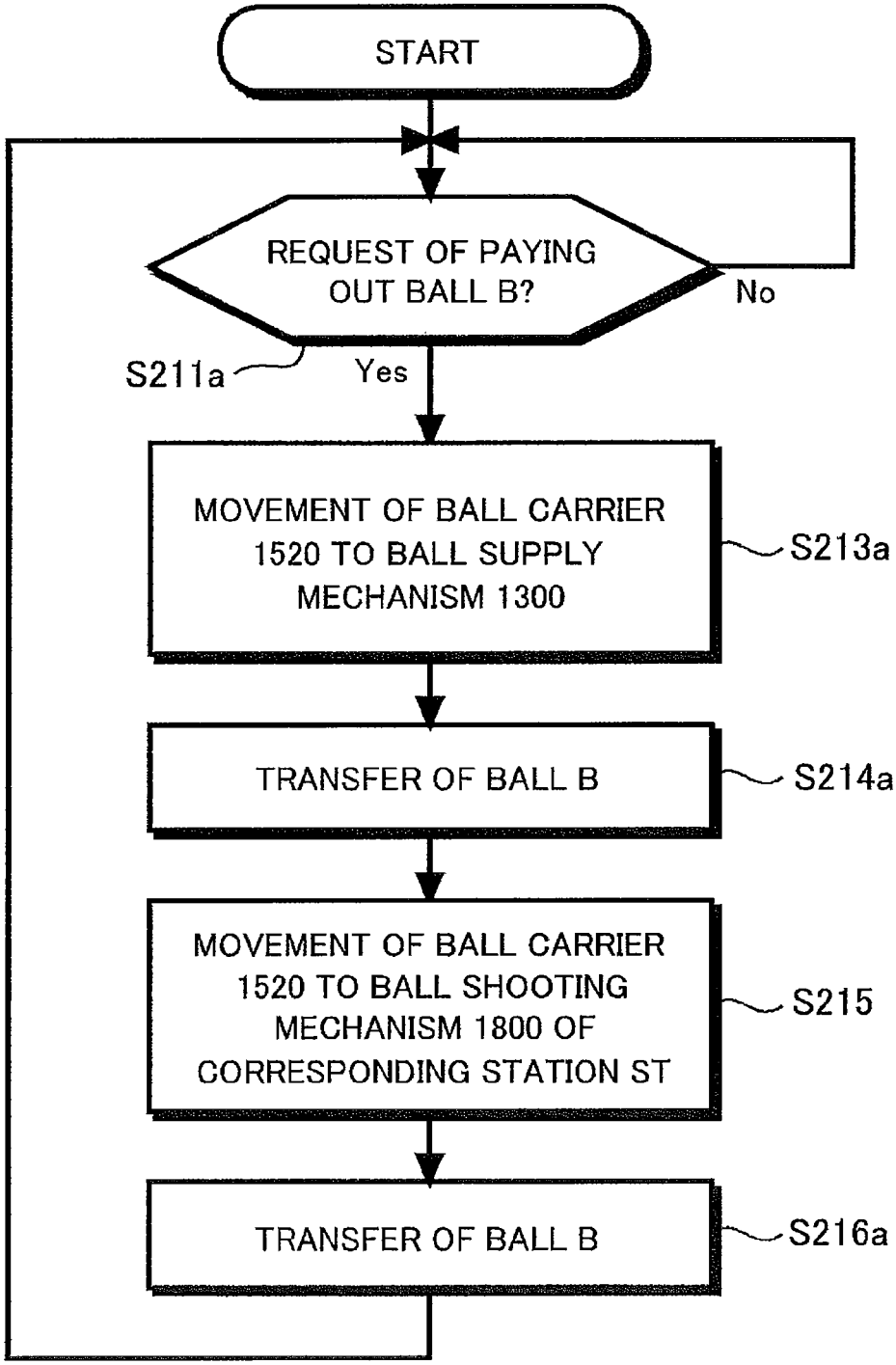
FIG. 64 is a flowchart illustrating an operation of the second control unit when a series of game in accordance with the modified example 2 of an embodiment of the present invention is performed (1).

On the other hand, the second control unit in the satellite SA, as illustrated in FIG. 64, constantly monitors whether or not the first control unit 600 requested for paying out the ball B to be rewarded to the station ST that includes this first control unit 600 in Step S122*d* in FIG. 63 (Step S211*a*). If the first control unit 600 requested for paying out the ball B to be rewarded to the station ST that includes this first control unit 600 (Yes in Step S211*a*), the second control unit moves the ball carrier 1520 (see FIG. 3) in the ball transporting path 1500 functioning as a predetermined transporting path for transporting a ball to the ball supply mechanism 1300 (see FIG. 3) along the ring shaped member 1550 (Step S213*a*), and then discharges the ball B from the ball supply mechanism 1300. Thus the second control unit performs the control of transferring the ball B from the ball supply mechanism 1300 to the ball carrier 1520 (Step S214*a*).

Next, the second control unit moves the ball carrier 1520 to the ball shooting mechanism 1800 in the corresponding station ST along the ring shaped member 1550 (Step S215), and then tilts the ball carrier 1520 toward the ball shooting mechanism 1800. Thus the second control unit performs the control of transferring the ball B from the ball carrier 1520 to the sloped rail portion 1801 (see FIG. 2 or FIG. 46) in the ball shooting mechanism 1800 (Step S216*a*). After this, the second control unit returns to Step S21*a*. Note that, when the ball B1 transferred to the sloped rail portion 1801 is interlocked with the interlocking/releasing operation control mechanism 1809 (see FIG. 46) provided in the sloped rail portion 1801, the ball B1 is temporarily halted at the starting end portion 1802 (see FIG. 46) that is the upper end thereof.

Figure 65:
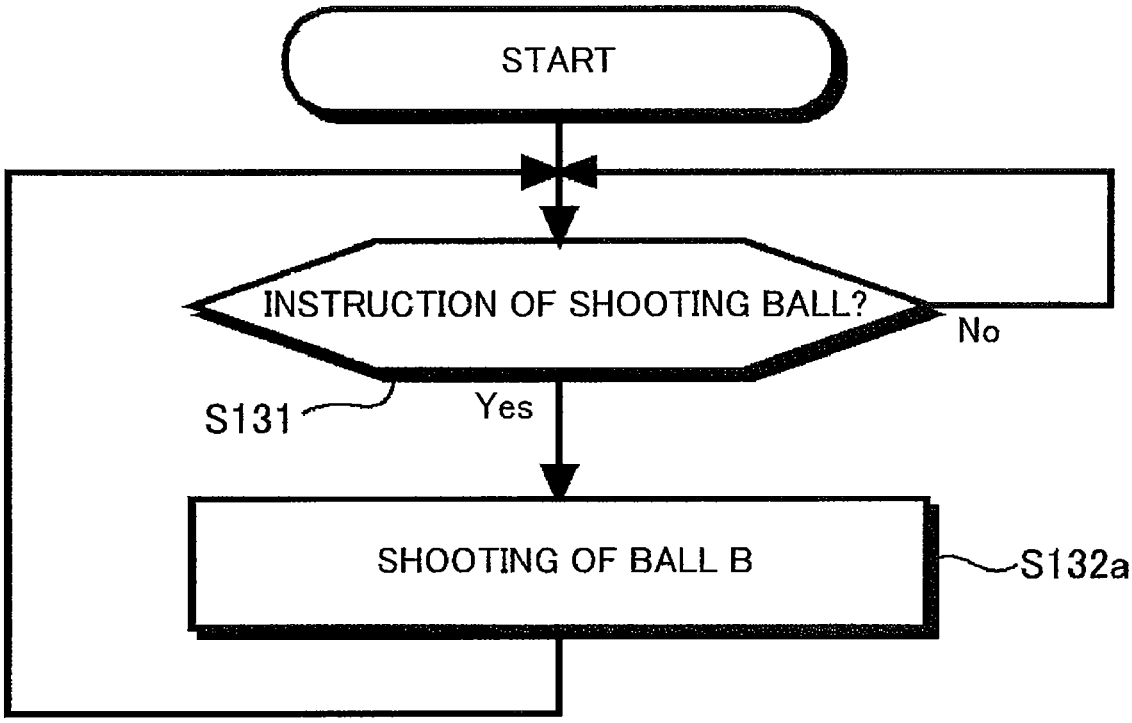
FIG. 65 is a flowchart illustrating an operation of the first control unit 600 when a series of game in accordance with the modified example 2 of an embodiment of the present invention is performed (2).

Also, as illustrated in FIG. 65, the first control unit 600 in the station ST constantly monitors whether or not the push button 1830 of the operating part 450 (see FIG. 40 or FIG. 41) was pushed by a game player (Step S131). If the push button 1830 of the operating part 450 was pushed (Yes in Step S131), the first control unit 600 controls the interlocking/releasing operation control mechanism 1809, which protrudes from the sloped rail portion 1801 in the ball shooting mechanism 1800, to be accommodated in the interior of the sloped rail portion 1801 (Step S132*a*). Accordingly, the ball B standing by at the starting end portion 1802 in the ball shooting mechanism 1800 goes down the sloped rail portion 1801 by means of gravity and enters the ball shooting position drawing mechanism 1810 (see FIG. 46), and is supplied to the main table 501 in the playing field 500 therethrough.

Figure 66:
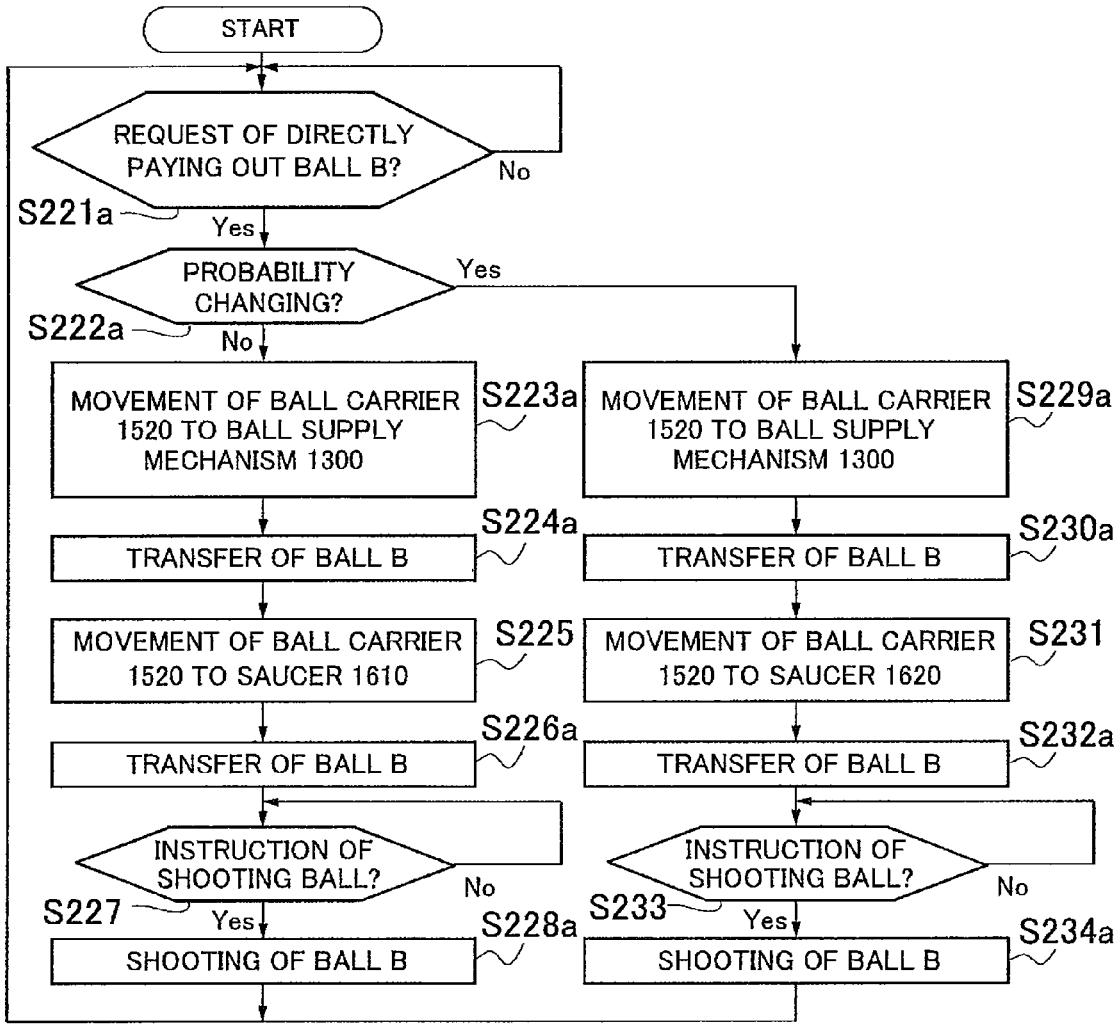
FIG. 66 is a flowchart illustrating an operation of the second control unit when a series of game in accordance with the modified example 2 of an embodiment of the present invention is performed (2).

Also, as illustrated in FIG. 66, the second control unit in the satellite SA constantly monitors whether or not the first control unit 600 requested for directly paying out the ball B to be rewarded to the ball shooting mechanism 1600 in the satellite SA in Step S124*d* in FIG. 63 (Step S221*a*). If the first control unit 600 requested for directly paying out the ball B to be rewarded to the ball shooting mechanism 1600 in the satellite SA (Yes in Step S221*a*), the second control unit judges whether or not the game condition informed by the corresponding first control unit 600 is in the probability change mode (the state that probability varies) (Step S222*a*).

If the judgment in Step S222*a* results in that the present game condition is in the probability change mode (Yes in Step S222*a*), the second control unit moves the ball carrier 1520 to the ball supply mechanism 1300 along the ring shaped member 1550 (Step S223*a*), and then discharges the ball B from the ball supply mechanism 1300. Thus the second control unit performs the control of transferring the ball B from the ball supply mechanism 1300 to the ball carrier 1520 (Step S224*a*).

Next, the second control unit moves the ball carrier 1520 to the saucer 1610 (see FIG. 3) in the ball shooting mechanism 1600 along the ring shaped member 1550 (Step S225), and then tilts the ball carrier 1520 toward the saucer 1610. Thus the second control unit performs the control of transferring the ball B from the ball carrier 1520 to the saucer 1610 (Step S226*a*).

Next, the second control unit monitors whether or not the push button 1830 of the operating part 450 (see FIG. 40 or FIG. 41) in the corresponding station ST was pushed by a game player (Step S227). Note that the pushed state of the push button 1830 is informed to the second control unit in the satellite SA from the first control unit 600 in the station ST through a predetermined network.

If the push button 1830 of the operating part 450 was pushed in Step S227 (Yes in Step S227), the second control unit performs the control of transferring the ball B from the saucer 1610 in the ball shooting mechanism 1600 to the ball shooting path 1110 (see FIG. 3) by tilting the saucer 1610 toward the ball shooting path 1110 (Step S228*a*). Then, the second control unit returns to Step S221. Note that the ball B transferred to the ball shooting path 1110 goes down the ball shooting path 1110 by means of gravity, and is supplied to the outer bingo stage 1100 (see FIG. 3) in the satellite SA.

On the other hand, if the judgment in Step S222*a* results in that the present game condition is not in the probability change mode (No in Step S222*a*), the second control unit moves the ball carrier 1520 to the ball supply mechanism 1300 along the ring shaped member 1550 (Step S229*a*), and then discharges the ball B from the ball supply mechanism 1300. Thus the second control unit performs the control of transferring the ball B from the ball supply mechanism 1300 to the ball carrier 1520 (Step S230*a*).

Next, the second control unit moves the ball carrier 1520 to the saucer 1620 (see FIG. 3) in the ball shooting mechanism 1600 along the ring shaped member 1550 (Step S231), and then tilts the ball carrier 1520 toward the saucer 1620. Thus the second control unit performs the control of transferring the ball B from the ball carrier 1520 to the saucer 1620 (Step S232*a*).

Next, the second control unit monitors whether or not the push button 1830 of the operating part 450 in the corresponding station ST was pushed by a game player (Step S233). Note that the pushed state of the push button 1830 is informed to the second control unit in the satellite SA from the first control unit 600 in the station ST through a predetermined network.

If the push button 1830 of the operating part 450 was pushed in Step S233 (Yes in Step S233), the second control unit performs the control of transferring the ball B from the saucer 1620 in the ball shooting mechanism 1600 to the ball shooting path 1210 (see FIG. 3) by tilting the saucer 1620 toward the ball shooting path 1210 (Step S234*a*). Then, the second control unit returns to Step S221. Note that the ball B transferred to the ball shooting path 1210 goes down the ball shooting path 1210 by means of gravity, and is supplied to the inner bingo stage 1200 (see FIG. 3) in the satellite SA.

Also, as described above, the ball B fallen from the main table 501 by the movement of the pusher part 510 while the game is performed is received by the ball receiver 1041 (see FIG. 4) in the ball transporting path 1040 (see FIG. 4). Then, the ball B passes through the ball stopper 1042 (see FIG. 4) and is set in the ball transporting part 1910 (see FIG. 1) standing by at the ball outlet 1043 (see FIG. 4). Here, falling of the ball is detected by a sensor (not illustrated in the figure) disposed between the ball receiver 1041 and the ball outlet 1043 (preferably in the vicinity of the ball outlet 1043). The detected result is inputted into the first control unit 600.

Figure 67:
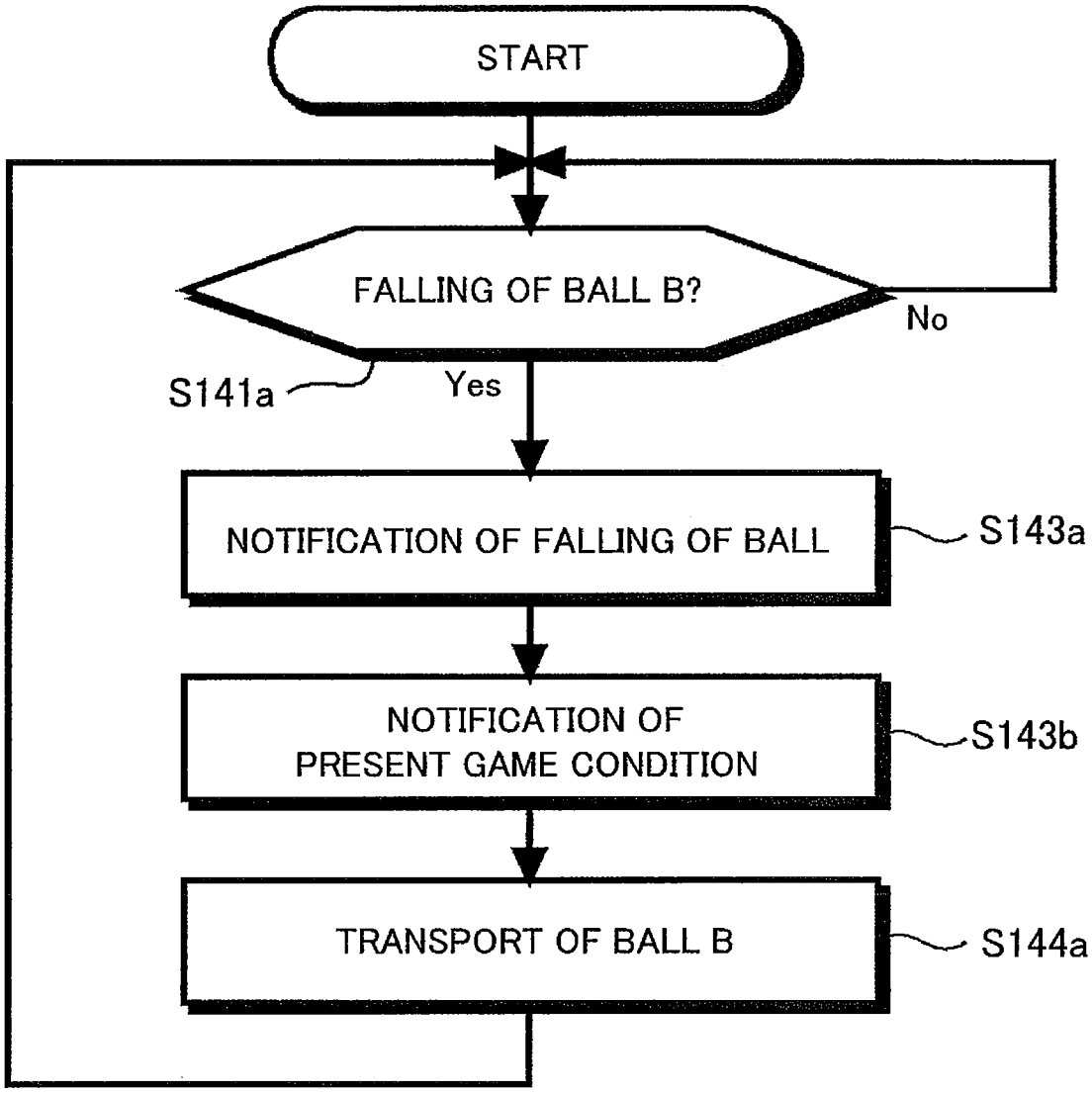
FIG. 67 is a flowchart illustrating an operation of the first control unit 600 when a series of game in accordance with the modified example 2 of an embodiment of the present invention is performed (3).

On the other hand, as illustrated in FIG. 67, the first control unit 600 of the station ST constantly monitors whether or not the ball B fell from the main table 501 in the playing field 500 (Step S141*a*). If falling of the ball B from the main table 501 was informed (Yes in Step S141*a*), the first control unit 600 informs the second control unit in the satellite SA of falling of the ball (Step S143*a*), and at the same time as this, informs the second control unit of the present game condition in the digital drawing game (Step S143*b*), and transports the ball B set in the ball transporting part 1910 to the upper end of the ball transporting part traveling slope 1910 by performing the control of making the ball transporting part 1910 in the transporting mechanism 1900 go up the ball transporting part traveling slope 1901 (Step S144*a*).

Figure 68:
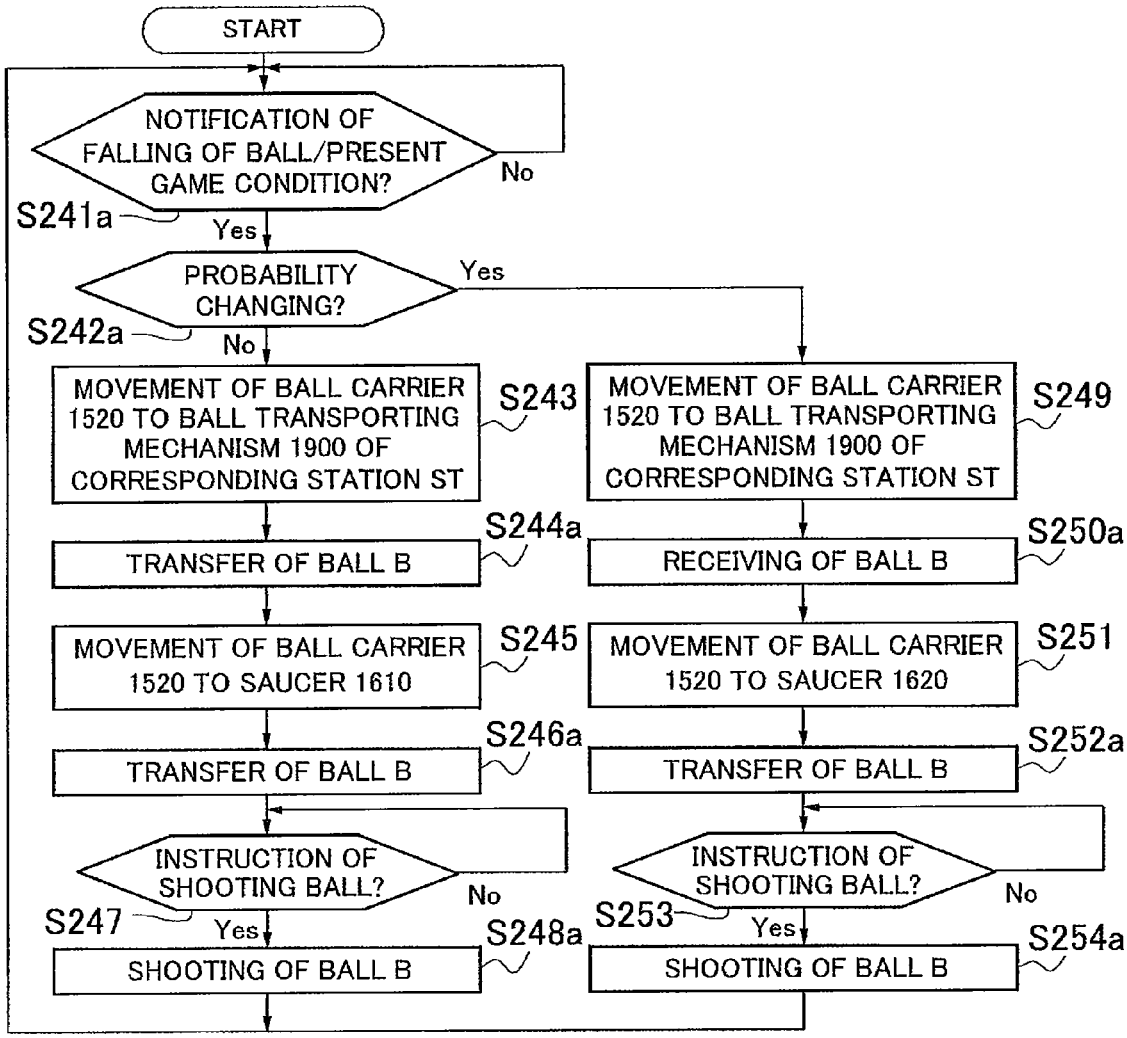
FIG. 68 is a flowchart illustrating an operation of the second control unit when a series of game in accordance with the modified example 2 of an embodiment of the present invention is performed (3).

On the other hand, as illustrated in FIG. 68, the second control unit in the satellite SA constantly monitors whether or not falling of the ball and the present game condition were informed from the first control unit 600 (Step S241*a*). When falling of the ball and the present game condition were informed from the first control unit 600, the second control unit Judges whether or not the present game condition is in the probability change mode (the state that probability varies) (Step S242*a*).

If the judgment in Step S242*a* results in that the present game condition is in the probability change mode (Yes in Step S242*a*), the second control unit moves the ball carrier 1520 (see FIG. 3) to the ball transporting mechanism 1900 in the station ST along the ring shaped member 1550 (Step S243), and then discharges the ball B from the ball transporting part 1910. Thus the second control unit performs the control of transferring the ball B from the ball transporting mechanism 1900 to the ball carrier 1520 (Step S244*a*). Note that the first control unit 600 may be configured to perform the control of discharging the ball B from the ball transporting part 1910.

Next, the second control unit moves the ball carrier 1520 to the saucer 1610 (see FIG. 3) in the ball shooting mechanism 1600 along the ring shaped member 1550 (Step S245), and then tilts the ball carrier 1520 toward the saucer 1610. Thus the second control unit performs the control of transferring the ball B from the ball carrier 1520 to the saucer 1610 (Step S246*a*).

Next, the second control unit monitors whether or not the push button 1830 of the operating part 450 (see FIG. 40 or FIG. 41) in the corresponding station ST was pushed by a game player (Step S247). Note that the pushed state of the push button 1830 is informed to the second control unit in the satellite SA from the first control unit 600 in the station ST through a predetermined network.

If the push button 1830 of the operating part 450 was pushed in Step S247 (Yes in Step S247), the second control unit performs the control of transferring the ball B from the saucer 1610 in the ball shooting mechanism 1600 to the ball shooting path 1110 (see FIG. 3) by tilting the saucer 1610 toward the ball shooting path 1110 (Step S248*a*). Then, the second control unit returns to Step S241. Note that the ball B transferred to the ball shooting path 1110 goes down the ball shooting path 1110 by means of gravity and is supplied to the outer bingo stage 1100 (see FIG. 3) in the satellite SA.

On the other hand, if the judgment in Step S242*a* results in that the present game condition is in the probability change mode (Yes in Step S242*a*), the second control unit moves the ball carrier 1520 to the ball transporting mechanism 1900 in the station ST along the ring shaped member 1550 (Step S249), and then discharges the ball B from the ball transporting part 1910. Thus the second control unit performs the control of transferring the ball B from the ball transporting mechanism 1900 to the ball carrier 1520 (Step S250*a*). Note that the first control unit 600 may be configured to perform the control of discharging the ball B from the ball transporting part 1910.

Next, the second control unit moves the ball carrier 1520 to the saucer 1620 (see FIG. 3) in the ball shooting mechanism 1600 along the ring shaped member 1550 (Step S251), and then tilts the ball carrier 1520 toward the saucer 1620. Thus the second control unit performs the control of transferring the ball B from the ball carrier 1520 to the saucer 1620 (Step S252*a*).

Next, the second control unit monitors whether or not the push button 1830 of the operating part 450 in the corresponding station ST was pushed by a game player (Step S253). Note that the pushed state of the push button 1830 is informed to the second control unit in the satellite SA from the first control unit 600 in the station ST through a predetermined network.

When the push button 1830 of the operating part 450 was pushed in Step S253 (Yes in Step S253), the second control unit performs the control of transferring the ball B from the saucer 1620 in the ball shooting mechanism 1600 to the ball shooting path 1210 (see FIG. 3) by tilting the saucer 1620 toward the ball shooting mechanism 1210 (Step S254*a*). Then, the second control unit returns to Step S241. Note that the ball B transferred to the ball shooting path 1210 goes down the ball shooting path 1210 by means of gravity, and is supplied to the inner bingo stage 1200 (see FIG. 3) in the satellite SA.

Also, as described above, the ball B shot into the outer bingo stage 1100 in the above described Step S228*a* or S248*a* goes around the outer bingo stage 1100, and then enters any of the prize-winning spots 1101. Entrance of the ball B into any of the prize-winning spots 1101 is detected by the sensor provided in each of the prize-winning spots 1101, and is informed to the second control unit. In a similar way to this, as described above, the ball B shot into the inner bingo stage 1200 in the above described Step S234*a* or S254*a* goes around the inner bingo stage 1200, and then enters any of the prize-winning spots 1201. Entrance of the ball B into any of the prize-winning spots 1201 is detected by the sensor provided in each of the prize-winning spots 1201, and is informed to the second control unit.

On the other hand, as explained with reference to FIG. 59, the second control unit in the satellite SA constantly monitors whether or not the ball B entered any of the prize-winning spots 1101 or 1201, that is, whether or not a prize corresponding to ant of the prize-winning spots 1101 or 1102 was rewarded (Step S261). If reward corresponding to any of the prize-winning spots was informed (Yes in Step S261), the second control unit judges whether or not the prize allocated to the prize-winning spot 1101 or 1201 into which the ball B entered is the jackpot challenge prize (Step S262). If the judgment results in that the allocated prize is the jackpot challenge prize (Yes in Step S262), the second control unit performs the jackpot game (Step S263), and then returns to Step S261.

On the other hand, if the judgment in Step S262 results in that any of the numbers 1 to 9 is allocated to the prize-winning spot 1101 or 1201 to be rewarded (No in Step S252), the second control unit specifies the number allocated to the prize-winning spot 1101 or 1201 to be rewarded (Step S264), informs this/these to the first control unit 600 in the station ST (Step S265), and then returns to Step S261.

Figure 69:
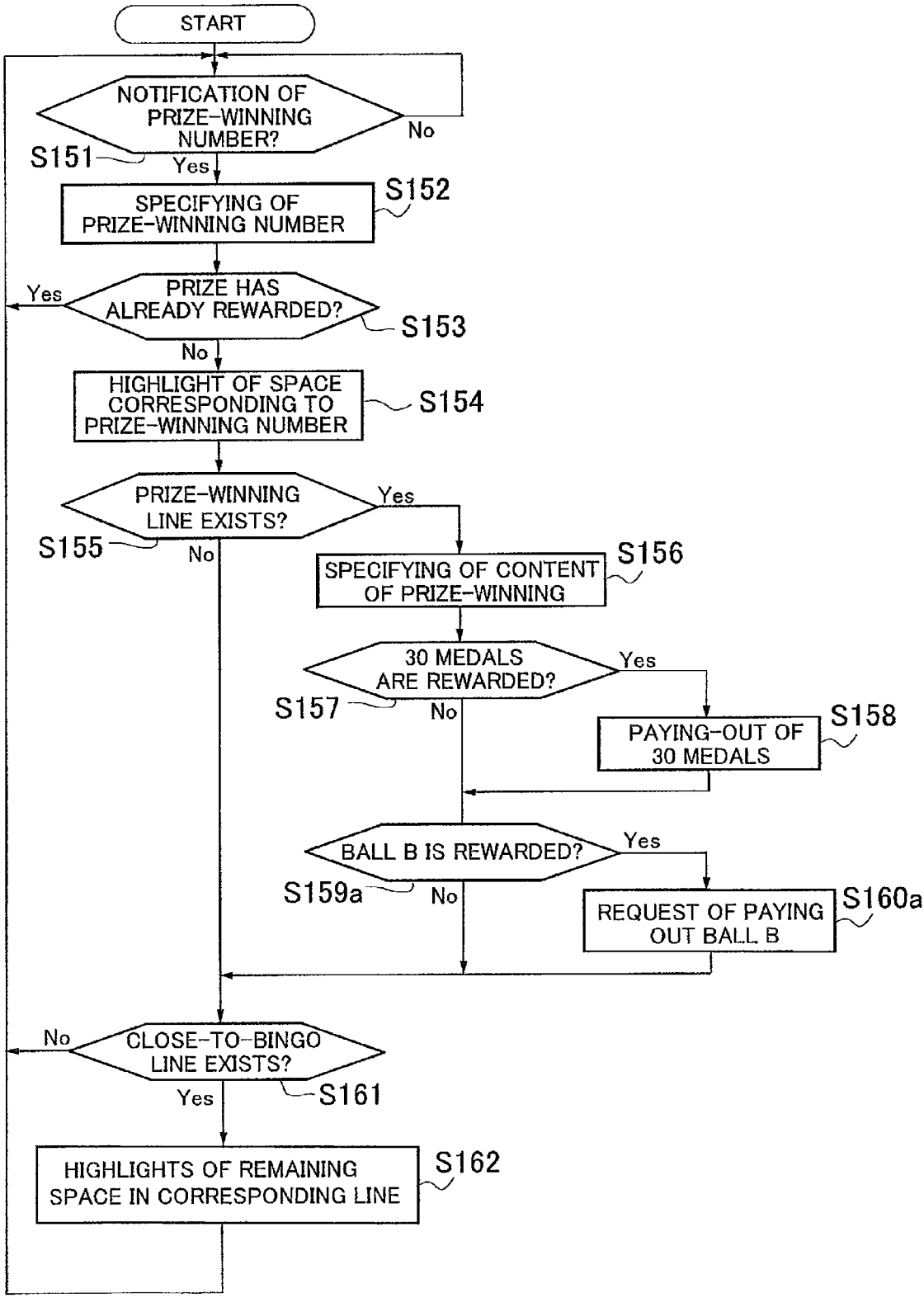
FIG. 69 is a flowchart illustrating an operation of the first control unit 600 when a series of game in accordance with the modified example 2 of an embodiment of the present invention is performed (4).

On the other hand, as illustrated in FIG. 69, the first control unit 600 in the station ST constantly monitors whether or not the prize-winning number was informed from the second control unit in the satellite SA in Step S265 in FIG. 59 (Step S151). If the prize-winning number was informed (Yes in Step S151), the first control unit 600 specifies the informed prize-winning number (Step S152), and judges whether or not the prize-winning number has already been rewarded (Step S153). If the judgment results in that the number has already been rewarded (Yes in Step S153), the first control unit 600 returns to Step S151.

On the other band, if the informed prize-winning number has not been rewarded yet (No in Step S153), the first control unit 600 highlights the space that is correspondingly allocated to the prize-winning number in the bingo table displayed in the display 701 (Step S154).

Next, the first control unit 600 judges whether or not a line in which all the spaces are rewarded (this is referred to as a reward line) exists in the lines L11 to L18 in the bingo table (Step S155). If the judgment results in that the reward line exists (Yes in Step S155), the first control unit 600 specifies the reward content of the prize allocated to the reward line (Step S156).

Next, the first control unit 600 judges whether or not paying out the predetermined number of medal(s) M (e.g., 30 medals) is included in the specified reward content, for instance (Step S157). If the judgment results in that paying out the predetermined number of medal(s) M is not included (No in Step S157), the first control unit 600 proceeds to Step S159. On the other hand, if the judgment in Step S157 results in that paying out 30 medals M is included (Yes in Step S157), the first control unit 600 pays out 30 medals M to the playing field 500 by driving the lifting-up hopper 300 and the medal discharging part 330, which are illustrated in FIG. 2, for instance (Step S158), and then proceeds to Step S159. Note that the medal(s) M to be rewarded may be directly paid out to a game player by driving the lifting-up hopper 1020 and the medal paying-out part 1030, which are illustrated in FIG. 1, for instance.

In Step S159, the first control unit 600 judges whether or not paying out a single or plurality of ball(s) B is included in the specified reward content (Step S159). If the judgment results in that paying out a single or plurality of ball(s) B is not included (No in Step S159), the first control unit 600 proceeds to Step S161. On the other hand, if the judgment results in that paying out a single or plurality of ball(s) B is included (Yes in Step S159, the first control unit 600 requests the second control unit in the satellite SA to pay out a single or plurality of ball(s) B (Step S160), and then proceeds to Step S161. Note that the second control unit requested to pay out a single or plurality of ball(s) B supplies the ball(s) B to the corresponding station ST or the ball shooting mechanism 1600 by performing an operation that is almost the same as the operation illustrated in FIG. 64 or FIG. 66 once or more than once.

In Step S161, the first control unit 600 judges whether or not a line in which one of the spaces is not rewarded but the rest of the spaces are all rewarded (this is referred to as a close-to-bingo line) exists in the lines L11 to L18 in the bingo table (Step S161). If the judgment results in that the close-to-bingo line exists (Yes in Step S161), the first control unit 600 highlights the remaining space in the corresponding line, that is, the space that has not been rewarded yet (Step S162), and then returns to Step S151.

With the above described operations, a series of games including the digital drawing game and the bingo game are provided to a game player.

Note that the case is exemplified that the numbers 1 to 9 or the jackpot challenge prize is preliminarily allocated to the prize-winning spots 1101 and the prize-winning spots 1201, respectively, as described above. However, the present invention is not limited to this. For example, the position (any of OS1 to OS10 and IS1 to IS5) of the prize-winning spots 1101 and 1201 to which the jackpot challenge prize (or the jackpot prize) is allocated, and the number thereof may be changed by the function of software in accordance with a condition. For example, if the game condition of the digital drawing game in the station ST where a game player challenging a bingo game is seated is the normal mode, the jackpot challenge prize may be allocated to the prize-winning spot 1101 (OS1) and the prize-winning spot 1201 (IS1). On the other hand, if the game condition of the digital drawing game is in the probability change mode, the control of allocating the jackpot challenge prize to the prize-winning spots 1101 (OS2 and OS6) and the prize-winning spots 1201 (IS1 and IS3) may be performed. In this case, correspondence between the jackpot challenge prize or the number and the prize-winning spots 1101 or 1201 is generated and controlled by the second control unit in the satellite SA. Also, in this case, which of the normal mode and the probability change mode the present game condition is in is informed by the first control unit 600.

Also, in the present modified example 2, for the purpose of sequentially controlling the flow of the ball B, sensors for detecting existence or passage of the ball may be disposed on a transporting path of the ball B at a predetermined interval(s). Furthermore, sensors for detecting existence or passage of the ball may be disposed in the ball carrier 1520 and the ball transporting part 1910 at a predetermined interval(s) for almost the same reason.

The invention claimed is:

1. A game device being configured to perform a first drawing game and a second drawing game, comprising:

a first drawing field associated with either the first prize or the second prize which is drawn with the drawing medium during the first game;

a second drawing field associated with either the first prize or the second prize which is drawn with the drawing medium during the first game;

a first control unit configured to:

perform the second drawing game to electrically draw any of a plurality of prizes including a third prize to provide a game player with the drawing medium, a fourth prize to set subsequent game conditions to a first game condition in which winning probability of winning the third prize is first winning probability, and a fifth prize to set the subsequent game conditions to a second game condition in which winning probability of winning the third prize is second winning probability that is higher than the first winning probability, set either the first game condition or the second game condition as a present game condition, perform subsequent second drawing games under the first game condition when the fourth prize is rewarded, and perform the subsequent second drawing games under the second game condition when the fifth prize is rewarded;

a supplier configured to supply the drawing medium to a predetermined transporting path;

a second control unit;

a first feeding path selectively connectable to the predetermined transporting path to receive the drawing medium therefrom and provide the drawing medium to the first drawing field when the second control unit determines that the present game condition is in the first game condition, wherein either the first prize or the second prize is rewarded when the drawing medium enters any of the plurality of first prize-winning spots; and a second feeding path selectively connectable to the predetermined transporting path to receive the drawing medium therefrom and provide the drawing medium to the second drawing field when the second control unit determines that the present game condition is in the second game condition, wherein either the first prize or the second prize is rewarded when the drawing medium enters any of the plurality of second prize-winning spots.

2. The game device of claim 1, wherein winning probability of winning the second prize in the second drawing field is higher than winning probability of winning the second prize in the first drawing field.

3. The game device of claim 1, wherein the first drawing field includes a first disk on which the drawing medium is allowed to go round while the drawing medium rotationally moves, and a plurality of first prize-winning spots which are provided in the first disk and into which the drawing medium is allowed to rotationally enter, wherein the second drawing field is disposed to surround the first disk, and includes a ring shaped second disk on which the drawing medium is allowed to go round while the drawing medium rotationally moves and a plurality of second prize-winning spots which are provided in the second disk and into which the drawing medium is allowed to rotationally enter, each second prize-winning spot being associated with either the first prize or the second prize.

4. The game device of claim 3, wherein the first disk rotates around a predetermined rotational axis, and wherein the second disk rotates around the predetermined rotational axis.

5. The game device of claim 3, wherein the prize correspondingly allocating means correspondingly allocates the second prize to the greater number of the first prize-winning spots and the second prize-winning spots when the present game condition is in the second game condition than the number of the first prize-winning spots and the second prize-winning spots when the present game condition is in the first game condition.

6. The game device of claim 1, further comprising an accumulating part that collects the drawing medium provided to a game player, and wherein the supplier supplies the drawing medium to the predetermined transporting path by directly or indirectly pushing the drawing medium from the accumulating part to the predetermined transporting path.

7. The game device of claim 6, wherein the drawing medium is paid out to the accumulating part based on a drawing result of the second drawing game.

8. The game device of claim 1, wherein the supplier supplies the drawing medium to the predetermined transporting path based on the drawing result in the second drawing game.

9. The game device of claim 1, further configured to perform a bingo game using a bingo table on which plural types of characters are arranged, and wherein the first prize is rewarded to any of the plural types of characters to be used in the bingo game.

10. The game device of claim 1, wherein the drawing medium is a ball.

11. A method of controlling a game device being configured to perform a first drawing game to draw either a first prize or a second prize by shooting a drawing medium into a first drawing field having a plurality of first prize-winning spots, and to draw either the first prize or the second prize by shooting the drawing medium into a second drawing field having a plurality of second prize-winning spots, the first and second prize-winning spots each being associated with the first or the second prize, the method comprising:

performing a second drawing game to electrically draw any of a plurality of prizes which include a third prize to provide a game player with the drawing medium, a fourth prize to set subsequent game conditions to a first game condition in which winning probability of winning the third prize is first winning probability, and a fifth prize to set the subsequent game conditions to be a second game condition in which winning probability of winning the third prize is second winning probability that is higher than the first winning probability, the performing including:

setting either the first game condition or the second game condition as a present game condition;

performing subsequent second drawing games under the first game condition when the fourth prize is rewarded; and performing the subsequent second drawing games under the second game condition when the fifth prize is rewarded;

supplying the drawing medium to a predetermined transporting path;

when the present game condition is set to the first game condition, then feeding the drawing medium to the first drawing field, detecting into which of the plurality of first prize-winning spots the drawing medium enters, specifying the associated prize;

when the present game condition is set to the second game condition, then feeding the drawing medium to the second drawing field, detecting into which of the plurality of second prize-winning spots in the second drawing field the drawing medium enters, and specifying the associated prize.

12. The method of controlling a game device of claim 11, wherein a ratio of the number of second prized associated with the second prize-winning spots to the number of first prizes associated with the second prize-winning spots is greater than a ratio of the number of second prizes associated with the first prize-winning to the number of first prizes associated with the first prize-winning spots.

13. The method of controlling a game device of claim 11, wherein the game device further includes an accumulating part to temporarily accumulate the drawing medium provided to a game player, and a pushing part to feed the drawing medium to the predetermined transporting path by directly or indirectly pushing the drawing medium accumulated in the accumulating part to the predetermined transporting path, wherein the supplying the drawing medium includes driving the pushing part to push the drawing medium supplied to the predetermined transporting path, the method further comprising paying out the drawing medium to the accumulating part based on a drawing result of the second drawing game.

14. The method of controlling a game device of claim 11, wherein the drawing medium is supplied to the predetermined transporting path based on a drawing result of the second drawing game.

15. The method of controlling a game device of claim 11, further comprising correspondingly allocating the second prize to the greater number of the first prize-winning spots and the second prize-winning spots when the present game condition is in the second game condition than the number of the first prize-winning spots and the second prize-winning spots when the present game condition is in the first game condition.

16. The method of controlling a game device of claim 11, further comprising performing a bingo game using a bingo table on which plural types of characters are arranged, and wherein the first prize is configured to be rewarded to any of the plural types of characters to be used in the bingo game.

17. The method of controlling a game device of claim 11, wherein the drawing medium is a ball.

* * * * *